US007950948B2

(12) United States Patent
Amidon

(10) Patent No.: US 7,950,948 B2
(45) Date of Patent: May 31, 2011

(54) RELEASABLY ENGAGING HIGH DEFINITION MULTIMEDIA INTERFACE PLUG

(75) Inventor: Jeremy Amidon, Marcellus, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/829,957

(22) Filed: Jul. 2, 2010

(65) Prior Publication Data

US 2010/0267271 A1 Oct. 21, 2010

Related U.S. Application Data

(60) Division of application No. 12/477,440, filed on Jun. 3, 2009, now Pat. No. 7,862,367, which is a continuation-in-part of application No. 12/477,257, filed on Jun. 3, 2009, now Pat. No. 7,857,652, which is a continuation-in-part of application No. 12/276,833, filed on Nov. 24, 2008, now Pat. No. 7,892,014, which is a continuation-in-part of application No. 11/773,465, filed on Jul. 5, 2007, now Pat. No. 7,476,118, which is a continuation-in-part of application No. 11/696,716, filed on Apr. 4, 2007, now Pat. No. 7,455,545.

(51) Int. Cl.
*H01R 13/627* (2006.01)

(52) U.S. Cl. ..... 439/353; 439/352

(58) Field of Classification Search ..... 439/352–354, 439/357–358

See application file for complete search history.

(56) References Cited

U.S. PATENT DOCUMENTS

| | | | |
|---|---|---|---|
| 5,176,538 | A | 1/1993 | Hansell, III et al. |
| 5,785,557 | A | 7/1998 | Davis |
| 6,099,339 | A | 8/2000 | Yanagida et al. |
| 6,116,937 | A | 9/2000 | Pan |
| 6,132,231 | A | 10/2000 | Suzuki |
| 6,264,500 | B1 | 7/2001 | Kawabe |
| 6,364,687 | B1 | 4/2002 | Chen |
| 6,561,847 | B1 | 5/2003 | Xiang et al. |
| 6,595,801 | B1 | 7/2003 | Leonard et al. |
| 6,709,286 | B1 | 3/2004 | Korsunsky et al. |
| 6,821,139 | B1 | 11/2004 | Wu |
| 6,830,472 | B1 | 12/2004 | Wu |
| 6,860,750 | B1 | 3/2005 | Wu |
| 6,881,095 | B2 | 4/2005 | Murr et al. |
| 6,902,432 | B2 | 6/2005 | Morikawa et al. |

(Continued)

FOREIGN PATENT DOCUMENTS

CN ZL 200820213627.5 Y 9/2009

OTHER PUBLICATIONS

PCT/US2009/064740. International Search Report and Written Opinion. Applicant: Amidon et al. Mailed date: Jul. 1, 2010. 9 pages.

(Continued)

*Primary Examiner* — Javaid Nasri

(74) *Attorney, Agent, or Firm* — Schmeiser, Olsen & Watts, LLP

(57) ABSTRACT

A releasably engaging high definition multimedia plug comprises a plug body and an actuator operable with the plug body to move a locking tab of the plug and facilitate releasable engagement of the plug with a standard high definition multimedia receptacle. A corresponding method of releasably securing a high definition multimedia interface plug into standard high definition multimedia interface receptacle is also provided.

3 Claims, 88 Drawing Sheets

U.S. PATENT DOCUMENTS

| | | | | |
|---|---|---|---|---|
| 6,932,640 | B1 | 8/2005 | Sung | |
| 6,935,896 | B1 | 8/2005 | Tsai | |
| D509,190 | S | 9/2005 | Tsai | |
| D509,475 | S | 9/2005 | Tsai | |
| D510,069 | S | 9/2005 | Tsai | |
| 6,948,965 | B2 | 9/2005 | Kumamoto et al. | |
| 6,997,733 | B2 | 2/2006 | Peng | |
| 7,033,218 | B2 | 4/2006 | Huang et al. | |
| 7,044,791 | B2 | 5/2006 | Wang | |
| 7,128,588 | B2 | 10/2006 | Hu et al. | |
| 7,165,989 | B2 | 1/2007 | Huang et al. | |
| 7,175,465 | B1 | 2/2007 | Tsai | |
| 7,198,522 | B1 | 4/2007 | Ho et al. | |
| 7,854,618 | B2 * | 12/2010 | Liu et al. | 439/131 |
| 2003/0207606 | A1 | 11/2003 | Ho | |
| 2004/0185696 | A1 | 9/2004 | Long et al. | |
| 2006/0040555 | A1 | 2/2006 | Chen et al. | |
| 2006/0141865 | A1 | 6/2006 | Su et al. | |
| 2006/0148300 | A1 | 7/2006 | Huang et al. | |
| 2006/0172599 | A1 | 8/2006 | Hankey et al. | |
| 2006/0216991 | A1 | 9/2006 | Boutros | |
| 2007/0049100 | A1 | 3/2007 | Tsai | |
| 2008/0305683 | A1 | 12/2008 | Li et al. | |
| 2010/0124832 | A1 | 5/2010 | Liu et al. | |

OTHER PUBLICATIONS

High-Definition Multimedia Interface Specification Version 1.0. Published by: HDMI Licensing, LLC. Sep. 4, 2003. pp. 1-51.

High-Definition Multimedia Interface Specification Version 1.2a. Published by: HDMI Licensing, LLC. Dec. 14, 2005. pp. 1-193. (Attached as Part 1 and Part 2 due to size.).

High-Definition Multimedia Interface Specification Version 1.3. Published by: HDMI Licensing, LLC. Jun. 22, 2006. pp. 1-237. (Attached as Part 1 and Part 2 due to size.).

High-Definition Multimedia Interface Specification Version 1.3a. Published by: HDMI Licensing, LLC. Nov. 10, 2006. pp. 1-276. (Attached as Part 1 and Part 2 due to size.).

Office Action (Mail Date Apr. 21, 2010) for U.S. Appl. No. 12/276,833, filed Nov. 24, 2008, Confirmation No. 4892.

Notice of Allowance (Mail Date May 18, 2010) for U.S. Appl. No. 12/477,257, filed Jun. 3, 2009; Confirmation No. 7066.

Notice of Allowance (Mail Date Aug. 23, 2010) for U.S. Appl. No. 12/477,257, filed Jun. 3, 2009; Confirmation No. 7066.

Notice of Allowance (Mail Date Apr. 26, 2010) for U.S. Appl. No. 12/477,440, filed Jun. 3, 2009; Confirmation No. 7443.

Notice of Allowance (Mail Date Aug. 27, 2010) for U.S. Appl. No. 12/477,440, filed Jun. 3, 2009; Confirmation No. 7443.

U.S. Appl. No. 12/829,929, filed Jul. 2, 2010; Confirmation No. 9501; Customer No. 72687.

Notice of Allowance (Mail Date Oct. 13, 2010) for U.S. Appl. No. 12/276,833, filed Nov. 24, 2008; Confirmation No. 4892.

* cited by examiner (Prior Art)

| Pin | Signal |
|---|---|
| 1 | TMDS Data2+ |
| 2 | TMDS Data2 Shield |
| 3 | TMDS Data2- |
| 4 | TMDS Data1+ |
| 5 | TMDS Data1 Shield |
| 6 | TMDS Data1- |
| 7 | TMDS Data0+ |
| 8 | TMDS Data0 Shield |
| 9 | TMDS Data0- |
| 10 | TMDS Clock+ |
| 11 | TMDS Clock Shield |
| 12 | TMDS Clock- |
| 13 | CEC |
| 14 | Reserved (N.C. on Device) |
| 15 | SCL |
| 16 | SDA |
| 17 | DDC/CEC Ground |
| 18 | + 5V |
| 19 | Hot Plug Detect |

FIG. 41

(Prior Art)

| Pin | Signal |
|---|---|
| 1 | TMDS Data2+ |
| 2 | TMDS Data2 Shield |
| 3 | TMDS Data2- |
| 4 | TMDS Data1+ |
| 5 | TMDS Data1 Shield |
| 6 | TMDS Data1- |
| 7 | TMDS Data0+ |
| 8 | TMDS Data0 Shield |
| 9 | TMDS Data0- |
| 10 | TMDS Clock+ |
| 11 | TMDS Clock Shield |
| 12 | TMDS Clock- |
| 13 | TMDS Data5+ |
| 14 | TMDS Data5 Shield |
| 15 | TMDS Data5- |
| 16 | TMDS Data4+ |
| 17 | TMDS Data4 Shield |
| 18 | TMDS Data4- |
| 19 | TMDS Data3+ |
| 20 | TMDS Data3 Shield |
| 21 | TMDS Data3- |
| 22 | CEC |
| 23 | Reserved (N.C. on Device) |
| 24 | Reserved (N.C. on Device) |
| 25 | SCL |
| 26 | SDA |
| 27 | DDC/CEC Ground |
| 28 | + 5V |
| 29 | Hot Plug Detect |

FIG. 42

RELEASABLY ENGAGING HIGH DEFINITION MULTIMEDIA INTERFACE PLUG

CROSS-REFERENCE TO RELATED APPLICATIONS

This application is a divisional of and claims priority from U.S. application Ser. No. 12/477,440 filed Jun. 3, 2009 now issued on Jan. 4, 2011 as U.S. Pat. No. 7,862,367 and entitled RELEASABLY ENGAGING HIGH DEFINITION MULTIMEDIA INTERFACE PLUG, which is a continuation-in-part of and claims priority from U.S. application Ser. No. 12/477,257 filed Jun. 3, 2009 now issued on Dec. 28, 2010 as U.S. Pat. No. 7,857,652 and entitled RELEASABLY ENGAGING HIGH DEFINITION MULTIMEDIA INTERFACE PLUG, which is a continuation-in-part of and claims priority from U.S. application Ser. No. 12/276,833 filed Nov. 24, 2008 now U.S. Pat. No. 7,892,014 and entitled RELEASABLY ENGAGING HIGH DEFINITION MULTIMEDIA INTERFACE PLUG, which is a continuation-in-part of and claims priority from U.S. application Ser. No. 11/773,465 filed Jul. 5, 2007 now issued on Jan. 13, 2009 as U.S. Pat. No. 7,476,118 B2 and entitled RELEASABLY ENGAGING HIGH DEFINITION MULTIMEDIA INTERFACE PLUG, which is a continuation-in-part of and claims priority from U.S. application Ser. No. 11/696,716 filed Apr. 4, 2007 now issued on Nov. 25, 2008 as U.S. Pat. No. 7,455,545 B2 and entitled LOCKING HIGH DEFINITION MULTIMEDIA INTERFACE PLUG.

FIELD OF THE INVENTION

The present invention relates generally to high definition cable communications. More particularly, the present invention relates to a securely fastening high definition multimedia interface (HDMI) connector and related method of use. (HDMI, and the HDMI logo are trademarks or registered trademarks of HDMI Licensing, LLC).

BACKGROUND OF THE INVENTION

The onset of High Definition Televisions have led to the production of peripheral high definition (HD) components such as cable boxes, DVD players and mass storage devices that provide stored HD multimedia content. The HD components therefore necessitated the use of cables that are capable of transmitting data such as the digital visual interface (DVI) cable. The DVI cable had a shortfall of not providing an audio signal requiring an additional set of audio cables. The answer to the clutter of cables was to provide a new cable known as high definition multimedia interface that replaces the previous DVI cable. As shown in FIGS. 1-4, a standard high definition multimedia interface cable connector 1000 is commonly held onto a typical high definition multimedia interface receptacle 20 via friction interference fittings 22 unlike the previous DVI connectors that utilized two screws to secure the connectors. Moreover, a standard high definition multimedia interface receptacle 20 generally has fittings such as spring biased tabs 22 positioned in openings 25, wherein the tabs 22 are configured to fit into corresponding detents 1030 on an extension 1020 of a typical high definition multimedia interface plug 1000 to provide some interference between mated components and further assist in the retention of the standard high definition multimedia interface connector plug 1000 as mated within a typical high definition multimedia interface receptacle 20. However, the common configuration of standard high definition multimedia interface connector plugs 1000 is susceptible to poor performance due to structural and operable deficiencies; the standard plugs 1000 tend to come loose. Although the common spring biased tabs 22 provide some resistance to unwanted retraction of standard high definition multimedia interface plugs 1000, ordinary bumping the connector plugs 1000 or associated cables while cleaning, dusting or moving electrical devices often loosens the standard high definition multimedia interface connectors 1000 from proper mating positions with typical high definition multimedia interface receptacles 20. Moreover, the increasing use of wall mounted flat screen televisions, out of necessity or for the sake of aesthetics, has led to the increasing placement of high definition multimedia interface receptacles 20 that face downward. The downward orientation of the high definition multimedia interface receptacles 20 can further contribute to loose connections and signal loss if there is not sufficient friction between the plugs 1000 and the receptacles 20 to maintain contact as the associated standard high definition multimedia interface cable connectors 1000 fall off and become unplugged or otherwise disconnected due to the pull of gravity. Accordingly, a need exists for providing a releasably locking high definition multimedia interface plug.

SUMMARY OF THE INVENTION

The present invention provides an apparatus and method for use with high definition multimedia interface cable connections that offers improved reliability.

A first aspect of the invention provides a locking high definition multimedia interface plug comprising: a connector body having at least one opening; an actuator operable with the connector body; a locking tab configured to be moved by the actuator; a first position of the actuator wherein the locking tab is biased to protrude from the opening of the body; and, a second position of the actuator, wherein the locking tab does not protrude from the body, and, wherein the actuator is operable to move the locking tab between the first position and the second position.

A second aspect of the invention provides a locking high definition multimedia interface plug comprising: a locking tab movably locatable within an opening of a plug body; and an actuator, mounted on the plug body, wherein the actuator is configured to move the locking tab into a locked position in contact with a typical opening of a standard high definition multimedia interface receptacle, and wherein the actuator is configured to move the locking tab into an unlocked position not in contact with a typical opening of a standard high definition multimedia interface receptacle.

A third aspect of the invention provides a locking high definition multimedia interface cable connector comprising: a plug body having an opening; a lock button operably associated with the plug body; an actuator operably associated with the lock button; and a locking tab operably associated with the actuator, wherein the actuator is movable between a first position wherein the associated locking tab protrudes from the opening and a second position wherein the associated locking tab is located within the opening so as not to protrude from the opening.

A fourth aspect of the invention provides a locking high definition multimedia interface plug comprising: a body configured to be inserted into a high definition multimedia interface receptacle having openings on its outer surface; and a locking means associated with the body, said locking means configured to interact with the openings of the receptacle and securely releasably lock the body into receptacle.

A fifth aspect of the invention provides a locking high definition multimedia interface plug comprising: a body having an opening through which a movable locking tab extends; and an actuator associated with the body and located to move the locking tab into engagement with a typical opening of a standard high definition multimedia interface receptacle.

A sixth aspect of the invention provides a locking high definition multimedia interface connector plug comprising: a plug body, including an extension having an opening therein; a depressible lock button connected to the plug body; and an actuator coupled to a locking tab, wherein the actuator is operable with the depressible lock button; and wherein when the lock button is depressed the actuator moves the locking tab to reside within the opening.

A seventh aspect of the invention provides a locking high definition multimedia interface connector plug comprising: a plug body, including an extension having an opening therein; an inner section of the extension, the inner section having a guide portion, the guide portion having a depression; and an actuator coupled to a locking tab, the locking tab downwardly biased to reside within the depression of the guide portion when the actuator is in a second position, and wherein when the actuator is in the first position the locking tab engages a ramp to bend the locking tab outwards to protrude from the opening.

An eighth aspect of the invention provides a locking high definition multimedia interface connector plug comprising: a plug body, having an opening therein; a hinged lock button attached to the plug body; an actuator coupled to the lock button; and a locking tab operable with the actuator; wherein when the hinged lock button is pressed toward the actuator, the actuator moves the locking tab to reside within the opening.

A ninth aspect of the invention provides a locking high definition multimedia interface connector plug comprising: a plug body having an integrally joined locking tab; wherein the locking tab is normally biased downward into an opening of the plug body; and a sliding actuator having a first position wherein the actuator resides beneath the locking tab and bends the locking tab outward from the opening of the plug body; and wherein the sliding actuator has a second position wherein the actuator resides in a slide track allowing the locking tab to be downwardly biased into a depression.

A tenth aspect of the invention provides a locking high definition multimedia interface connector plug comprising: a plug body having an high definition multimedia interface connection end, the plug body including an opening therein; an actuator operable with the plug body; and a locking tab attached to the actuator, wherein the locking tab angularly extends through the opening of the plug body and away from the high definition multimedia interface connection end when the actuator is in a first position, and wherein the locking tab is retracted beneath the opening of the plug body when the actuator is in a second position.

An eleventh aspect of the invention provides a locking high definition multimedia interface connector plug comprising: a plug body having an extension, the extension including an opening; a sliding body lock button having an internal spring, the sliding body lock button connected to the plug body; an actuator, wherein the sliding body lock button is configured to work upon and move the actuator; and a locking tab associated with the actuator, wherein the locking tab protrudes from the opening of the body extension when the actuator is in a first position and resides within the opening of the body extension when the actuator is in a second position.

A twelfth aspect of the invention provides a locking high definition multimedia interface connector plug comprising: a receptacle-shaped plug body; an opening positioned in the receptacle shaped plug body; an actuator operable with the plug body; and a locking tab in contact with the actuator and positioned to releasably engage a typical opening of the receptacle when the plug body is mated with the receptacle, and wherein the actuator moves the locking tab to release engagement of the locking tab from the typical opening of the receptacle.

A thirteenth aspect of the present invention provides a method of locking an high definition multimedia interface plug into a receptacle comprising the steps of: providing a locking high definition multimedia interface plug including: a body configured to be inserted into a high definition multimedia interface receptacle, an actuator operable with the body; and a locking tab coupled to the actuator, wherein the locking tab is configured to movably protrude from an opening of the body; and biasing the locking tab sufficiently to protrude from the opening of the body to engage the receptacle and releasably lock the body into the receptacle.

A fourteenth aspect of the present invention provides a high definition multimedia interface connector for connection an high definition multimedia interface cable to an high definition multimedia interface receptacle, the high definition multimedia interface receptacle having an internal passageway defined therein, an outer surface of the internal passageway having at least one opening, the high definition multimedia interface comprising a connector body having an extension, the extension configured for insertion into the internal passageway; and, at least one projection extending from an outer surface of the extension, the projection configured to releasably engage the at least one opening upon insertion of the extension into the internal passageway.

A fifteenth aspect of the present invention provides a high definition multimedia interface connector comprising: a connector body, the connector body extending along a longitudinal axis and having a first end a and a second end: an extension, the extension operatively attached to the second end of the connector body, the extension extending along the longitudinal axis; and, at least, one projection on an outer surface of the extension, the projection extending away from the longitudinal axis of the extension.

A sixteenth aspect of the present invention provides a method of attaching a high definition multimedia interface connector to a high definition multimedia interface receptacle having an internal passageway defined therein, an outer surface of the internal passageway having at least one opening, comprising the steps of: providing a connector body having and extension configured to be inserted into the internal passageway, the extension having a projection extending from an outer surface of the extension, the projection configured to engage at least one spring biased tab partially disposed with the opening; inserting the extension into the high definition multimedia interface; and, engaging the projection with the opening to bias the tab sufficiently to cause a mechanical friction interference fit between the connector body and the high definition multimedia interface receptacle.

A seventeenth aspect of the present invention provides an high definition multimedia interface connector comprising: a connector body having an extension configured to be inserted into an high definition multimedia interface receptacle having at least one opening on its outer surface; and an engaging means associated with the extension, the engaging means configured to interact with the at least one opening of the receptacle and releasably engage the body into the receptacle.

An eighteenth aspect of the present invention provides a releasably engaging high definition multimedia interface plug comprising: a connector body having an opening, the connector body being operable with a wedge actuator, the wedge actuator positioned to be slidably movable below a locking tab of the plug; wherein, when the wedge actuator is slidably moved in a first axial direction relative to the connector body, the wedge actuator obtains a position where it is wedged below the locking tab and the locking tab is biased to protrude from the opening of the body; and wherein, when the wedge actuator is slidably moved in a second opposite axial direction relative to the connector body, the wedge actuator obtains a position where it is not in contact with the locking tab and the locking tab resides substantially within the opening of the body.

A nineteenth aspect of the present invention provides a releasably engaging high definition multimedia interface plug comprising: a connector body, a wedge actuator operable with the connector body; a locking tab configured to be moved by the wedge actuator; a first position of the wedge actuator, wherein the wedge actuator is wedged below the locking tab, so that the locking tab physically contacts and exerts a resultant force upon a typical spring biased tab of a corresponding standard high definition multimedia interface receptacle into which the locking plug has been inserted; and a second position of the wedge actuator, wherein the wedge actuator resides in a position away from the locking tab, so that the locking tab does not contact the typical spring biased tab of the corresponding standard high definition multimedia interface receptacle into which the locking plug has been inserted.

A twentieth aspect of the present invention provides A releasably engaging high definition multimedia interface plug comprising: a connector body; a body extension, extending from the connector body and sized for insertion into a standard high definition multimedia interface receptacle, the body extension having an opening; a locking tab, located on the body extension; and means for locating the locking tab, so that the locking tab protrudes from the opening of the extension and physically contacts and exerts a resultant force upon a typical spring biased tab of the corresponding standard high definition multimedia interface receptacle into which the locking plug has been inserted; and means for locating the locking tab, so that the locking tab does not contact the typical spring biased tab of the corresponding standard high definition multimedia interface receptacle into which the locking plug has been inserted.

A twenty-first aspect of the present invention provides a method of releasably securing a high definition multimedia interface plug into releasably engaging high definition multimedia interface plug, the method comprising the steps of: providing a releasably engaging high definition multimedia interface plug, the interface plug including: a connector body having an opening, a wedge actuator operable with the connector body; a locking tab configured to be moved by the wedge actuator; a first position of the wedge actuator, wherein the wedge actuator is locatable below the locking tab; and a second position of the wedge actuator, wherein the actuator is locatable in a position away from the locking tab; moving the wedge actuator so that the wedge actuator obtains a position where it is not in contact with the locking tab and the locking tab resides substantially within the opening of the body and so that the locking tab will not contact the typical spring biased tab of the corresponding standard high definition multimedia interface receptacle into which the locking plug is insertable; inserting the releasably engaging high definition multimedia interface plug into a corresponding standard high definition multimedia interface receptacle; and moving the wedge actuator in a direction away from the connector body, so that the wedge actuator obtains a position where it is wedged below the locking tab and the locking tab is biased to protrude from the opening of the body and so that the locking tab physically contacts and exerts a resultant force upon a typical spring biased tab of the corresponding standard high definition multimedia interface receptacle into which the locking plug is inserted, thereby releasably securing the plug within the receptacle.

A twenty-second aspect of the present invention provides a releasably engaging high definition multimedia interface plug comprising: a connector body having an opening, the connector body being operable with an actuator having a ramped portion of a forward edge, the ramped portion of the forward edge of the actuator positioned to be slidably movable in contact with and below at least one flexible engagement member having a locking tab residing thereon; wherein, when the actuator is slidably moved in a first axial direction relative to the connector body, the ramped portion of the forward edge of the actuator obtains a position where it is in contact with and below the at least one flexible engagement member and bending the flexible engagement member in a plane not perpendicular with the direction of insertion of the plug into a corresponding standard interface receptacle so that the locking tab is located to protrude from the opening of the body; and wherein, when the actuator is slidably moved in a second opposite axial direction relative to the connector body, the ramped portion of the forward edge of the actuator obtains a position where it is not in contact with and not below the at least one flexible engagement member and the locking tab resides substantially within the opening of the body.

A twenty-third aspect of the present invention provides a releasably engaging high definition multimedia interface plug comprising: a connector body having an opening, the connector body being operable with an actuator having a forward edge, the forward edge of the actuator positioned to be slidably movable in contact with a flexible engagement member having two locking tabs residing thereon; wherein, when the actuator is slidably moved in a first axial direction relative to the connector body, the forward edge of the actuator obtains a position where it is in contact with the flexible engagement member and the two locking tabs are located to protrude from the opening of the body; and wherein, when the actuator is slidably moved in a second opposite axial direction relative to the connector body, the forward edge of the actuator obtains a position where it is not in contact with the flexible engagement member and the two locking tabs reside substantially within the opening of the body.

A twenty-fourth aspect of the present invention provides a releasably engaging high definition multimedia interface plug comprising: a connector body having an opening, the connector body being operable with an actuator having a forward edge, the forward edge of the actuator positioned to be slidably movable in contact with and below a depression in a flexible engagement member having two locking tabs residing thereon; wherein, when the actuator is slidably moved in a first axial direction relative to the connector body, the forward edge of the actuator obtains a position where it is in contact with and below the depression in the flexible engagement member and the two locking tabs are located to protrude from the opening of the body; and wherein, when the actuator is slidably moved in a second opposite axial direction relative to the connector body, the forward edge of the actuator obtains a position where it is not in contact with and not below the depression in the flexible engagement member and the two locking tabs reside substantially within the opening of the body.

A twenty-fifth aspect of the present invention provides a releasably engaging high definition multimedia interface plug comprising: a connector body having an opening, the connector body being operable with an actuator having a ramped portion of a forward edge, the ramped portion of the forward edge of the actuator positioned to be slidably movable in contact with and below a flexible engagement member having two locking tabs residing thereon; wherein, when the actuator is slidably moved in a first axial direction relative to the connector body, the ramped portion of the forward edge of the actuator obtains a position where it is in contact with and below the flexible engagement member and the two locking tabs are located to protrude from the opening of the body; and wherein, when the actuator is slidably moved in a second opposite axial direction relative to the connector body, the ramped portion of the forward edge of the actuator obtains a position where it is not in contact with and not below the flexible engagement member and the two locking tabs reside substantially within the opening of the body.

A twenty-sixth aspect of the present invention provides a releasably engaging high definition multimedia interface plug comprising: a high definition multimedia interface connection end; a connector body having an opening, the connector body operable with a slidable actuator having a ramped portion of a forward edge, the ramped portion of the forward edge of the actuator positionable below a flexible engagement member, the flexible engagement member having a locking tab residing thereon; wherein, when the actuator is slidably moved in a first axial direction relative to the interface connection end, the ramped portion of the forward edge of the actuator obtains a position where it is in contact with and below the flexible engagement member and the locking tab is biased to protrude from the opening of the body; and wherein, when the actuator is slidably moved in a second opposite axial direction relative to the interface connection end, the ramped portion of the forward edge of the actuator obtains a position where it is not in contact with and not below the flexible engagement member and the locking tab resides substantially within the opening of the body.

A twenty-seventh aspect of the present invention provides a releasably engaging high definition multimedia interface plug comprising: a connector body; a lock button, operable with the connector body, the lock button having a locked position and an unlocked position; an movable actuator, the actuator operable with the lock button; a locking tab configured to be moved by the forward edge of the actuator; a first position of the actuator corresponding to the locked position of the lock button, wherein the actuator moves the locking tab, so that the locking tab extends into engagement with a typical sidewall opening of a corresponding standard high definition multimedia interface receptacle into which the releasably engaging plug has been inserted; and a second position of the actuator corresponding to the unlocked position of the lock button, wherein the actuator resides in a position away from the locking tab, so that the locking tab does not contact nor extend into engagement with a typical sidewall opening of the corresponding standard high definition multimedia interface receptacle into which the releasably engaging plug has been inserted.

A twenty-eighth aspect of the present invention provides a locking high definition multimedia interface plug comprising: a connector body, having top and bottom portions movably mounted on a cable receiver portion; a body extension, extending from the connector body and sized for insertion into a standard high definition multimedia interface receptacle, the body extension having an opening, wherein the top and bottom portions are movable with respect to the body extension; a locking tab, located on the body extension; means for locating the locking tab, so that the locking tab protrudes from the opening of the extension and extends into engagement with a typical sidewall opening of the corresponding standard high definition multimedia interface receptacle into which the locking plug has been inserted; and means for locating the locking tab, so that the locking tab does not contact nor extend into engagement with a typical sidewall opening of the corresponding standard high definition multimedia interface receptacle into which the locking plug has been inserted.

A twenty-ninth aspect of the present invention provides a method of releasably securing a high definition multimedia interface plug into standard high definition multimedia interface receptacle, the method comprising: providing a releasably engaging high definition multimedia interface plug including: a plug body; a compressible lock button, the lock button axially movably operable with respect to a portion of the plug body; an actuator, movable through operation of the lock button; and a locking tab, movable through operation of the actuator; inserting the releasably engaging high definition multimedia interface plug into a standard high definition multimedia interface receptacle; and moving the lock button axially to move the actuator to move the locking tab into secure engagement with a typical sidewall opening of the corresponding standard high definition multimedia interface receptacle into which the locking plug has been inserted.

BRIEF DESCRIPTION OF THE DRAWINGS

Some of the embodiments of this invention will be described in detail, with reference to the following figures, wherein like designations denote like members, wherein:

FIG. 41 depicts a pin layout of a typical high definition multimedia interface 19 pin connector; and FIG. 42 depicts a pin layout of a typical high definition multimedia interface 29 pin connector.

DETAILED DESCRIPTION OF THE INVENTION

Figure 1:
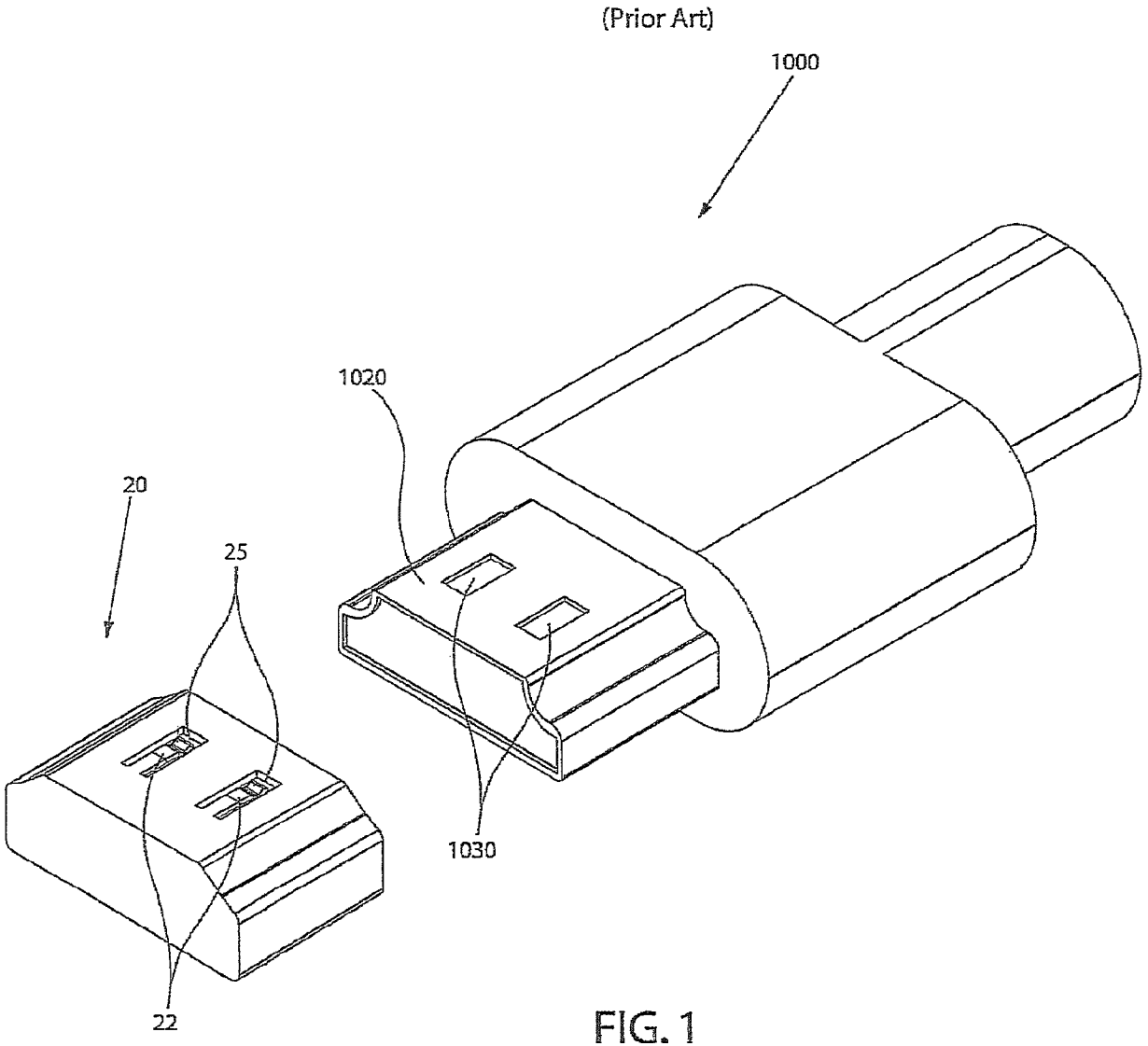
FIG. 1 depicts a perspective view of a standard high definition multimedia interface connector of the prior art prior to mating with a typical high definition multimedia interface receptacle.
Figure 2:
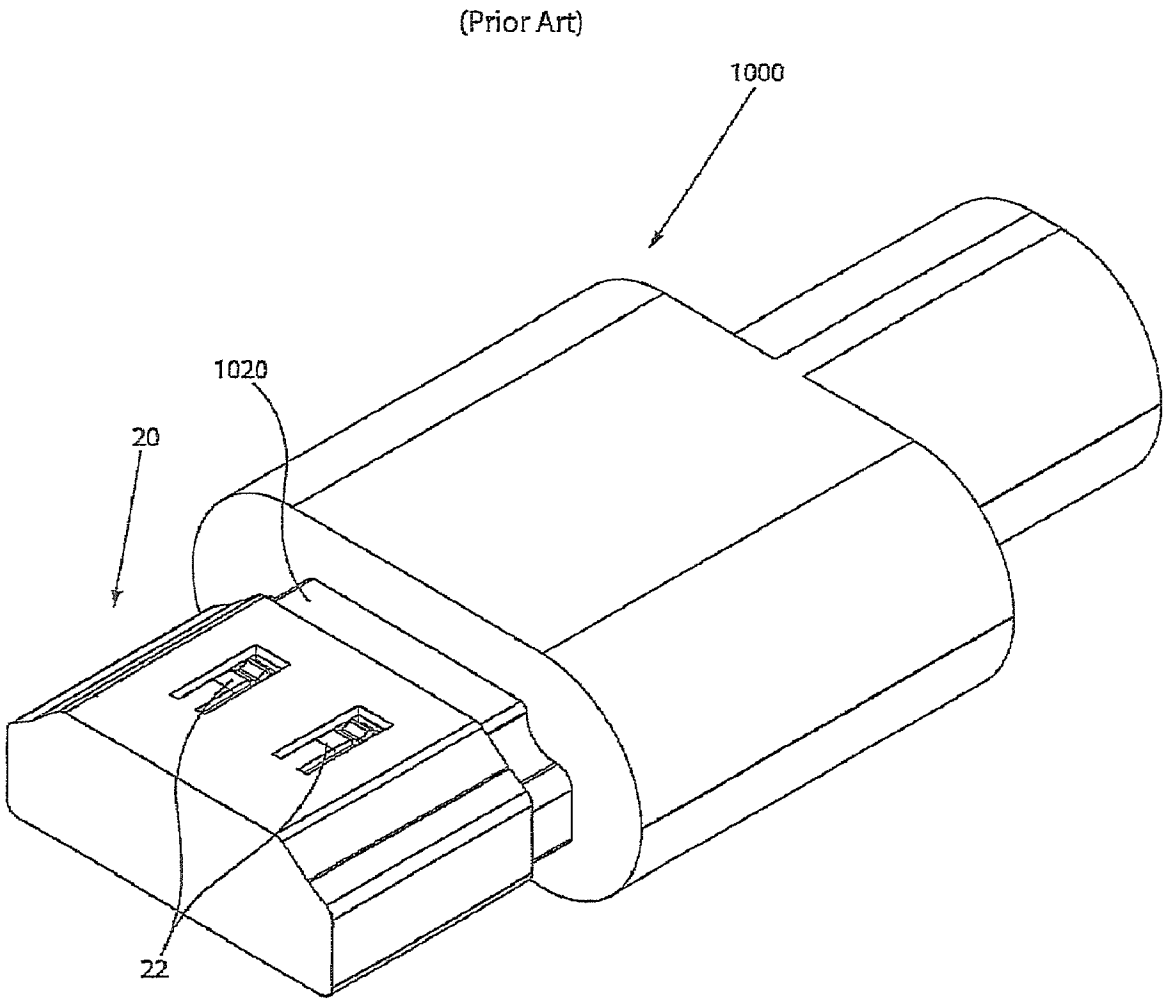
FIG. 2 depicts a perspective view of a standard high definition multimedia interface connector of the prior art as mated with a typical high definition multimedia interface receptacle.
Figure 3:
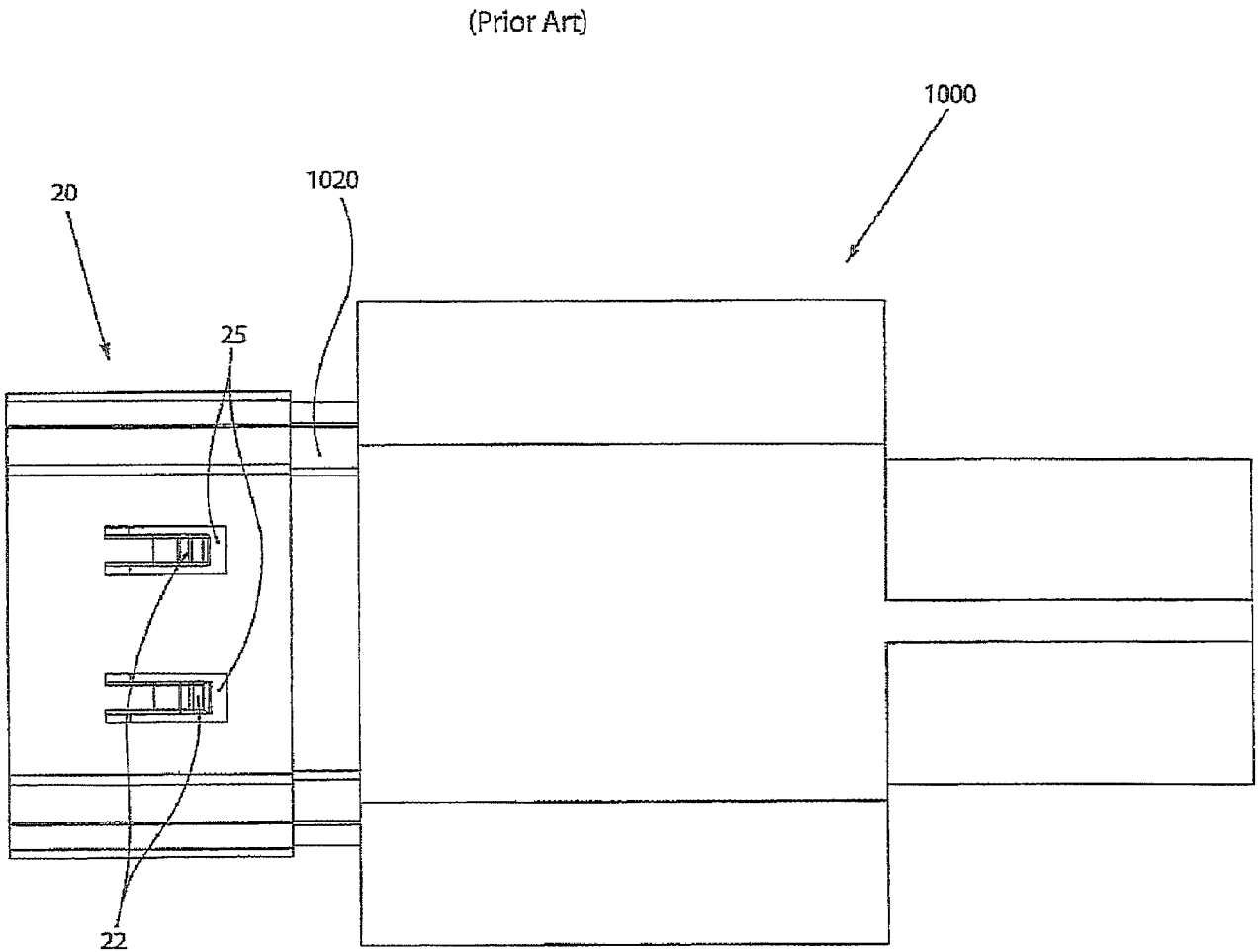
(Prior Art) FIG. 3
FIG. 3 depicts a top view of a standard high definition multimedia interface connector of the prior art as mated with a typical high definition multimedia interface receptacle.
Figure 4:
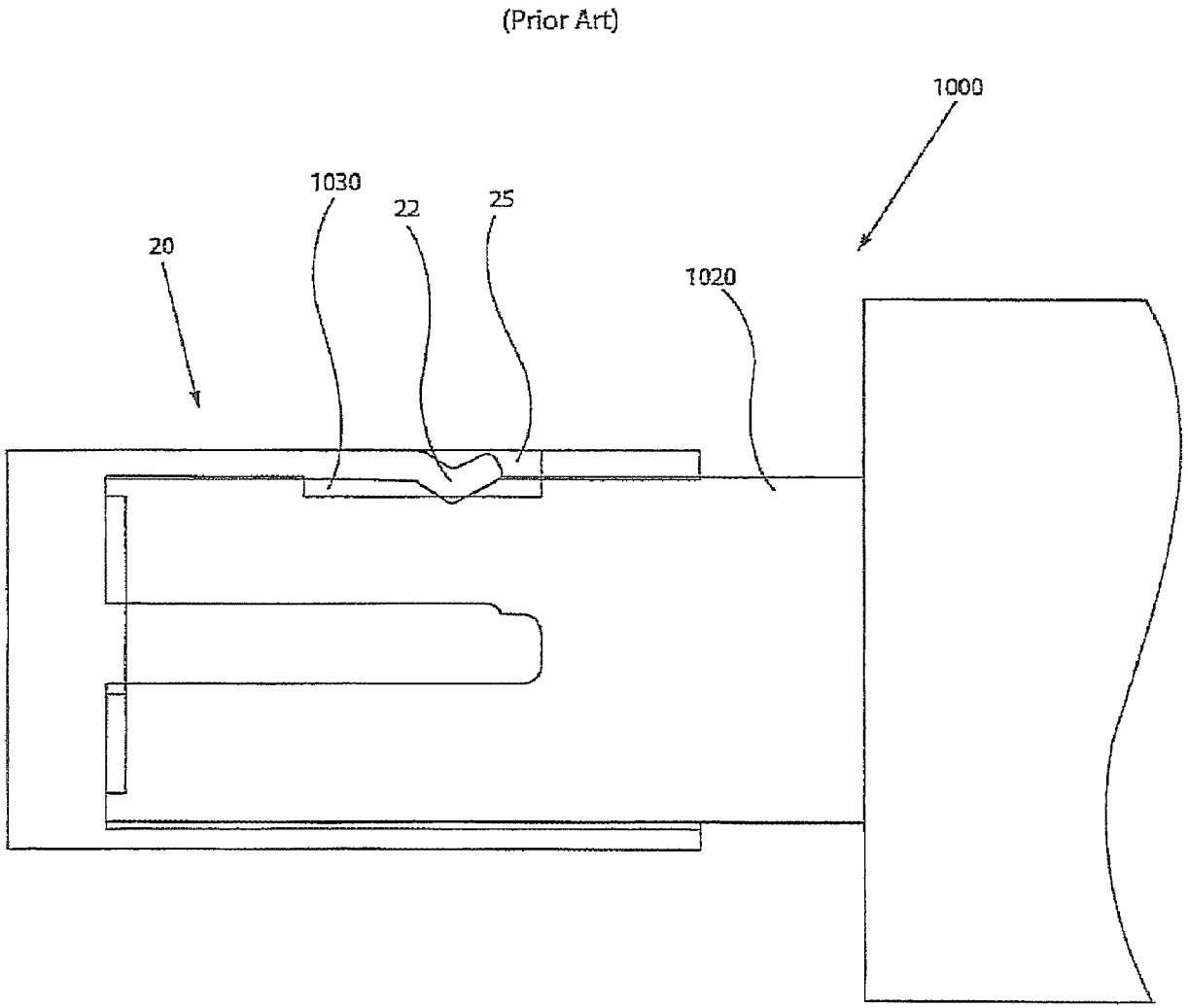
(Prior Art) FIG. 4
FIG. 4 depicts a partial cutaway side view of a standard high definition multimedia interface connector of the prior art as mated with a typical high definition multimedia interface receptacle.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Figure 5:
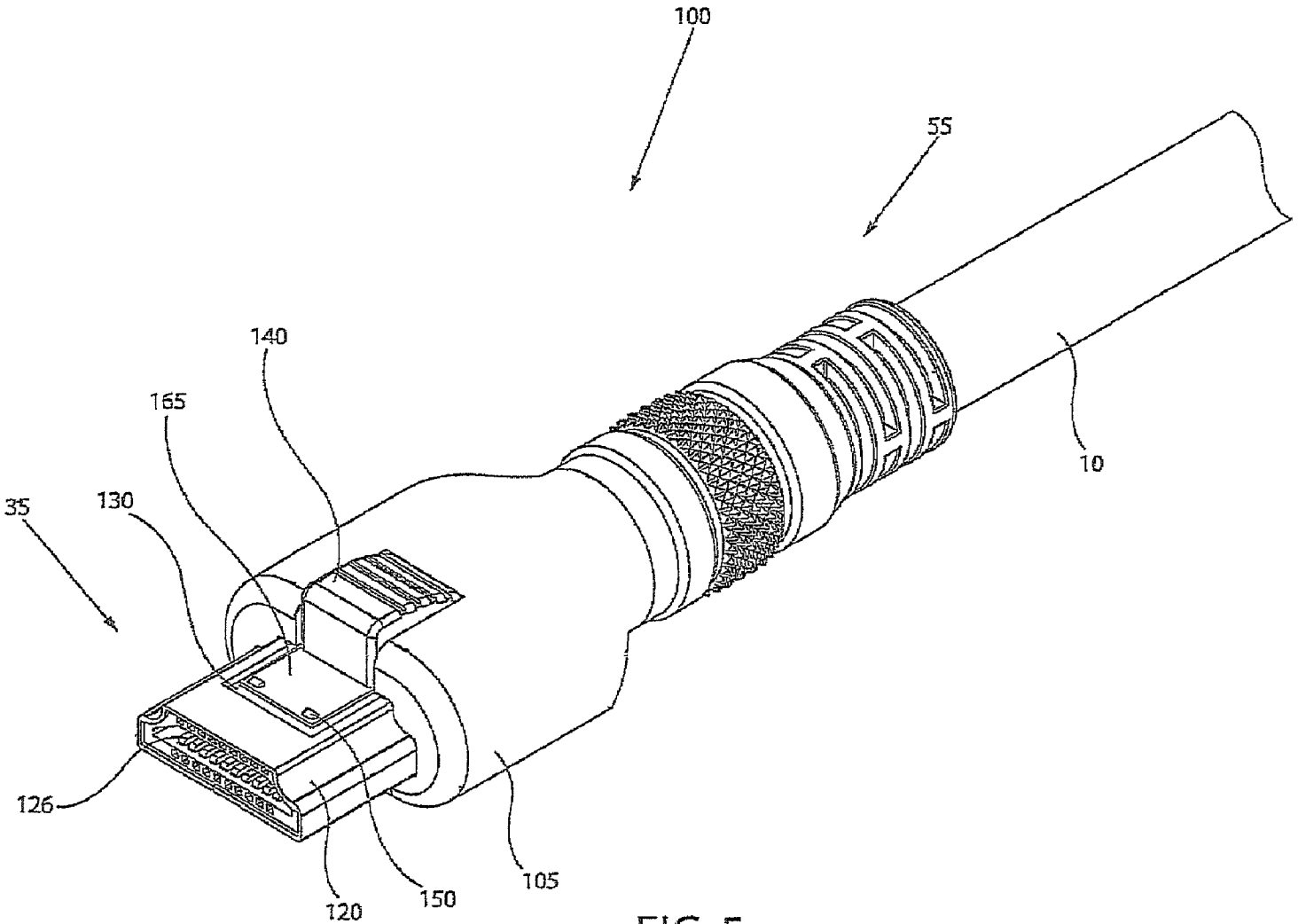
FIG. 5 depicts a perspective view of an embodiment of a releasably locking high definition multimedia interface plug, according to the present invention.

With reference to the drawings, FIG. 5 depicts a perspective view of an embodiment of a locking high definition multimedia interface plug 100 for connecting high definition multimedia interface cable 10 to high definition electronic components having standard high definition multimedia interface receptacles. Accordingly, the locking high definition multimedia interface plug 100 has an high definition multimedia interface connection end 35. The locking high definition multimedia interface plug 100 comprises a connector body or plug body 105, having an opening 130. The plug body 105 may include an extension 120. The opening 130 may be located on the extension 120 of the plug body 105. The plug body 105 can help retain a connected high definition multimedia interface cable 10. The locking high definition multimedia interface plug 100 may have a cable connection end 55. The locking high definition multimedia interface plug 100 comprises an actuator 165 configured to move a locking tab 150. The actuator may be associated with, or physically connected to, the locking tab 150, such that movement of the actuator 165 causes the locking tab 150 to move. Moreover, the actuator 165 may operate with a lock button 140 associated with, or operably coupled to, the plug body 105. The lock button 140 is configured to be manipulated by a user in an up, down, or sideways motion to work upon the actuator 165 and cause the actuator 165 to move the locking tab 150 between a first position 160 (see FIG. 8) and a second position 170 (see FIG. 9). The lock button 140 may be integrally formed with actuator 165, or may be separately attached to the actuator 165 and located to contact or otherwise configured to afford work upon the actuator in some operable manner. The lock button 140 may be depressible. In addition, a locking high definition multimedia interface plug 100 has a plug terminal contact 126.

Figure 6:
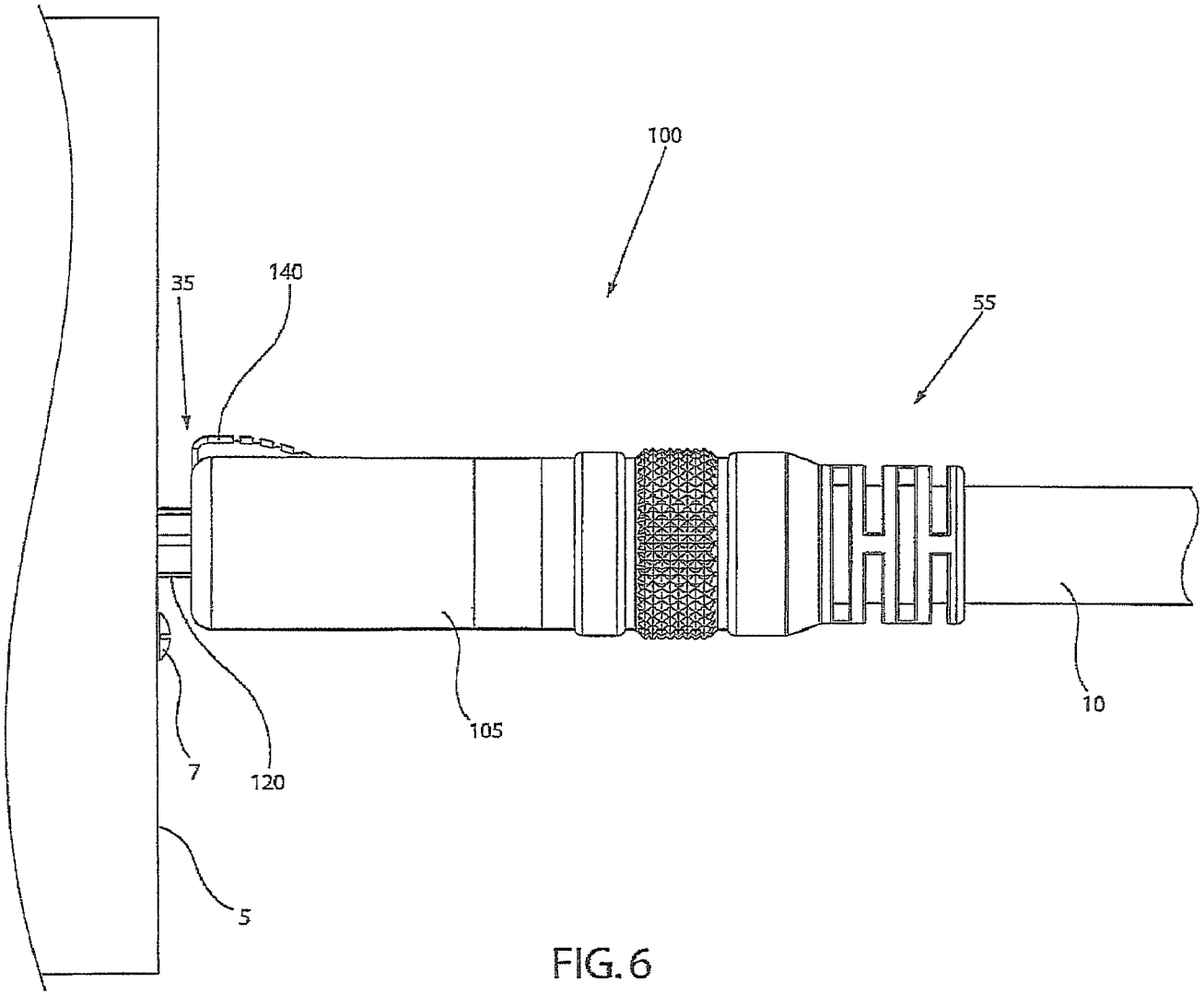
FIG. 6 depicts a side view of an embodiment of a locking high definition multimedia interface plug mated to a receptacle.

Referring further to the drawings, FIG. 6 depicts a side view of an embodiment of a locking high definition multimedia interface plug 100 mated to a receptacle 20 (shown in FIG. 7), the receptacle 20 may be secured to a housing 5, for example, by a mounting screw 7. The housing 5 may be any physical component of a high definition electrical device. For example, the housing may be the outer casing of a flat-screen HD television, the shell of a cable TV box, or the covering of a DVD player. The high definition multimedia interface connection end 35 of the locking high definition multimedia interface plug may be plugged into the receptacle to facilitate a connection and allow transmission of electronic communications through the cable 10 connected to the cable connection end 55 of the locking high definition multimedia interface plug. An extension 120 may extend from the plug body 105 and be configured to be inserted into the receptacle 20. The lock button 140 is utilized to help securely fasten the locking high definition multimedia interface plug 100 to the receptacle 20 mounted in the housing 5.

Figure 7:
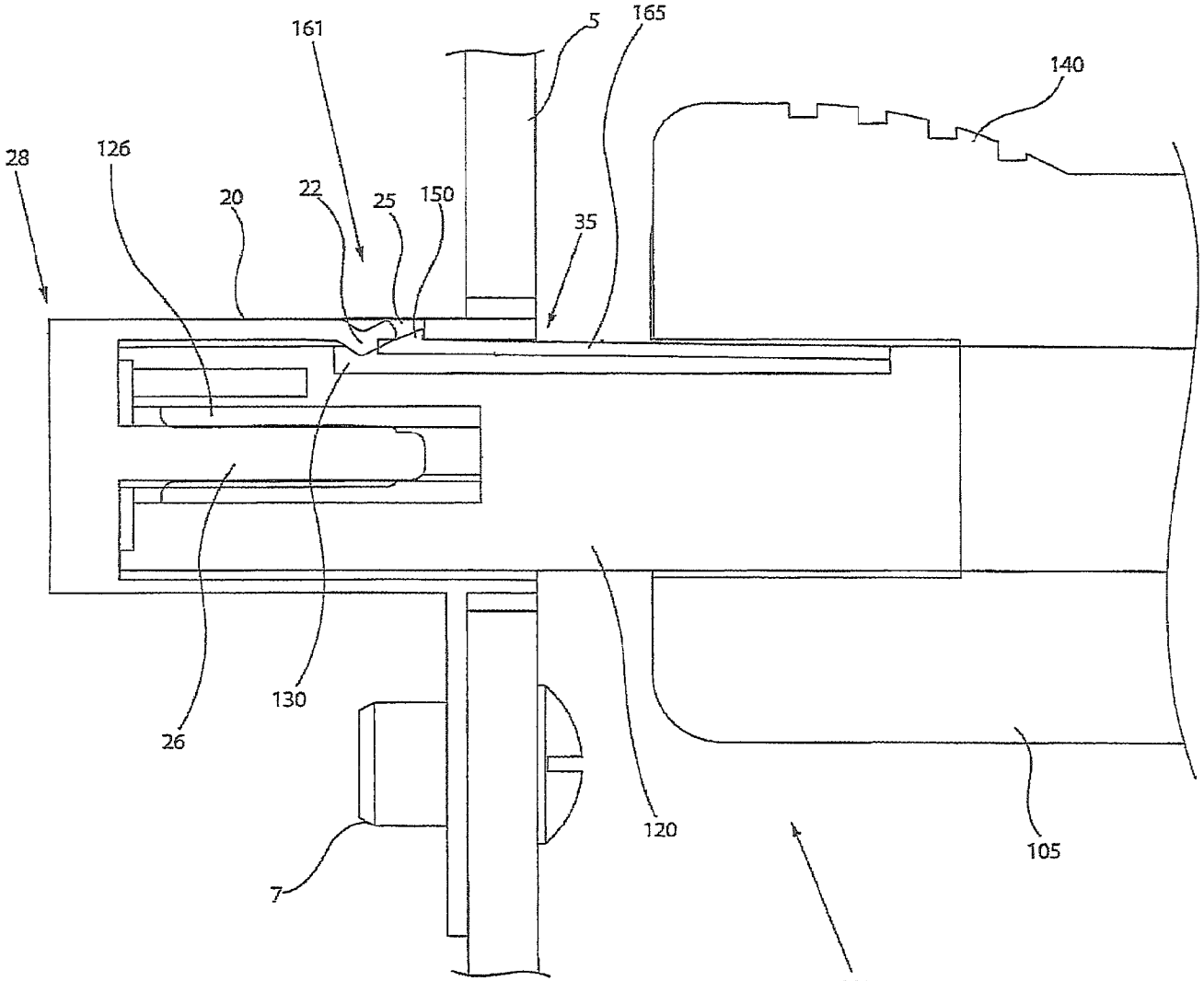
FIG. 7 depicts a partial cutaway side view of an embodiment of a locking high definition multimedia interface plug mated with a receptacle.

With continued reference to the drawings, FIG. 7 depicts a partial cutaway side view of an embodiment of a locking high definition multimedia interface plug 100 mated with a receptacle 20. The plug terminal contacts 126 are configured to mate with a receptacle port contact 26 of the receptacle 20. A typical high definition multimedia interface receptacle, as described previously, may commonly have a sidewall opening 25 with a spring biased tab 22 (as shown in FIG. 1). The sidewall opening 25 is located on the outer surface of the receptacle and generally permits the spring biased tab 22 to protrude somewhat into a detent(s) of a standard high definition multimedia interface plug (see FIGS. 1-4). Hence, when the spring biased tab(s) 22 protrudes into the typical detent(s) of a standard high definition multimedia interface plug, some mechanical interference between the parts is created to help retain the standard plug in mated position with the receptacle 20. However, the typical shape of the spring biased tab 22 and the associated forces of the interference fit of the tab 22 with openings or detents of a standard high definition multimedia interface plug are often insufficient to securely retain the standard high definition multimedia interface plug in an appropriate mating position with the receptacle 20. Accordingly, embodiments of a locking high definition multimedia interface plug 100 are configured such that the typical spring biased tab 22 of a standard high definition multimedia interface receptacle can protrude into the opening 130 of the body 105 helping to secure the locking high definition multimedia interface plug 100 to the receptacle 20. Thus, the inclusion of a locking tab 150 of the present invention facilitates a secure mating position when the locking high definition multimedia interface plug 100 is releasably mounted to a standard high definition multimedia interface receptacle.

The locking tab 150 of a locking high definition multimedia interface plug 100 may be configured to be moved into a locked position 161 (as shown in FIG. 7), wherein the locking tab 150 may be located so as to operably protrude into and engage the typical sidewall opening 25 of a receptacle 20. The shape of the locking tab may be configured to substantially hinder and/or stop the retraction of the locking high definition multimedia interface plug 100 from a mated position with the receptacle 20 in a locking, but be releasable simply by the provision of a motive force acting on the actuator 165 of the plug 100. The configuration of the locking high definition multimedia interface plug 100 may necessitate the movement of the locking tab 150 out of the opening 25 before the locking high definition multimedia interface plug may be retracted. However, tab 150 embodiments may be provided wherein the tabs 150 are configured to slip, move, break away, or otherwise facilitate release from a locked position 161 when sufficient force is placed upon the tabs 150. Hence, the tabs 150 may release to prevent damage from occurring to the high definition multimedia interface receptacle as a result of the force. With respect to FIG. 8, various configurations of locking tab embodiments 150$a_1$, 150$a_2$, and 150$a_3$ are shown. A locking tab embodiment 150$a_1$ may include a ramped rear edge 158$a_1$ having a reverse incline. The reverse incline may be angled such that sufficient force may cause the rear edge 158$a_1$ to slip out from engagement with the opening 25 of a receptacle 20 (see FIG. 7). Nevertheless, the rear edge 158$a_1$ may be shaped so that typical forces due to gravity, dusting, cleaning, moving electrical devices, or otherwise bumping a cable 10 (see FIGS. 5-6) or high definition multimedia interface plug 100 will not be sufficient to break away the locking tab 150$a_1$. But a substantial jerk on the cable 10 or a large push against the mated plug 100 will cause the tab 150$a_1$ to release so that the receptacle 20 is not damaged as a result of the force from the jerk or push.

Figure 8:
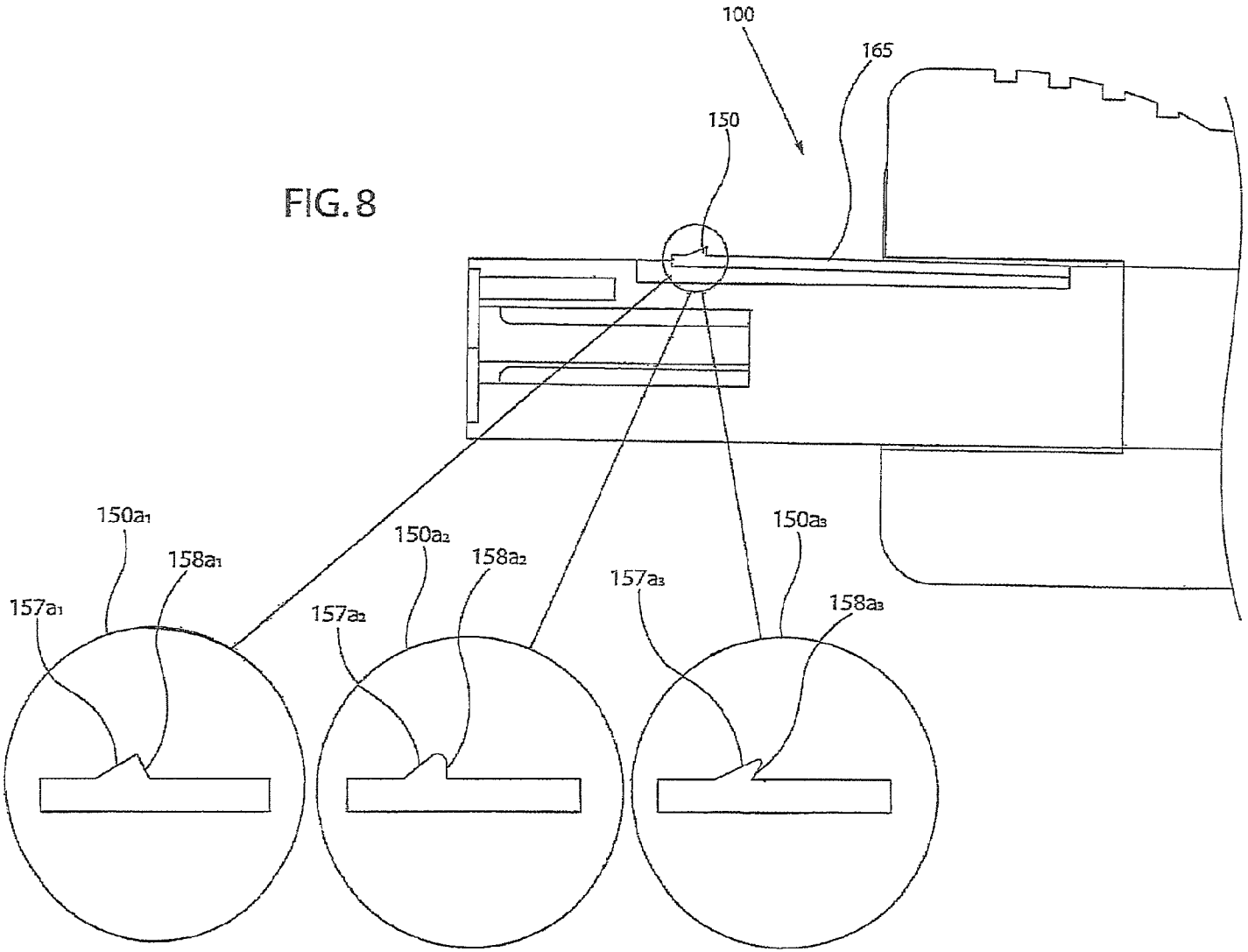
FIG. 8 depicts a partial cutaway side view of a locking high definition multimedia interface plug with blow-ups of various locking tab embodiments.

Referring further to FIG. 8, embodiments of the locking tab 150 are configured to permit easy insertion of the plug 100 into the receptacle 20. For example, a tab 150 may have rounded, beveled, or ramped forward edges 157 permitting unidirectional movement of the tab 150 into docking engagement with the receptacle 20. The plug 100 may be inserted into a receptacle 20 and the ramped forward edges 157 may allow the locking tabs 150 to slidably snap into a locked position 161 when the extension 120 is inserted such that the tab(s) 150 securely protrude into the opening(s) 25 of the receptacle 20 (see FIG. 7). Accordingly, a locking tab embodiment 150$a_1$ may include a ramped edge 157$a_1$ having a forward incline permitting the tab 157$a_1$ to slidably snap into engagement with the opening 25 of the receptacle 20. However, as shown and described above the rear edge 158$a_1$ may be ramped in a reverse direction and may have a steeper angle of incline making it harder for the tab 150$a_1$ to slide in the reverse direction. Other embodiments of the locking tab 150, such as embodiments 150$a_2$ and 150$a_3$, may also include rear edges or impedance surface(s) 158 configured to obstruct movement in the opposite releasing direction while the tab 150 is snapped into the opening 25 of the receptacle 20. For instance, tab embodiment 150$a_2$ includes a verticle rear edge 158$a_2$ designed to hinder movement in the reverse direction when the tab 150$a_2$ is in a locked position 161 (see FIG. 7). However, the transition between the ramped forward edge 157$a_2$ and vertical rear edge 158$a_2$ may be rounded so that the tab 150$a_2$ may move if sufficient force is provided in the reverse direction. Tab embodiment 150$a_3$ includes a forward inclined rear edge 158$a_3$ designed to hinder movement in the reverse direction when the tab 150$a_3$ is in a locked position 161. The tab embodiment 158$a_3$ may be designed to snap off or break away if sufficient force is provided in the reverse direction. Thus, embodiments of a locking tab 150 may facilitate release from a locked position 161 when sufficient force is inflicted upon the tab 150.

Figure 9:
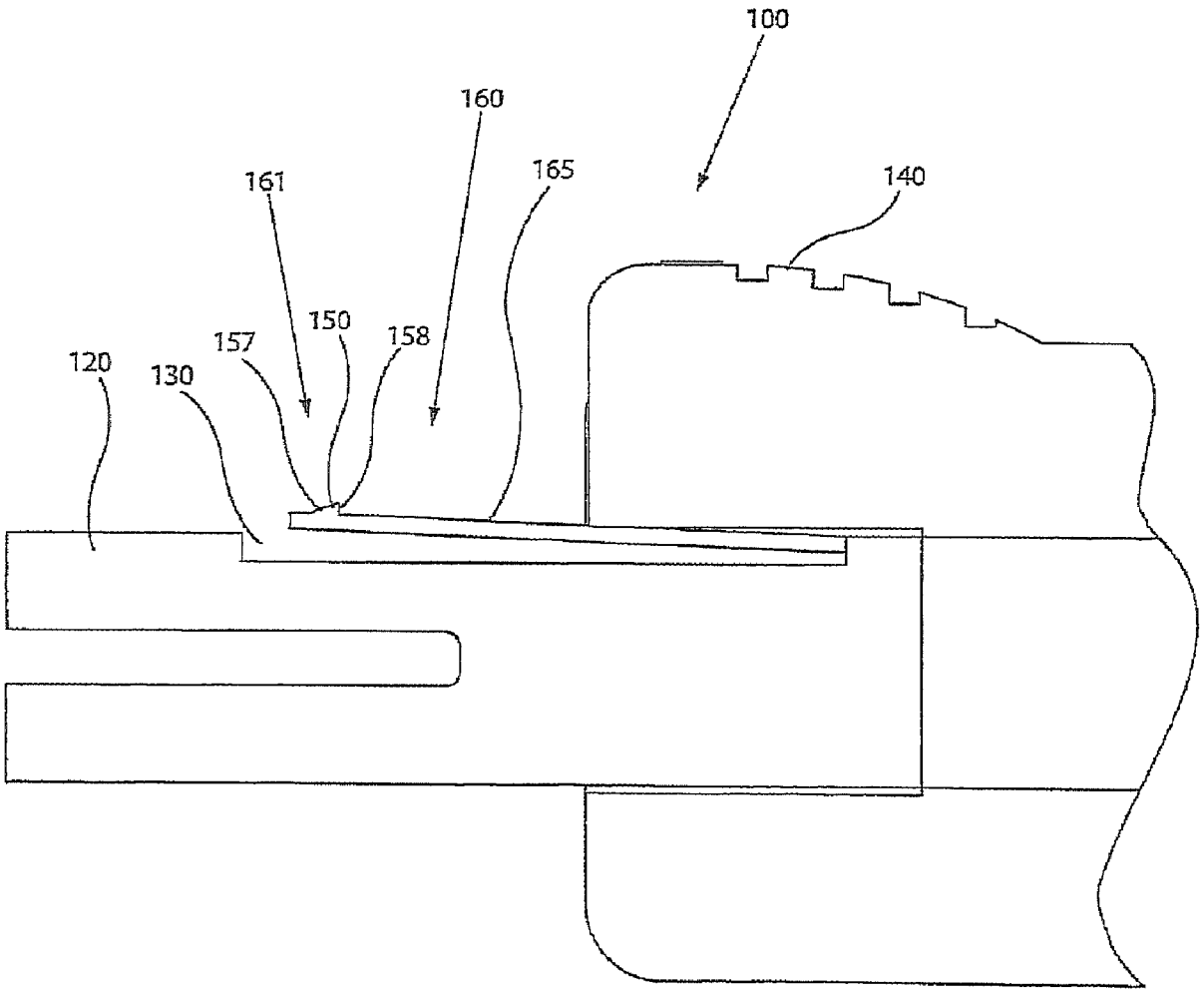
FIG. 9 depicts a partial cutaway side view of a locking high definition multimedia interface plug, wherein an actuator is located in a first position.

The locking tab 150 may be moved into and/or may be moved out of the typical opening 25 of a receptacle 20 by operation of an actuator 165. For example, a lock button 140 may be configured to be depressed, or made to slide forward and backward, to slide side-to-side, or otherwise set in motion to act upon the actuator 165, which, in turn, moves the locking tab 150. For instance, the lock button 140 may be used to move a leaf-spring type actuator 165 downward, as shown in FIG. 9, and also cause the locking tab 150 to move downward into the opening 130 of the extension 120 and out of the opening 25 of the receptacle 20 to thereby unlock the plug 100 from the receptacle 20. However, it should also be appreciated that the configurations of locking high definition multimedia interface plug embodiments, to be described later, also permit maneuvering of the lock button 140 to work upon the actuator 165 and thereby move the locking tab 150 into an interference position within the sidewall opening 25 of the receptacle 20.

With continued reference to FIGS. 1-8, when mating a locking high definition multimedia interface plug 100 to a receptacle 20, a user may grip the plug body 105 and advance, push or otherwise insert the connection end 35 of the plug 100 into a corresponding receptacle 20. The receptacle 20 may facilitate electrical communication with other electrical components. For example a circuit connection end 28 (see FIG. 7) of the receptacle 20 may include contacts or leads that make possible the communication of electromagnetic signals to various electronic devices.

Embodiments of locking high definition multimedia interface plugs, such as plug 100, may utilize a movable actuator 165 to help position a locking tab 150 into an interfering location with respect to a receptacle 20. Referring to FIG. 9 a locking high definition multimedia interface plug 100 is shown having an actuator 165 located in a first position 160. A first position 160 of the actuator 165 may correspond to a locked position 161 when the plug 100 is mated with a receptacle 20. When the actuator 165 is located in a first position 160, the locking tab 150 may be biased to protrude from the opening 130. A lock button 140 may be operably associated with the plug body 105 and the actuator 165 may be operably associated with the lock button. Accordingly, the locking tab 150 operably associated with the actuator 165, may contact, engage, or otherwise interfere with the typical sidewall opening 25 of a standard high definition multimedia interface receptacle 20 and thereby help to restrict the unplugging the locking high definition multimedia interface plug 100 from the receptacle 20.

Figure 10:
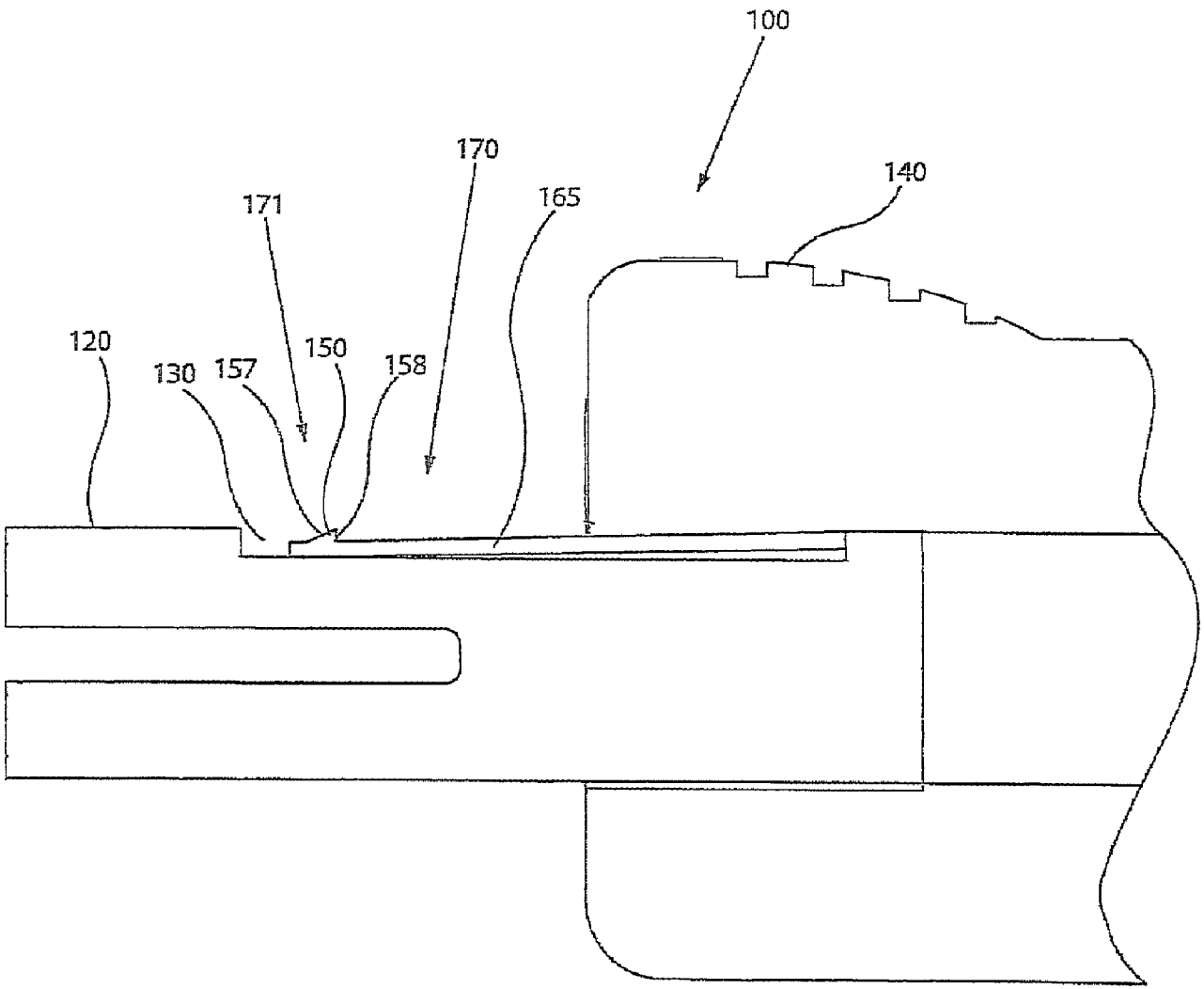
FIG. 10 depicts a partial cutaway side view of a locking high definition multimedia interface plug, wherein an actuator is located in a second position.

The actuator 165 may also be movably locatable in a second position 170, wherein the associated locking tab 150 does not protrude from the opening 130 of the body, as depicted in FIG. 10. For example, when the actuator 165 is in a second position 170, the locking tab 150 may be positioned within the opening 130 of the body extension 120 so that it does not extend away from the opening 130. A second position 170 of the actuator 165 may correspond to an unlocked position 171 when the plug 100 is mated with a receptacle 20. Hence, when the actuator 165 is in a second position 170, the locking tab(s) 150 may not contact or otherwise interfere with other physical components, such as sidewalls or opening(s) 25 of a receptacle 20, in proximate association with the extension 120. It should be appreciated that when locking high definition multimedia interface plug embodiments, such as plug 100, are mated to a receptacle 20, unlocking and efficiently retracting the plug 100 from the receptacle 20 may involve the operable positioning of the actuator 165 into a second position 170, thereby eliminating the interference between the impedance surfaces 158 of the locking tab(s) 150 and the sidewall opening(s) 25 of the receptacle 20.

Figure 39:
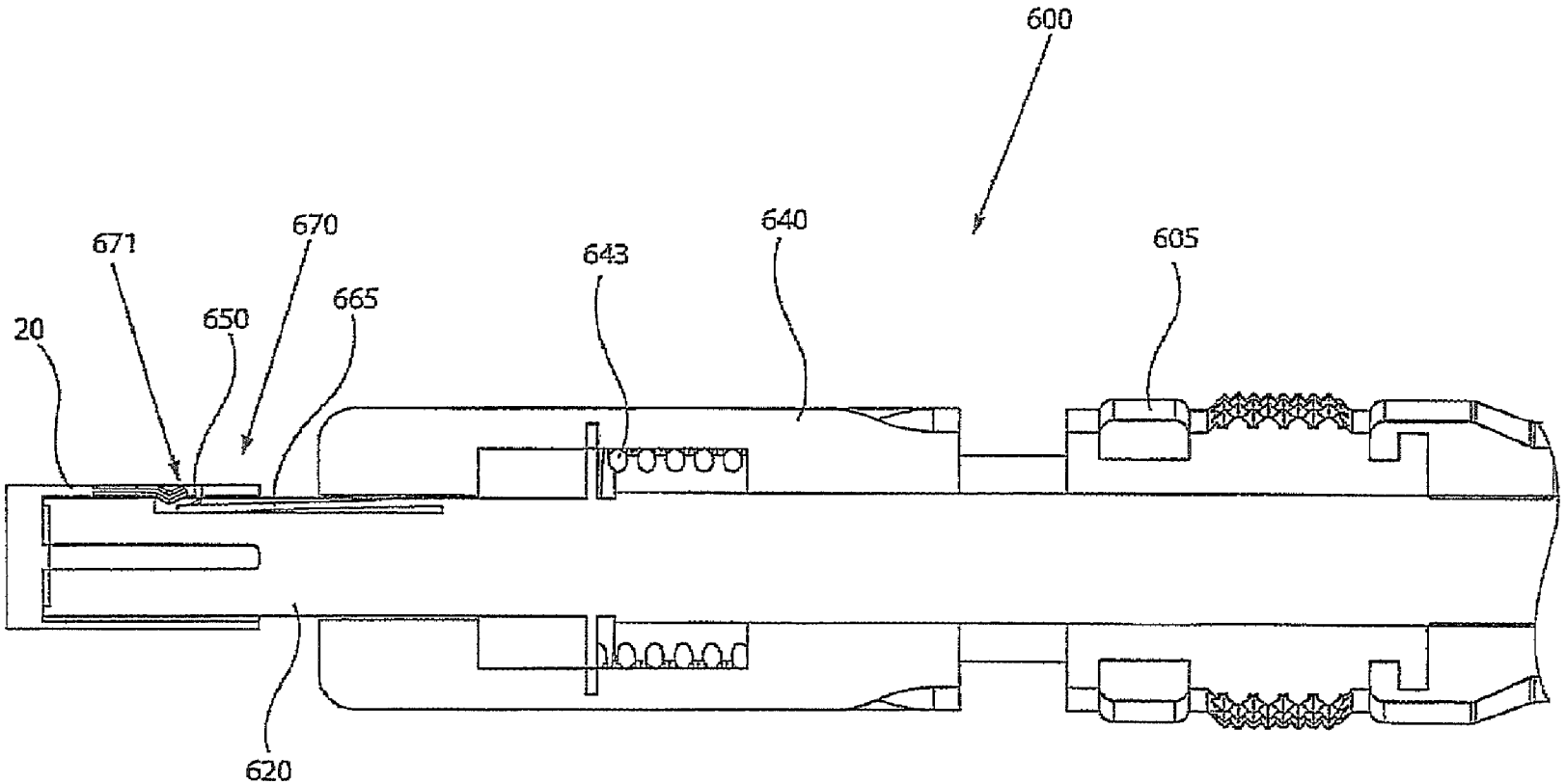
FIG. 39 depicts a cut-away view of a further embodiment of a locking high definition multimedia interface plug in an unlocked position as mated with a receptacle.

A locking high definition multimedia interface plug embodiment 100 may comprise a locking tab 150 movably locatable within an opening of a plug body 105, such as opening 130 in body extension 120. Moreover the locking high definition multimedia interface plug 100 may comprise an actuator 165 operably configured to move the locking tab 150 into a locked position 161, wherein said locking tab 150 protrudes from the opening 130 of the extension 120 to securely engage an high definition multimedia interface receptacle 20. Moreover, the actuator 165 may be operably configured to move the locking tab 150 into an unlocked position 171 (see also unlocked position 671 of FIG. 39), wherein said locking tab 150 does not protrude or extend away from the opening 130.

Figure 11:
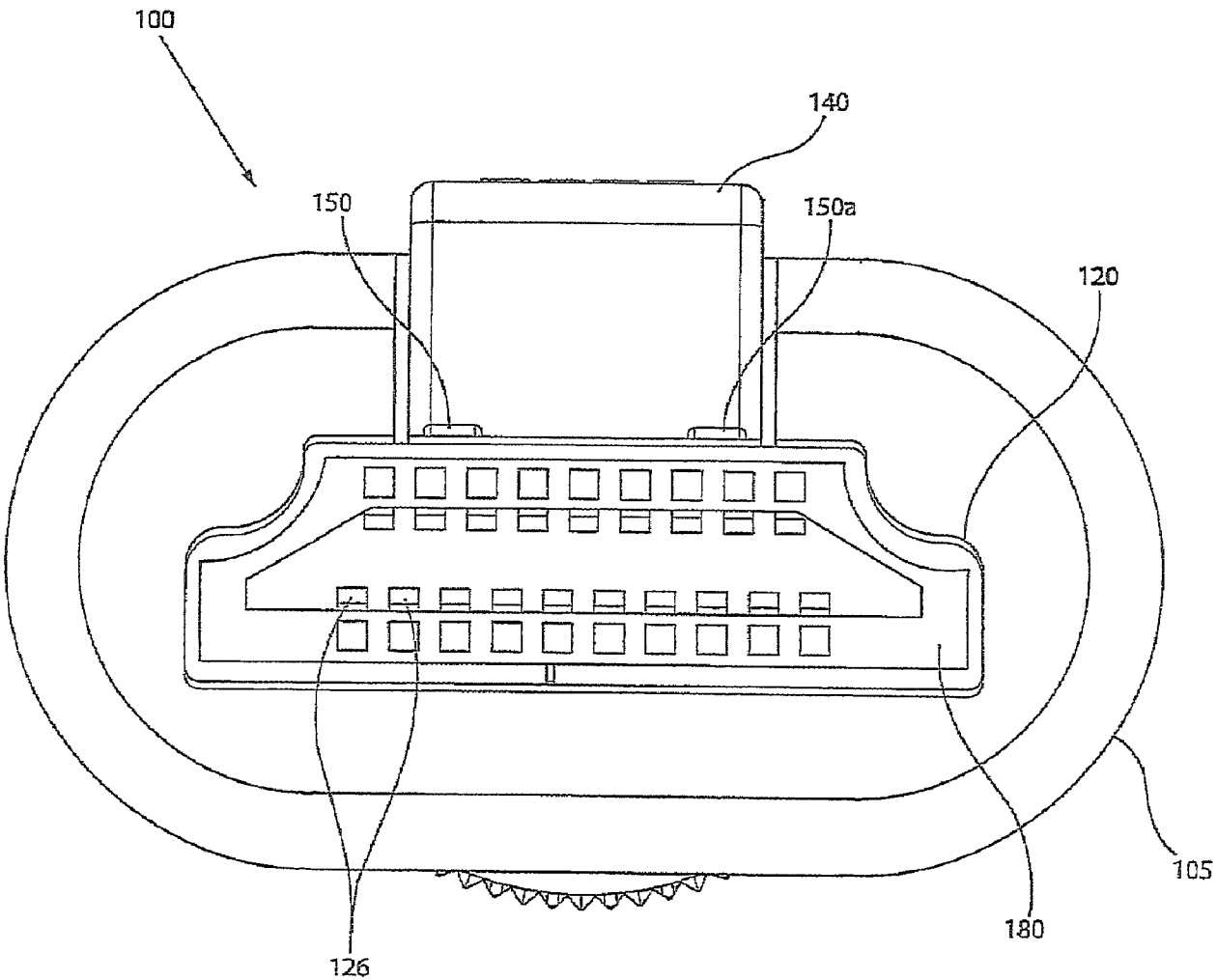
FIG. 11 depicts an end view of an embodiment of a locking high definition multimedia interface plug.

FIG. 11 depicts an end view of an embodiment of a locking high definition multimedia interface plug 100. The locking high definition multimedia interface plug 100 may comprise one or more locking tabs, such as locking tabs 150*a* and 150*b*. As depicted, the locking tabs 150*a-b* are protruding from the extension 120. Hence, the actuator 165 (not shown) may be located in a first position 160 (see FIG. 9). Whenever, the tabs 150*a-b* are located so as to interfere with a corresponding receptacle 20, then the corresponding location of the locking high definition multimedia interface plug 100 components may be attributable to a locked position 161. The tabs 150*a-b* must therefore be moved to an unlocked position 171, a position essentially eliminating interference with a receptacle 20, for the locking high definition multimedia interface plug 100 to be efficiently retracted from a mated position with the receptacle 20. A user may grip the plug body 105 and depress the lock button 140 to work upon the actuator 165 and move the locking tabs 150*a-b* out of sight within the opening 130 (not shown) of body extension 120. Additionally, embodiments of a locking high definition multimedia interface plug 100 may comprise an inner section 180, the end of which being shown in FIG. 11. The inner section 180 also may include plug terminal contacts 126 configured to physically and electrically contact corresponding receptacle port contacts 26 (see FIG. 7) of a typical high definition multimedia interface receptacle 20. Plug terminal contacts 126 are further delineated in FIGS. 41-42. Accordingly, a locking high definition multimedia interface plug embodiment 100 may include 19 terminals, as in either a typical Type A or a typical Type C high definition multimedia interface standard connector (see FIG. 41) or 29 terminals that are typically present in a standard Type B high definition multimedia interface connector (see FIG. 42). The inner section 180 may be integrally formed with the extension 120, may be separately joined to the extension 120, or may be removably secured within the extension 120. Moreover, the plug terminal contacts 126 may be integrally formed as part of the inner section 180, may be separately joined to the inner section 180, or may be removably secured to the inner section 180. The inner section 180 may be formed of conductive materials or may be formed of a dielectric material.

An embodiment of a body extension member 220 that may be used in a High Definition Multimedia Interface communication applications is shown in FIGS. 12-16. The extension 220 may have at least one opening 230 (as shown, an extension 220 preferably includes two openings 230). The extension 220 may be configured to fit into an high definition multimedia interface receptacle, such as receptacle 20, or may be configured to be used with any other receptacle that relies upon a friction or tolerance fit to retain the extension 220 within the receptacle. The high definition multimedia interface standard uses a conductive surface for the extension 220, but in other applications the extension 220 may be an insulator. The extension 220 may be a metal that is stamped or otherwise formed into the desired shape or may be a conductive polymer that is injection molded or extruded. The extension 220 may be formed of dimensionally stable materials that could be made conductive if required to be used in connectors.

Figure 13:
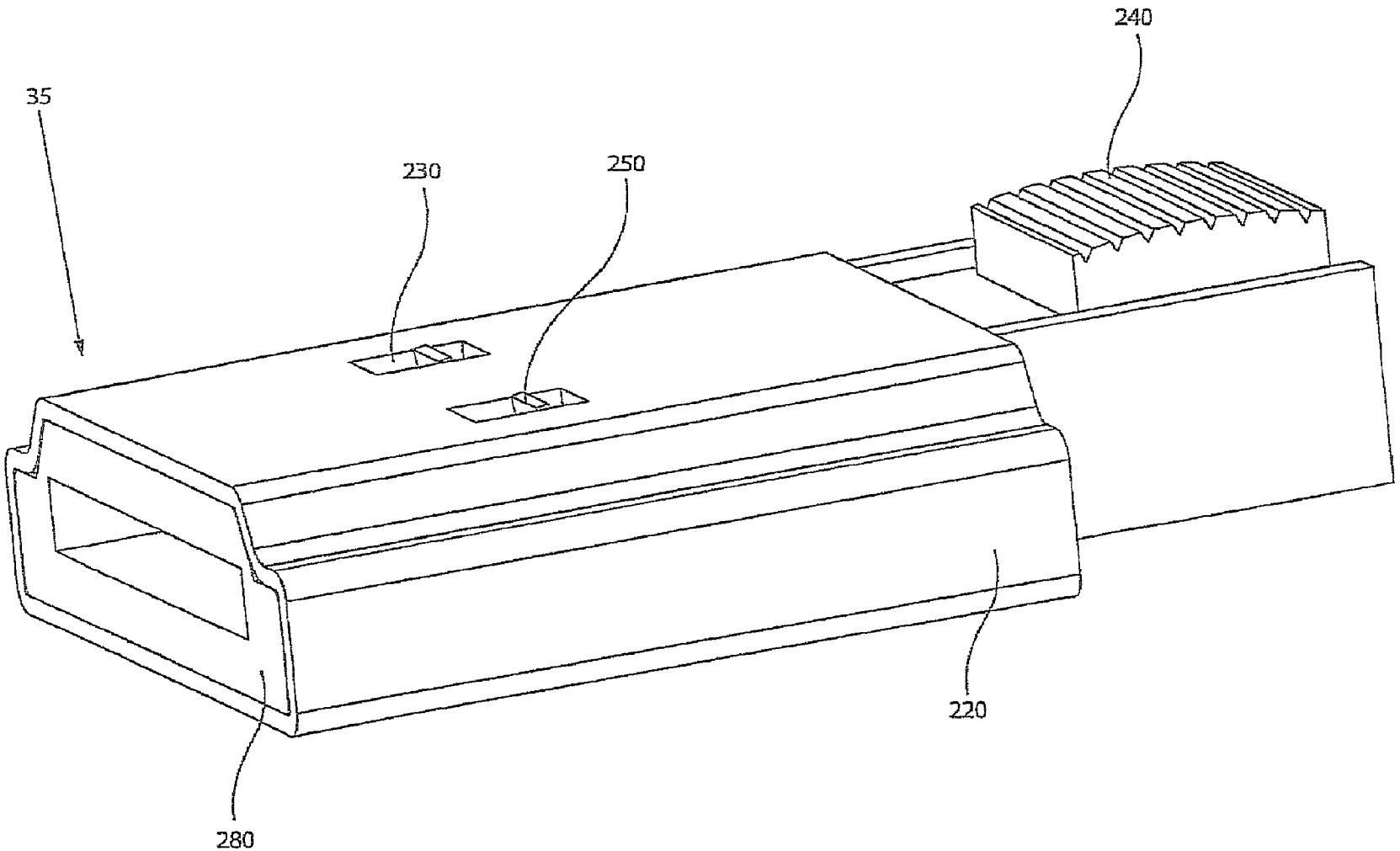
FIG. 13 depicts a perspective view of an embodiment of a plug in an unlocked position.

An extension member 220 may be retained somewhat within a plug receptacle, such as receptacle 20, by friction due to close tolerance with the receptacle. However, with respect to a locking high definition multimedia interface plug embodiments, such as plug 100, the extension 220 may include a releasable protrusion, or locking tab 250 that may engage an opening 25 of a receptacle 20, and prevent unintended release. As shown in FIG. 13, the locking tabs 250 may be configured to reside with the openings 230 of the extension member 220. Furthermore, an high definition multimedia interface connector end 35 of the extension 220 may be inserted into an high definition multimedia interface receptacle 20 and may be selectively locked or secured into the receptacle with the use of an actuator 265. The actuator may be worked upon by a lock button 240 operated by a user. The user operates the lock button 240 either by compression or sliding until it is moved sufficiently to work upon the actuator to help secure the plug 100. To secure the high definition multimedia interface type plug extension embodiment 220 into a plug receptacle the extension 220 includes a locking tab 250 that may be biased or moved by the actuator 265.

Figure 14:
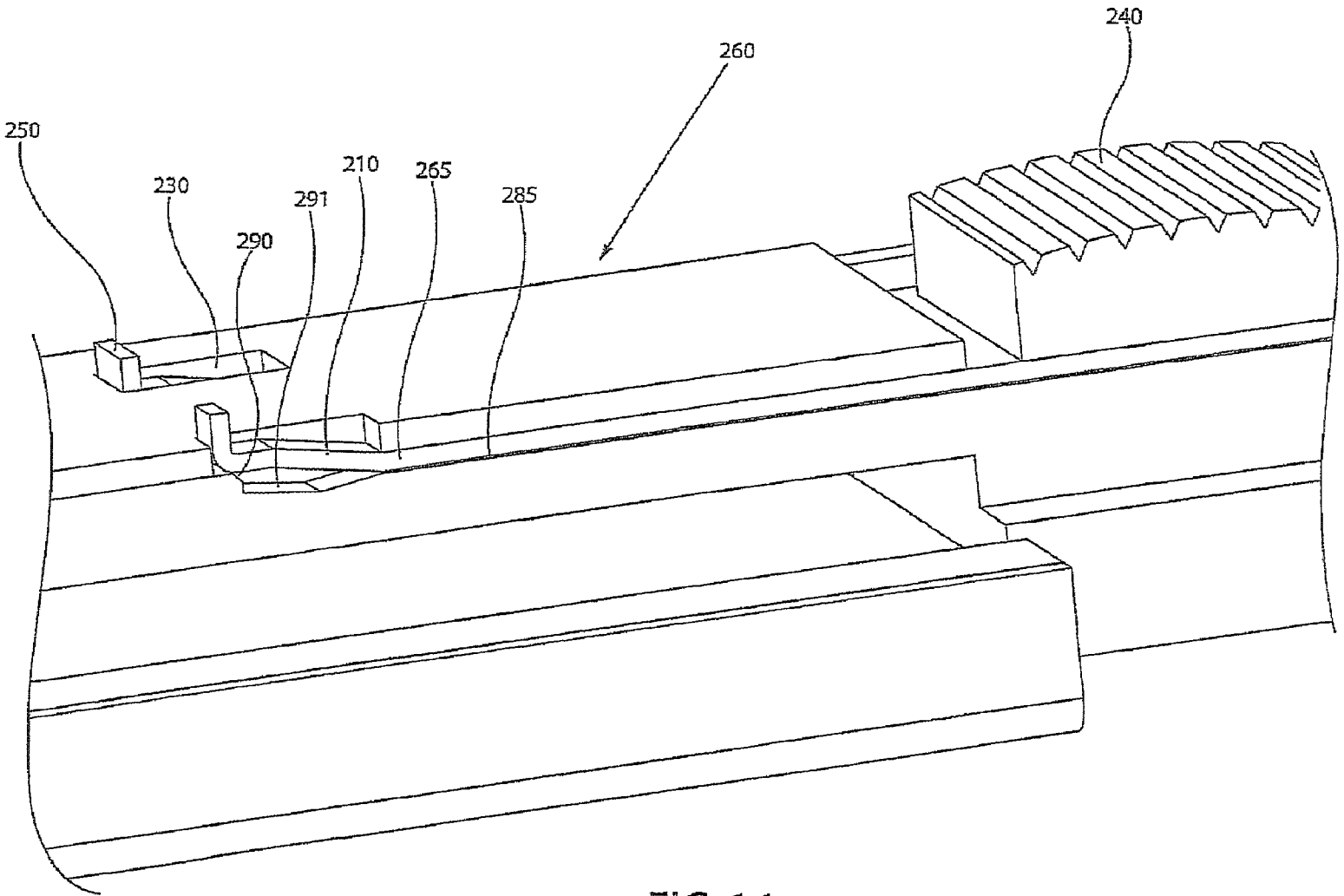
FIG. 14 depicts a partial cut-away view of an embodiment of a plug in a locked position.
Figure 15:
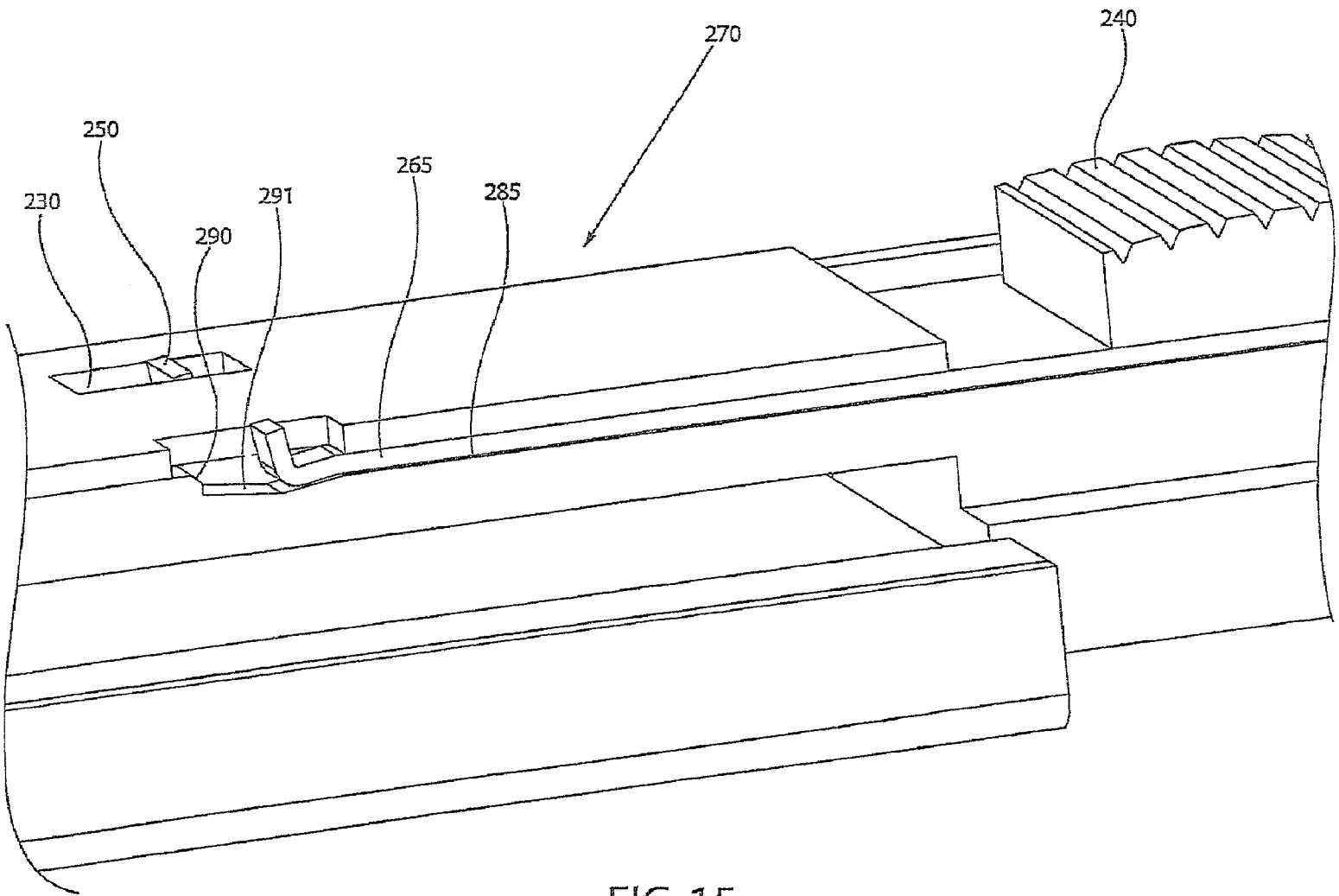
FIG. 15 depicts a partial cut-away view of an embodiment of a plug in an un-locked position.

The actuator 265 has a first position 260, as shown in FIG. 14, where the lock button 240 is slidingly moved to work upon the actuator 265 so that the locking tab 250 is biased to protrude from said opening 230 of said extension 220. The actuator 265 has a second position 270, as shown in FIG. 15, where the lock button 240 is slidingly moved to cause the actuator 265 to move the locking tab 250 to be positioned substantially within said at least one opening 230 of said extension 220. The locking tab 250 may also be configured to be resiliently biased into a locked position 161, corresponding to the first position 260 of the actuator 265, so that that the lock button 240 may be compressed moving the actuator relative to an unlocked position 171 and release the locking tab 250 once resiliently engaged into a receptacle 20, such as by maneuvering the locking tab 250 out of the sidewall opening 25 of a receptacle 20 (see FIG. 7).

Figure 12:
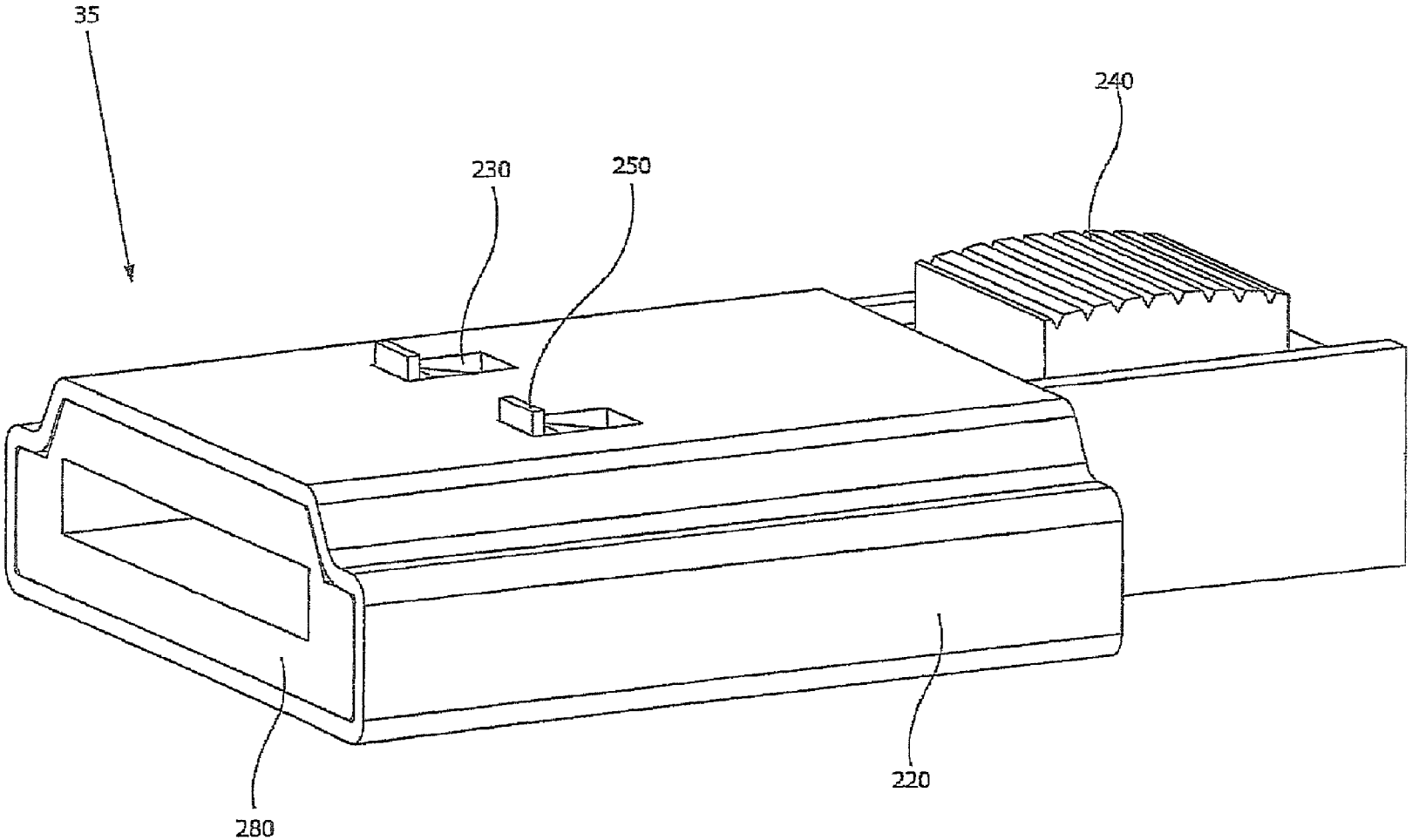
FIG. 12 depicts a perspective view of an embodiment of a plug in a locked position.

As shown in FIG. 12, the extension embodiment 220 may further include sub components such as an inner section 280 positioned within said extension member 220. The extension 220 may be a one-piece extension component that includes molded in or insertable terminal ends, such as plug terminal contacts 126 (see FIG. 11). The inner section 280 may also contain a guide portion 285 (see FIGS. 14-15) that may be configured as a channel, pathway or groove within the inner section 280 that may be configured to facilitate linear sliding or other guided movement of the actuator 265. The inner section 280 may be any structurally rigid material such as an injection molded plastic that would allow the introduction of the terminals, such as terminals 126.

FIG. 15 is an exploded view of an extension 220 of embodiments of a locking high definition multimedia interface plug, such as plug 100, and includes an actuator 265 having a proximate end 266 and a distal end 267, wherein the proximate end 266 may be attached to, or otherwise operable with said lock button 240, and wherein the distal end 267 may be attached to, or otherwise operable with said locking tab 250. The actuator 265 may be produced from a resilient material that may be biased to a desired orientation. Moreover, the actuator 265 material could be made of a spring-type steel or a resilient polymeric material that is either stamped or injection molded. When the button 240 works upon the actuator 265, a ramp 290 may be positioned on said inner section 280. The movement of said locking tab 250 against said ramp 290 may be resiliently biased to protrude through said opening 230 on said extension 220 when said lock button 240 is in the first position 260. A depression 291 may be formed within said inner section 280 and may be configured to accept said locking tab 250 when said lock button 240 is in the second position 270 to allow release of the extension 220 from an high definition multimedia interface receptacle.

Figure 17:
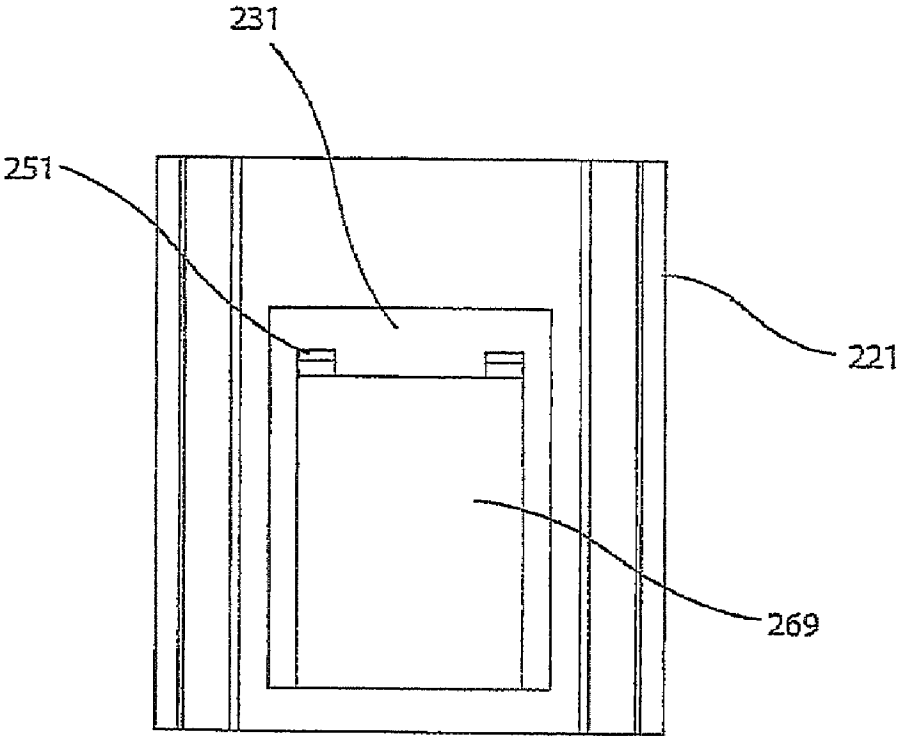
FIG. 17 depicts a top view of another embodiment of a plug.
Figure 18:
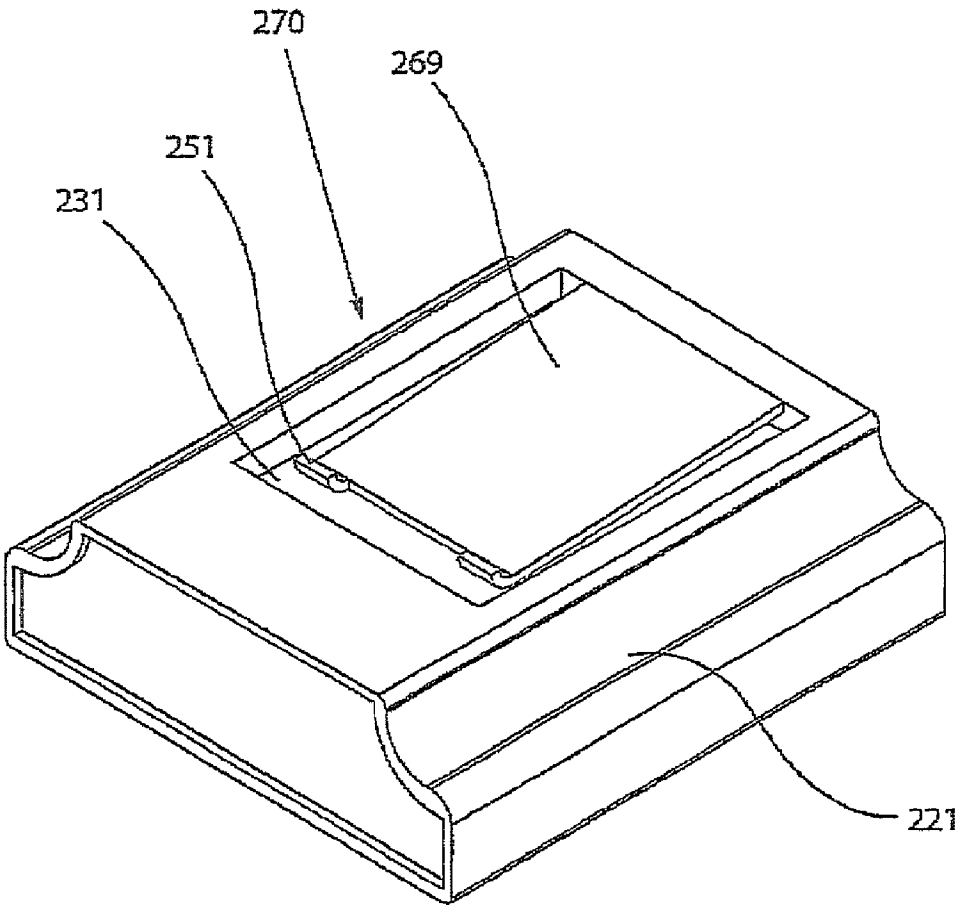
FIG. 18 depicts a perspective view of another embodiment of a plug.
Figure 19:
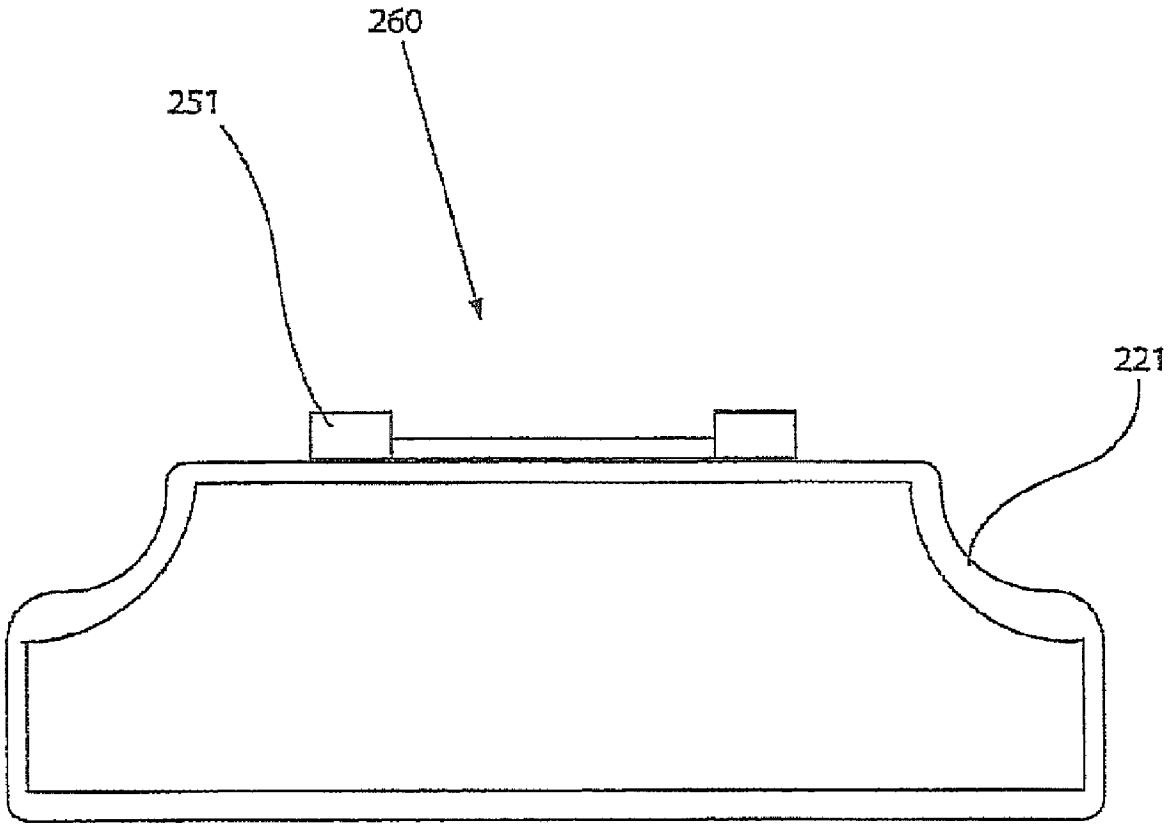
FIG. 19 depicts an end view of another embodiment of a plug.
Figure 20:
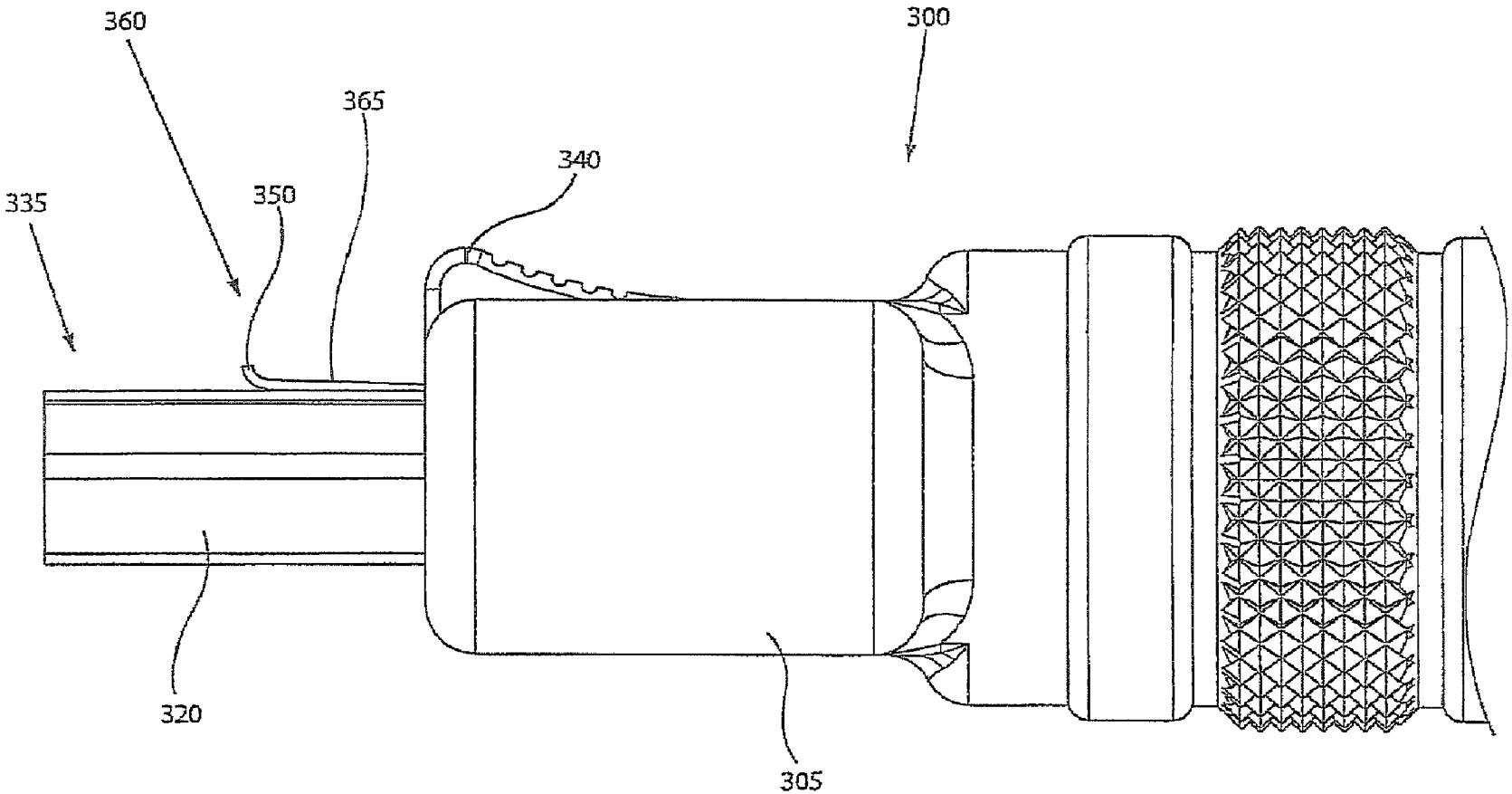
FIG. 20 depicts a partial side view of another embodiment of a locking high definition multimedia interface plug.
Figure 21:
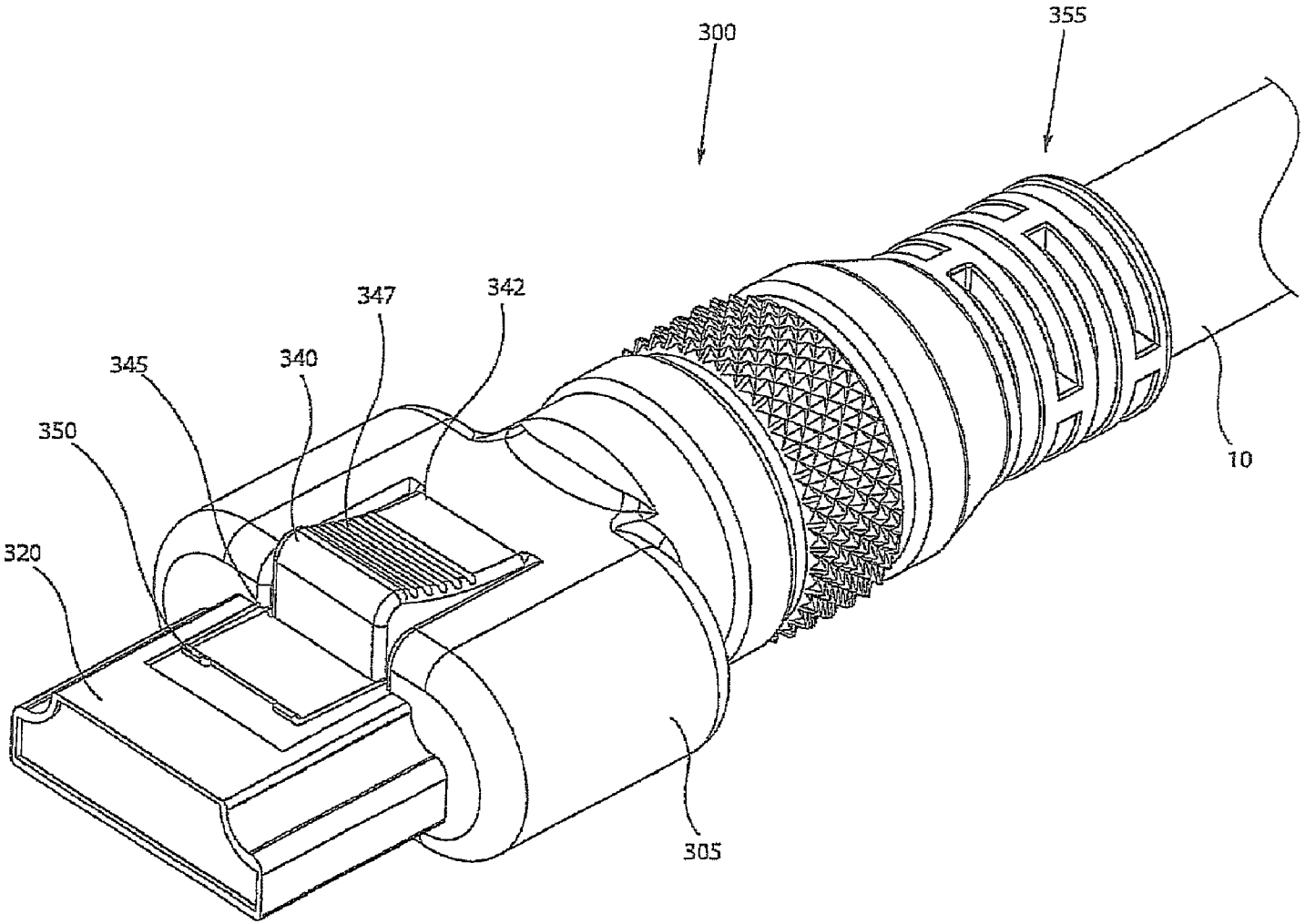
FIG. 21 depicts a perspective view of another embodiment of a locking high definition multimedia interface plug.
Figure 22:
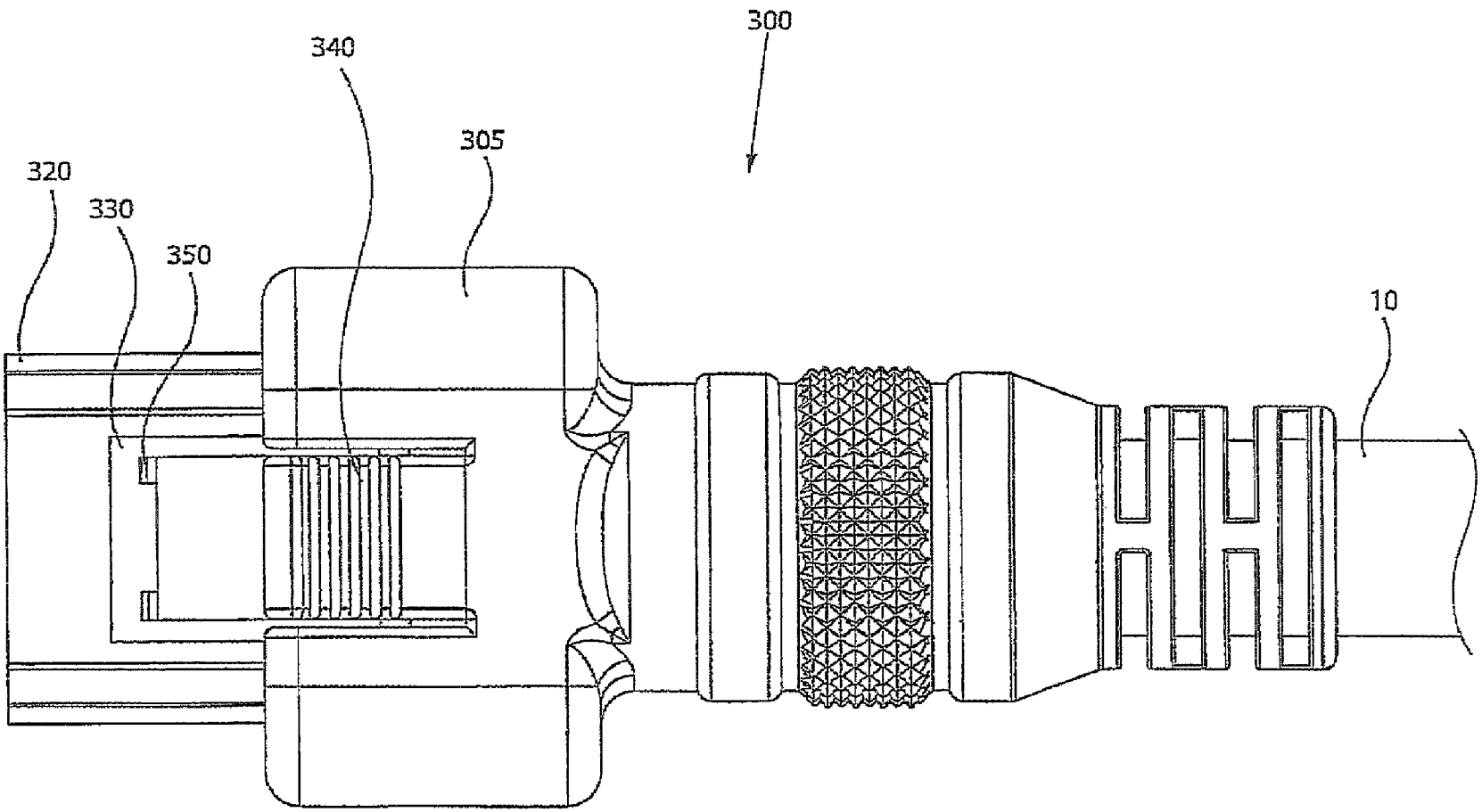
FIG. 22 depicts a top view of another embodiment of a locking high definition multimedia interface plug.
Figure 23:
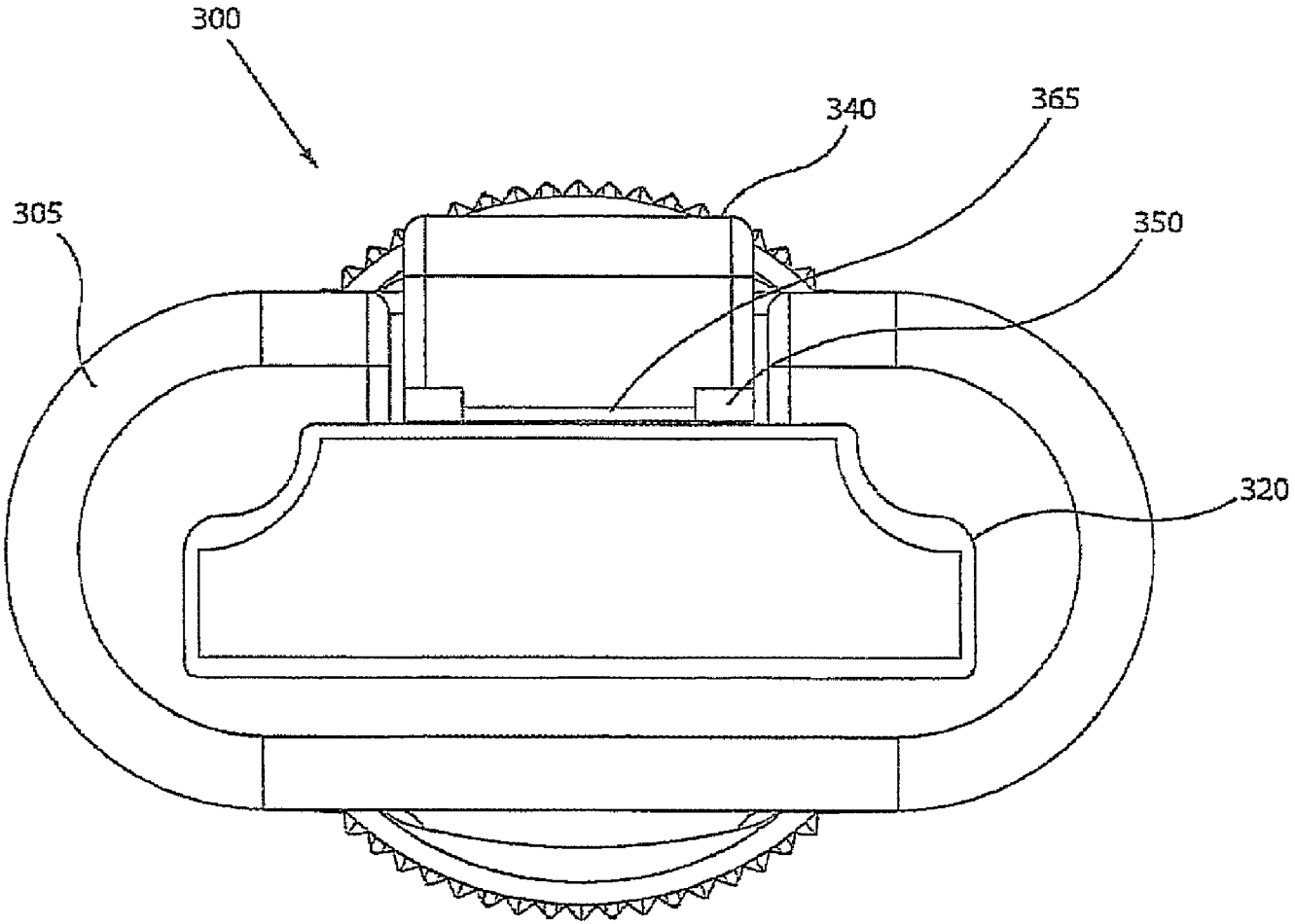
FIG. 23 depicts an end view of another embodiment of a locking high definition multimedia interface plug.
Figure 24:
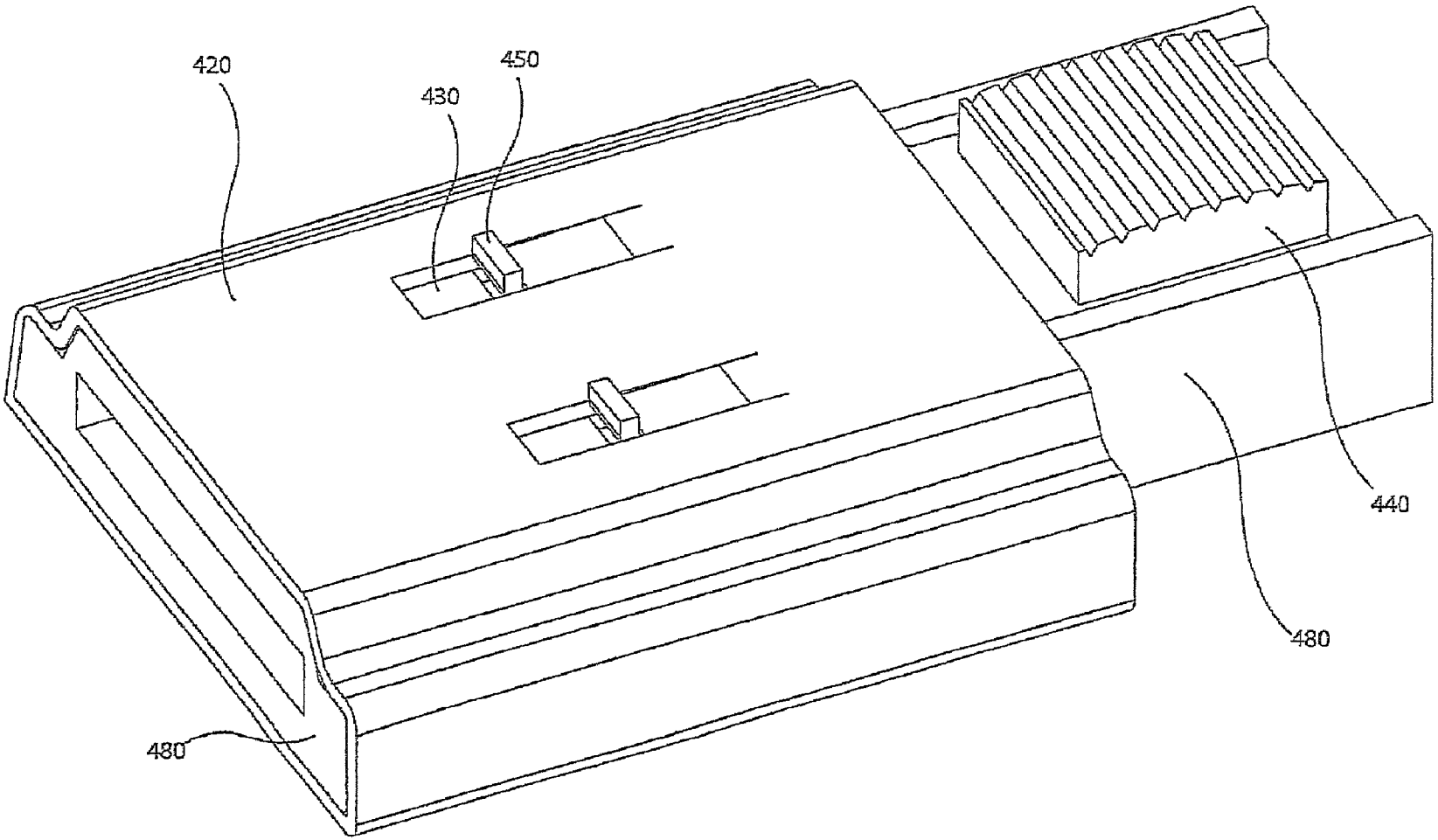
FIG. 24 depicts a perspective view of a further embodiment of a plug in a locked position.
Figure 25:
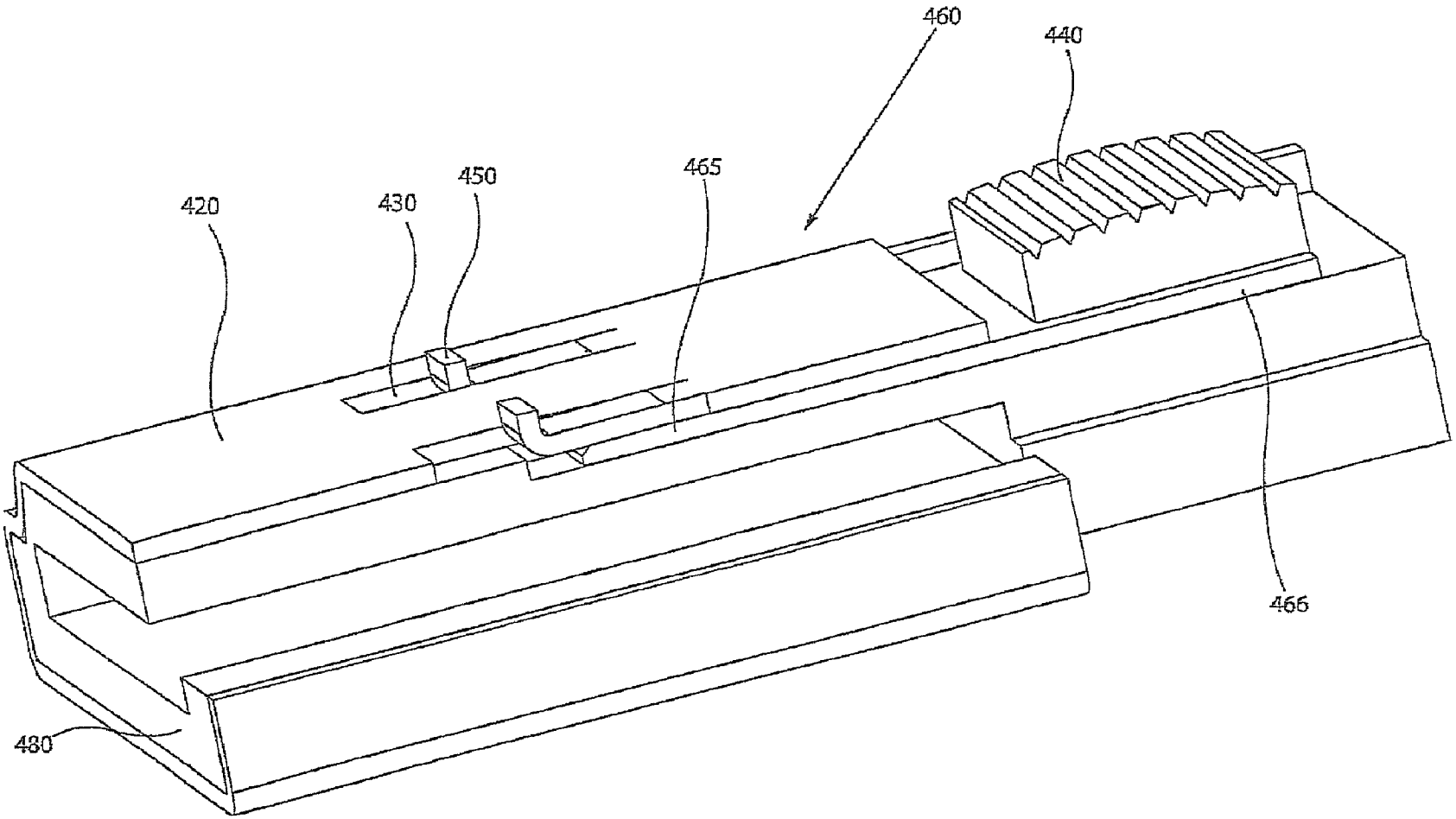
FIG. 25 depicts a cutaway view of a further embodiment of a plug in a locked position.
Figure 26:
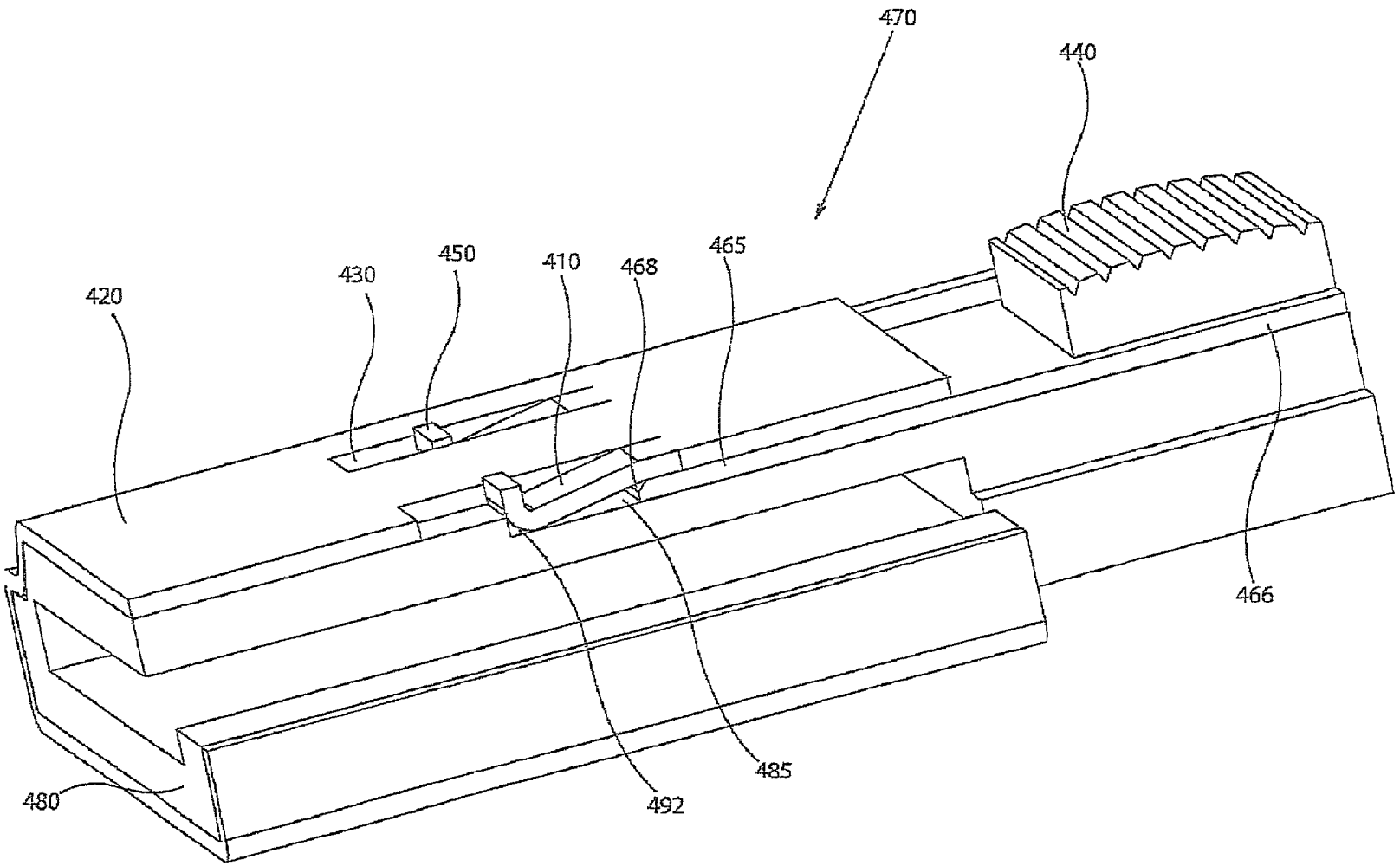
FIG. 26 depicts a cutaway view of a further embodiment of a plug in an unlocked position.
Figure 27:
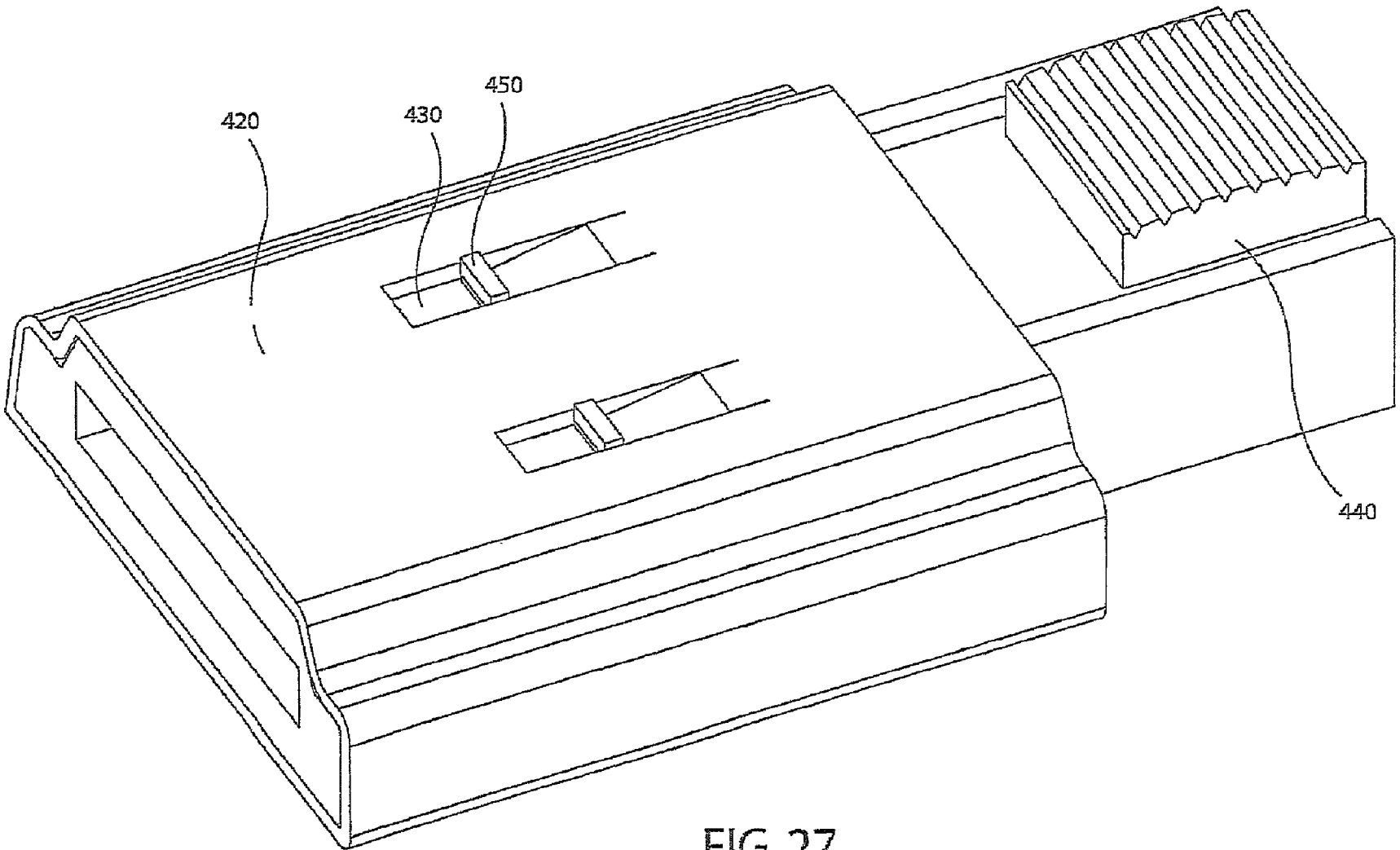
FIG. 27 depicts a perspective view of a further embodiment of a plug in an unlocked position.
Figure 28:
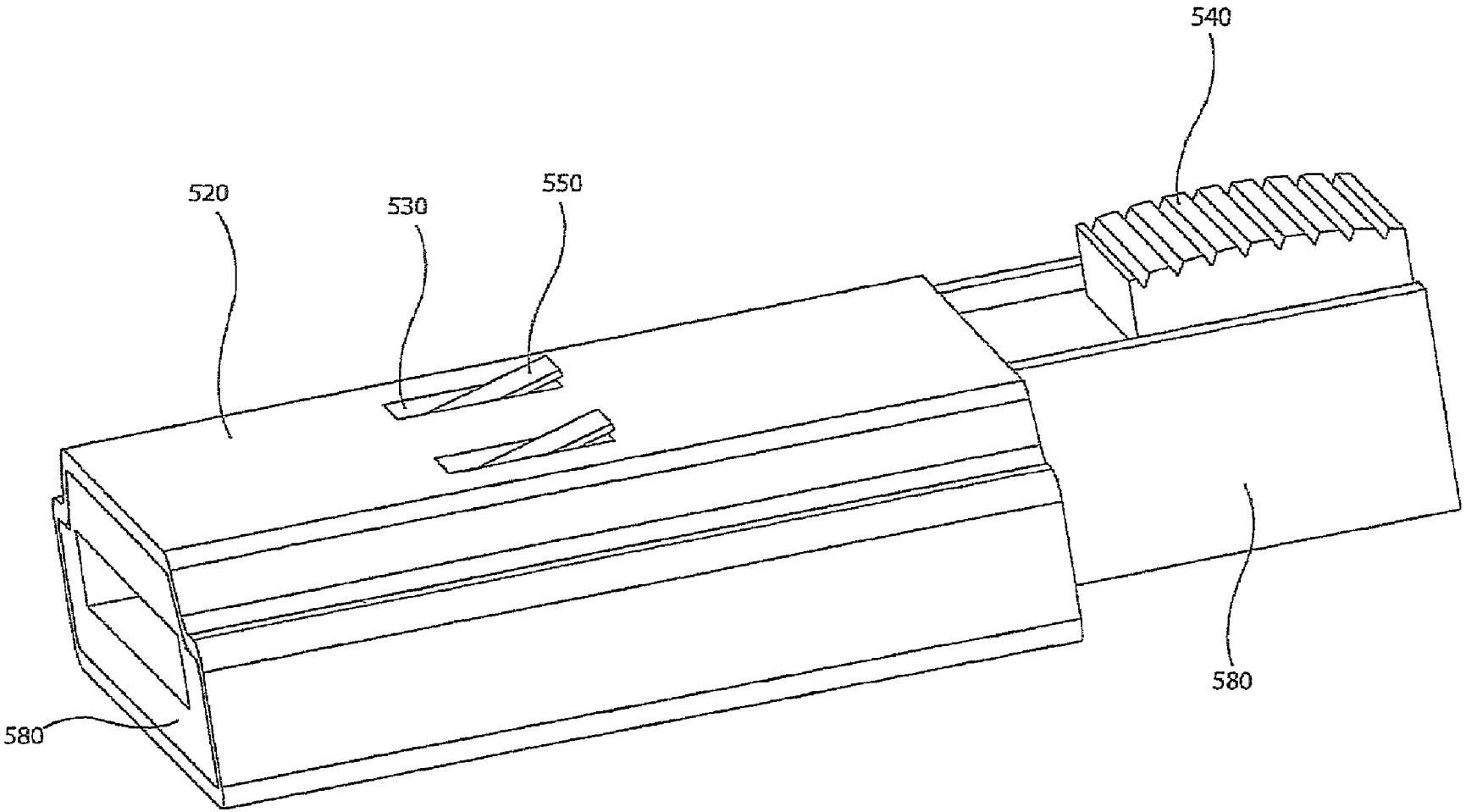
FIG. 28 depicts a perspective view of a still further embodiment of a plug in a locked position.
Figure 29:
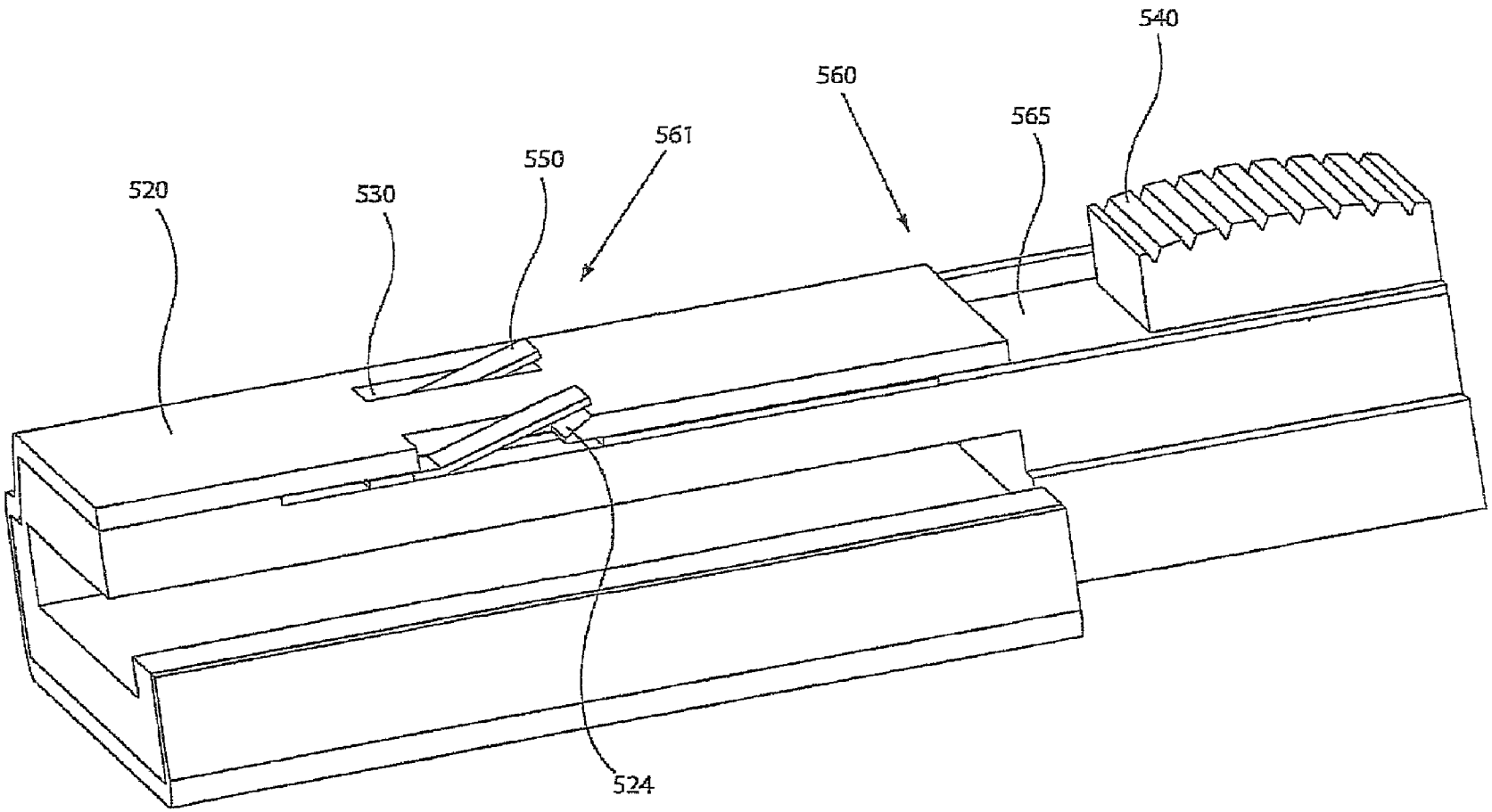
FIG. 29 depicts a cut-away view of a still further embodiment of a plug in a locked position.
Figure 30:
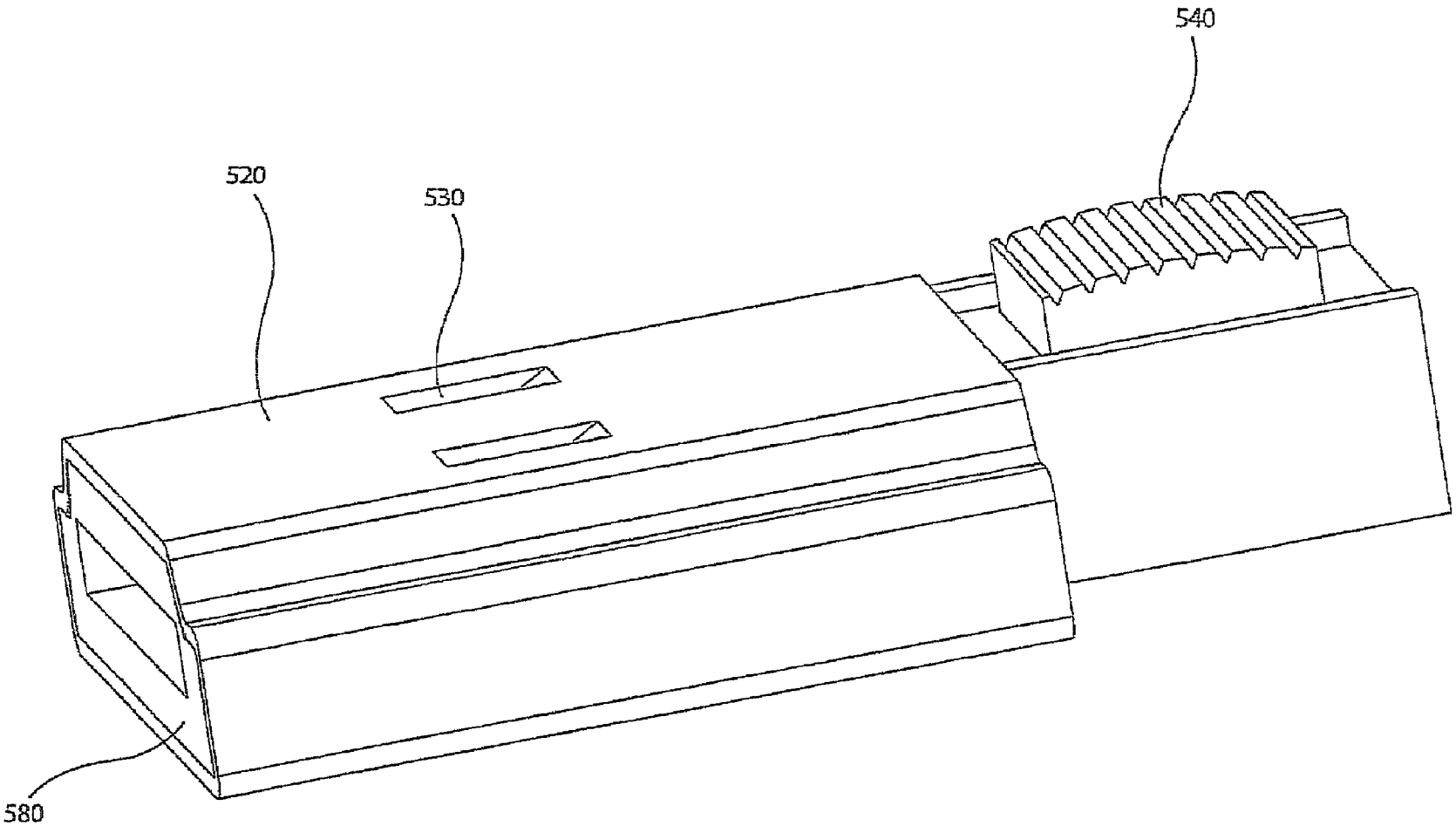
FIG. 30 depicts a perspective view of a still further embodiment of a plug in an unlocked position.

As shown in FIGS. 17-19, an locking high definition multimedia interface plug embodiments may include a single large opening 231 of an extension 221. An actuator 269 structure having adjoined locking tips 251 may be located in a first position 260 such that the locking tips 251 protrude above the surface of the extension embodiment 221. Moreover, the actuator 269 may be located in a second position 270 such that the locking tips 251 reside substantially within the large opening 231 of the extension 221.

As shown in FIGS. 20-23, another locking high definition multimedia interface plug embodiment 300 is depicted. The connector plug 300 may comprise a diving hinge lock button 340 operable with a plug body 300. The hinged lock button 340 may be attached to the plug body 305 or integrally formed with the plug body 305 such that the lock button 340 attaches to the plug body 305 in the general vicinity of a location 342. The lock button 340 is coupled to the actuator 365. A user may operate the lock button 340 by pressing the button 340 toward the actuator 365. The lock button 340 is configured such that motive force provided by a user transfers from the lock button 340 to the actuator 365 to move a locking tab 350. When the actuator 365 is in a first position 360 the locking tab is biased to protrude from the extension 320. Accordingly, a user can insert the high definition multimedia interface connector end 335 into a receptacle and assist the action of locking through the hinged operation of the lock button 340. Surface features 347, such as ridges, may be provided on the exterior surface of the lock button to correspond to a better user interface during operation. The lock button 340 may contact or otherwise interact with the actuator 365 at a juncture 345. A cable 10 is connected to the locking high definition multimedia interface plug 300 at a cable connector end 355.

FIGS. 24-27 show another plug embodiment that includes a sliding actuator 465 that is coupled at a proximate end 466 to a lock button 440. The sliding actuator 465 may engage and lift the inwardly biased locking tab 450 of the plug body extension 420. The locking tab 450 may be attached to or be integral with the body extension 420. The tab 450 may be formed to be normally downwardly biased having a resilient member 410 that is converted to an upward bias by movement of the distal end 468 of the sliding actuator 465 underneath the locking tab 450 when the lock button 440 is moved to the first position 460. The placement of the sliding actuator 465 beneath the locking tab 450 causes the locking tab 450 to bend outward to protrude from the opening 430 of the body extension 420. When the actuator 465 is in the second position, the locking tab may be biased downward through the opening of the body extension 420 and into a depression 492 or portion of slide track 485.

Figure 16:
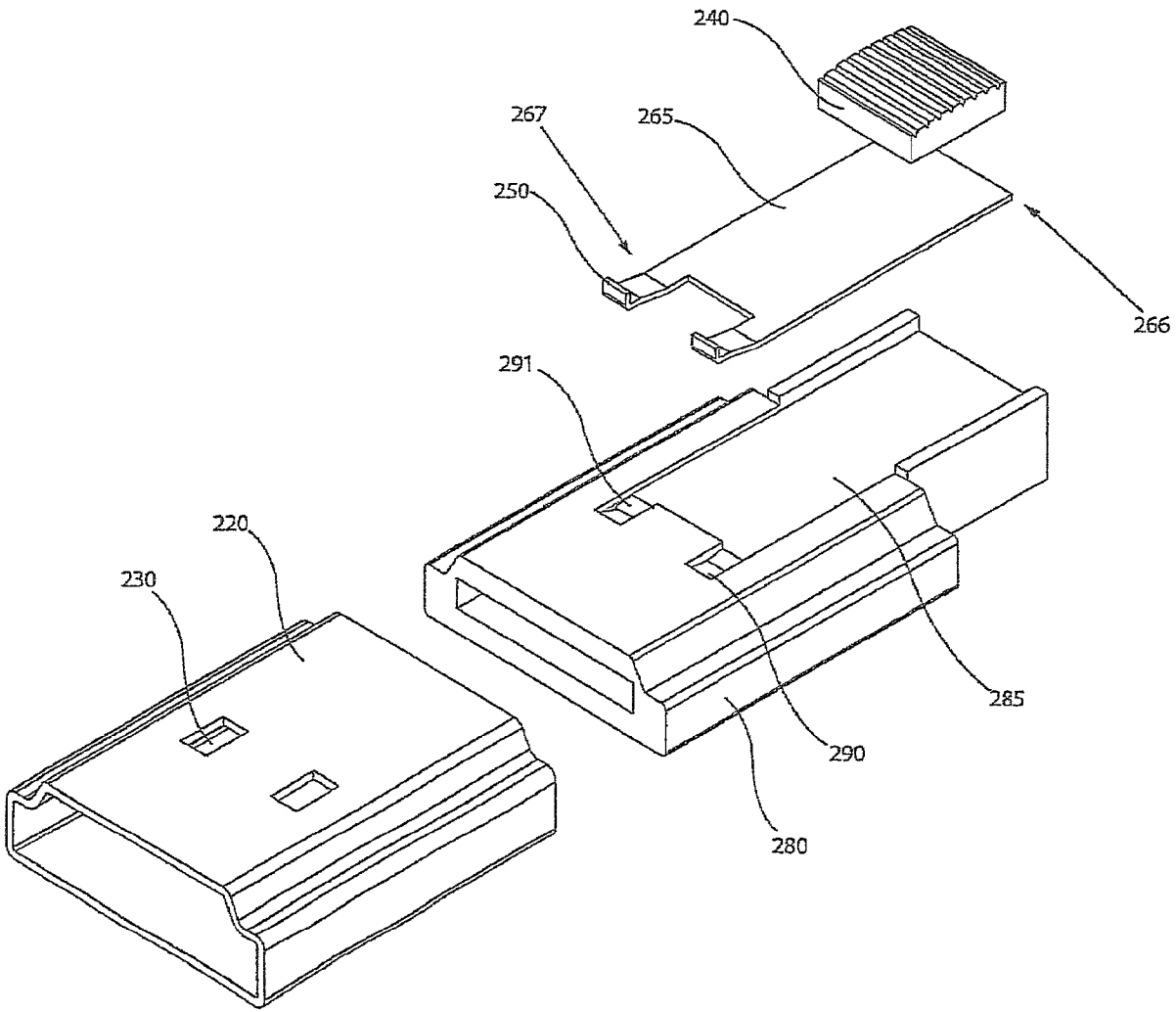
FIG. 16 depicts an exploded view of an embodiment of a plug.

The plug body extension embodiment 420 includes a slide track 485 formed in an inner section 480 similar to that shown in FIGS. 14-16, but without the inclusion of a ramp 290. In FIGS. 14-16 a ramp 290 is formed in the inner section 280, wherein said locking tab 250 is separate from the extension 220 and said locking tab 250 is resiliently biased or pushed outwards through said opening 230 in the extension 220 by said ramp 290 when the lock button 240 is slid into the first position 260.

In another embodiment, an extension 520 of a locking plug, as shown in FIGS. 28-31, may be structured to operate somewhat in contrast to embodiments previously discussed. The extension 520 includes at least one locking tab 550 that angularly protrudes and is biased away from opening 530 of the extension 520 in a direction away from the high definition multimedia interface connection end 35 of the plug. The opening 530 of the extension 520 may include a ramped edge 524. When an actuator 565 is in a first position 560 (see FIG.

Figure 31:
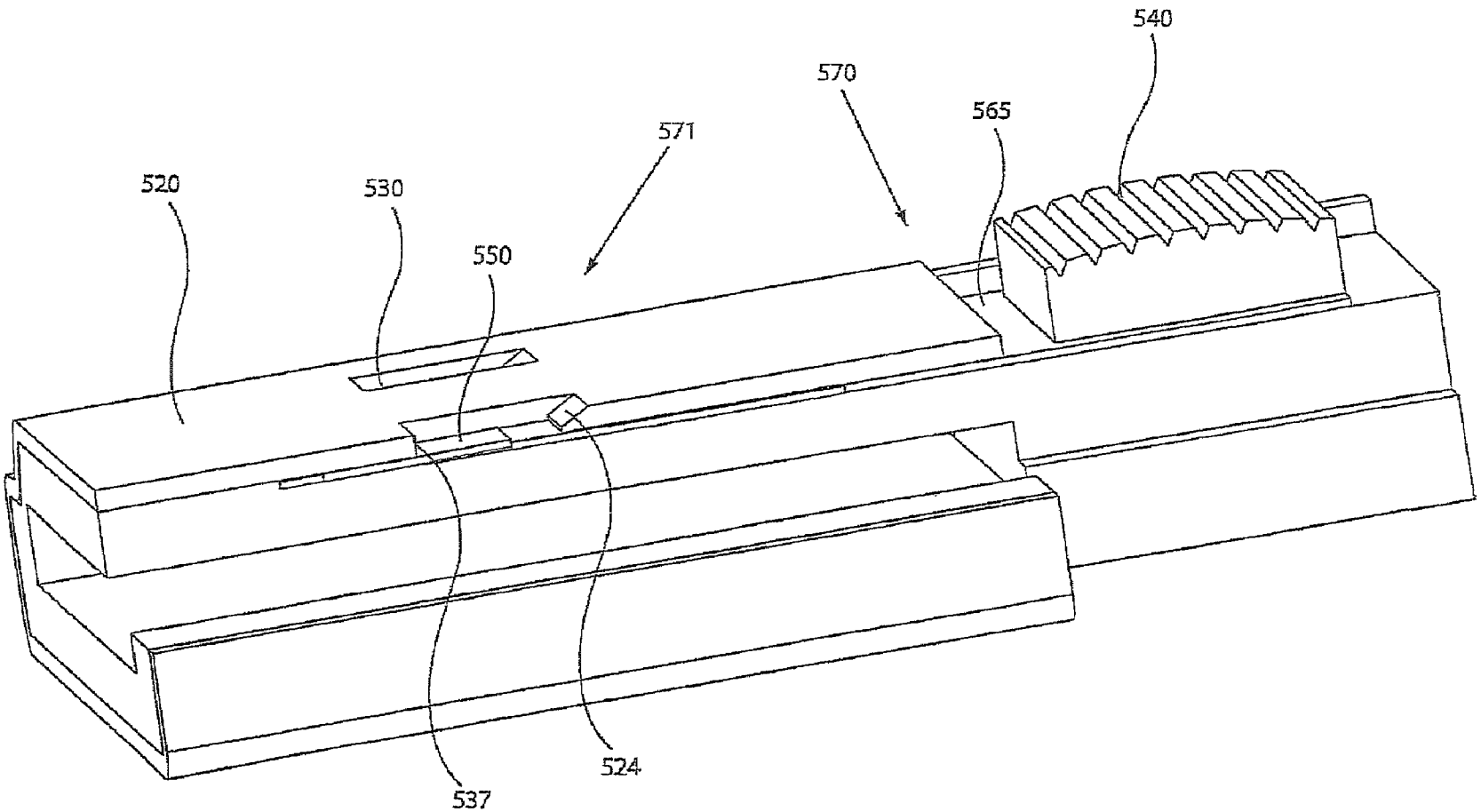
FIG. 31 depicts a cut-away view of a still further embodiment of a plug in an unlocked position.
Figure 32:
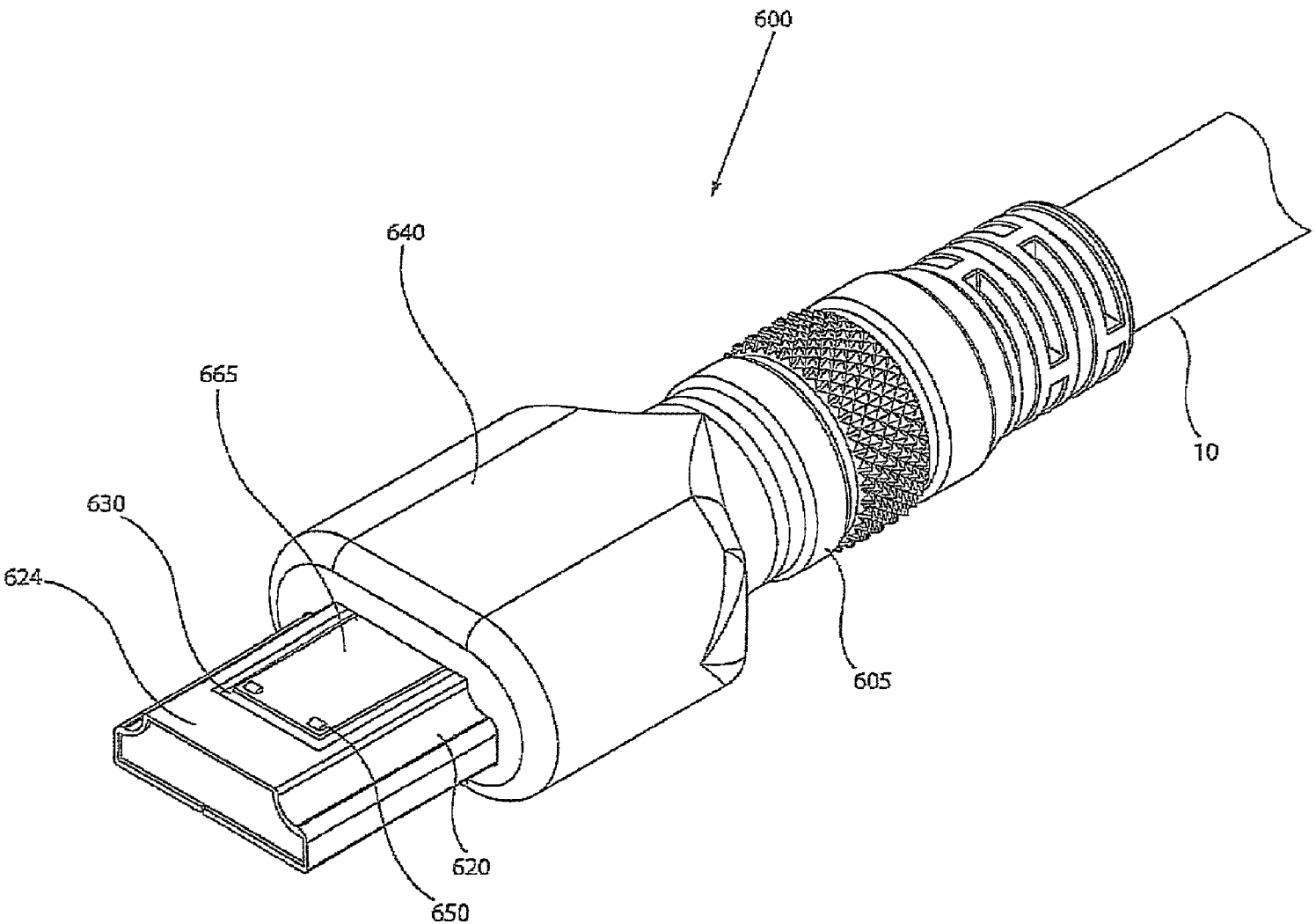
FIG. 32 depicts a perspective view of a further embodiment of a locking high definition multimedia interface plug in a locked position.
Figure 33:
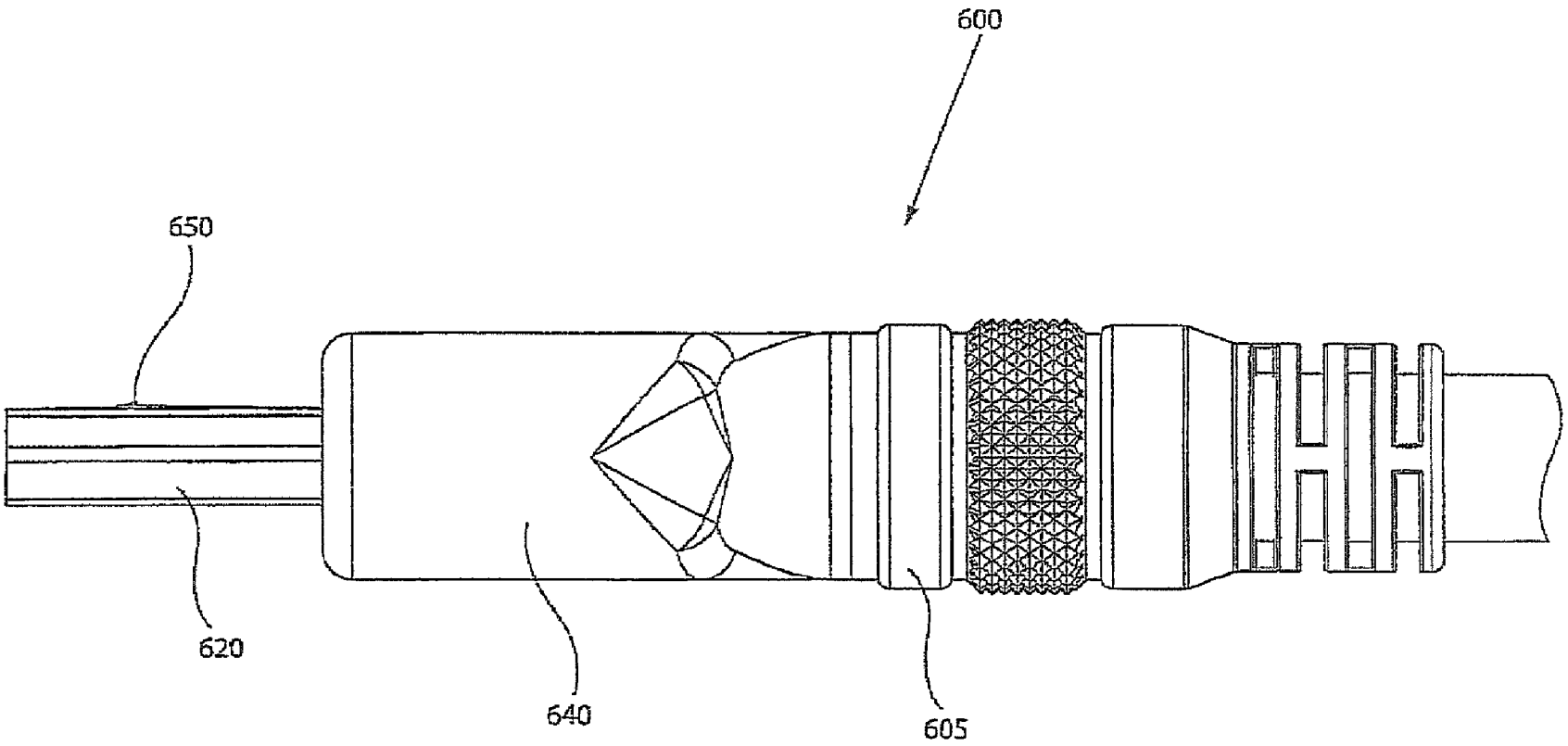
FIG. 33 depicts a side view of a further embodiment of a locking high definition multimedia interface plug in a locked position.
Figure 34:
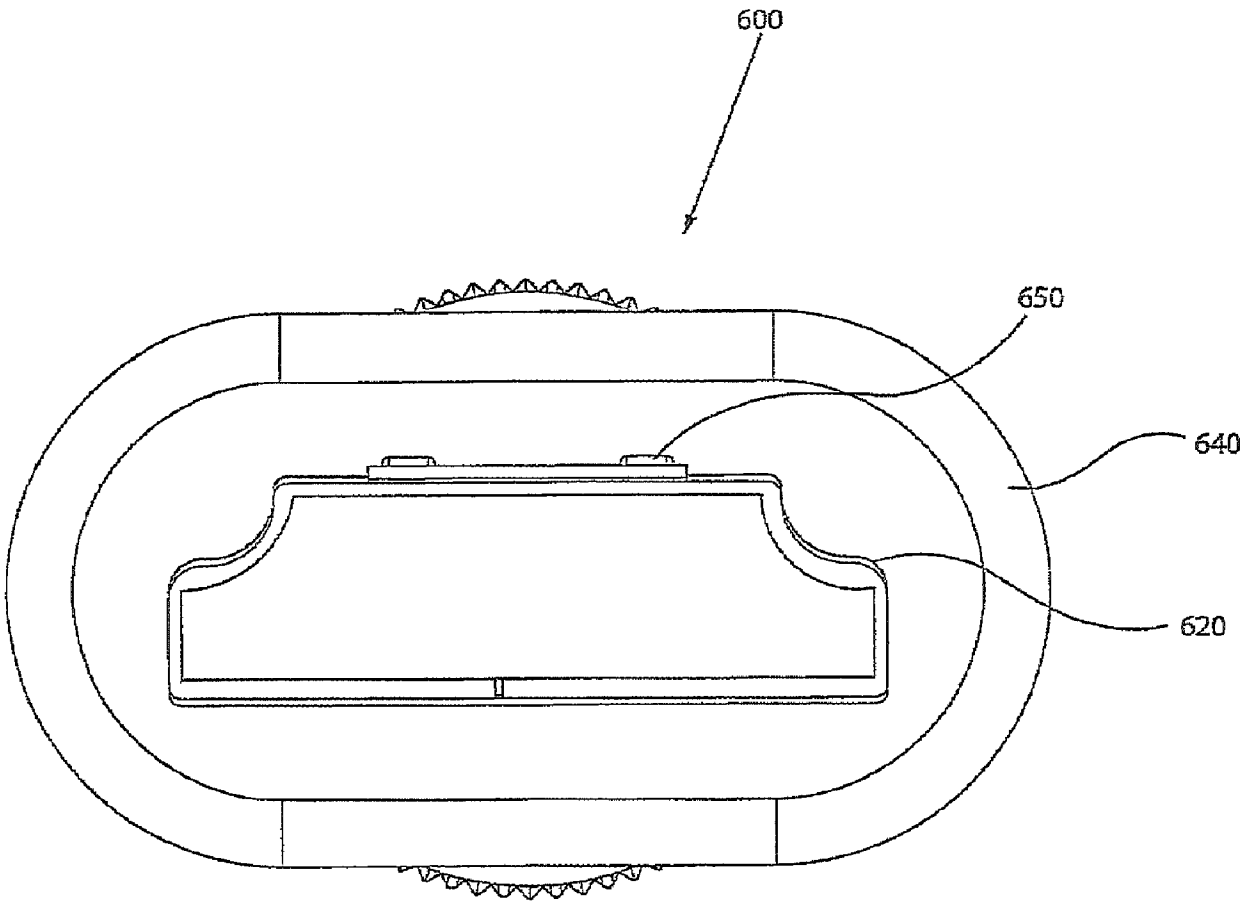
FIG. 34 depicts an end view of a further embodiment of a locking high definition multimedia interface plug in a locked position.
Figure 35:
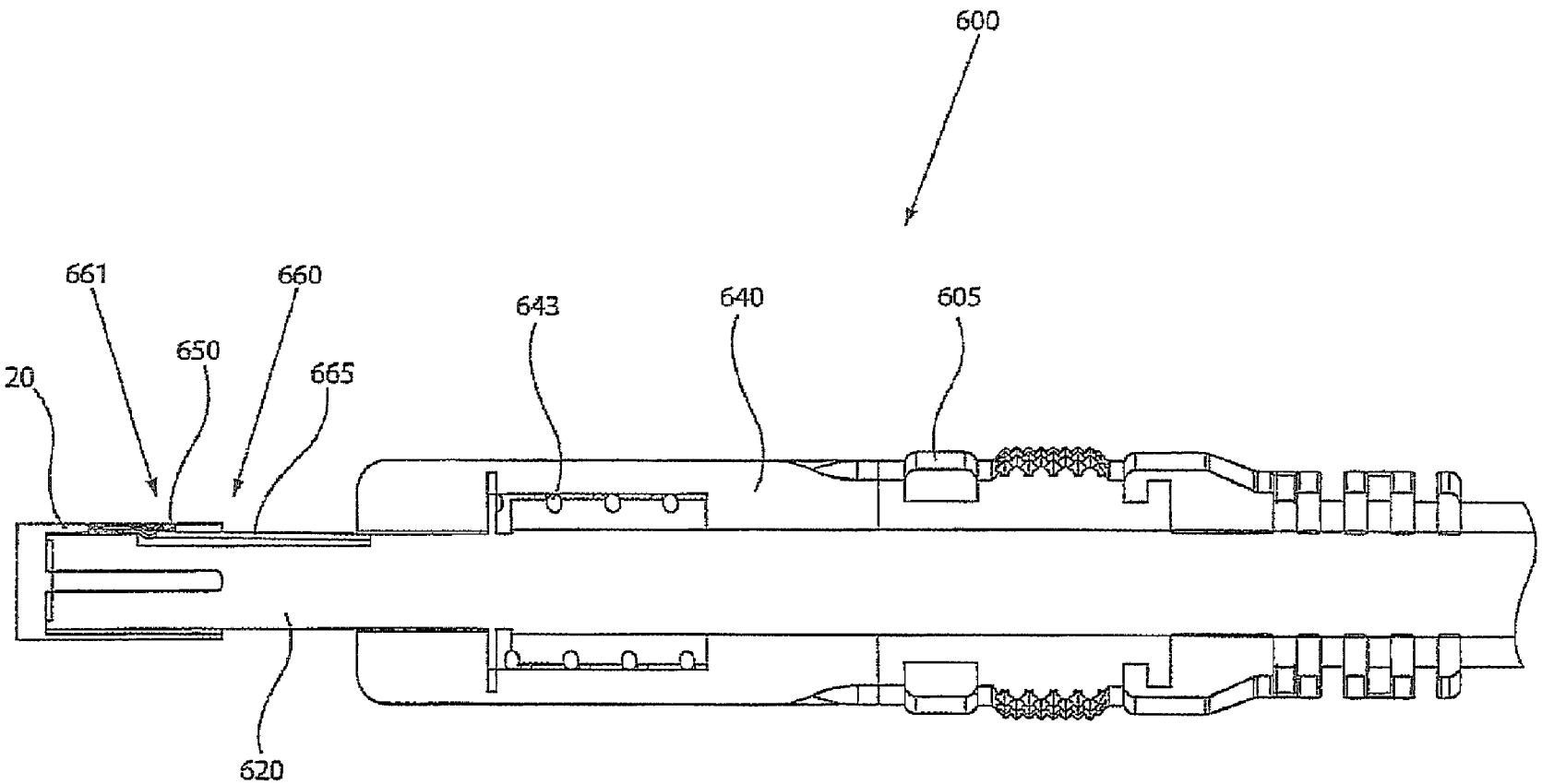
FIG. 35 depicts a cut-away view of a further embodiment of a locking high definition multimedia interface plug in a locked position as mated with a receptacle.
Figure 36:
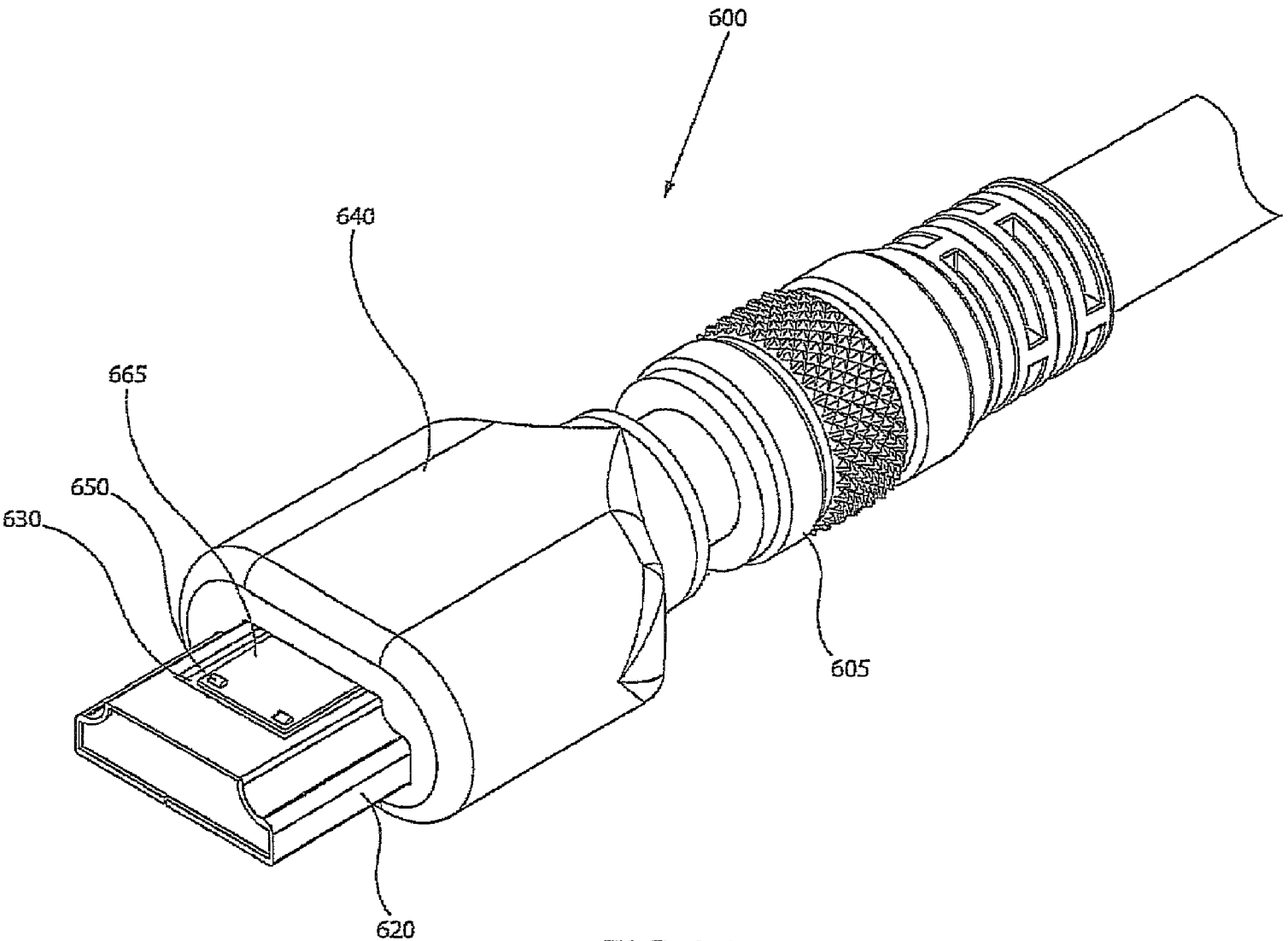
FIG. 36 depicts a perspective view of a further embodiment of a locking high definition multimedia interface plug in an unlocked position.
Figure 37:
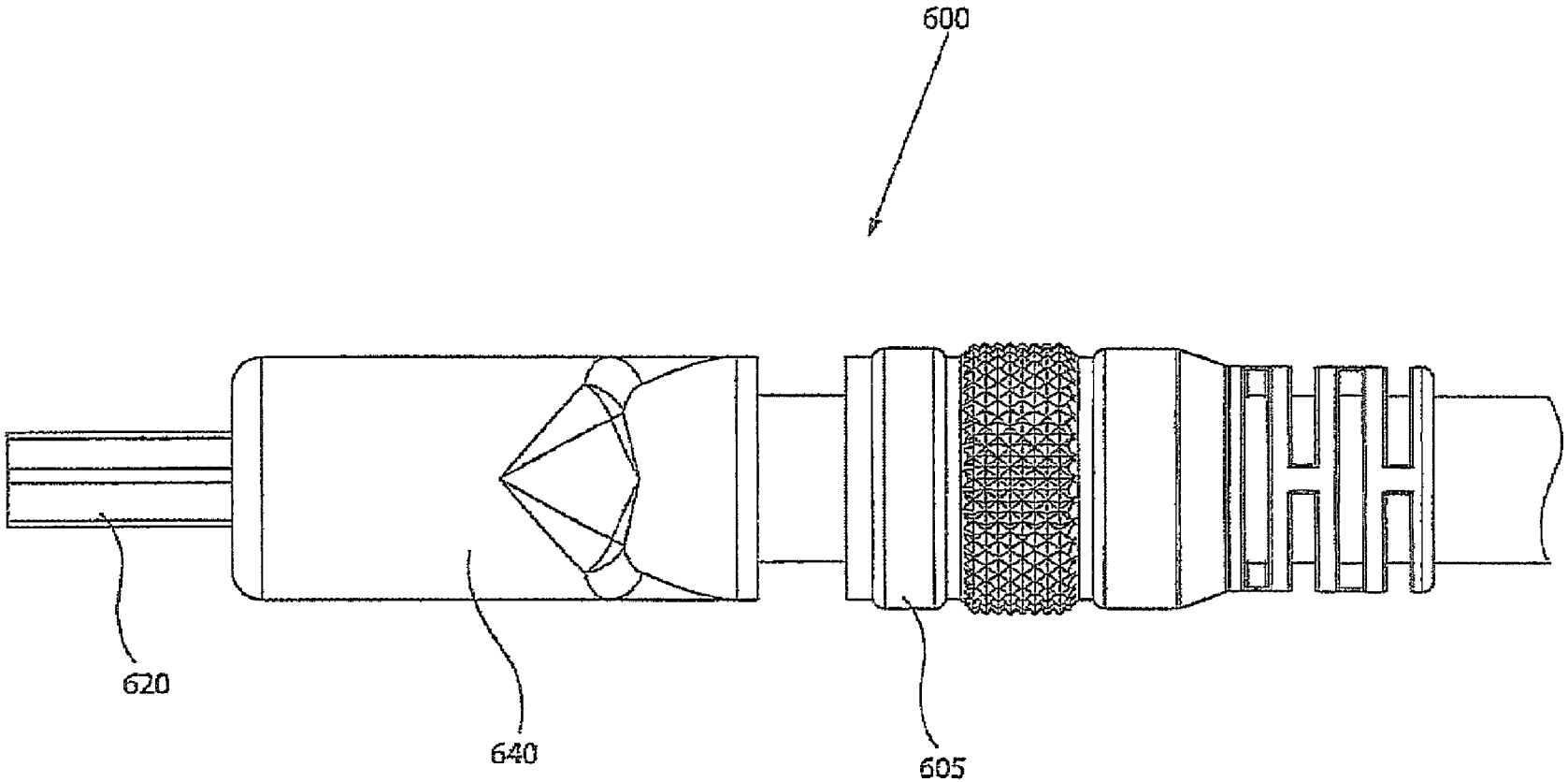
FIG. 37 depicts a side view of a further embodiment of a locking high definition multimedia interface plug in an unlocked position.
Figure 38:
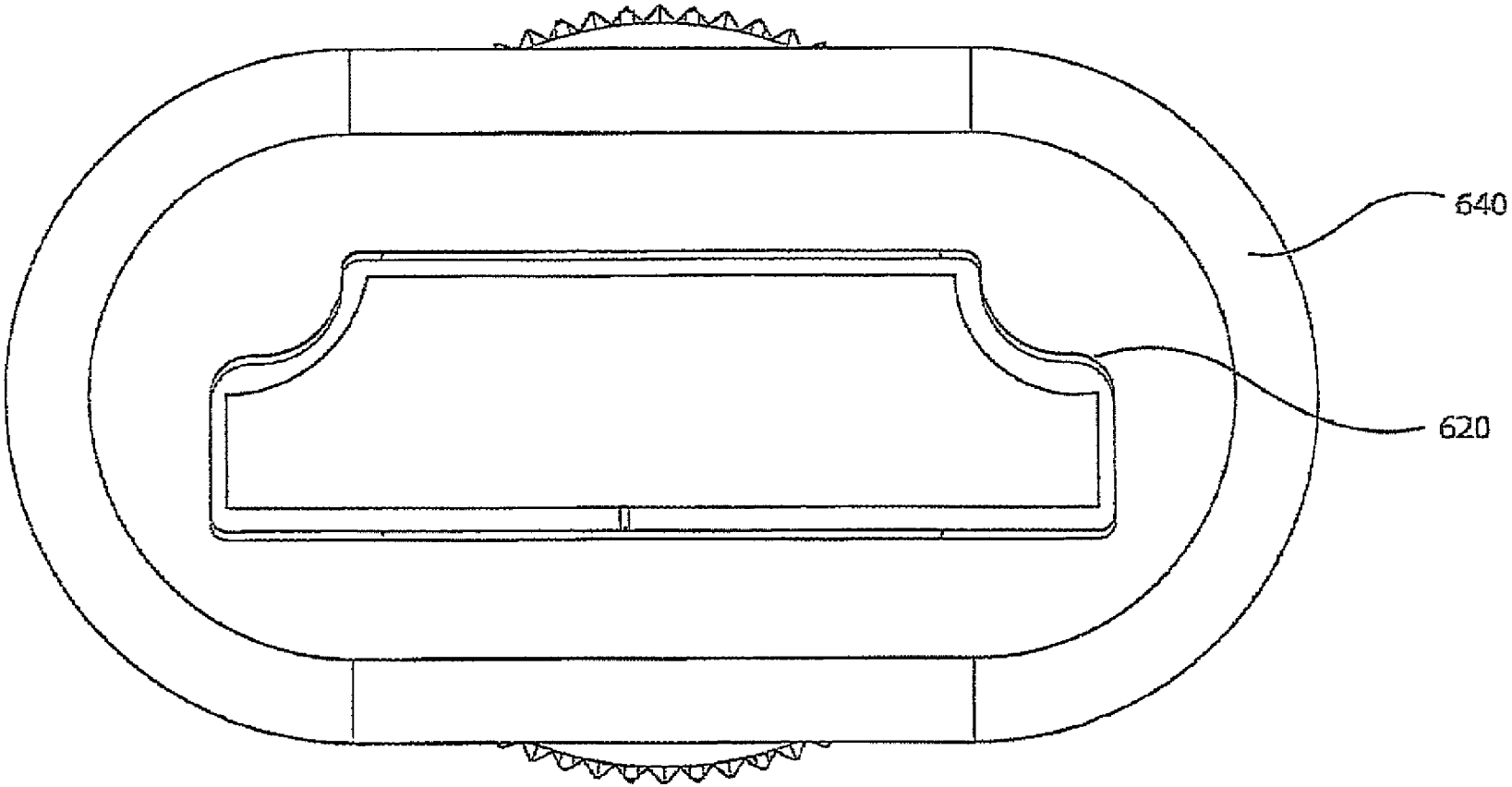
FIG. 38 depicts an end view of a further embodiment of a locking high definition multimedia interface plug in an unlocked position.

29), the extension 520 may be secured within a receptacle 20 in a locked position (see FIG. 7) since said locking tab 550 is biased upward into an opening 25 of the receptacle. Accordingly, the locking tabs 550, being angled away from the high definition multimedia interface connection end 35, facilitate snap locking of the tabs 550 into the receptacle openings 25 when the extension 520 is inserted into a receptacle 20. The angled geometry of the snap locking tabs 550, being substantially opposite to the direction of insertion, prevents the unwanted retraction of locking high definition multimedia interface plug embodiments once snapped into a mated position with the receptacle 20. However, the tabs 550 and related components are configured to break away or otherwise release when a substantial amount of force is applied to the snap connection, such as by a retractive jerking of the cable 10. A lock button 540 is provided to move the actuator 565 to a second position 570, as shown in FIG. 31. When the actuator 565 is moved to the second position 570, the locking tabs 550 contact edge 537 of the opening 530 thereby causing the locking tabs 550 to be pushed downward and retracted and moved beneath opening 530. When the locking tabs 550 are retracted within opening 530 the plug is in an unlocked position 571 and a user may retract the plug from a receptacle 20.

A further locking high definition multimedia interface connector plug embodiment 600 is depicted in FIGS. 32-39. This embodiment employs a sliding body lock button 640 operably coupled to a plug body 605 configured to retain a cable 10. The sliding body lock button 640 may work upon an actuator 665 to move one or more locking tabs 650 such that they protrude from or reside within top surface 624 of an extension member 620. The sliding body lock button 640 may include an inner spring 643 which tends to drive the locking button toward the plug body 605. When the sliding body lock button 640 is driven to the plug body 605 by spring 643, the actuator 665 is in a first position 660 and acts to place the locking tabs 650 into a biased position protruding from the extension 620 (see FIGS. 33-34). This protruding position of the locking tabs 650 corresponds to a locked position 661 of the locking high definition multimedia interface plug 600 when the plug is mated with a receptacle 20. When the plug 600 is in the locked position, the plug 600 is securely but releasably retained within the receptacle 20.

A user may slide the sliding body lock button 640 away from the plug body 605 and compress the inner spring 643. Moreover, when the sliding body lock button 640 is slid toward the extension it engages the actuator 665 to move to a second position 670. When the actuator is in the second position 670, the locking tabs 650 may reside within the opening 630 of the extension 620 and not protrude from the top surface 624 of the extension 620 (see FIGS. 37-38). When the locking tabs 650 do not protrude from the extension 620 they do not interfere with the receptacle 20 permitting the locking high definition multimedia interface plug to be easily retracted and unplugged from the receptacle 20.

Figure 40:
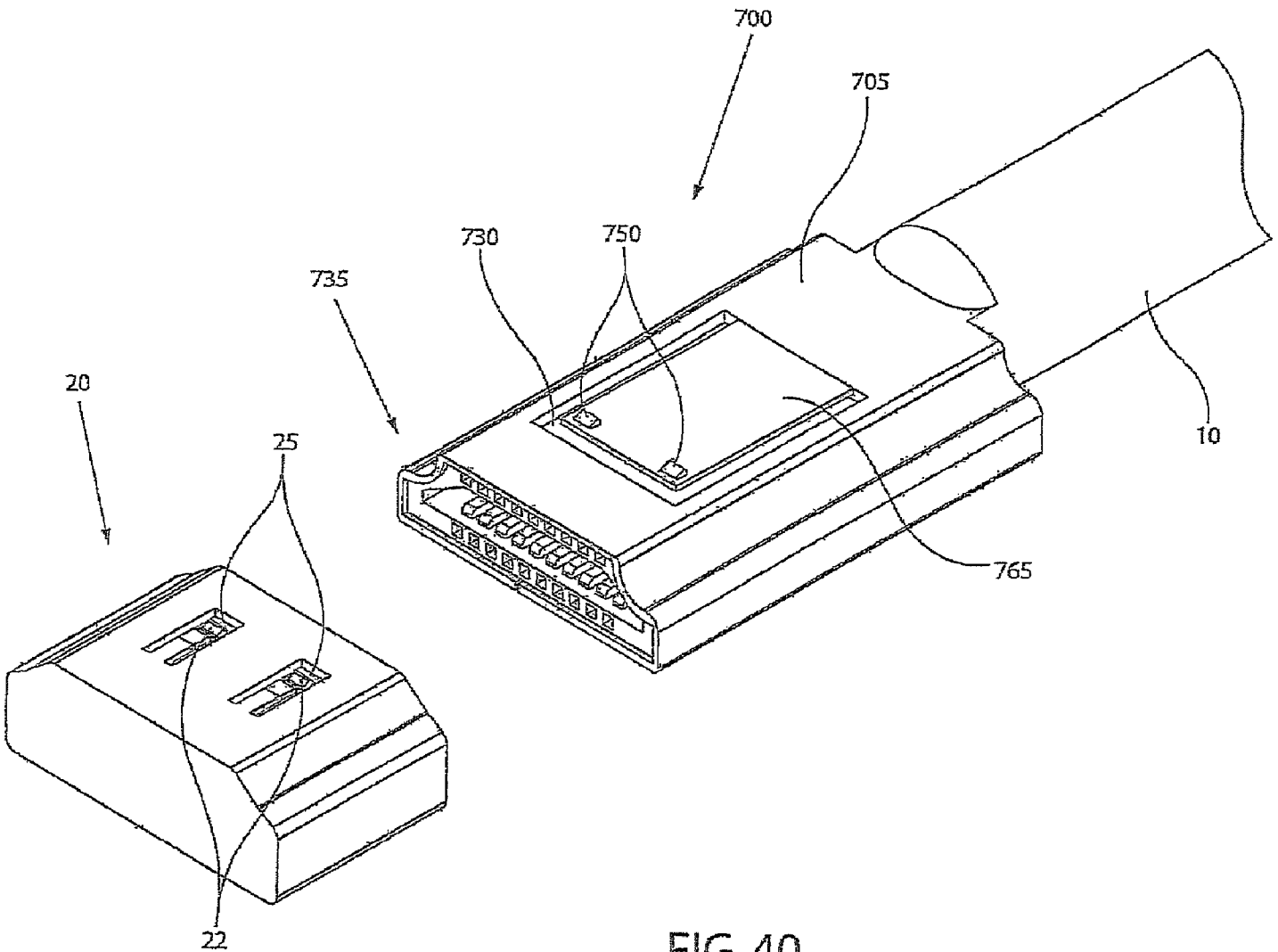
FIG. 40 depicts a perspective view of a still further embodiment of a locking high definition multimedia interface plug prior to mating with a receptacle.

FIG. 40 depicts a perspective view of another locking high definition multimedia interface plug embodiment 700 prior to mating with a receptacle 20. The locking plug 700 includes a receptacle-shaped plug body 705 configured to mate with and be inserted into the receptacle 20. A substantial portion of the plug body 705 is shaped having a complimentary form relative to a corresponding mating receptacle 20. An opening 730 is positioned in the body 705. An actuator 765 is configured to move locking tabs 750 into and/or out of the opening 730 of body 705. The placement of the tabs 750 out of the opening 730 corresponds to a first position 161 (see FIG. 9). The placement of the tabs within the opening 730 corresponds to a second position 171 (see FIG. 10). When the high definition multimedia interface connection end 735 is inserted into the receptacle 20, the locking tabs 750 may slide along a top interior surface of the receptacle 20 until the plug 700 is inserted to a point where the locking tabs can engage the typical openings 25 of the receptacle. When operably plugged-in or mounted to the receptacle 20, the locking high definition multimedia interface plug 700 is firmly held by engagement of the locking tabs 750. Moreover, the spring biased tabs 22 releasably engage the opening 730 of the locking plug 700 when the plug 700 is operably mounted to the receptacle. The plug 700 may be released, unmounted, or unplugged from the receptacle 20 by moving the actuator 765 to in turn move the locking tabs 750 out of engagement with the openings 25 of the receptacle 20.

Embodiments of a locking high definition multimedia interface plug, such as plugs 100, 300, 600, and 700 may be configured as shown in FIGS. 41 and 42 to be inserted into a high definition multimedia interface receptacle corresponding to Type A, B or C high definition multimedia interface plug standards. Moreover, embodiments of a locking plug 100/300/600/700 may have a locking means to securely but releasably plug into a high definition multimedia interface receptacle, such as receptacle 20, as discussed above. The locking means may include a locking tab 150/250/251/350/450/550/650/750 configured to interact with the receptacle 20 to retain the plug 100/300/600/700. Moreover, the locking means may include any movable feature configured to operably interfere with a portion of a typical opening 25 (see FIGS. 1-4) of a high definition multimedia interface receptacle 20 to securely retain the plug 100/300/600/700 to the receptacle 20. The locking means may move into locking position through operation of an actuator 165/265/365/465/565/665/765.

A method of compliantly locking a plug 100/200/300/600/700 into a receptacle 20 is depicted in reference to FIGS. 5-42 and may comprise the steps of: providing a locking high definition multimedia interface 100/300/600/700 including a plug body 105/305/605/705. The plug body may have an extension 120/220/221/320/420/520/620 configured to be inserted into a high definition multimedia interface receptacle, such as receptacle 20. Accordingly, the each of the extension embodiments, such as extensions 120/220/221/320/420/520/620, may be configured to be an operable extension of any plug body embodiment. The plug 100/300/600/700 also includes an actuator 165/265/365/465/565/665/765 operable with the body 105/305/605/705. In addition, the locking high definition multimedia interface plug 100/300/600/700 includes a locking tab 150/250/251/350/450/550/650/750 coupled to the actuator 165/265/365/465/565/665/765, wherein the locking tab 150/250/251/350/450/550/650/750 is configured to movably protrude from an opening 130/230/330/430/530/630/730 of the body 105/305/605/705. The plug 100/300/600/700 may be removably secured to the receptacle, such as receptacle 20, by biasing the locking tab 150/250/251/350/450/550/650/750 sufficiently to protrude from the opening 130/230/330/430/530/630/730 of the body 105/305/605/705, or operable body extension 120/220/221/320/420/520/620, to engage the receptacle 20 and releasably lock the body 105/305/605/705 into the receptacle 20.

Embodiments of a locking high definition multimedia interface plug 100/300/600 may utilize an actuator 165/265/365/465/565/665/765 to bias the locking tab 150/250/251/350/450/550/650/750. Accordingly, the locking tab 150/250/251/350/450/550/650 may be biased by working on the actuator 165/265/365/465/565/665/765 to move the actuator 165/265/365/465/565/665/765 and move the locking tab 150/250/251/350/450/550/650/750.

Removal of the embodiments of a locking high definition multimedia interface cable connector plug 100/300/600/700 may comprise the steps of: unbiasing the locking tab 150/250/251/350/450/550/650/750 sufficiently to prevent protrusion of the locking tab 150/250/251/350/450/550/650/750 from the opening 130/230/330/430/530/630/730 of the body 105/305/605/705, or operable body extension 120/220/221/320/420/520/620, to unlock the plug 100/300/600/700 from the high definition multimedia interface receptacle, such as receptacle 20.

Embodiments of a locking high definition multimedia interface plug 100/300/600 may utilize an actuator 165/265/365/465/565/665/765 to unbias the locking tab 150/250/251/350/450/550/650/750. Accordingly, the locking tab 150/250/251/350/450/550/650/750 may be unbiased by working on the actuator 165/265/365/465/565/665/765 to move the actuator 165/265/365/465/565/665/765 and move the locking tab 150/250/251/350/450/550/650/750.

Certain embodiments may utilize the operation of a lock button 140/240/340/440/540/640/740 to work on the actuator 165/265/365/465/565/665/765 and accomplish the biasing or unbiasing of the locking tab 150/250/251/350/450/550/650/750 sufficiently to enable protrusion or prevent protrusion of the locking tab 150/250/251/350/450/550/650/750 from the opening 130/230/330/430/530/630/730 of the body 105/305/605/705, or operable body extension 120/220/221/320/420/520/620, to lock or unlock the plug 100/300/600/700 from the high definition multimedia interface receptacle, such as receptacle 20.

Figure 43:
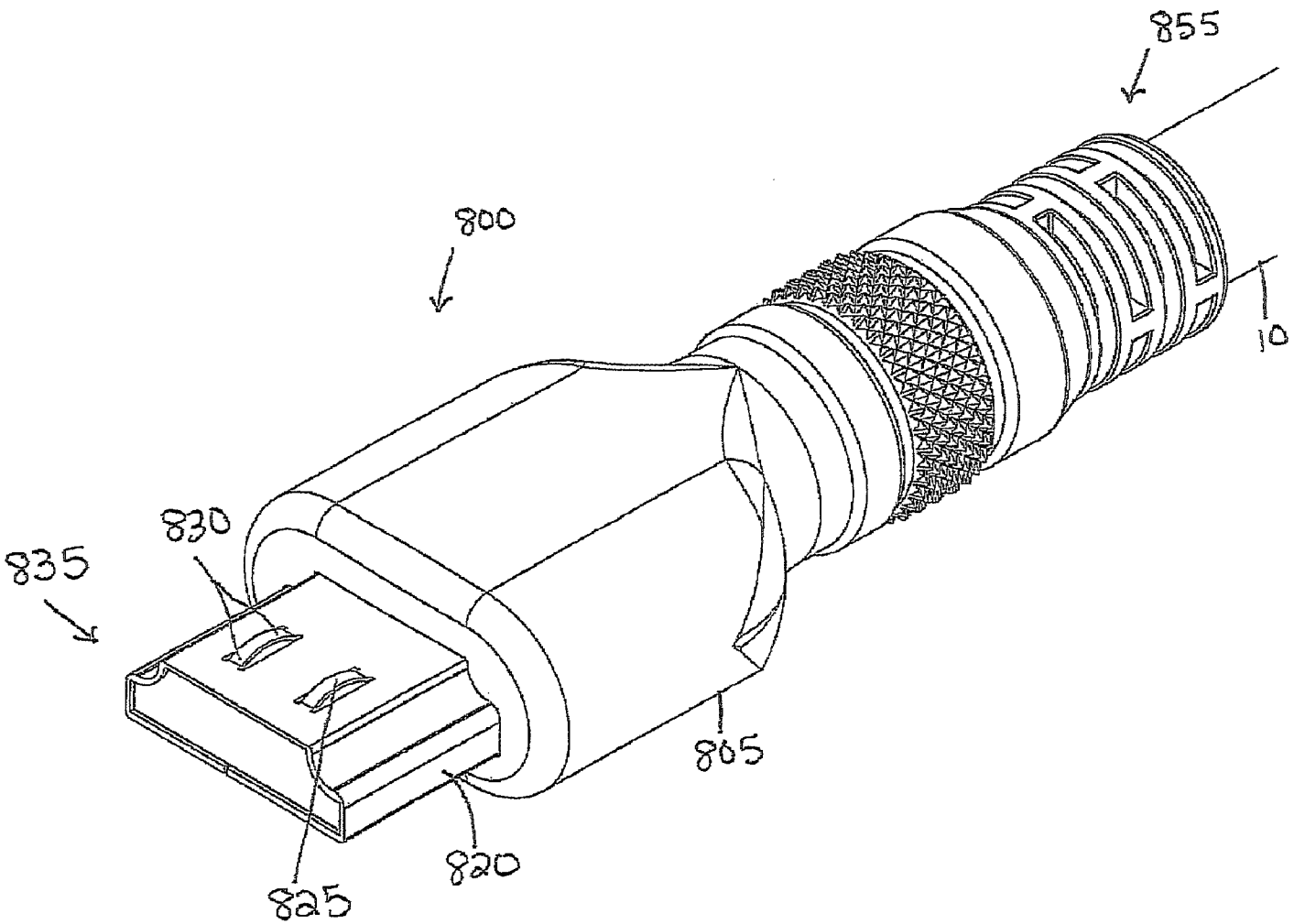
FIG. 43 depicts a perspective view of an embodiment of a releasably engaging high definition multimedia interface plug.

With reference to the drawings, FIG. 43 depicts a perspective view of an embodiments of a releasably engaging high definition multimedia plug 800 for connecting high definition multimedia interface cable 10 to high definition electronic components having standard high definition multimedia interface receptacles. Accordingly, the releasably engaging high definition multimedia interface plug 100 has an high definition multimedia interface connection end 835 and an high definition multimedia interface cable connection end 855. The releasably engaging high definition multimedia interface plug 800 comprises a connector body or plug body 805. The plug body 805 may include an extension 820. The plug body 805 can help retain a connected high definition multimedia interface cable 10. Extension 820 may have projections(s) 825 located on its outer surface. In this instance, the projections are disclosed as convex surfaces.

Figure 44:
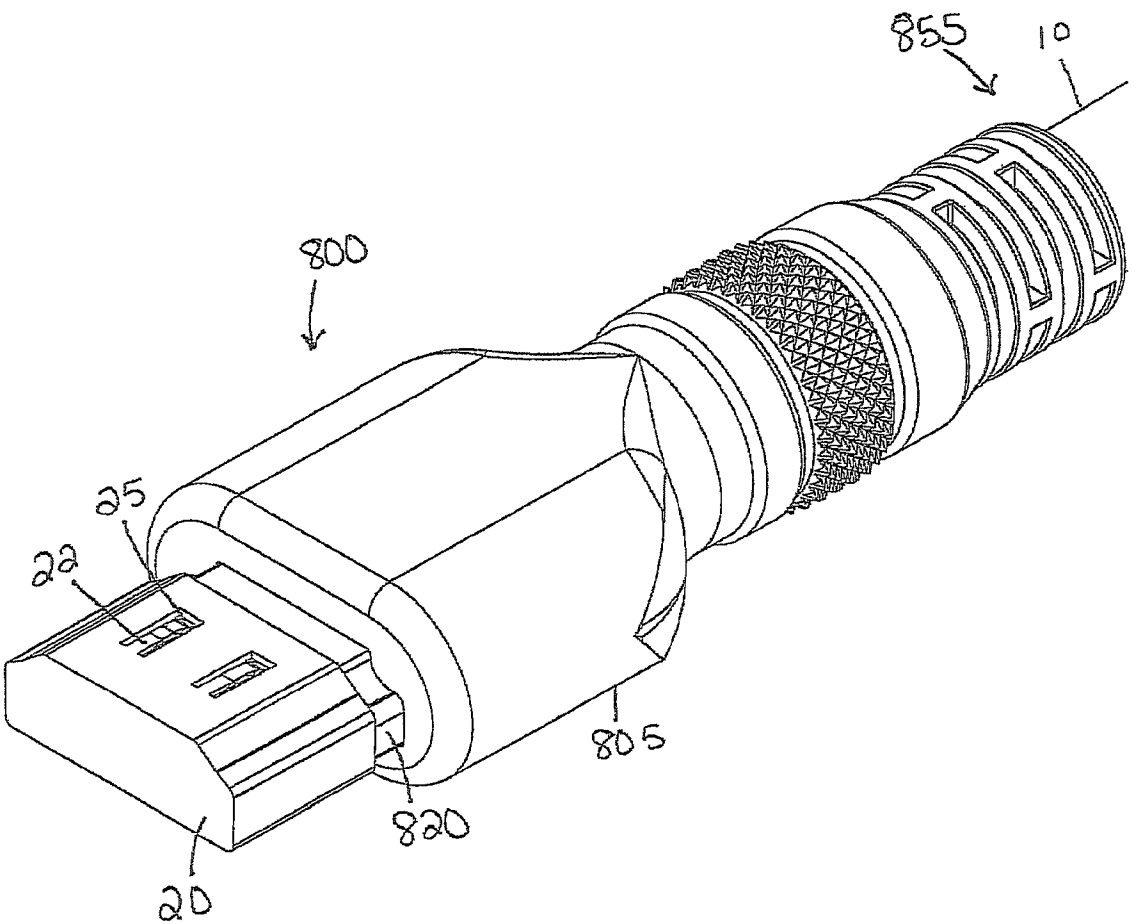
FIG. 44 depicts a perspective view of the high definition multimedia interface plug of FIG. 43 mated to an high definition multimedia interface receptacle.

Referring further to the drawings, FIG. 44 depicts a perspective view of an embodiment of a releasably engaging high definition multimedia interface plug 800 whereby extension 820 is fully inserted into receptacle 20. In this instance, projections 825 have releasably engaged and fully biased spring biased tabs 22, which are disposed within sidewall openings 25. The high definition multimedia interface connection end 835 of the releasably engaging high definition multimedia interface plug may be plugged into the receptacle to facilitate a connection and allow transmission of electronic communications through the cable 10 connected to the cable connection end 855 of the releasably engaging high definition multimedia interface plug. Extension 820 is configured to be inserted into the receptacle 20.

Figure 45A:
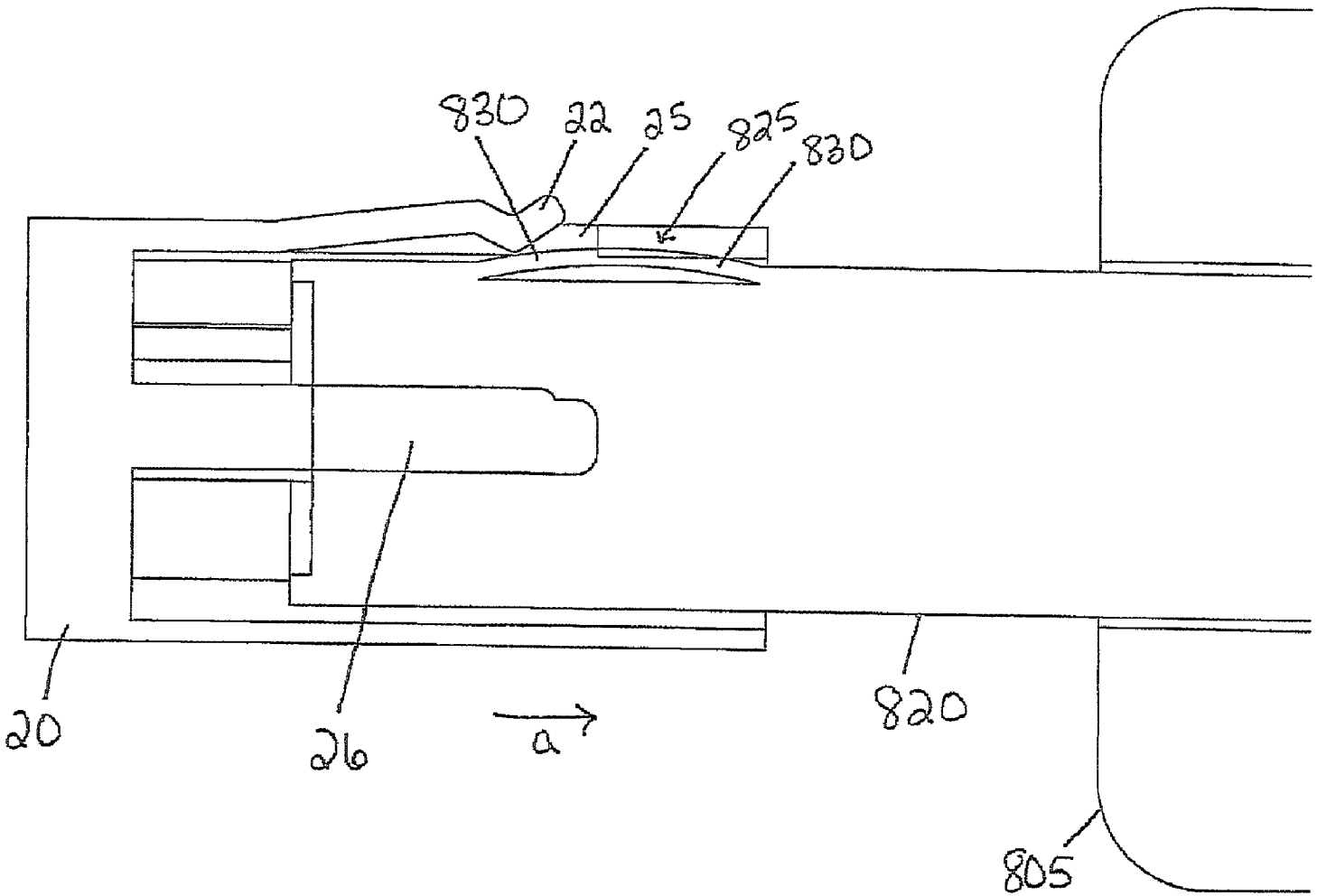
FIG. 45A depicts a side cross-section view of the high definition multimedia interface plug of FIG. 44, either partially inserted into or almost fully withdrawn from an high definition multimedia interface receptacle.
Figure 45B:
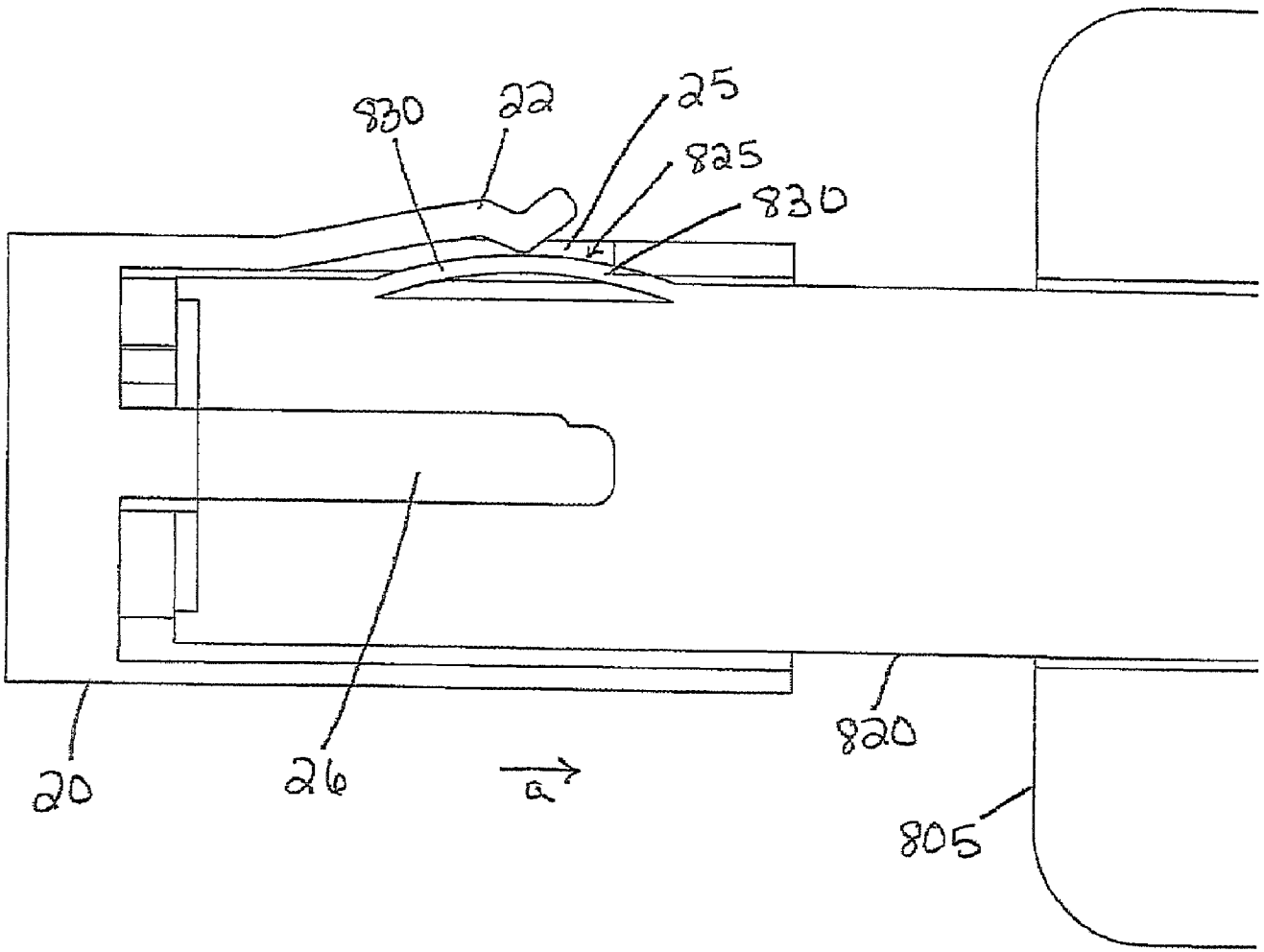
FIG. 45B depicts a side cross-section view of the high definition multimedia interface plug of FIG. 44, either almost fully inserted into or partially withdrawn from an high definition multimedia interface receptacle.
Figure 45C:
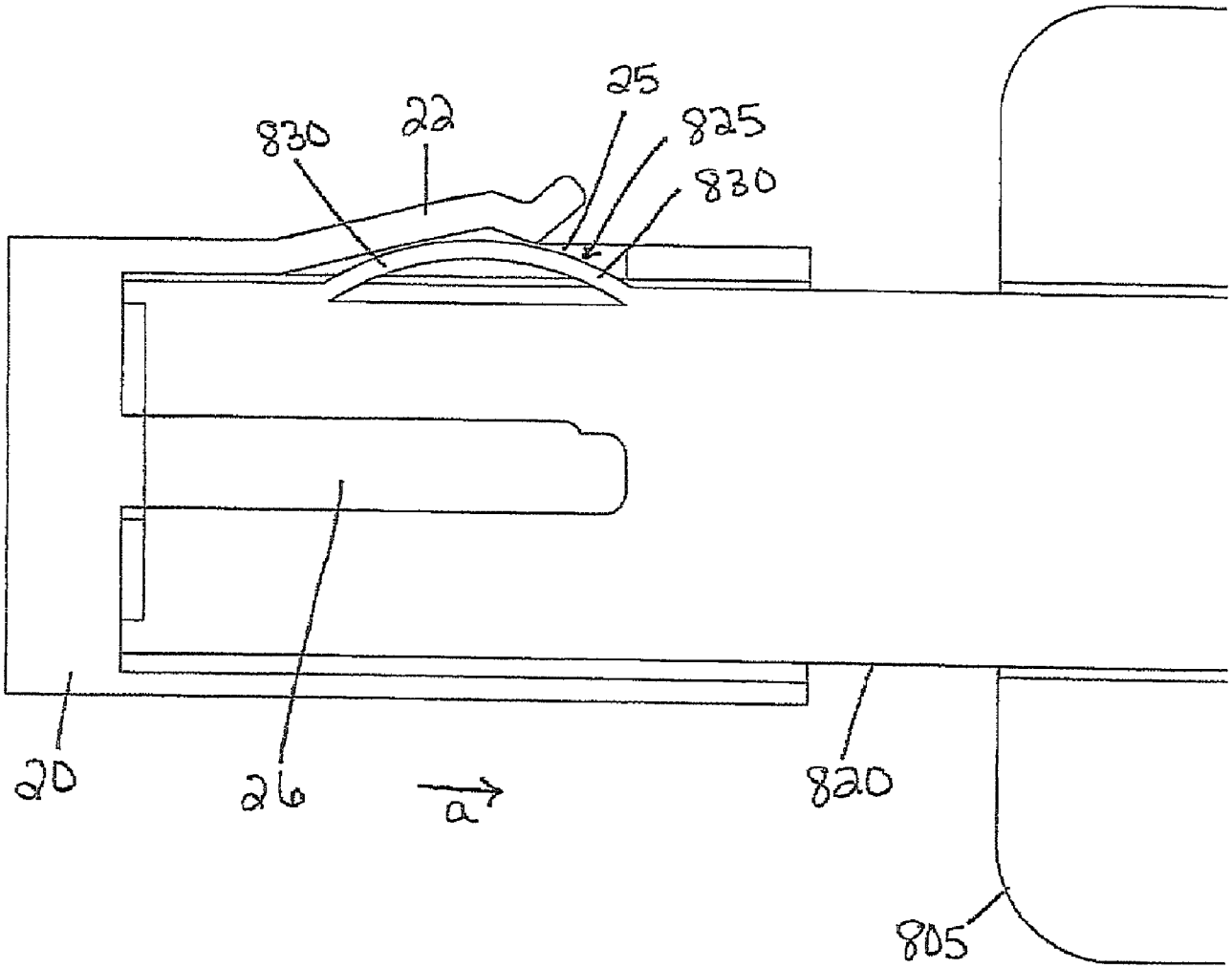
FIG. 45C depicts a side cross-section view of the high definition multimedia interface plug of FIG. 44, fully inserted into an high definition multimedia interface receptacle.

Referring to FIGS. 45A, 45B and 45C, FIG. 45A depicts a partial cutaway side view of an embodiment of a releasably engaging high definition multimedia interface plug 800, either partially inserted into or almost fully withdrawn from receptacle 20. As extension 820 is inserted into receptacle 20, transitional surfaces 830 engage and being to bias spring biased tabs 22 disposed within sidewall openings 25. As extension 820 is further inserted into receptacle 20 (see FIG. 45B), transitional surfaces 830 bias spring biased tabs 22 further, until extension 820 is fully inserted into receptacle 20 (see FIG. 45C). At this point, spring biased tabs 22 are fully biased, causing an increased mechanical friction fit. Upon the application of a sufficient retractive force of the extension 820 from the receptacle 20 in the direction a indicated in FIGS. 45B and 45C, transitional surface 830 will begin to unbias the spring biased tabs 22. As extension 820 is further withdrawn from receptacle 20 (see FIG. 45A), transitional surfaces 830 unbias spring biased tabs 22 further, until extension 820 is fully withdrawn from receptacle 20 (see FIG. 45C). Spring biased tabs 22 have now substantially returned to there pre-biased shape.

With continued reference to the drawings, FIG. 45C depicts a partial cutaway side view of an embodiment of a releasably engaging high definition multimedia interface plug 800 fully inserted into receptacle 20. Receptacle port contact 26 of the receptacle 20 is configured to mate with the plug terminal contacts (not shown). A typical high definition multimedia interface receptacle, as described previously, may commonly have a sidewall opening 25 with a spring biased tab 22 (as shown in FIG. 1). The sidewall opening 25 is located on the outer surface of the receptacle and generally permits the spring biased tab 22 to protrude somewhat into a detent(s) of a standard high definition multimedia interface plug (see FIGS. 1-4). Hence, when the spring biased tab(s) 22 protrudes into the typical detent(s) of a standard high definition multimedia interface plug, some mechanical friction fit between the parts is created to help retain the standard plug in mated position with the receptacle 20. However, the typical shape of the spring biased tab 22 and the associated force of the friction fit of the tab 22 with openings or detents of a standard high definition multimedia interface plug are often insufficient to securely retain the standard high definition multimedia interface plug in appropriate mating position with the receptacle 20. Accordingly, embodiments of a releasably engaging high definition multimedia interface plug 800 provide projection(s) 825 that are positioned on extension 820 to mate with the sidewall openings 25 of the receptacle 20. Projections 825 are configured to increase the amount of mechanical friction fit between the spring biased tab(s) 22 and the plug body 805, thereby preventing the connector 800 from unintentionally falling out of the receptacle 20. Projections 825 may include transitional surface(s) 830 formed in the direction of insertion and withdrawal of the plug body 805 into the receptacle 20. Transitional surface(s) 830 are configured to allow for insertion and withdrawal of the plug body 805 into the receptacle 20 without the use of tools and without causing damage to the mating receptacle 20 and/or connector 800. Transitional surfaces 830 are configured to release when a sufficient amount of retractive force is applied to the connection, such as a jerking of cable 10 and the like.

Figure 46:
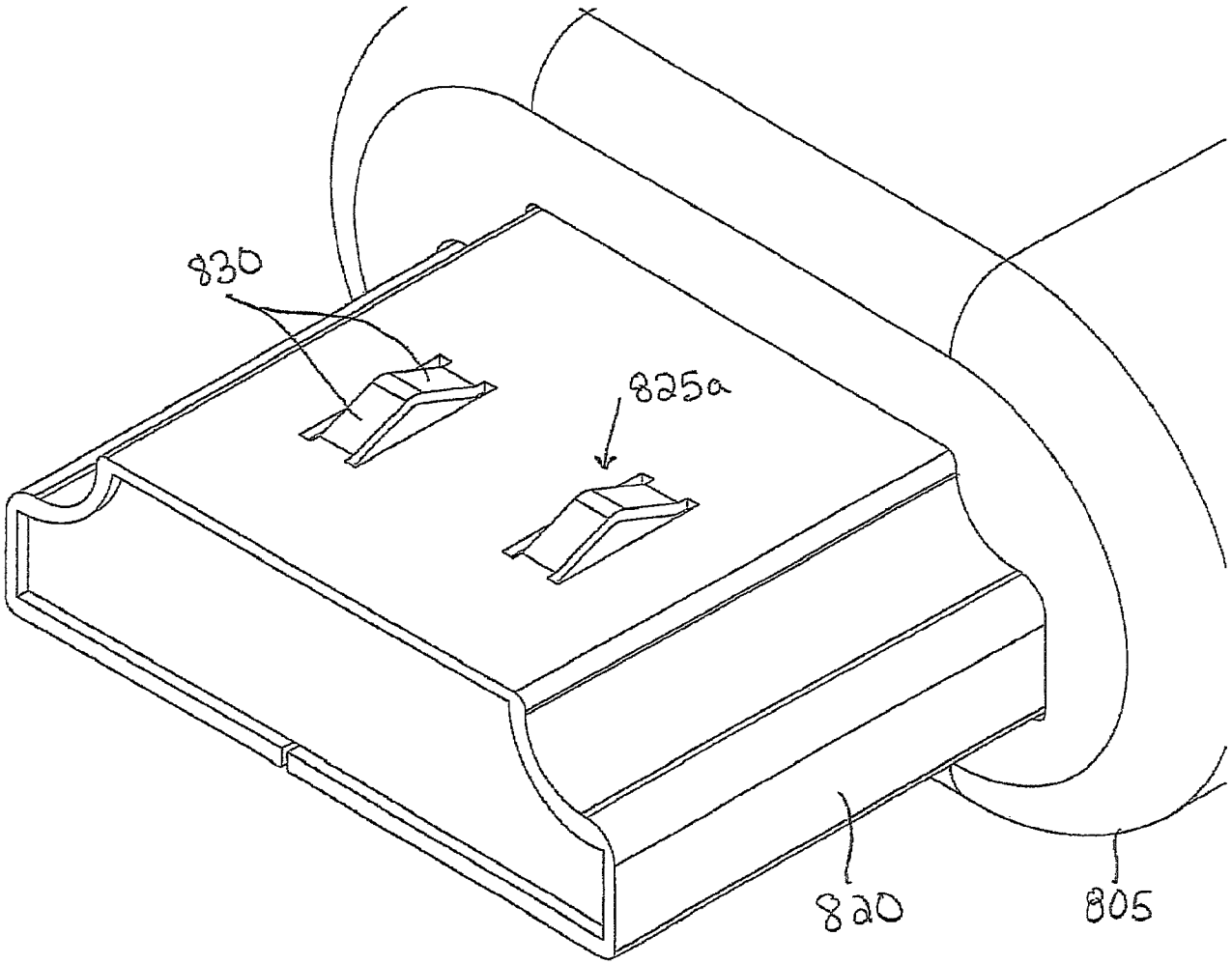
FIG. 46 depicts a perspective view of a further embodiment of a releasably engaging high definition multimedia interface plug.
Figure 47:
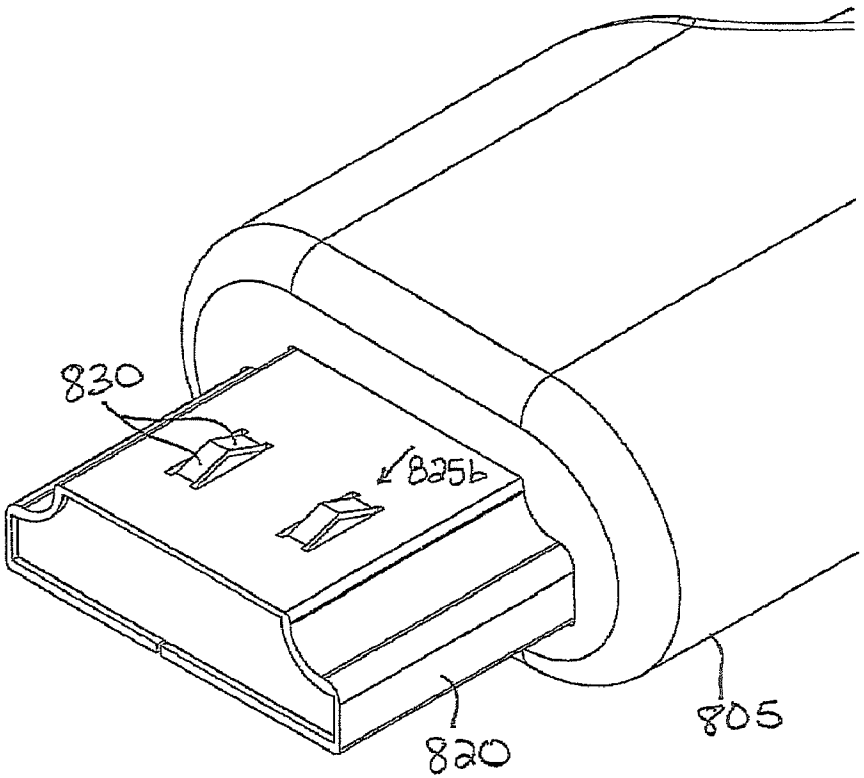
FIG. 47 depicts a perspective view of a further embodiment of a releasably engaging high definition multimedia interface plug.
Figure 48:
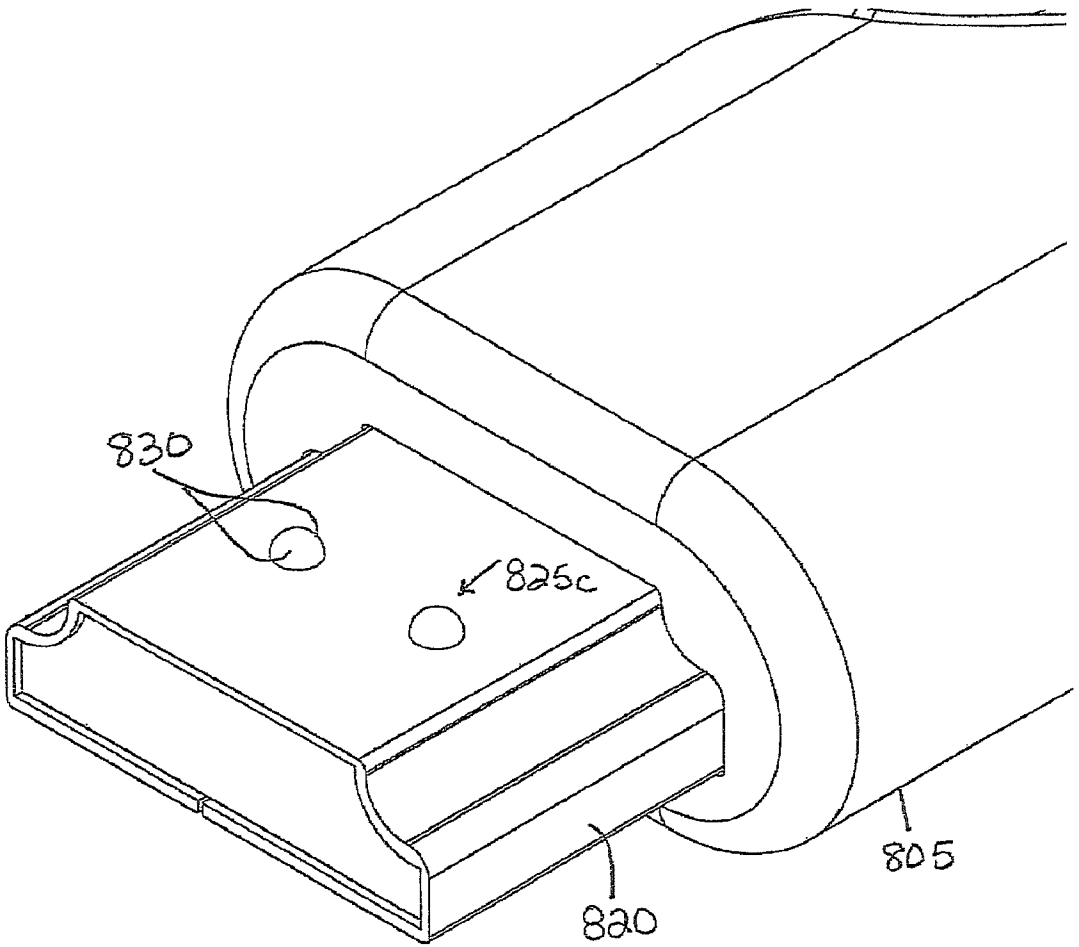
FIG. 48 depicts a perspective view of a still further embodiment of a releasably engaging high definition multimedia interface plug.

Referring to FIGS. 43 and 46-48, projections 825 may take various shapes, including convex, arcuate, ramped or radial. An arcuate shape includes surfaces that are arched or curved. FIG. 43 shows a convex surface 825, FIG. 46 shows an arcuate surface 825A, FIG. 47 shows a ramped surface 825B, FIG. 48 shows a radial surface 825C.

Figure 49:
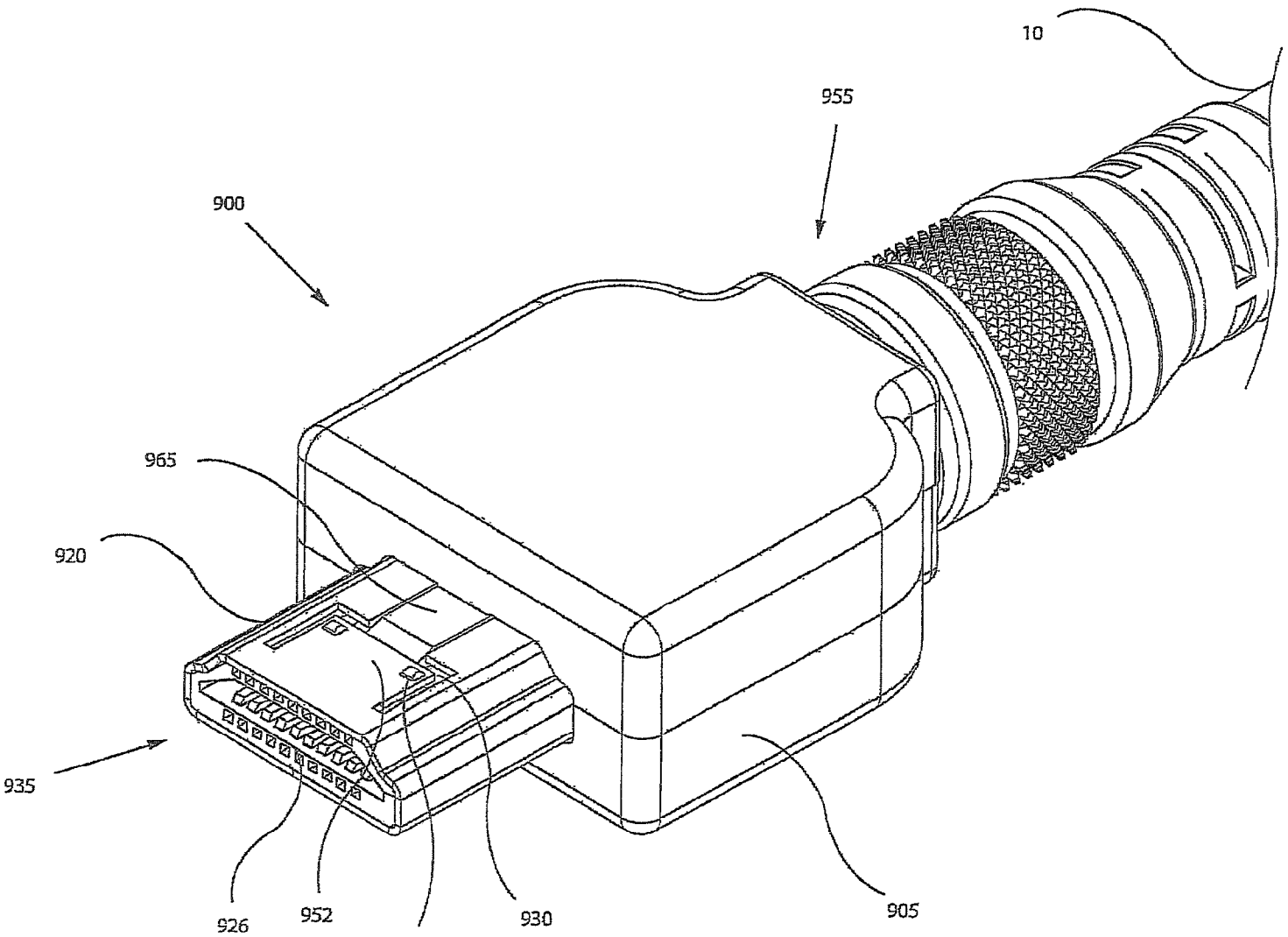
FIG. 49 depicts a perspective view of another embodiment of a releasably engaging high definition multimedia interface plug.

With continued reference to the drawings, FIG. 49 depicts a perspective view of another embodiment of a releasably engaging high definition multimedia interface plug 900. Embodiments of a releasably engaging high definition multimedia interface plug 900 may help facilitate connecting high definition multimedia interface cable 10 to high definition electronic components having standard high definition multimedia interface receptacles, such as receptacle 20 depicted in FIGS. 1-4. As such, embodiments of a releasably engaging high definition multimedia interface plug may include many similar structural features and similar functional operability as other embodiments of locking releasably engaging high definition multimedia interface plugs 100/200/300/400/500/600/700/800 previously described.

A releasably engaging high definition multimedia interface plug 100 has a high definition multimedia interface connection end 935. The releasably engaging high definition multimedia interface plug 900 comprises a connector body or plug body 905, having an opening 930. The plug body 905 may include an extension 920. The opening 930 may be located on the extension 920 of the plug body 905. The plug body 905 can help retain a connected high definition multimedia interface cable 10. Embodiments of a releasably engaging high definition multimedia interface plug 900 include a cable connection end 955. Moreover, embodiments of a releasably engaging high definition multimedia interface plug 900 all comprise an actuator 965 configured to move a locking tab 950. The actuator 965 may operate with the locking tab 950, such that movement of the actuator 965 causes the locking tab 950 to bias or move. The locking tab 950 may operate with a flexible engagement member 952. More than one locking tab 950 may operate with the flexible engagement member 952 in correlation with proper placement for releasable secure engagement with a standard high definition multimedia interface receptacle, such as receptacle 20. The actuator 965 may operate with the flexible engagement member 952, such that movement of the actuator 965 causes the flexible engagement member 952 to bias or move causing the locking tab 950 to bias or move as a result of the operation of the actuator 965.

Various embodiments of a releasably engaging high definition multimedia plug 900 may include a lock button, such as, but not limited to, the lock button 140 depicted in FIG. 5. The actuator 965 may operate with such a lock button 140, wherein the lock button 140 may be associated with, or operably coupled to, the plug body 905. The lock button, such as lock button 140, is configured to be manipulated by a user in an up, down, or sideways motion to work upon the actuator 965 and cause the actuator 965 to move the locking tab 950 between a first position 960 (see FIG. 53) and a second position 970 (see FIG. 51). The lock button, such as lock button 140, may be integrally formed with actuator 965, or may be separately attached to the actuator 965 and located to contact or otherwise be configured to afford work upon the actuator 965 in some operable manner. The lock button, such as lock button 140, may be depressible. In addition, a releasably engaging high definition multimedia interface plug 900 has a plug terminal contact 926.

Figure 50:
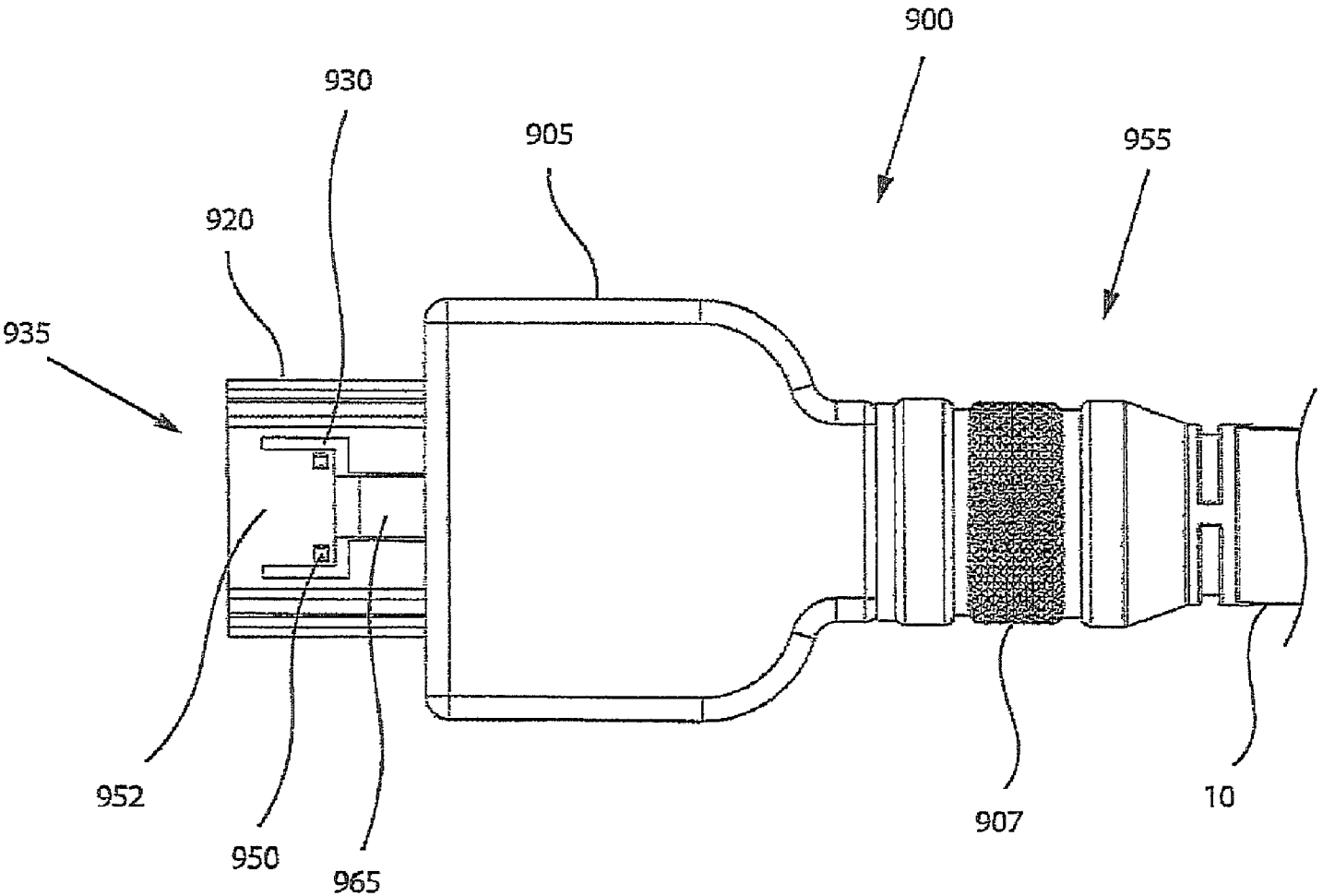
FIG. 50 depicts a top view of the embodiment of the releasably engaging high definition multimedia interface plug of FIG. 49.

Referring further to the drawings, FIG. 50 depicts a top view of the embodiment of the releasably engaging high definition multimedia interface plug 900. As clearly depicted, portions of the interface plug body 905 may have grip enhancing features 907, such as knurling. A user may grip the body 905 and thereby advance the releasably engaging high definition multimedia interface plug into a corresponding standard high definition multimedia interface receptacle 20. The wedge actuator 965 may be operable associated with the body 905 in a manner such that movement of all or a portion of the body 905 moves the wedge actuator 965.

Figure 51:
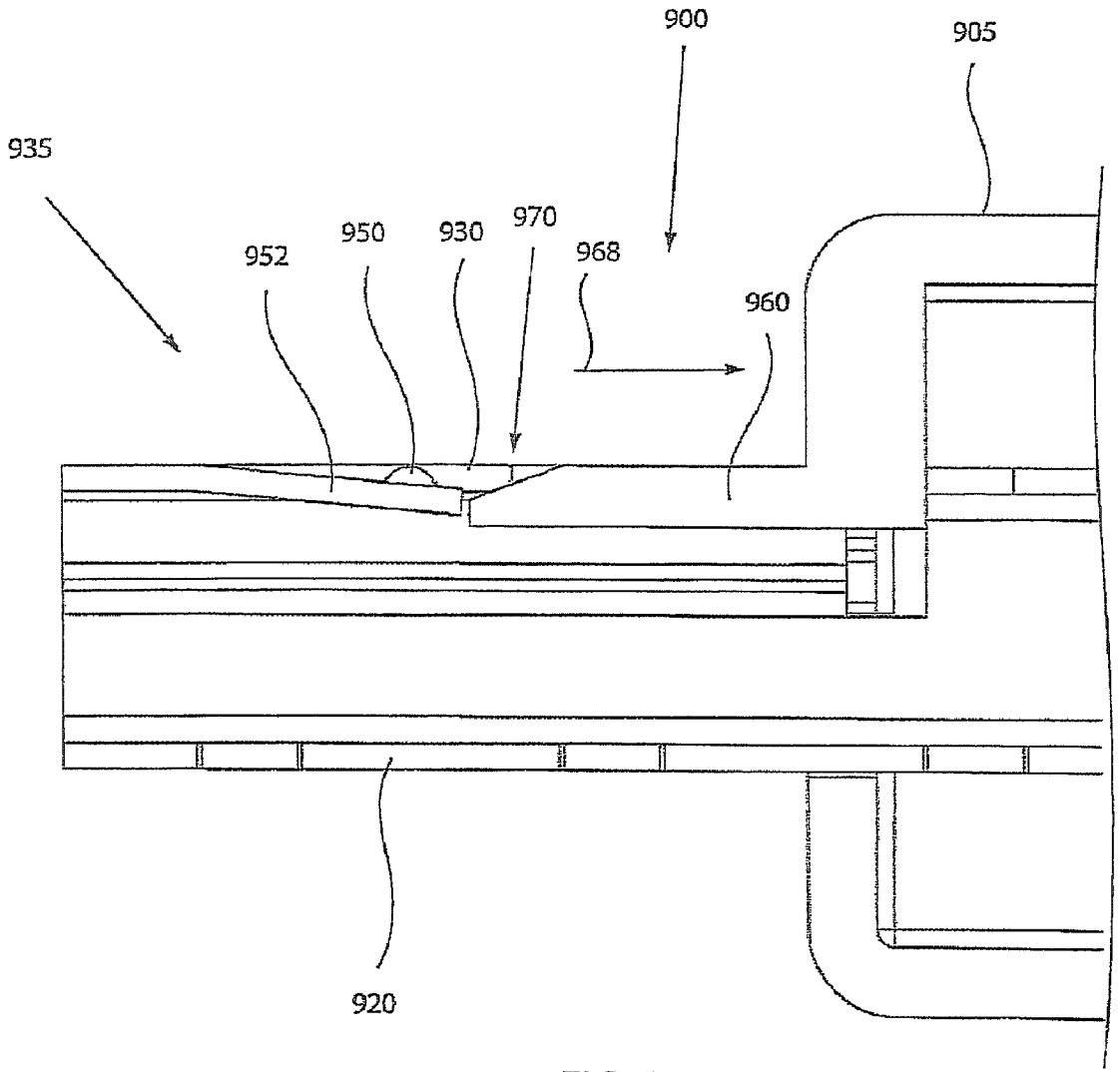
FIG. 51 depicts a side cross section view of a portion of the embodiment of the releasably engaging high definition multimedia interface plug of FIG. 49 just prior to actuation.
Figure 52:
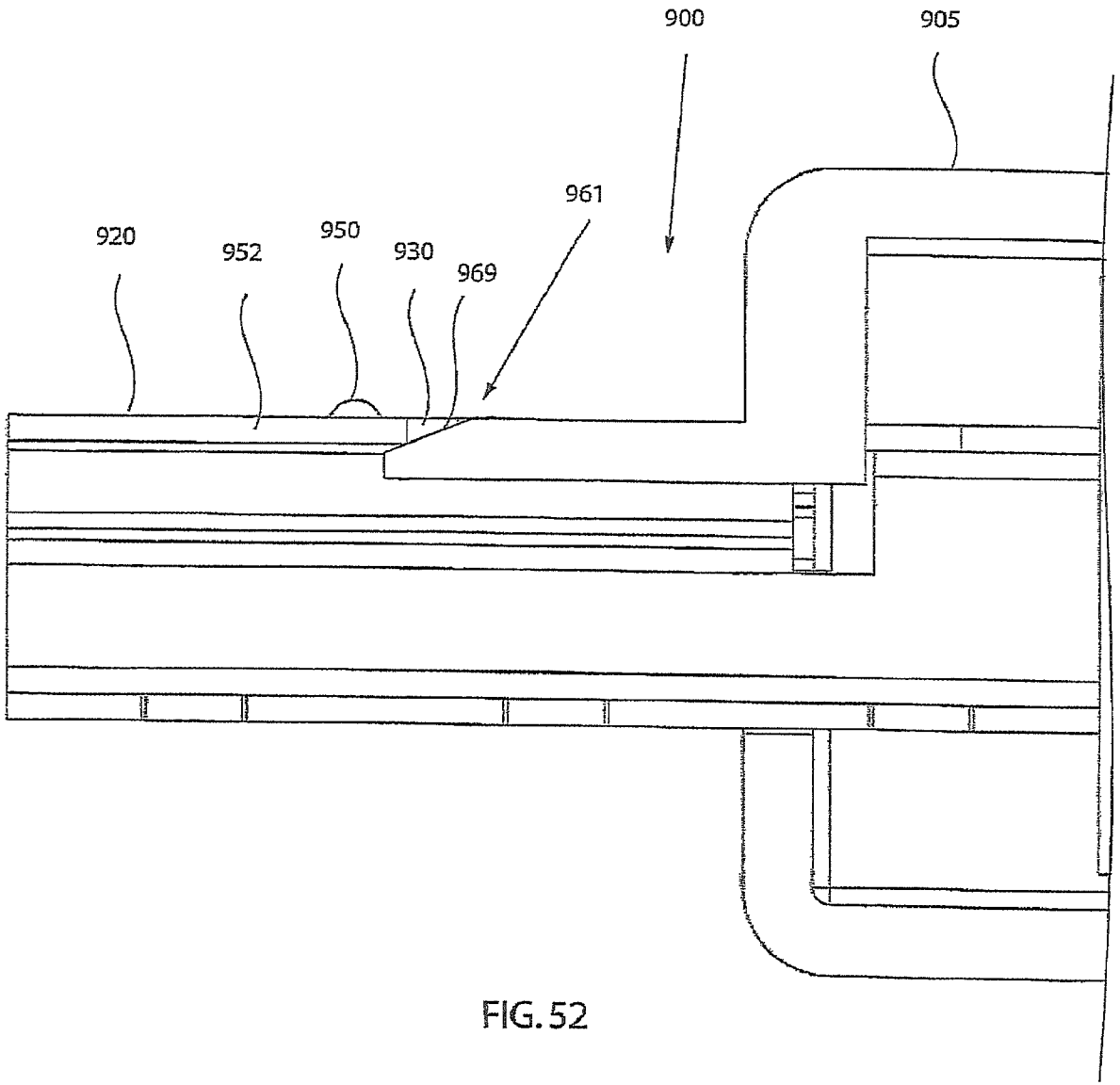
FIG. 52 depicts a side cross section view of a portion of the embodiment of the releasably engaging high definition multimedia interface plug of FIG. 49 during actuation.
Figure 53:
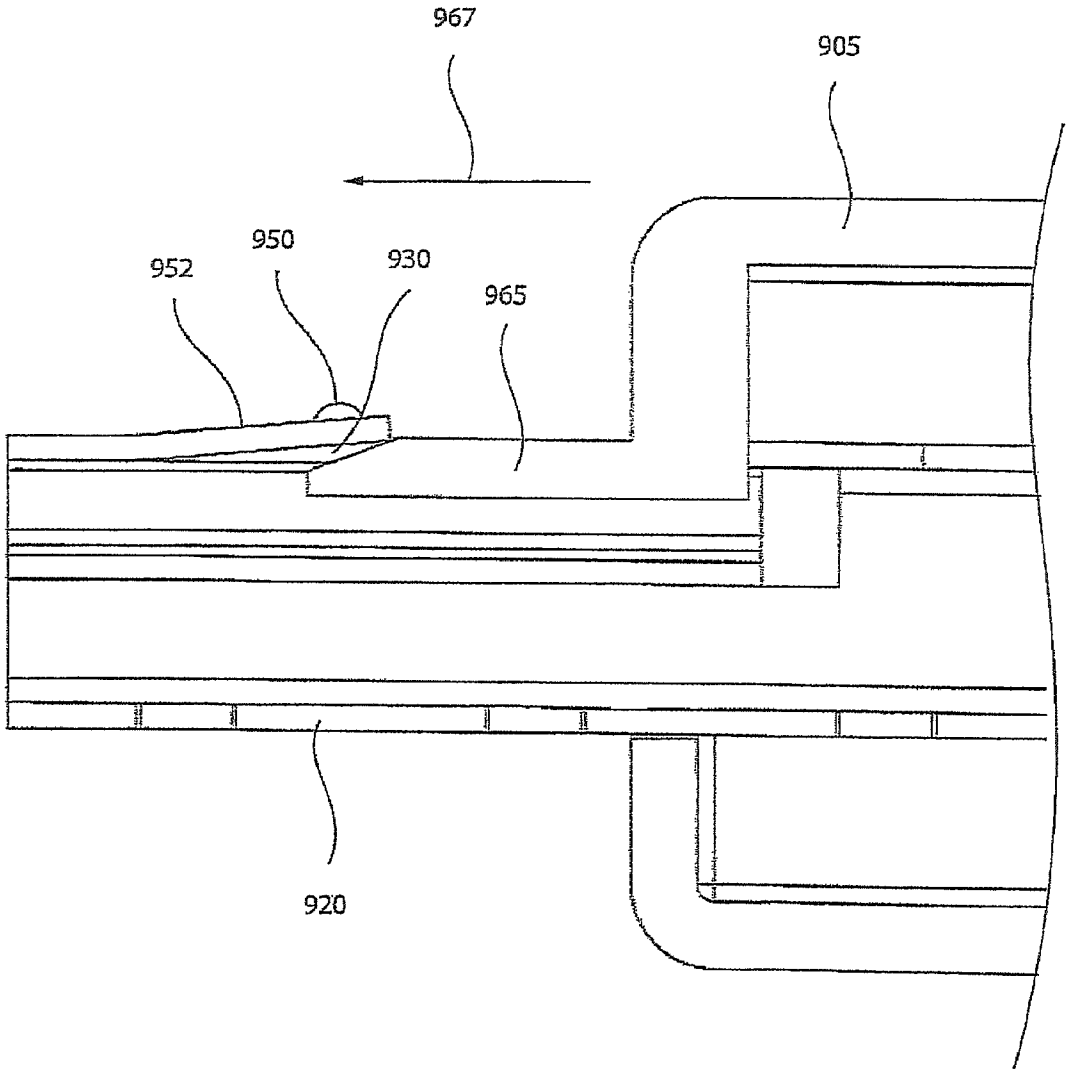
FIG. 53 depicts a side cross section view of a portion of the embodiment of the releasably engaging high definition multimedia interface plug of FIG. 49 after actuation.
Figure 54:
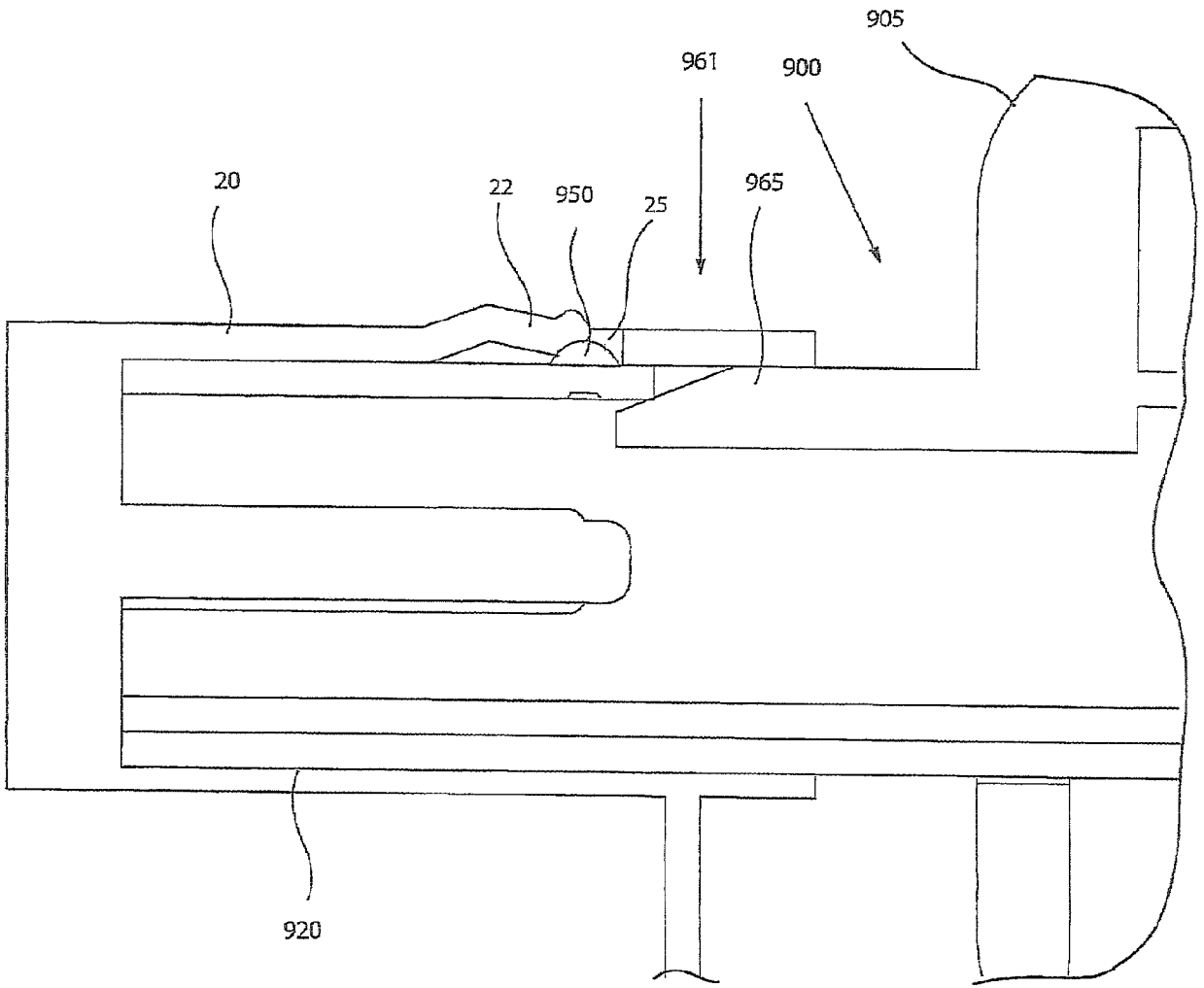
FIG. 54 depicts a side cross section view of a portion of the embodiment of the releasably engaging high definition multimedia interface plug of FIG. 49, during actuation and while mating with a typical high definition multimedia interface receptacle.

Further description of the various components and functionality of a releasably engaging high definition multimedia interface plug 900, in particular the operable association of the wedge actuator 965 and the locking tab(s) 950, is provided with reference to FIGS. 51-53. The wedge actuator 965 may be positioned to be slidably movable below a locking tab 950 of the interface plug 900. For example, as depicted in FIG. 53, when the wedge actuator 965 is slidably moved in a direction 967 away from the connector body 905, the wedge actuator 965 obtains a position, such as a first position 960, where the wedge actuator 965 is wedged below the locking tab 950 and the locking tab 950 is biased to protrude from the opening 930 of the body. It should be appreciated that embodiments of a high definition multimedia interface plug 900 may include an actuator 965 that is configured such that the actuator 965 is operable with the body 905 such that movement of the actuator in a direction toward the body 905, as opposed to away from the body 905, places the actuator 965 in a wedged location below the locking tab 950 in a first position 960. A first position 960 may be a position of the wedge actuator 965, wherein the wedge actuator 965 is wedged below the locking tab 950, so that the locking tab 950 physically contacts and exerts a resultant force upon a typical spring biased tab 22 of a corresponding standard high definition multimedia interface receptacle 20 into which the locking plug 900 has been inserted. FIG. 53 depicts a side cross section view of a portion of the embodiment of the releasably engaging high definition multimedia interface plug 900 after actuation. A first position 961 may correspond to a locked position 961, depicted in FIG. 2. However a locked position may also correspond to the location and functionality of a wedge actuator 965 during actuation. Movement of an actuator 965 in a first axial direction relative to the body, such as direction 967, places the actuator 965 into engagement with the locking tab 950.

As depicted in FIG. 51, when the wedge actuator 965 is slidably moved in a direction 968 toward the connector body 905, the wedge actuator 965 obtains a position, such as a second position 970, where the wedge actuator 965 is not in contact with the locking tab 950 and the locking tab 950 resides substantially within the opening 930 of the body 905. It should be appreciated that embodiments of a high definition multimedia interface plug 900 may include an actuator 965 that is configured such that the actuator 965 is operable with the body 905 such that movement of the actuator in a direction away from the body 905, as opposed to towards the body 905, places the actuator 965 in a location where it is not in contact with the locking tab 950 and the locking tab 950 resides substantially within the opening 930 of the body 905 in a second position 970. A second position 970 may be a position of the wedge actuator 965, wherein the wedge actuator 965 resides in a position away from the locking tab 950, so that the locking tab 950 does not contact the typical spring biased tab 22 of the corresponding standard high definition multimedia interface receptacle 20 into which the locking plug 900 has been inserted. Movement of an actuator 965 in a second opposite axial direction relative to the body, such as direction 968, may locate the actuator 965 so that it is not in engagement with the locking tab 950.

A locking tab 950 of a releasably engaging high definition multimedia interface plug 900 may be configured to be moved by an actuator, such as a wedge actuator 965. For example, as depicted in FIG. 52, embodiments of a wedge actuator 965 may include a ramped forward edge 969. The ramped forward edge 969 may help operable contact between the wedge actuator 965 and the locking tab 950. For instance, the narrowest portion of the ramped forward edge 969 of the wedge actuator 965 may make initial contact with the locking tab 950 during actuation as the wedge actuator 965 is moved in a direction 967 away from the main plug body 905 and toward a first position 960 (see FIG. 53). The ramp of the forward edge 969 may help to control the bias of the locking tab 950 as the wedge actuator 965 is wedged under the locking tab 950. Conversely, the ramp of the forward edge 969 may help to control unbiasing of the locking tab 950 as the wedge actuator 965 is moved in a direction 968 toward the main plug body 905 and ultimately into a second position 970.

The actuator 965 is located to move the locking tab 950 into or out of engagement with a typical opening 25 of a standard high definition multimedia interface receptacle 20, such as depicted in FIGS. 1-4. The flexible engagement member 952 of or operable with the locking tab 950 may bend upward allowing the protrusion of the locking tab 950 to be maneuvered into the hole 25 of a standard high definition multimedia interface receptacle 20 and thereby help to engage the receptacle 20 and secure the plug 900 to the receptacle 20. When engaged in a secure manner the wedge actuator 965 may reside in locked position 961.

Embodiments of a releasably engaging high definition multimedia interface plug 900 may include means for locating the locking tab 950, so that the locking tab 950 protrudes from the opening 930 of the extension 920 and physically contacts and exerts a resultant force upon a typical spring biased tab 22 of the corresponding standard high definition multimedia interface receptacle 20 into which the locking plug 900 has been inserted. Moreover, embodiments of a releasably engaging high definition multimedia interface plug 900 may include means for locating the locking tab 950, so that the locking tab 950 does not contact the typical spring biased tab 22 of the corresponding standard high definition multimedia interface receptacle 20 into which the locking plug 900 has been inserted. The means for locating the locking tab 950 may be any actuator, such as, for example, a wedge actuator 965, that is operable with embodiments of the present invention to move a locking tab, such as, for example, locking tab 950. In addition, the means for locating the locking tab 950 may interact with a lock button, such as, for example, lock button 140 depicted in FIG. 5. Furthermore, the means for locating the locking tab 950 may be operable to move the locking tab 950 into or out of engagement with a typical opening 25 of a standard high definition multimedia interface receptacle 20.

With continued reference to the all the drawings, and particularly FIGS. 49-54, a method of releasably securing a high definition multimedia interface plug 900 to a standard high definition multimedia interface receptacle 20 is described. The methodology may include a step of providing a releasably engaging high definition multimedia interface plug 900. The interface plug 900 may include a connector body 905 having an opening 930. In addition the interface plug 900 may include a wedge actuator 965 operable with the connector body 905, and a locking tab 950 configured to be moved by the wedge actuator 965. A first position 160 of the wedge actuator 965 may pertain to the interface plug 900, wherein the wedge actuator 965 is locatable below the locking tab 950. Moreover, a second position 170 of the wedge actuator 965 may pertain to the interface plug 900, wherein the wedge actuator 965 is locatable in a position away from the locking tab 950. A further methodological step may include moving the wedge actuator 965 so that the wedge actuator 965 obtains a position 970 where it is not in contact with the locking tab 950 and the locking tab 950 resides substantially within the opening 930 of the body 905 and so that the locking tab 950 will not contact the typical spring biased tab 22 of the corresponding standard high definition multimedia interface receptacle 20 into which the releasably engaging plug 900 is insertable. Another methodological step may include inserting the releasably engaging high definition multimedia interface plug 900 into a corresponding standard high definition multimedia interface receptacle 20. Once inserted, a further methodological step may include moving the wedge actuator 965 in a direction 967 away from the plug body 905, so that the wedge actuator 965 obtains a position 960 where it is wedged below the locking tab 950 and the locking tab 950 is biased to protrude from the opening 930 of the body 905 and so that the locking tab 950 physically contacts and exerts a resultant force upon a typical spring biased tab 22 of the corresponding standard high definition multimedia interface receptacle 20 into which the releasably engaging plug 900 is inserted, thereby releasably securing the plug 900 within the receptacle 20.

To release the plug 900 from its secure connection with the receptacle 20, further methodology may include again moving the wedge actuator 965 so that the wedge actuator 965 obtains a position 970 where it is not in contact with the locking tab 950 and the locking tab 950 resides substantially within the opening 930 of the body 905 and so that the locking tab 950 will not contact the typical spring biased tab 22 of the corresponding standard high definition multimedia interface receptacle 20 into which the releasably engaging plug 900 has been inserted. Then the methodology for releasably engaging a high definition multimedia interface plug 900 with a standard high definition multimedia receptacle 20 may include removing the releasably engaging high definition multimedia interface plug 900 from the corresponding standard high definition multimedia interface receptacle 20.

Figure 55:
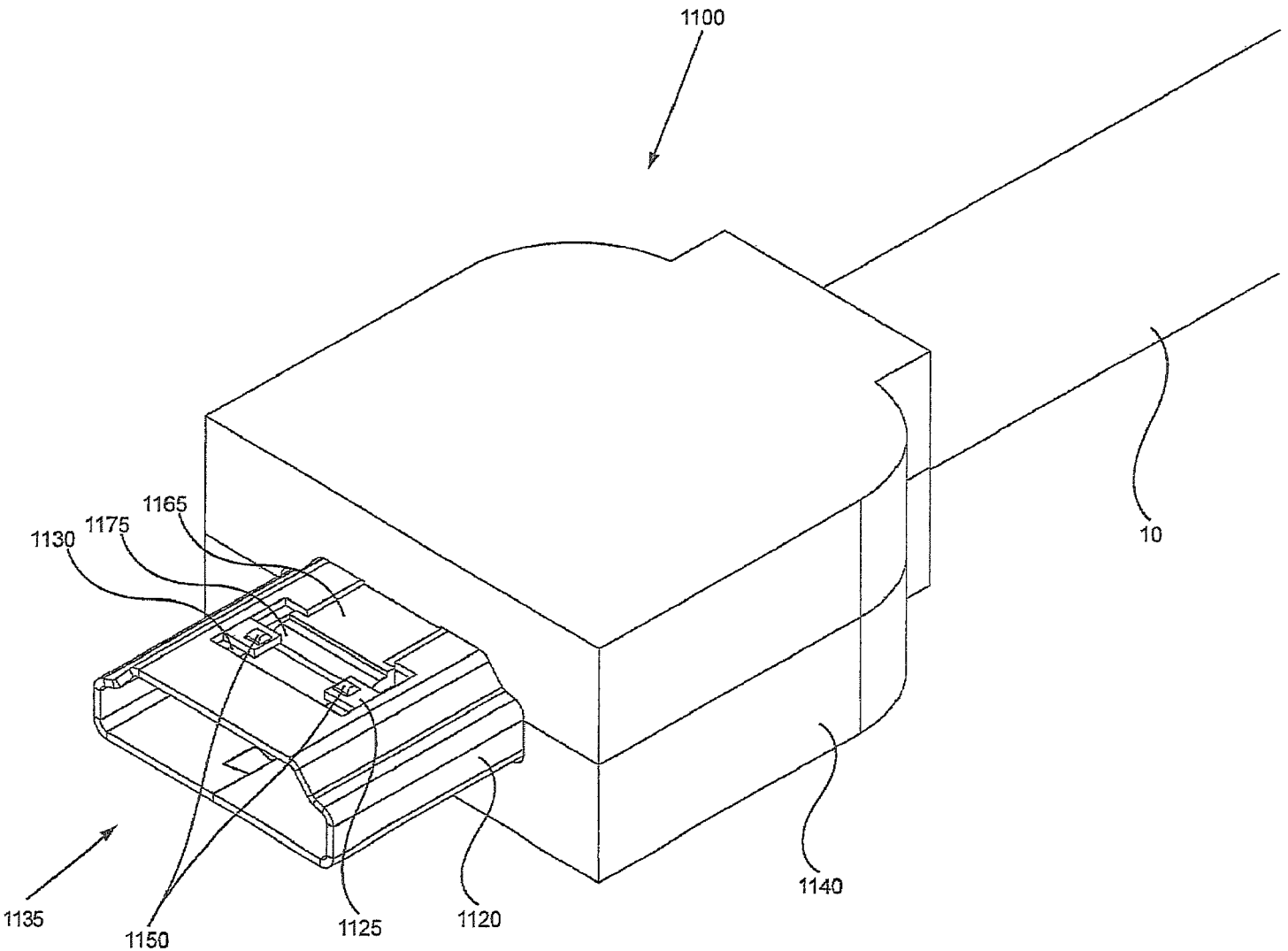
FIG. 55 depicts a perspective view of an embodiment of a releasably locking high definition multimedia interface plug in an unlocked position, according to the present invention.

FIG. 55 depicts a perspective view of an embodiment of a releasably locking high definition multimedia interface plug 1100, according to the present invention. The releasably locking high definition multimedia interface plug 1100 may be used for connecting high definition multimedia interface cable 10 to high definition electronic components having standard high definition multimedia interface receptacles, such as receptacle 20 depicted in FIGS. 1-4. As such, embodiments of a releasably engaging high definition multimedia interface plug 1100 may include many similar structural features and similar functional operability as other embodiments of locking releasably engaging high definition multimedia interface plugs 100/200/300/400/500/600/700/800/900 previously described. Accordingly, the releasably locking high definition multimedia interface plug 1100 comprises a connector body associated with or coupled to both a lock button 1140 and a high definition multimedia interface cable 10, a high definition multimedia interface connection end 1135, a body extension member 1120 having an opening 1130 therein, locking tab(s) 1150 coupled to flexible engagement member(s) 1125 where the flexible engagement member(s) 1125 is coupled to the body extension member 1120, and an actuator 1165 having a ramped portion of a forward edge 1175.

Figure 58:
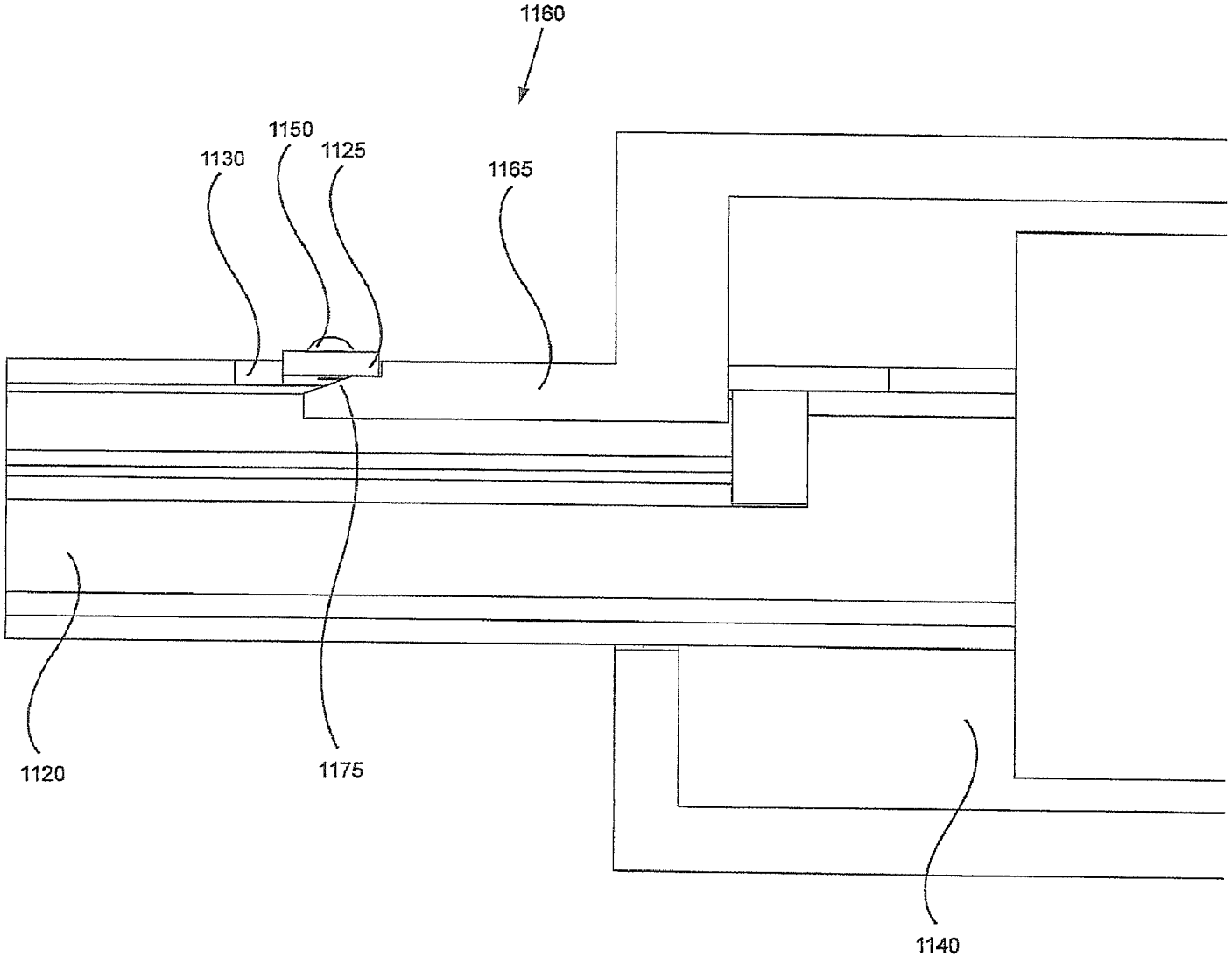
FIG. 58 depicts a cutaway side view of an embodiment of the releasably locking high definition multimedia interface plug of FIG. 55 in a locked position.
Figure 59:
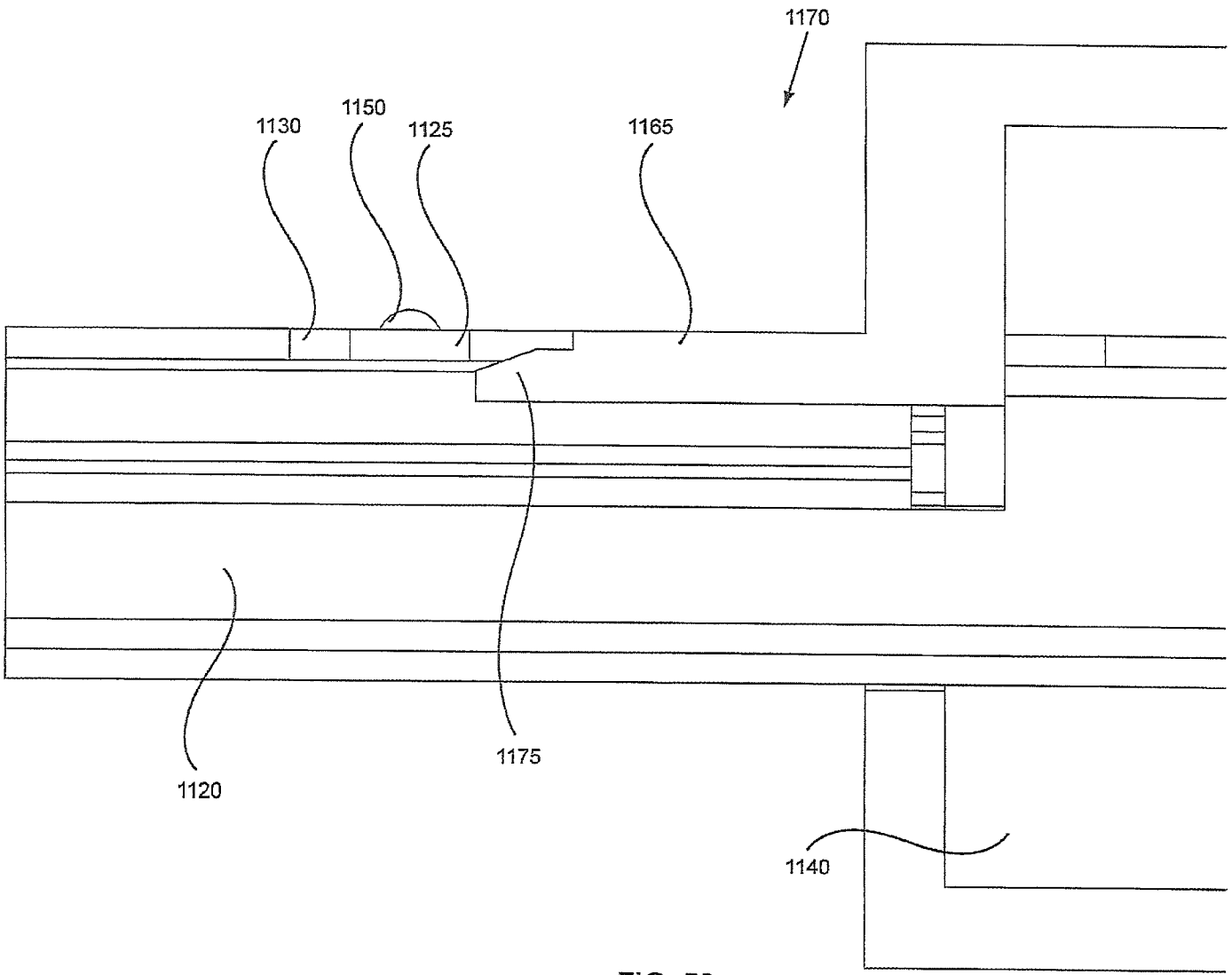
FIG. 59 depicts a cutaway side view of an embodiment of the releasably locking high definition multimedia interface plug of FIG. 55 in an unlocked position.

The lock button 1140 is configured to be manipulated by a user in an up, down, or sideways motion to work upon the actuator 1165 and cause the actuator 1165 to move the locking tab(s) 1150 between a locked position 1160 (see FIG. 58) and an unlocked position 1170 (see FIG. 59). The lock button 1140 may be integrally formed with actuator 1165, or may be separately attached to the actuator 1165 and located to contact or otherwise be configured to afford work upon the actuator 1165 in some operable manner. The actuator 1165 may be positioned to be slidably movable below the flexible engagement members(s) 1125 of the interface plug 1100. The ramped portion of the forward edge 1175 of the actuator 1165 may operate with the flexible engagement member(s) 1125 such that when the ramped portion of the forward edge 1175 of actuator 1165 physically contacts and exerts a resultant force upon the flexible engagement members(s) 1125, the locking tab(s) 1150 coupled to the flexible engagement member(s) 1125 are operably positioned to protrude into and engage the typical sidewall opening 25 of a corresponding standard high definition multimedia interface receptacle 20 into which the locking plug 1100 has been inserted.

Figure 56:
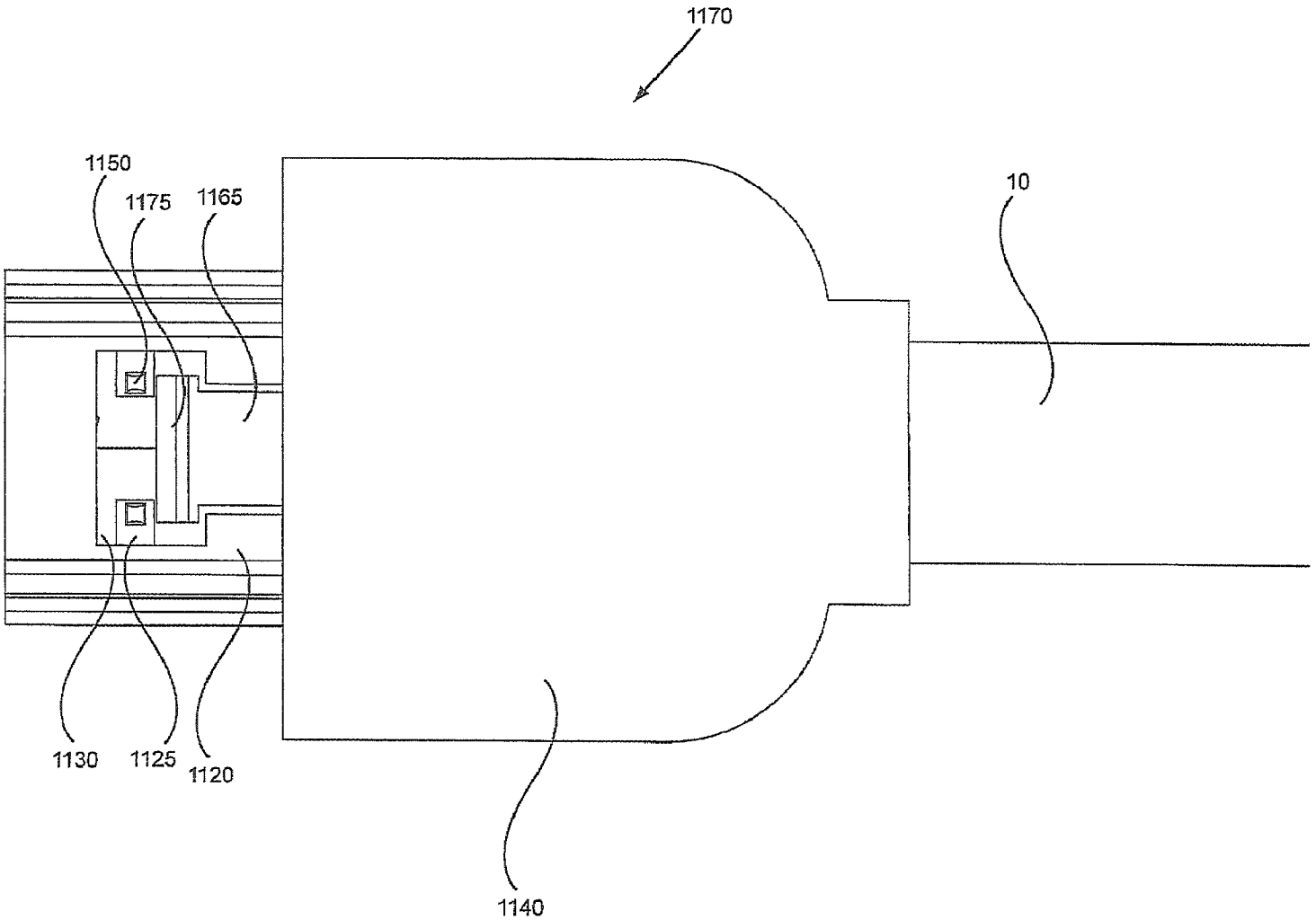
FIG. 56 depicts a top view of an embodiment of the releasably locking high definition multimedia interface plug of FIG. 55 in an unlocked position.

FIGS. 55, 56 and 59 depict multiple views of an embodiment of the releasably locking high definition multimedia interface plug 1100 of FIG. 55 in an unlocked position 1170. When the actuator 1165 is slidably moved in an axial direction away from the high definition multimedia interface connection end 1135 and toward the connector body and high definition multimedia interface cable 10, the actuator 1165 obtains an unlocked position 1170 where the ramped portion of the forward edge 1175 of the actuator 1165 is not in contact with the flexible engagement member(s) 1125. As a result, the locking tab(s) 1150 coupled to the flexible engagement member(s) 1125 is not biased and therefore resides substantially within the opening 1130 in the body extension member 1120 of releasably locking high definition multimedia interface plug 1100. However, those in the art should appreciate that the components of the high definition multimedia interface plug 1100 may be oppositely configured such that movement of the actuator 1165 in an axial direction towards the high definition multimedia interface connection end 1135 and away from the connector body and high definition multimedia interface cable 10 permits the connector components to obtain an unlocked position 1170 where the ramped portion of the forward edge 1175 of the actuator 1165 is not in contact with the flexible engagement member(s) 1125.

Figure 57:
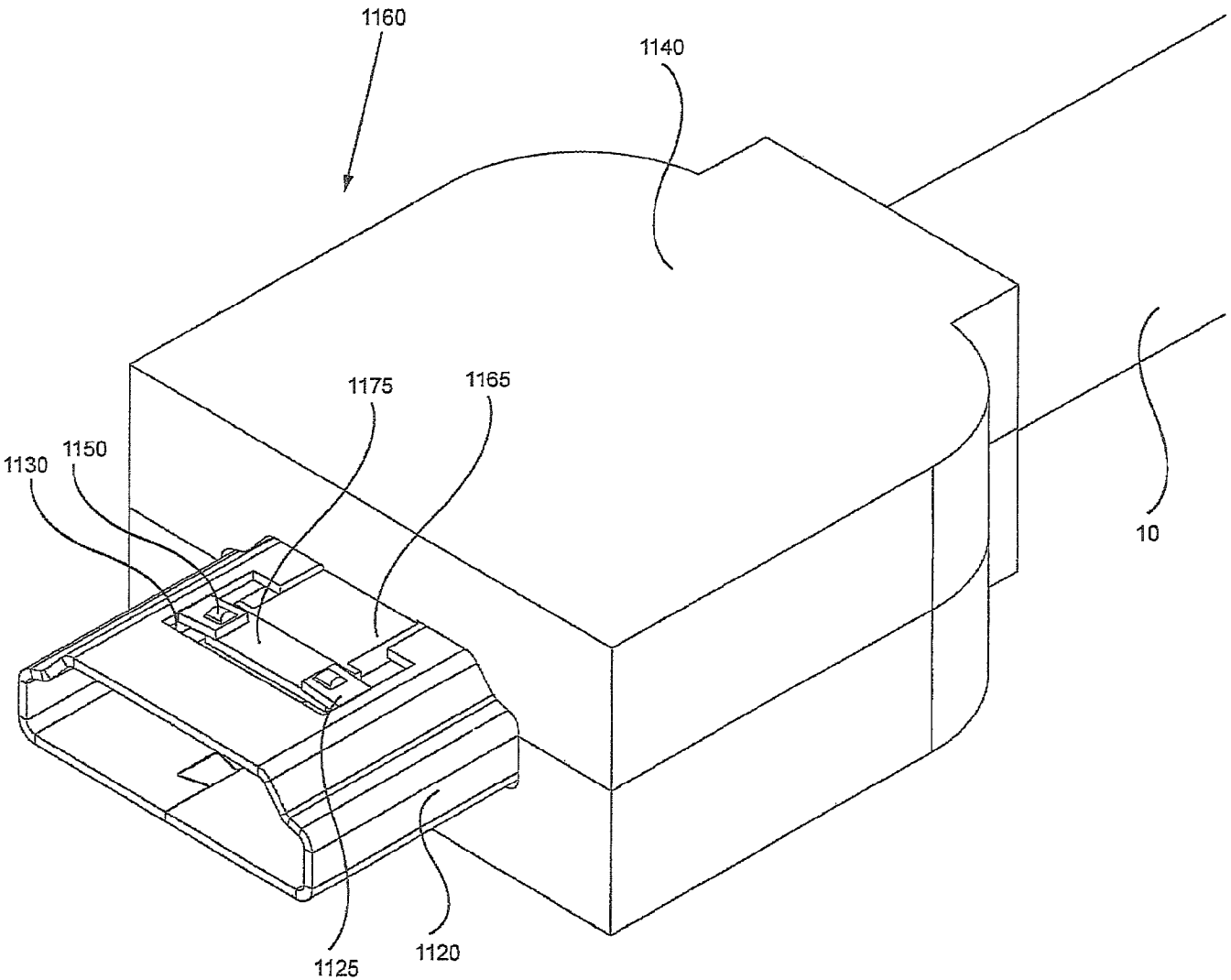
FIG. 57 depicts a perspective view of an embodiment of the releasably locking high definition multimedia interface plug of FIG. 55 in a locked position.

FIGS. 57 and 58 depict multiple views of an embodiment of the releasably locking high definition multimedia interface plug 1100 of FIG. 55 in a locked position 1160. When the actuator 1165 is slidably moved in an axial direction towards the high definition multimedia interface connection end 1135 and away from the connector body and high definition multimedia interface cable 10, the actuator 1165 obtains a locked position 1160 where the ramped portion of the forward edge 1175 of the actuator 1165 contacts the flexible engagement member(s) 1125. The flexible engagement member(s) 1125 coupled with the locking tab(s) 1150 may bend or be biased upward allowing protrusion of the locking tab(s) 1150 to be maneuvered into the typical sidewall opening 25 of a standard high definition multimedia interface receptacle 20 and thereby help to engage the receptacle 20 and secure the plug 1100 to the receptacle 20. The flexible engagement member(s) 1125 is coupled to the body extension member 1120 in such a way that when in contact with the ramped portion of the forward edge 1175 of the actuator 1165, the flexible engagement member(s) 1125 bias along a plane which is not parallel to the axial direction which the actuator 1165 may be slidably moved. When engaged in a secure manner the actuator 1165 may reside in the locked position 1160.

Embodiments of a releasably engaging high definition multimedia interface plug 1100 may include means for locating the locking tab(s) 1150, so that the locking tab(s) 1150 protrudes from the opening 1130 of body extension member 1120 and physically extends into and engages a typical sidewall opening 25 of the corresponding standard high definition multimedia interface receptacle 20 into which the locking plug 1100 has been inserted. Moreover, embodiments of a releasably engaging high definition multimedia interface plug 1100 may include means for locating the locking tab(s) 1150, so that the locking tab(s) 1150 does not extend into engagement with the typical sidewall opening 25 of the corresponding standard high definition multimedia interface receptacle 20 into which the locking plug 1100 has been inserted. The means for locating the locking tab(s) 1150 may be an actuator 1165 having a ramped portion of a forward edge 1175 that is operable with embodiments of the present invention to move a locking tab(s) 1150. In addition, the means for locating the locking tab(s) 1150 may interact with the button 1140. Furthermore, the means for locating the locking tab(s) 1150 may be operable to move the locking tab(s) 1150 to contact and exert a resultant force upon a typical spring biased tab 22 of a standard high definition multimedia interface receptacle 20.

With continued reference to the all the drawings, and particularly FIGS. 55-59, a method of releasably securing a high definition multimedia interface plug 1100 to a standard high definition multimedia interface receptacle 20 is described. The methodology may include a step of providing a releasably engaging high definition multimedia interface plug 1100 comprising a connector body associated with or coupled to both a lock button 1140 and a high definition multimedia interface cable 10, a high definition multimedia interface connection end 1135, a body extension member 1120 having an opening 1130 therein, locking tab(s) 1150 coupled to flexible engagement member(s) 1125 where the flexible engagement member(s) 1125 is coupled to the body extension member 1120, and an actuator 1165 having a ramped portion of a forward edge 1175.

A locked position 1160 of the actuator 1165 may pertain to the interface plug 1100, wherein the ramped portion of the forward edge 1175 of the actuator 1165 is locatable below the flexible engagement member(s) 1125. Moreover, an unlocked position 1170 of the actuator 1165 may pertain to the interface plug 1100, wherein the ramped portion of the forward edge 1175 of the actuator 1165 is locatable in a position away from the flexible engagement member(s) 1125.

A further methodological step may include moving the actuator 1165, by means of the button 1140, so that the ramped portion of the forward edge 1175 of the actuator 1165 obtains an unlocked position 1170 where it is not in contact with the flexible engagement member(s) 1125 and the locking tab(s) 1150 resides substantially within the opening 1130 of the body extension member 1120 and so that the locking tab(s) 1150 does not engage the typical sidewall opening 25 of a corresponding standard high definition multimedia interface receptacle 20 into which the releasably engaging high definition multimedia interface plug 1100 is inserted and so that the locking tab(s) 1150 will not contact the typical spring biased tab 22 of the corresponding standard high definition multimedia interface receptacle 20.

Another methodological step may include inserting the releasably engaging high definition multimedia interface plug 1100 into a corresponding standard high definition multimedia interface receptacle 20. Once inserted, a further methodological step may include moving the ramped portion of the forward edge 1175 of the actuator 1165 in a direction away from the plug body and towards the high definition multimedia interface connection end 1135, so that the ramped portion of the forward edge 1175 of the actuator 1165 obtains a locked position 1160 where it is wedged below the flexible engagement member(s) 1125 and the locking tab(s) 1150 residing on the flexible engagement member(s) 1125 is biased to protrude from the opening 1130 of the body extension member 1120 and so that the locking tab(s) 1150 extends into engagement with the typical sidewall opening 25 of the corresponding standard high definition multimedia interface receptacle 20 into which the releasably engaging plug 1100 is inserted, thereby releasably securing the plug 1100 within the receptacle 20. The locking tab(s) 1150 may also physically contact and exert a resultant force upon the typical spring biased tab(s) 22 of the standard high definition multimedia interface receptacle 20.

To release the plug 1100 from its secure connection with the receptacle 20, further methodology may include again moving the ramped portion of the forward edge 1175 of the actuator 1165 so that the actuator 1165 obtains an unlocked position 1170 where it is not in contact with the flexible engagement member(s) 1125 and the locking tab(s) 1150 residing on the flexible engagement member(s) 1125 resides substantially within the opening 1130 of the body extension member 1120 and so that the locking tab(s) 1150 do not engage the typical sidewall opening 25 of the corresponding standard high definition multimedia interface receptacle 20 into which the releasably engaging high definition multimedia interface plug 1100 has been inserted, and so that the locking tab(s) 1150 will not contact the typical spring biased tab 22 of the corresponding standard high definition multimedia interface receptacle 20. Then the methodology for releasably engaging a high definition multimedia interface plug 1100 with a standard high definition multimedia receptacle 20 may include removing the releasably engaging high definition multimedia interface plug 1100 from the corresponding standard high definition multimedia interface receptacle 20.

Figure 60:
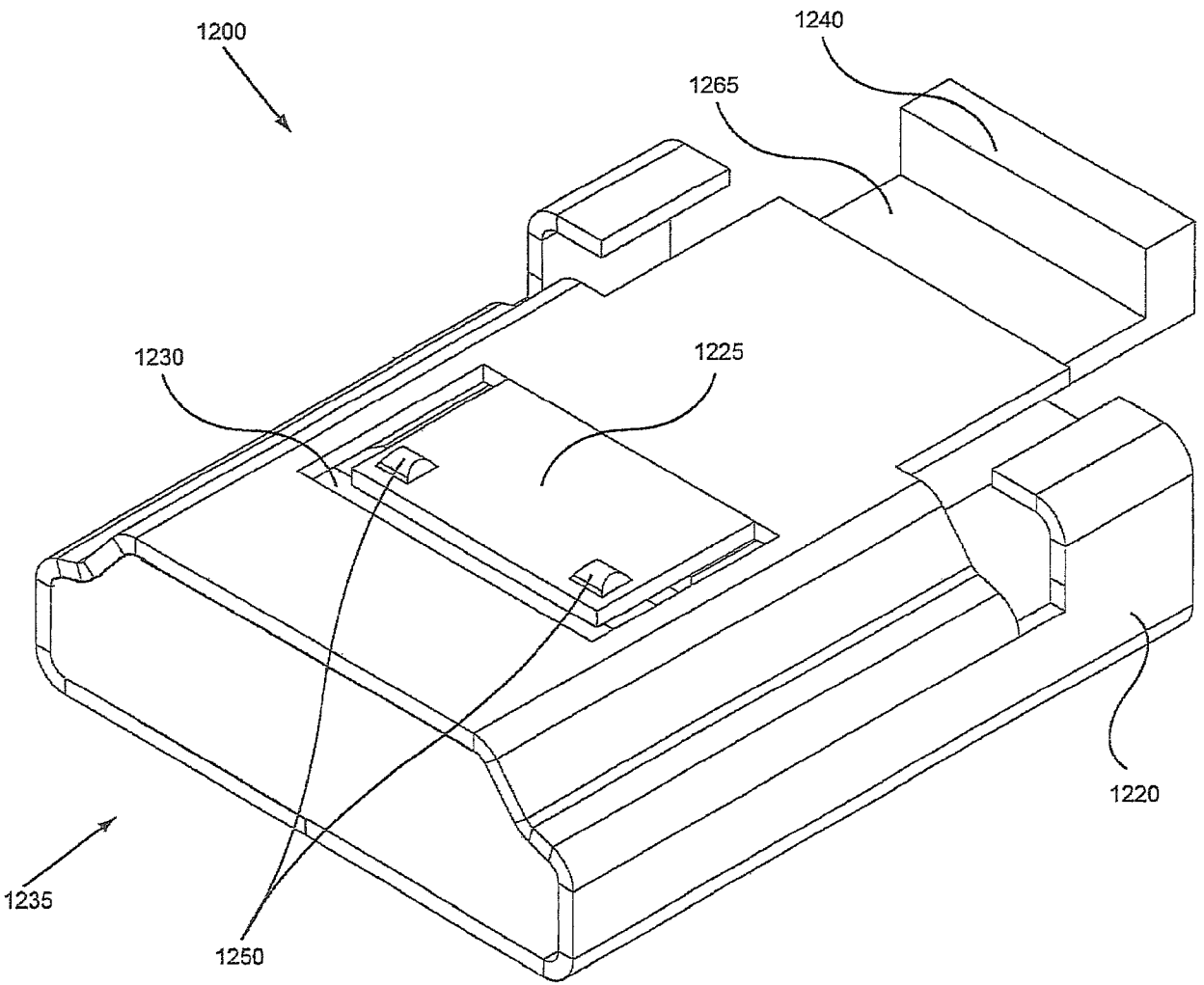
FIG. 60 depicts a perspective view of an embodiment of a releasably locking high definition multimedia interface plug in an unlocked position, according to the present invention.

FIG. 60 depicts a perspective view of an embodiment of a releasably locking high definition multimedia interface plug 1200, according to the present invention. The releasably locking high definition multimedia interface plug 1200 may be used for connecting high definition multimedia interface cable 10 to high definition electronic components having standard high definition multimedia interface receptacles, such as receptacle 20 depicted in FIGS. 1-4. As such, embodiments of a releasably engaging high definition multimedia interface plug 1200 may include many similar structural features and similar functional operability as other embodiments of locking releasably engaging high definition multimedia interface plugs 100/200/300/400/500/600/700/800/900/1100 previously described. Accordingly, the releasably locking high definition multimedia interface plug 1200 comprises a lock button 1240, a high definition multimedia interface connection end 1235, a body extension member 1220 having an opening 1230 therein, locking tab(s) 1250 coupled to flexible engagement member 1225 where the flexible engagement member 1225 is coupled to the body extension member 1220, and an actuator 1265 having a forward edge 1275.

Figure 62:
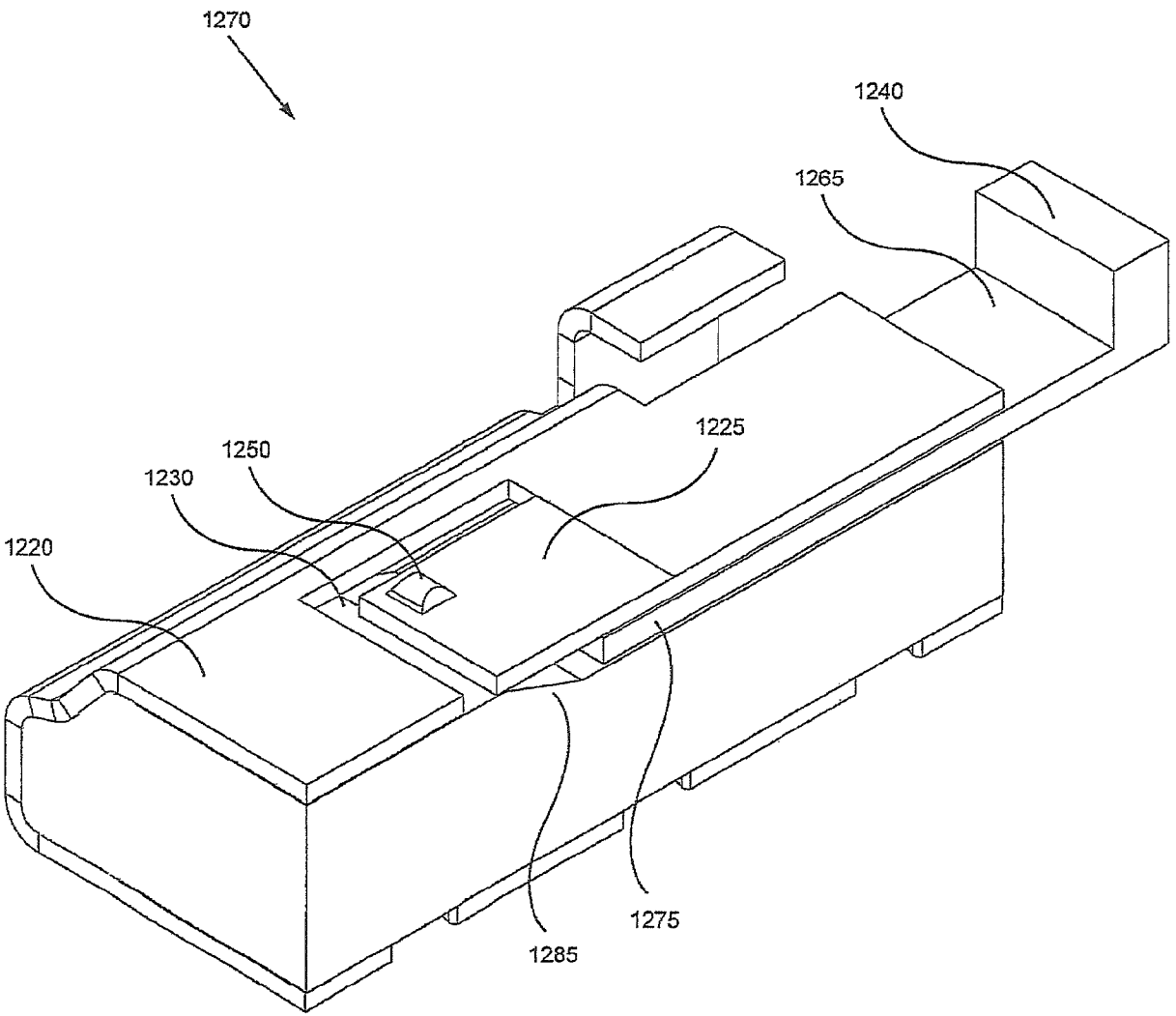
FIG. 62 depicts a cutaway perspective view of an embodiment of the releasably locking high definition multimedia interface plug of FIG. 60 in an unlocked position.

The lock button 1240 is configured to be manipulated by a user in an up, down, or sideways motion to work upon the actuator 1265 and cause the actuator 1265 to move the locking tab(s) 1250 between a locked position 1260 (see FIG. 63) and an unlocked position 1270 (see FIG. 62). The lock button 1240 may be integrally formed with actuator 1265, or may be separately attached to the actuator 1265 and located to contact or otherwise be configured to afford work upon the actuator 1265 in some operable manner. The actuator 1265 may be positioned to be slidably movable below the flexible engagement members(s) 1225 of the interface plug 1200. The forward edge 1275 of the actuator 1265 may operate with the ramped inner surface 1285 of the body extension member 1220 such that when the forward edge 1275 of the actuator 1265 physically contacts the ramped inner surface 1285 of the body extension member 1220 the forward edge 1275 is biased in an upwards position and exerts a resultant force upon the flexible engagement member 1225. The locking tab(s) 1250 coupled to the flexible engagement member 1225 are operably positioned to protrude into and engage the typical sidewall opening 25 of a corresponding standard high definition multimedia interface receptacle 20 into which the locking plug 1200 has been inserted.

Figure 64:
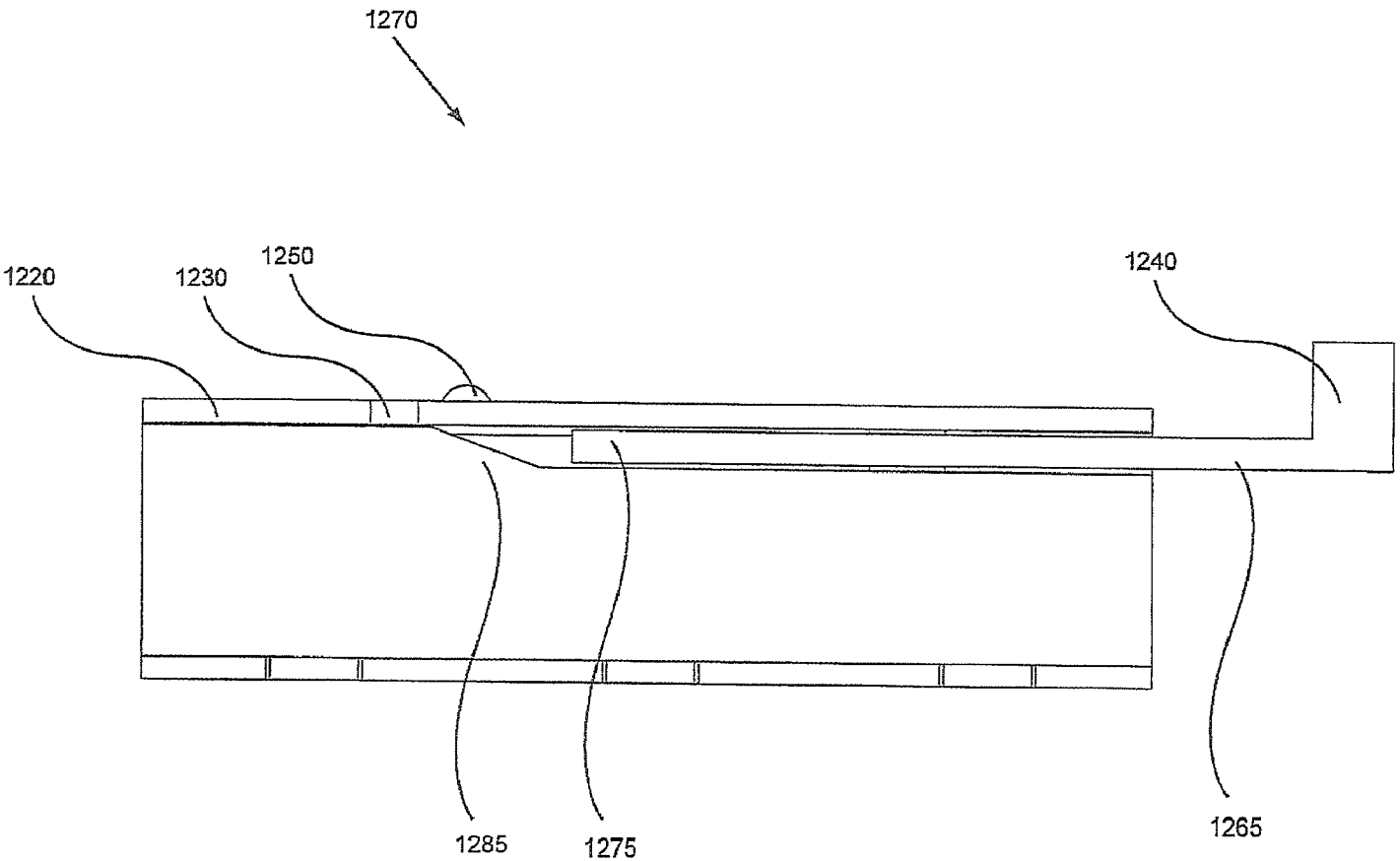
FIG. 64 depicts a cutaway side view of an embodiment of the releasably locking high definition multimedia interface plug of FIG. 60 in an unlocked position.

FIGS. 60, 62 and 64 depict multiple views of an embodiment of the releasably locking high definition multimedia interface plug 1200 of FIG. 60 in an unlocked position 1270. When the actuator 1265 is slidably moved in an axial direction away from the high definition multimedia interface connection end 1235 and toward the connector body and high definition multimedia interface cable 10, the actuator 1265 obtains an unlocked position 1270 where the forward edge 1275 of the actuator 1265 is not in contact with the ramped inner surface 1285 of the body extension member 1220 nor is the actuator 1265 in contact with the flexible engagement member 1225. As a result, the locking tab(s) 1250 coupled to the flexible engagement member 1225 is not biased and therefore resides substantially within the opening 1230 in the body extension member 1220 of releasably locking high definition multimedia interface plug 1200. However, those in the art should appreciate that the components of the high definition multimedia interface plug 1200 may be oppositely configured such that movement of the actuator 1265 in an axial direction towards the high definition multimedia interface connection end 1235 and away from the connector body and high definition multimedia interface cable 10 permits the connector components to obtain an unlocked position 1270 where the forward edge 1275 of the actuator 1265 is not in contact with the flexible engagement member 1225.

Figure 61:
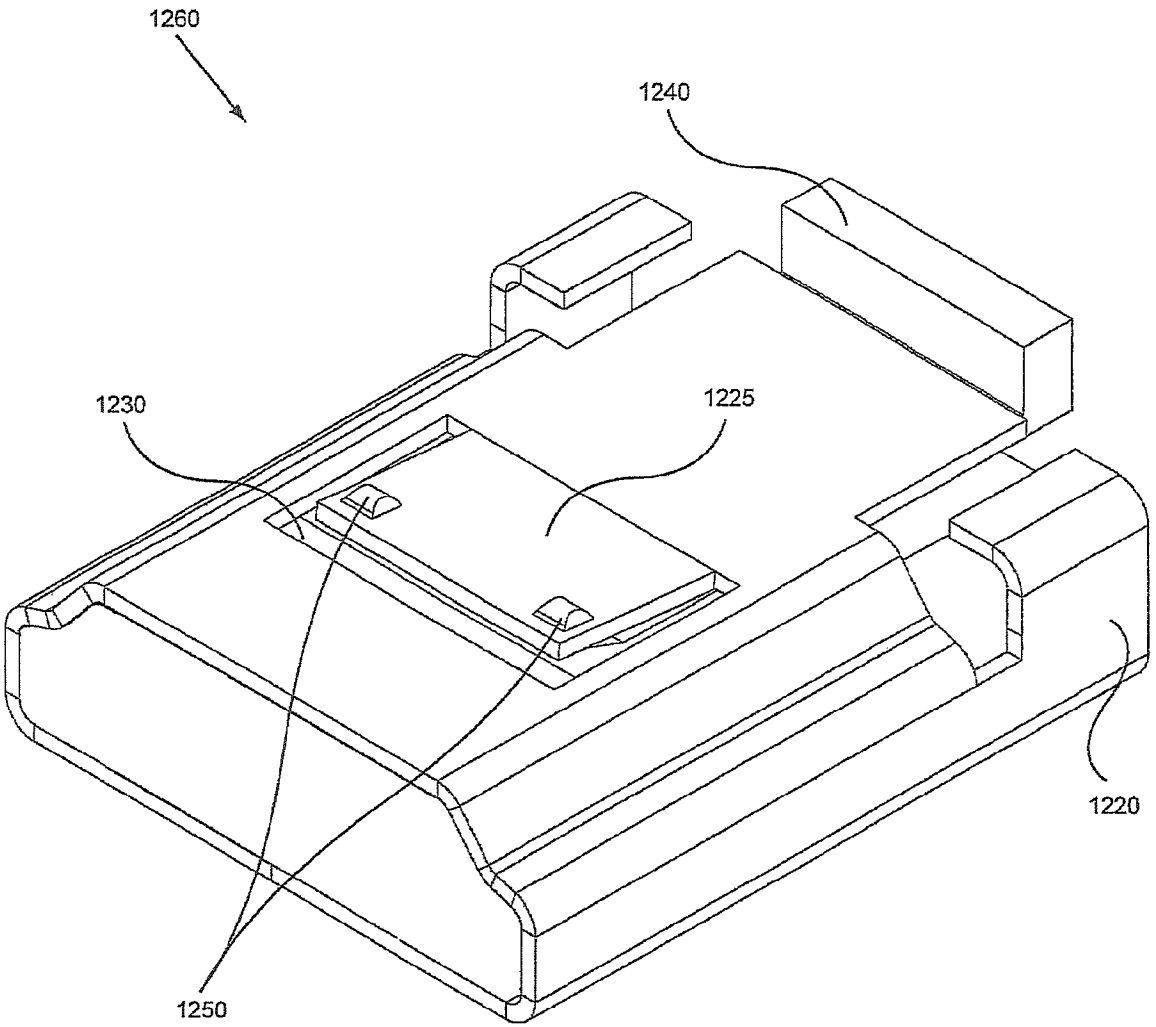
FIG. 61 depicts a perspective view of an embodiment of the releasably locking high definition multimedia interface plug of FIG. 60 in a locked position.
Figure 63:
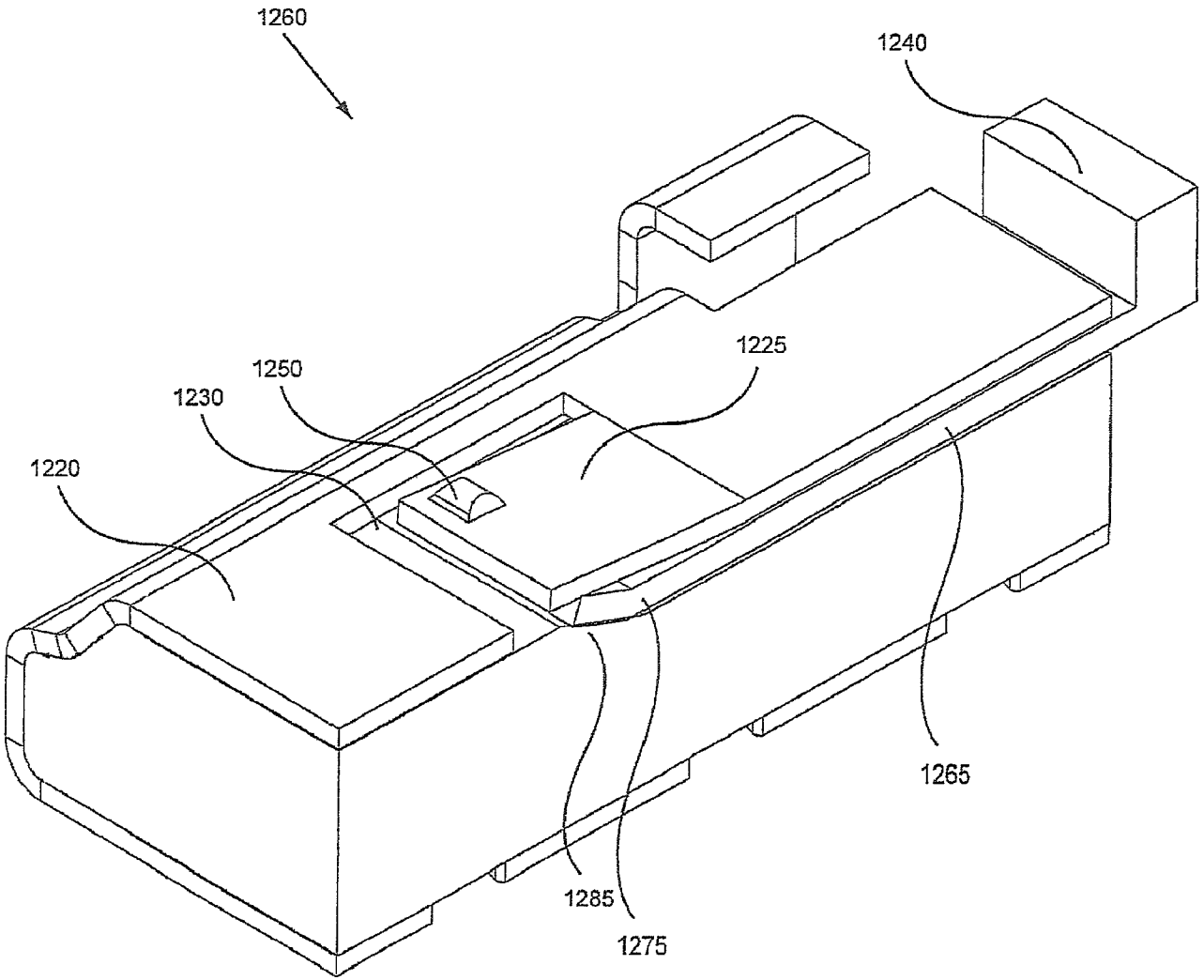
FIG. 63 depicts a cutaway perspective view of an embodiment of the releasably locking high definition multimedia interface plug of FIG. 60 in a locked position.
Figure 65:
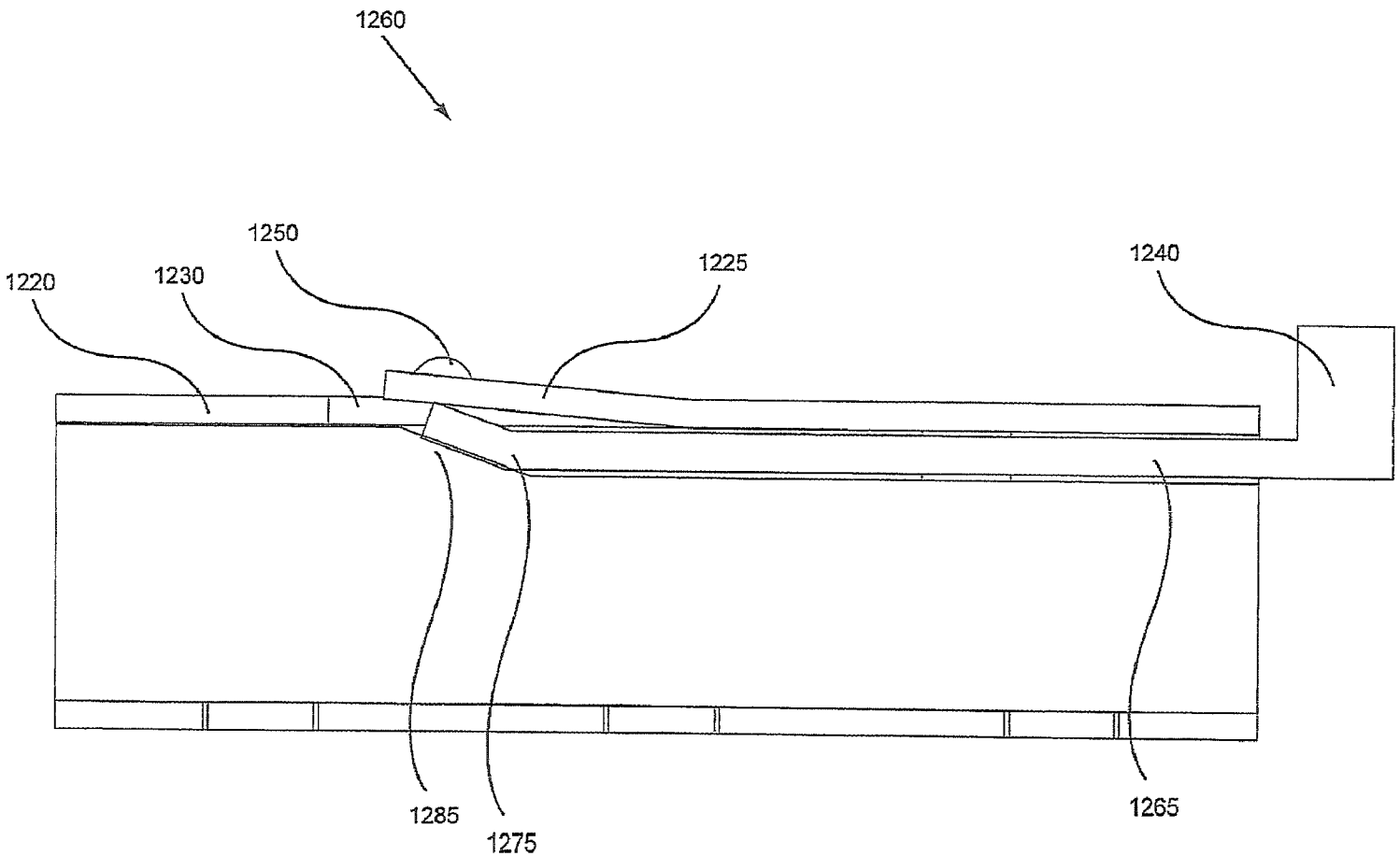
FIG. 65 depicts a cutaway side view of an embodiment of the releasably locking high definition multimedia interface plug of FIG. 60 in a locked position.

FIGS. 61, 63 and 65 depict multiple views of an embodiment of the releasably locking high definition multimedia interface plug 1200 of FIG. 60 in a locked position 1260. When the actuator 1265 is slidably moved in an axial direction towards the high definition multimedia interface connection end 1235 and away from the connector body and high definition multimedia interface cable 10, the actuator 1265 obtains a locked position 1260 where the forward edge 1275 of the actuator 1265 physically contacts the ramped inner surface 1285 of the body extension member 1220. As a result the forward edge 1275 is biased in an upwards position and exerts a resultant force upon the flexible engagement member 1225. The flexible engagement member 1225 coupled with the locking tab(s) 1250 may bend or be biased upward allowing protrusion of the locking tab(s) 1250 to be maneuvered into the typical sidewall opening 25 of a standard high definition multimedia interface receptacle 20 and thereby help to engage the receptacle 20 and secure the plug 1200 to the receptacle 20. When engaged in a secure manner the actuator 1265 may reside in the locked position 1260.

Embodiments of a releasably engaging high definition multimedia interface plug 1200 may include means for locating the locking tab(s) 1250, so that the locking tab(s) 1250 protrudes from the opening 1230 of body extension member 1220 and physically extends into and engages a typical sidewall opening 25 of the corresponding standard high definition multimedia interface receptacle 20 into which the locking plug 1200 has been inserted. Moreover, embodiments of a releasably engaging high definition multimedia interface plug 1200 may include means for locating the locking tab(s) 1250, so that the locking tab(s) 1250 does not extend into engagement with the typical sidewall opening 25 of the corresponding standard high definition multimedia interface receptacle 20 into which the locking plug 1200 has been inserted. The means for locating the locking tab(s) 1250 may be an actuator 1265 having a forward edge 1275 that is operable with embodiments of the present invention to move a locking tab(s) 1250. In addition, the means for locating the locking tab(s) 1250 may interact with the button 1240. Furthermore, the means for locating the locking tab(s) 1250 may be operable to move the locking tab(s) 1250 to contact and exert a resultant force upon a typical spring biased tab 22 of a standard high definition multimedia interface receptacle 20.

With continued reference to the all the drawings, and particularly FIGS. 60-65, a method of releasably securing a high definition multimedia interface plug 1200 to a standard high definition multimedia interface receptacle 20 is described. The methodology may include a step of providing a releasably engaging high definition multimedia interface plug 1200 comprising a lock button 1240, a high definition multimedia interface connection end 1235, a body extension member 1220 having an opening 1230 therein, locking tab(s) 1250 coupled to flexible engagement member 1225 where the flexible engagement member 1225 is coupled to the body extension member 1220, and an actuator 1265 having a forward edge 1275.

A locked position 1260 of the actuator 1265 may pertain to the interface plug 1200, wherein the forward edge 1275 of the actuator 1265 is locatable below the flexible engagement member 1225 and in contact with the ramped inner surface 1285 of the body extension member 1220. Moreover, an unlocked position 1270 of the actuator 1265 may pertain to the interface plug 1200, wherein the forward edge 1275 of the actuator 1265 is locatable in a position away from the ramped inner surface 1285 of the body extension member 1220 and flexible engagement member 1225.

A further methodological step may include moving the actuator 1265, by means of the button 1240, so that the forward edge 1275 of the actuator 1265 obtains an unlocked position 1270 where it is not in contact with the ramped inner surface 1285 nor in contact with the flexible engagement member 1225 and the locking tab(s) 1250 resides substantially within the opening 1230 of the body extension member 1220 and so that the locking tab(s) 1250 not engage the typical sidewall opening 25 of a corresponding standard high definition multimedia interface receptacle 20 into which the releasably engaging high definition multimedia interface plug 1200 is inserted and so that the locking tab(s) 1250 will not contact the typical spring biased tab 22 of the corresponding standard high definition multimedia interface receptacle 20.

Another methodological step may include inserting the releasably engaging high definition multimedia interface plug 1200 into a corresponding standard high definition multimedia interface receptacle 20. Once inserted, a further methodological step may include moving the forward edge 1275 of the actuator 1265 in a direction away from the plug body and towards the high definition multimedia interface connection end 1235, so that the forward edge 1275 of the actuator 1265 obtains a locked position 1260 where it is in contact with both the ramped inner surface 1285 of the body extension member 1220 and the flexible engagement member 1225. The locking tab(s) 1250 residing on the flexible engagement member 1225 is therefore biased to protrude from the opening 1230 of the body extension member 1220 and so that the locking tab(s) 1250 extends into engagement with the typical sidewall opening 25 of the corresponding standard high definition multimedia interface receptacle 20 into which the releasably engaging plug 1200 is inserted, thereby releasably securing the plug 1200 within the receptacle 20. The locking tab(s) 1250 may also physically contact and exert a resultant force upon the typical spring biased tab(s) 22 of the standard high definition multimedia interface receptacle 20.

To release the plug 1200 from its secure connection with the receptacle 20, further methodology may include again moving the forward edge 1275 of the actuator 1265 so that the actuator 1265 obtains an unlocked position 1270 where it is not in contact with both the flexible engagement member 1225 and the ramped inner surface 1285 of the body extension member 1220. The locking tab(s) 1250 residing on the flexible engagement member 1225 resides substantially within the opening 1230 of the body extension member 1220 and so that the locking tab(s) 1250 do not engage the typical sidewall opening 25 of the corresponding standard high definition multimedia interface receptacle 20 into which the releasably engaging high definition multimedia interface plug 1200 has been inserted, and so that the locking tab(s) 1250 will not contact the typical spring biased tab 22 of the corresponding standard high definition multimedia interface receptacle 20. Then the methodology for releasably engaging a high definition multimedia interface plug 1200 with a standard high definition multimedia receptacle 20 may include removing the releasably engaging high definition multimedia interface plug 1200 from the corresponding standard high definition multimedia interface receptacle 20.

Figure 66:
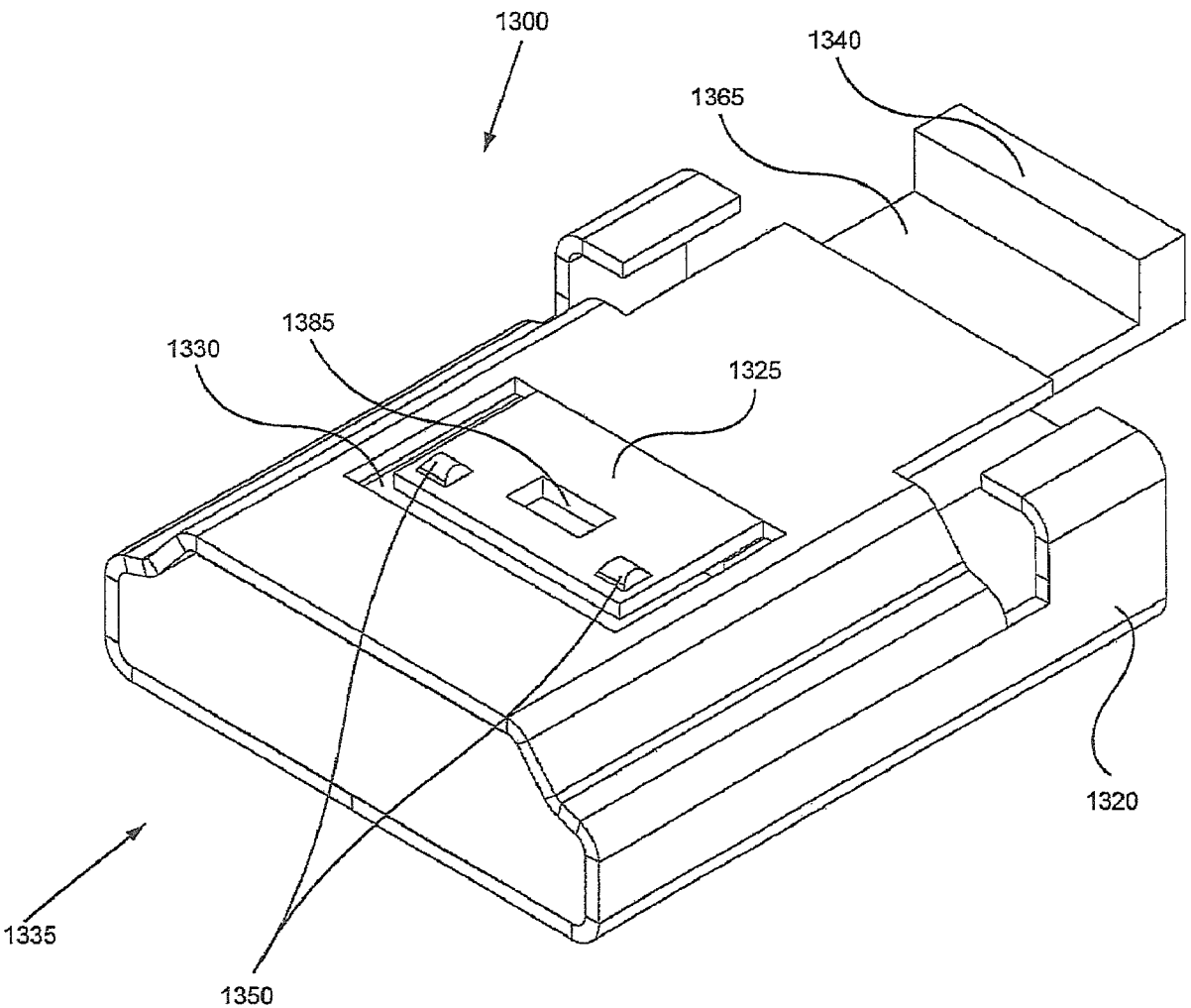
FIG. 66 depicts a perspective view of an embodiment of a releasably locking high definition multimedia interface plug in an unlocked position, according to the present invention.

FIG. 66 depicts a perspective view of an embodiment of a releasably locking high definition multimedia interface plug 1300, according to the present invention. The releasably locking high definition multimedia interface plug 1300 may be used for connecting high definition multimedia interface cable 10 to high definition electronic components having standard high definition multimedia interface receptacles, such as receptacle 20 depicted in FIGS. 1-4. As such, embodiments of a releasably engaging high definition multimedia interface plug 1300 may include many similar structural features and similar functional operability as other embodiments of locking releasably engaging high definition multimedia interface plugs 100/200/300/400/500/600/700/800/900/1100/1200 previously described. Accordingly, the releasably locking high definition multimedia interface plug 1300 comprises a lock button 1340, a high definition multimedia interface connection end 1335, a body extension member 1320 having an opening 1330 therein, locking tab(s) 1350 coupled to flexible engagement member 1325 having a depression 1385 therein, where the flexible engagement member 1325 is coupled to the body extension member 1320, and an actuator 1365 having a forward edge 1375.

The lock button 1340 is configured to be manipulated by a user in an up, down, or sideways motion to work upon the actuator 1365 and cause the actuator 1365 to move the locking tab(s) 1350 between a locked position 1360 (see FIG. 69) and an unlocked position 1370 (see FIG. 66). The lock button 1340 may be integrally formed with actuator 1365, or may be separately attached to the actuator 1365 and located to contact or otherwise be configured to afford work upon the actuator 1365 in some operable manner. The actuator 1365 may be positioned to be slidably movable below the flexible engagement members(s) 1325 of the interface plug 1300. The forward edge 1375 of the actuator 1365 may operate with the depression 1385 of the body extension member 1320 such that when the forward edge 1375 of the actuator 1365 physically contacts the depression 1385 of the flexible engagement member 1325 and said depression 1385 of the flexible engagement member 1325. The locking tab(s) 1350 coupled to the flexible engagement member 1325 are operably positioned to protrude into and engage the typical sidewall opening 25 of a corresponding standard high definition multimedia interface receptacle 20 into which the locking plug 1300 has been inserted.

Figure 67:
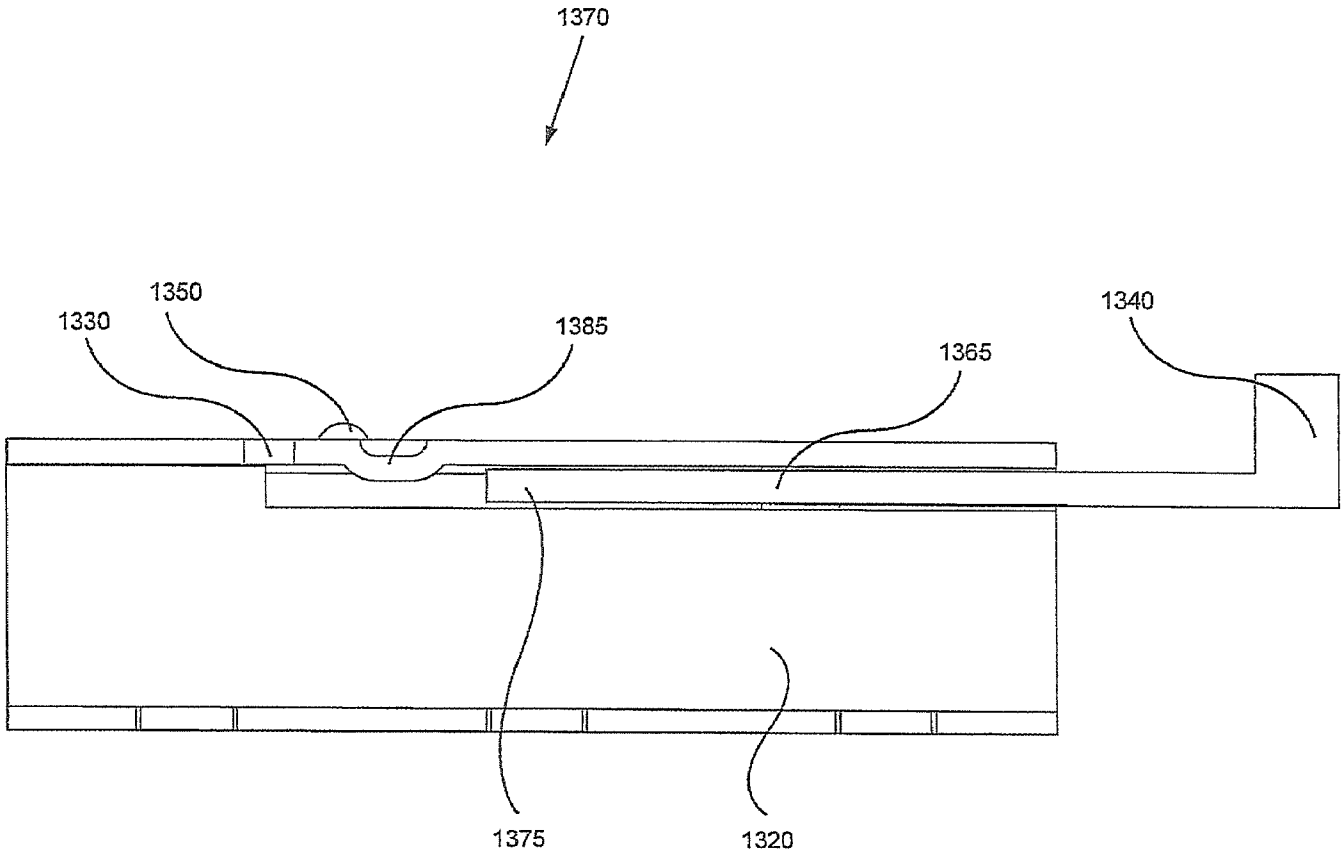
FIG. 67 depicts a cutaway side view of an embodiment of the releasably locking high definition multimedia interface plug of FIG. 66 in an unlocked position.
Figure 68:
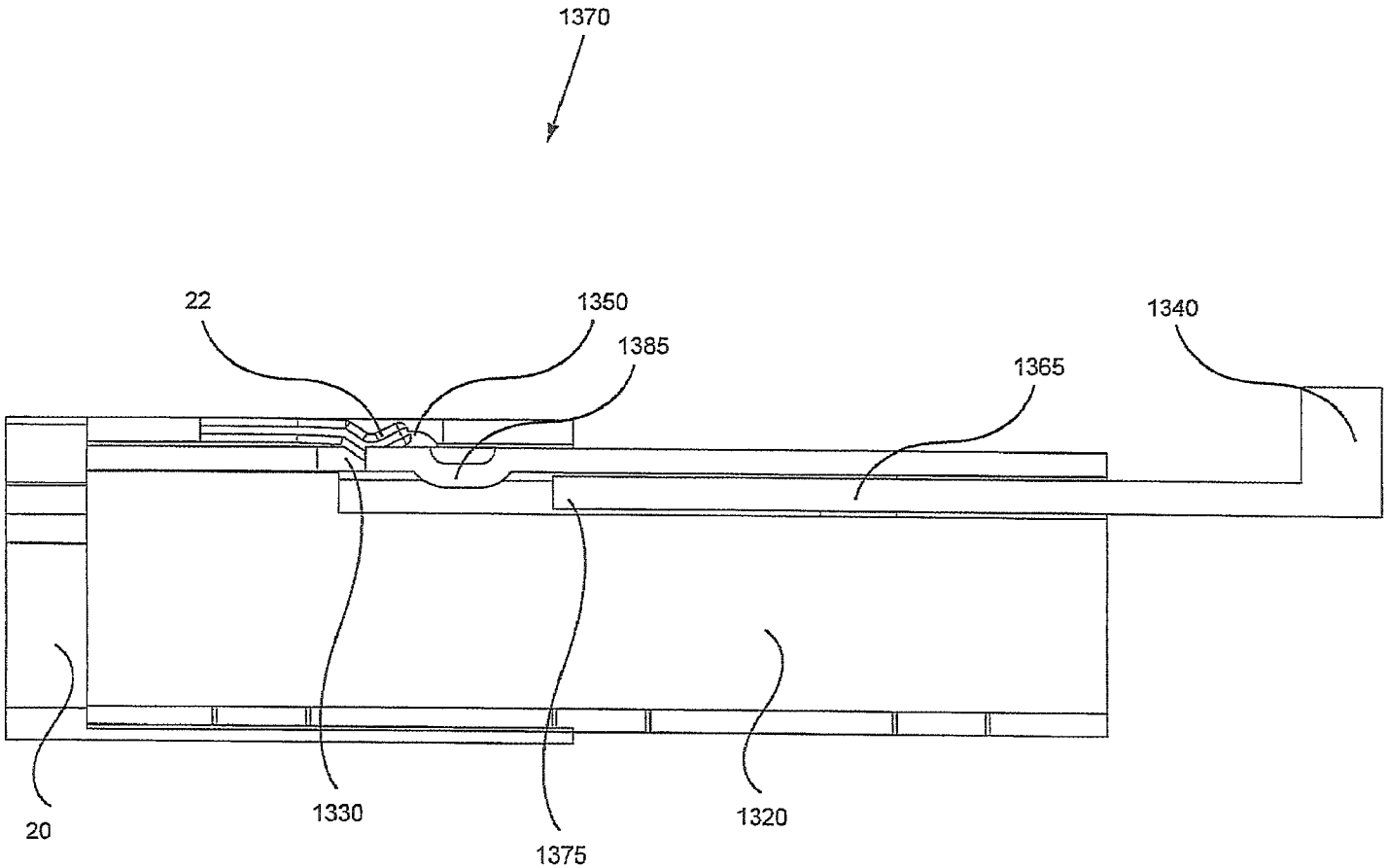
FIG. 68 depicts a cutaway side view of an embodiment of the releasably locking high definition multimedia interface plug of FIG. 66 in an unlocked position and mating with a typical high definition multimedia interface receptacle.

FIGS. 66, 67 and 68 depict multiple views of an embodiment of the releasably locking high definition multimedia interface plug 1300 of FIG. 66 in an unlocked position 1370. When the actuator 1365 is slidably moved in an axial direction away from the high definition multimedia interface connection end 1335 and toward the connector body and high definition multimedia interface cable 10, the actuator 1365 obtains an unlocked position 1370 where the forward edge 1375 of the actuator 1365 is not in contact with the depression 1385 of the flexible engagement member 1325. As a result, the locking tab(s) 1350 coupled to the flexible engagement member 1325 is not biased and therefore resides substantially within the opening 1330 in the body extension member 1320 of releasably locking high definition multimedia interface plug 1300. However, those in the art should appreciate that the components of the high definition multimedia interface plug 1300 may be oppositely configured such that movement of the actuator 1365 in an axial direction towards the high definition multimedia interface connection end 1335 and away from the connector body and high definition multimedia interface cable 10 permits connector components to obtain an unlocked position 1370 where the forward edge 1375 of the actuator 1375 is not in contact with the depression 1385 located in the flexible engagement member 1325.

Figure 69:
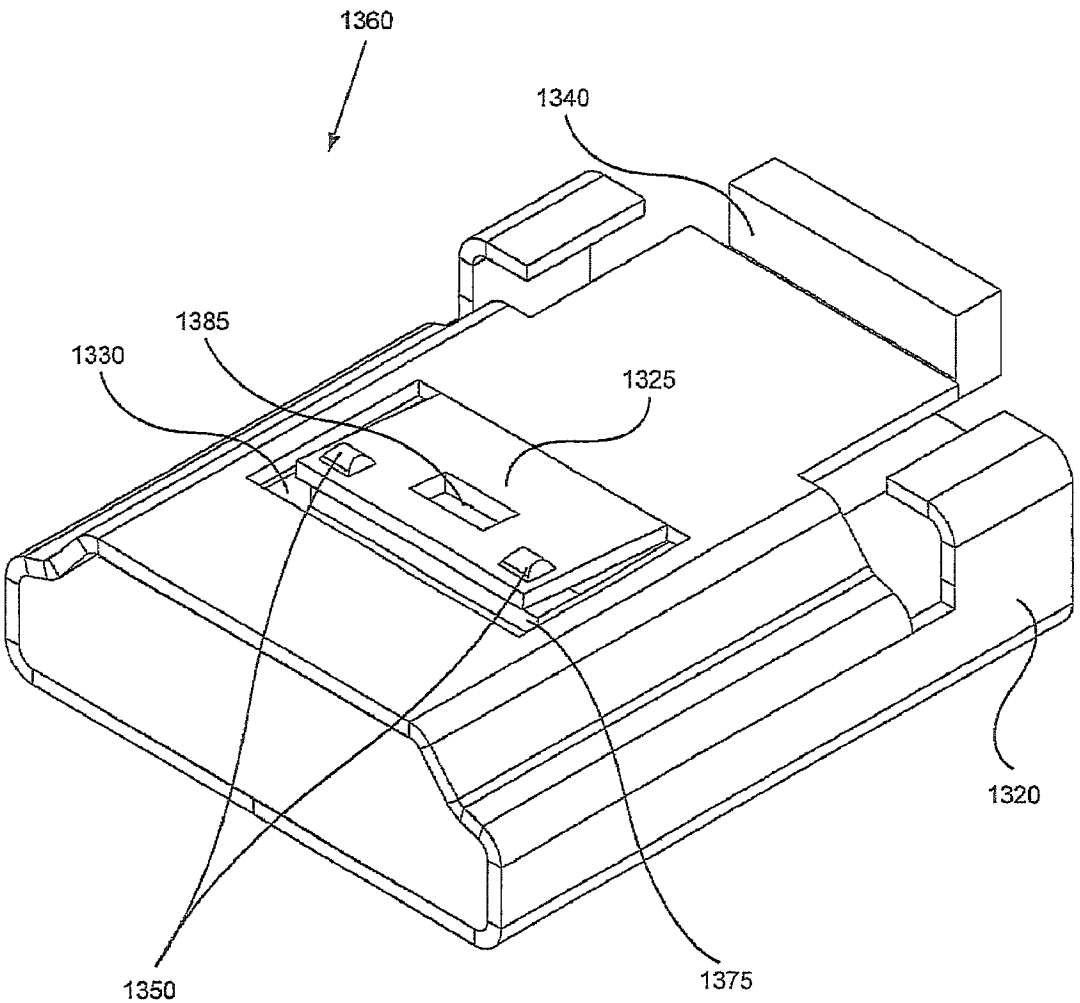
FIG. 69 depicts a perspective view of an embodiment of the releasably locking high definition multimedia interface plug of FIG. 66 in a locked position.
Figure 70:
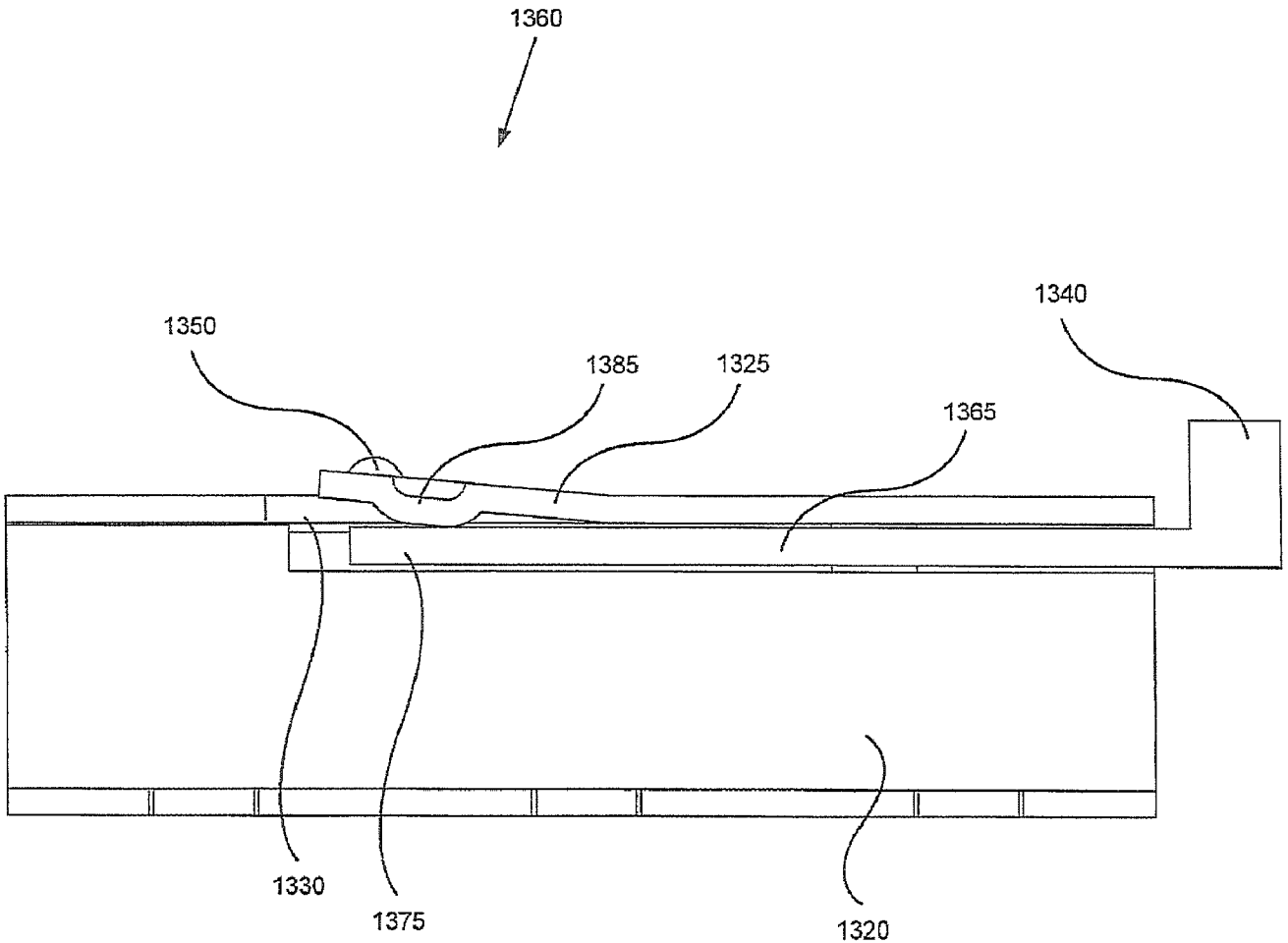
FIG. 70 depicts a cutaway side view of an embodiment of the releasably locking high definition multimedia interface plug of FIG. 66 in a locked position.
Figure 71:
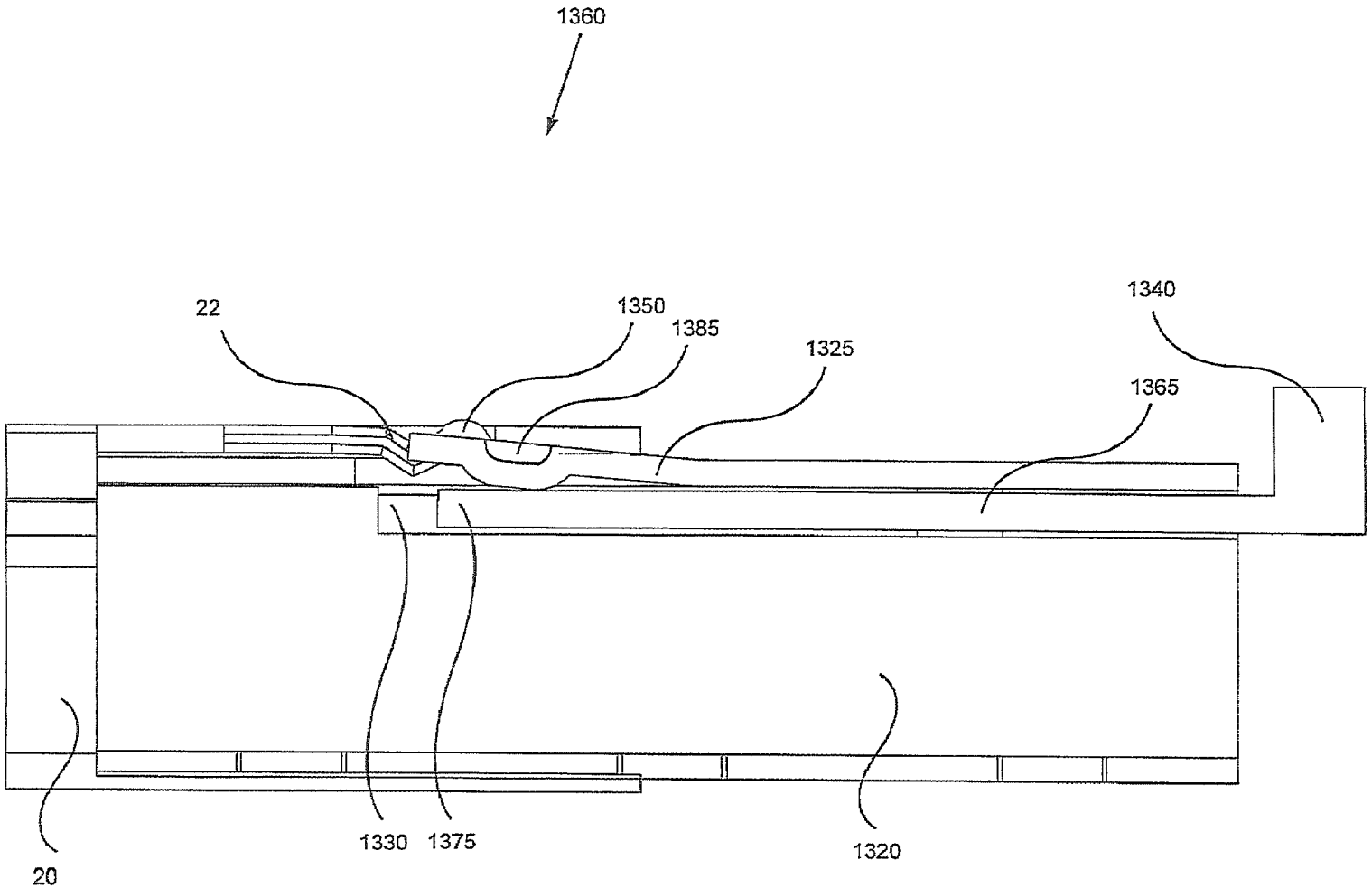
FIG. 71 depicts a cutaway side view of an embodiment of the releasably locking high definition multimedia interface plug of FIG. 66 in a locked position and mating with a typical high definition multimedia interface receptacle.

FIGS. 69, 70 and 71 depict multiple views of an embodiment of the releasably locking high definition multimedia interface plug 1300 of FIG. 66 in a locked position 1360. When the actuator 1365 is slidably moved in an axial direction towards the high definition multimedia interface connection end 1335 and away from the connector body and high definition multimedia interface cable 10, the actuator 1365 obtains a locked position 1360 where the forward edge 1375 of the actuator 1365 physically contacts the depression 1385 of the flexible engagement member 1325. As a result the flexible engagement members 1325 is biased in an upwards position and with the locking tab(s) 1350 coupled thereon may bend or be biased upward allowing protrusion of the locking tab(s) 1350 to be maneuvered into the typical sidewall opening 25 of a standard high definition multimedia interface receptacle 20 and thereby help to engage the receptacle 20 and secure the plug 1300 to the receptacle 20. When engaged in a secure manner the actuator 1365 may reside in the locked position 1360.

Embodiments of a releasably engaging high definition multimedia interface plug 1300 may include means for locating the locking tab(s) 1350, so that the locking tab(s) 1350 protrudes from the opening 1330 of body extension member 1320 and extends into and engages a typical sidewall opening 25 of the corresponding standard high definition multimedia interface receptacle 20 into which the locking plug 1300 has been inserted. Moreover, embodiments of a releasably engaging high definition multimedia interface plug 1300 may include means for locating the locking tab(s) 1350, so that the locking tab(s) 1350 does not extend into engagement with the typical sidewall opening 25 of the corresponding standard high definition multimedia interface receptacle 20 into which the locking plug 1300 has been inserted. The means for locating the locking tab(s) 1350 may be an actuator 1365 having a forward edge 1375 that is operable with embodiments of the present invention to move a locking tab(s) 1350. In addition, the means for locating the locking tab(s) 1350 may interact with the button 1340. Furthermore, the means for locating the locking tab(s) 1350 may be operable to move the locking tab(s) 1350 extend into engagement with the typical sidewall opening 25 of a standard high definition multimedia interface receptacle 20.

With continued reference to the all the drawings, and particularly FIGS. 66-71, a method of releasably securing a high definition multimedia interface plug 1300 to a standard high definition multimedia interface receptacle 20 is described. The methodology may include a step of providing a releasably engaging high definition multimedia interface plug 1300 comprising a lock button 1340, a high definition multimedia interface connection end 1335, a body extension member 1320 having an opening 1330 therein, locking tab(s) 1350 coupled to flexible engagement member 1325 having a depression 1385 therein, where the flexible engagement member 1325 is coupled to the body extension member 1320, and an actuator 1365 having a forward edge 1375.

A locked position 1360 of the actuator 1365 may pertain to the interface plug 1300, wherein the forward edge 1375 of the actuator 1365 is locatable below the depression 1385 of the flexible engagement member 1325. Moreover, an unlocked position 1370 of the actuator 1365 may pertain to the interface plug 1300, wherein the forward edge 1375 of the actuator 1365 is locatable in a position away from the depression 1385 of the flexible engagement member 1325.

A further methodological step may include moving the actuator 1365, by means of the button 1340, so that the forward edge 1375 of the actuator 1365 obtains an unlocked position 1370 where it is not in contact with the depression 1385 of the flexible engagement member 1325 and the locking tab(s) 1350 resides substantially within the opening 1330 of the body extension member 1320 and so that the locking tab(s) 1350 does not engage the typical sidewall opening 25 of a corresponding standard high definition multimedia interface receptacle 20 into which the releasably engaging high definition multimedia interface plug 1300 is inserted and so that the locking tab(s) 1350 will not contact the typical spring biased tab 22 of the corresponding standard high definition multimedia interface receptacle 20.

Another methodological step may include inserting the releasably engaging high definition multimedia interface plug 1300 into a corresponding standard high definition multimedia interface receptacle 20. Once inserted, a further methodological step may include moving the forward edge 1375 of the actuator 1365 in a direction away from the plug body and towards the high definition multimedia interface connection end 1335, so that the forward edge 1375 of the actuator 1365 obtains a locked position 1360 where it is in contact with the depression 1385 of the flexible engagement member 1325. The locking tab(s) 1350 residing on the flexible engagement member 1325 is therefore biased to protrude from the opening 1330 of the body extension member 1320 and so that the locking tab(s) 1350 extends into engagement with the typical sidewall opening 25 of the of the corresponding standard high definition multimedia interface receptacle 20 into which the releasably engaging plug 1300 is inserted, thereby releasably securing the plug 1300 within the receptacle 20. The locking tab(s) 1350 may also physically contact and exert a resultant force upon the typical spring biased tab(s) 22 of the standard high definition multimedia interface receptacle 20.

To release the plug 1300 from its secure connection with the receptacle 20, further methodology may include again moving the forward edge 1375 of the actuator 1365 so that the actuator 1365 obtains an unlocked position 1370 where it is not in contact with the depression 1385 of the flexible engagement member 1325. The locking tab(s) 1350 residing on the flexible engagement member 1325 resides substantially within the opening 1330 of the body extension member 1320 and so that the locking tab(s) 1350 do not engage the typical sidewall opening 25 of the corresponding standard high definition multimedia interface receptacle 20 into which the releasably engaging high definition multimedia interface plug 1300 has been inserted, and so that the locking tab(s) 1350 will not contact the typical spring biased tab 22 of the corresponding standard high definition multimedia interface receptacle 20. Then the methodology for releasably engaging a high definition multimedia interface plug 1300 with a standard high definition multimedia receptacle 20 may include removing the releas ably engaging high definition multimedia interface plug 1300 from the corresponding standard high definition multimedia interface receptacle 20.

Figure 72:
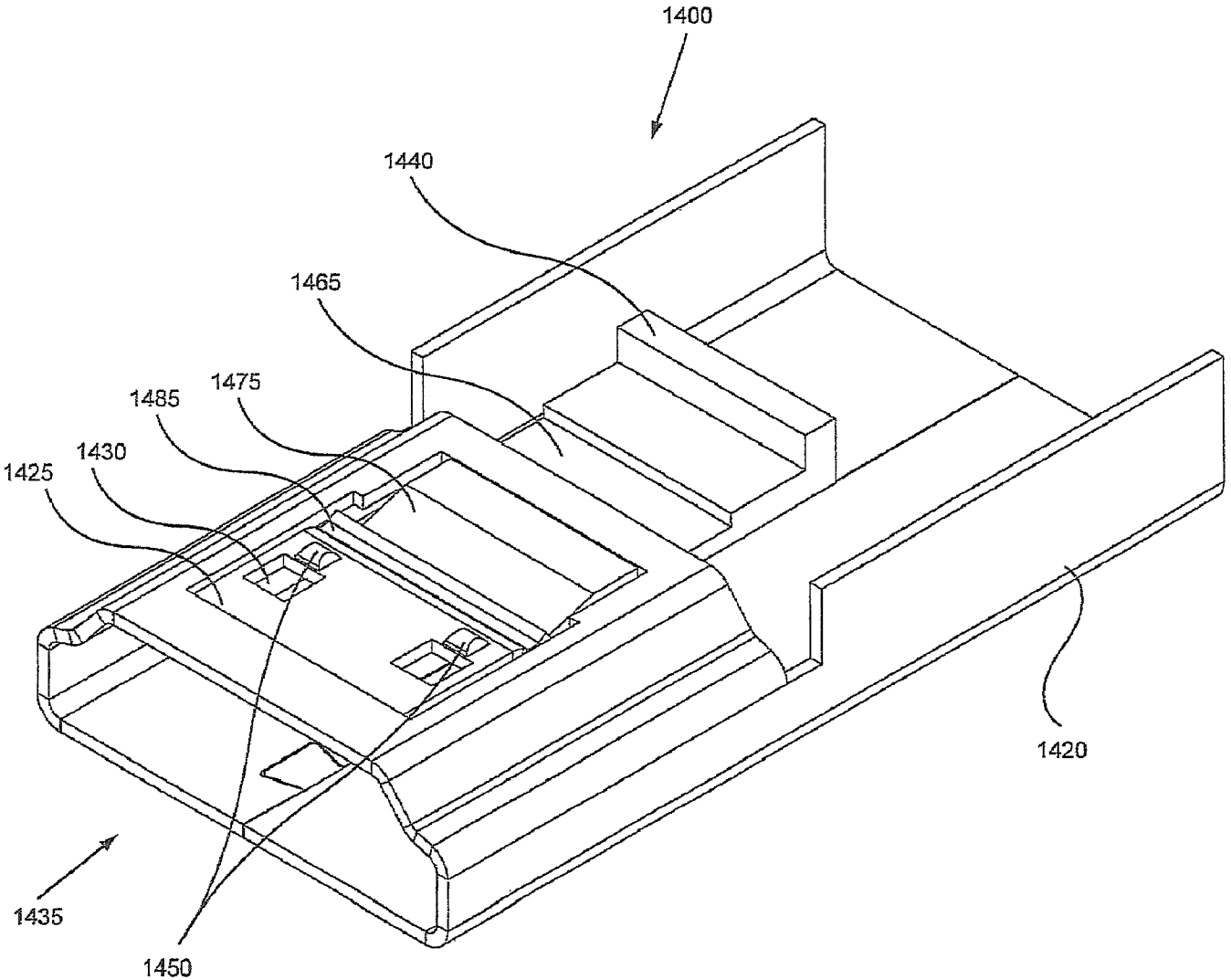
FIG. 72 depicts a perspective view of an embodiment of a releasably locking high definition multimedia interface plug in an unlocked position, according to the present invention.

FIG. 72 depicts a perspective view of an embodiment of a releasably locking high definition multimedia interface plug 1400, according to the present invention. The releasably locking high definition multimedia interface plug 1400 may be used for connecting high definition multimedia interface cable 10 to high definition electronic components having standard high definition multimedia interface receptacles, such as receptacle 20 depicted in FIGS. 1-4. As such, embodiments of a releasably engaging high definition multimedia interface plug 1400 may include many similar structural features and similar functional operability as other embodiments of locking releasably engaging high definition multimedia interface plugs 100/200/300/400/500/600/700/800/900/1100/1200/1300 previously described. Accordingly, the releasably locking high definition multimedia interface plug 1400 comprises a lock button 1440, a high definition multimedia interface connection end 1435, a body extension member 1420 having an opening 1430 therein, locking tab(s) 1450 coupled to flexible engagement member 1425 having an interface tab 1485 on the flexible engagement member's distal end, where the flexible engagement member 1425 is coupled to the body extension member 1420, and an actuator 1465 having a ramped portion of a forward edge 1475.

Figure 76:
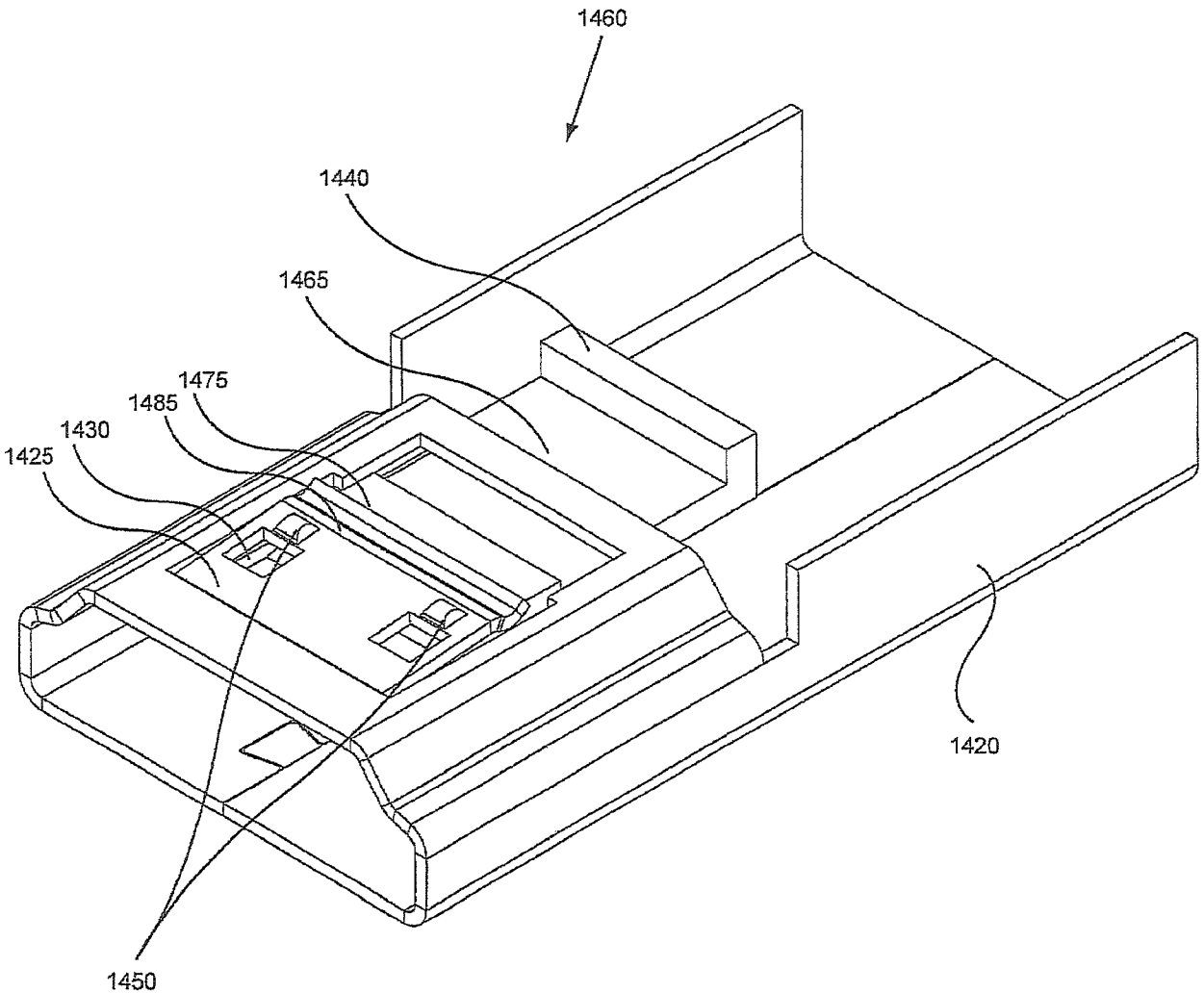
FIG. 76 depicts a perspective view of an embodiment of the releasably locking high definition multimedia interface plug of FIG. 72 in a fully locked position.
Figure 77:
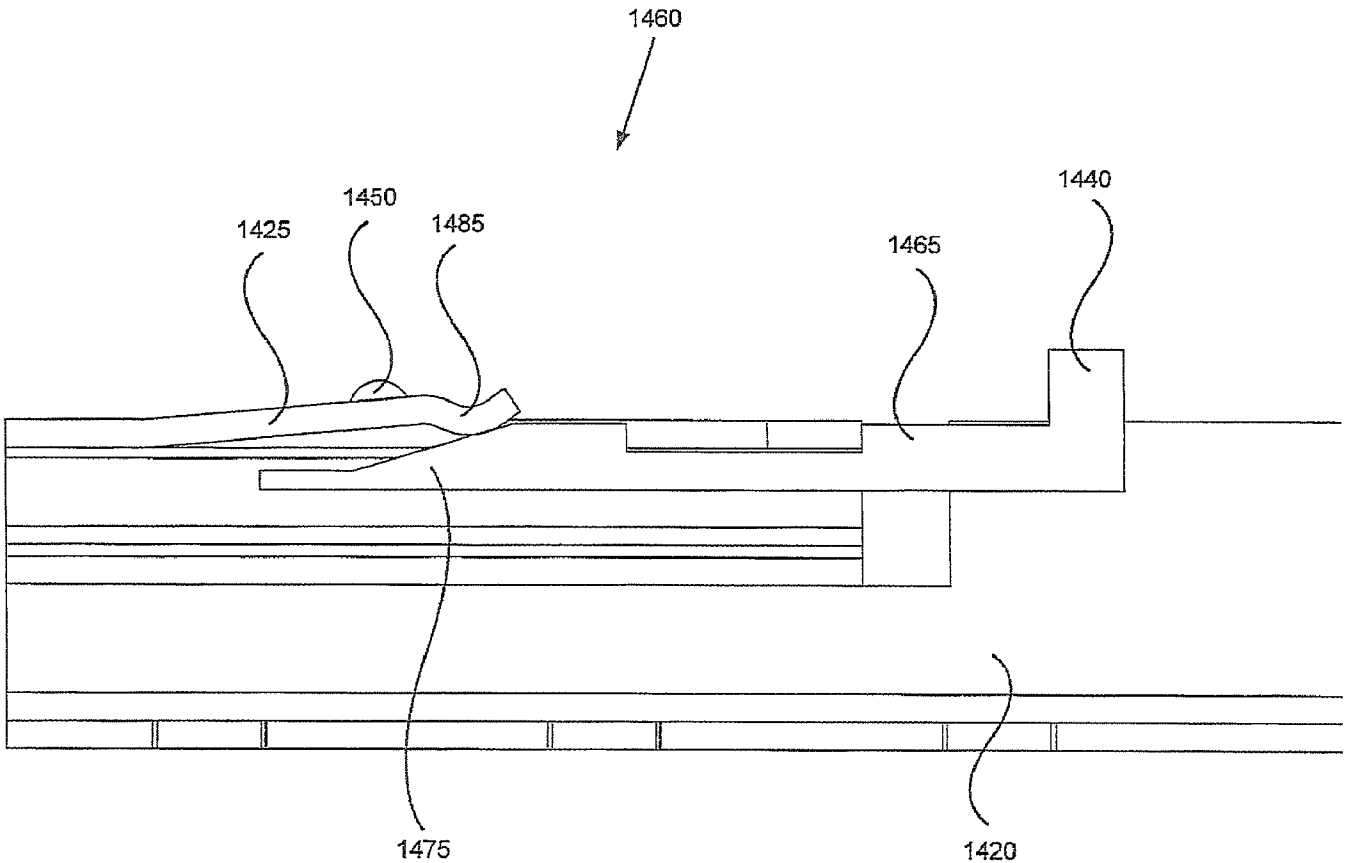
FIG. 77 depicts a cutaway side view of an embodiment of the releasably locking high definition multimedia interface plug of FIG. 72 in a fully locked position.

The lock button 1440 is configured to be manipulated by a user in an up, down, or sideways motion to work upon the actuator 1465 and cause the actuator 1465 to move the locking tab(s) 1450 between a locked position 1460 (see FIG. 76) and an unlocked position 1470 (see FIG. 72). The lock button 1440 may be integrally formed with actuator 1465, or may be separately attached to the actuator 1465 and located to contact or otherwise be configured to afford work upon the actuator 1465 in some operable manner. The actuator 1465 may be positioned to be slidably movable below the interface tab 1485 on the distal end of the flexible engagement members(s) 1425 of the interface plug 1400. The ramped portion of the forward edge 1475 of the actuator 1465 may operate with the interface tab 1485 on the distal end of the flexible engagement member 1425 such that when the ramped portion of the forward edge 1475 of the actuator 1465 physically contacts the interface tab 1485 the interface tab 1485 is biased in an upwards position and exerts a resultant force upon the flexible engagement member 1425. The locking tab(s) 1450 coupled to the flexible engagement member 1425 physically contacts and exerts a resultant force upon a typical spring biased tab 25 of a corresponding standard high definition multimedia interface receptacle 20 into which the locking plug 1400 has been inserted.

Figure 73:
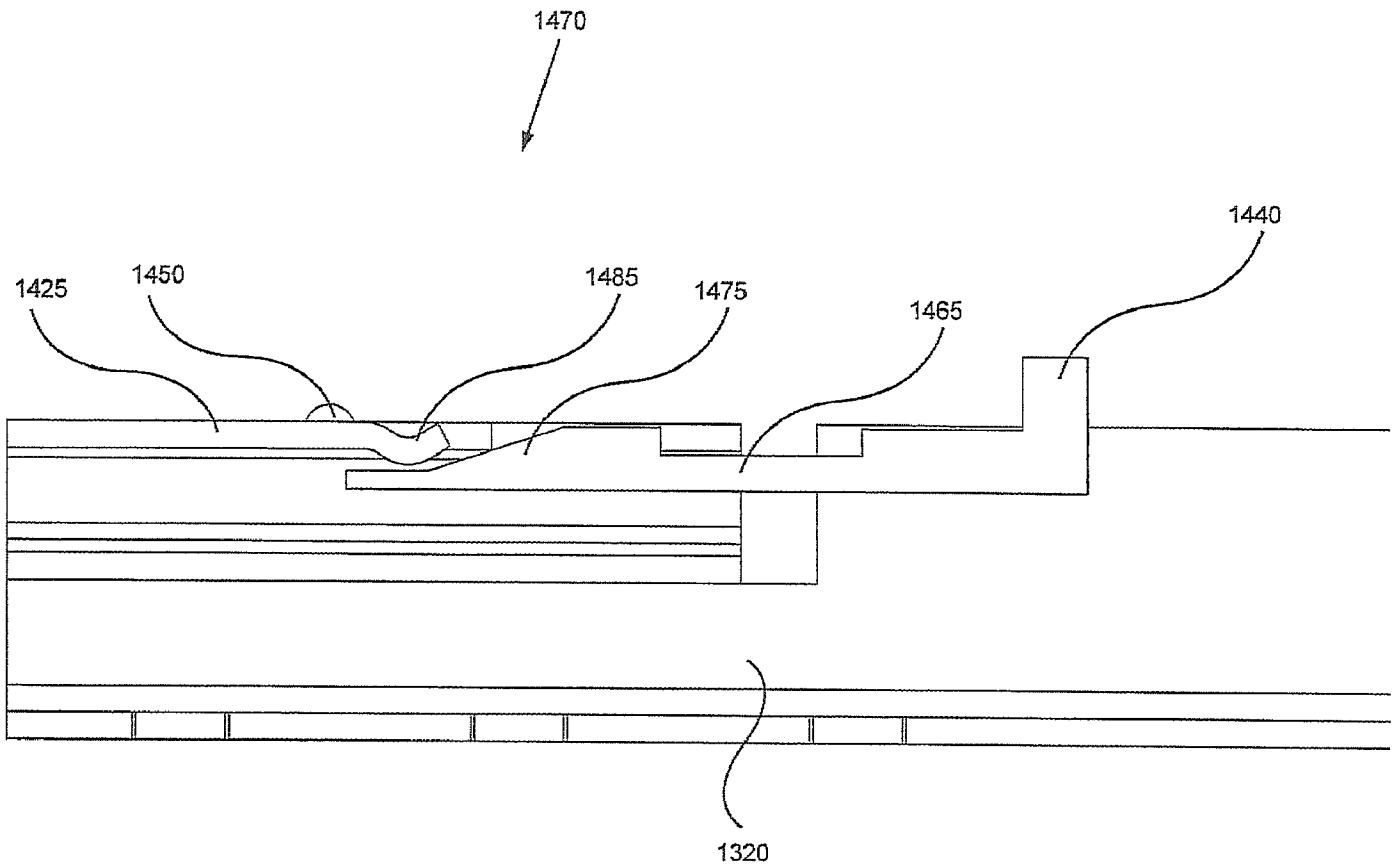
FIG. 73 depicts a cutaway side view of an embodiment of the releasably locking high definition multimedia interface plug of FIG. 72 in an unlocked position.
Figure 74:
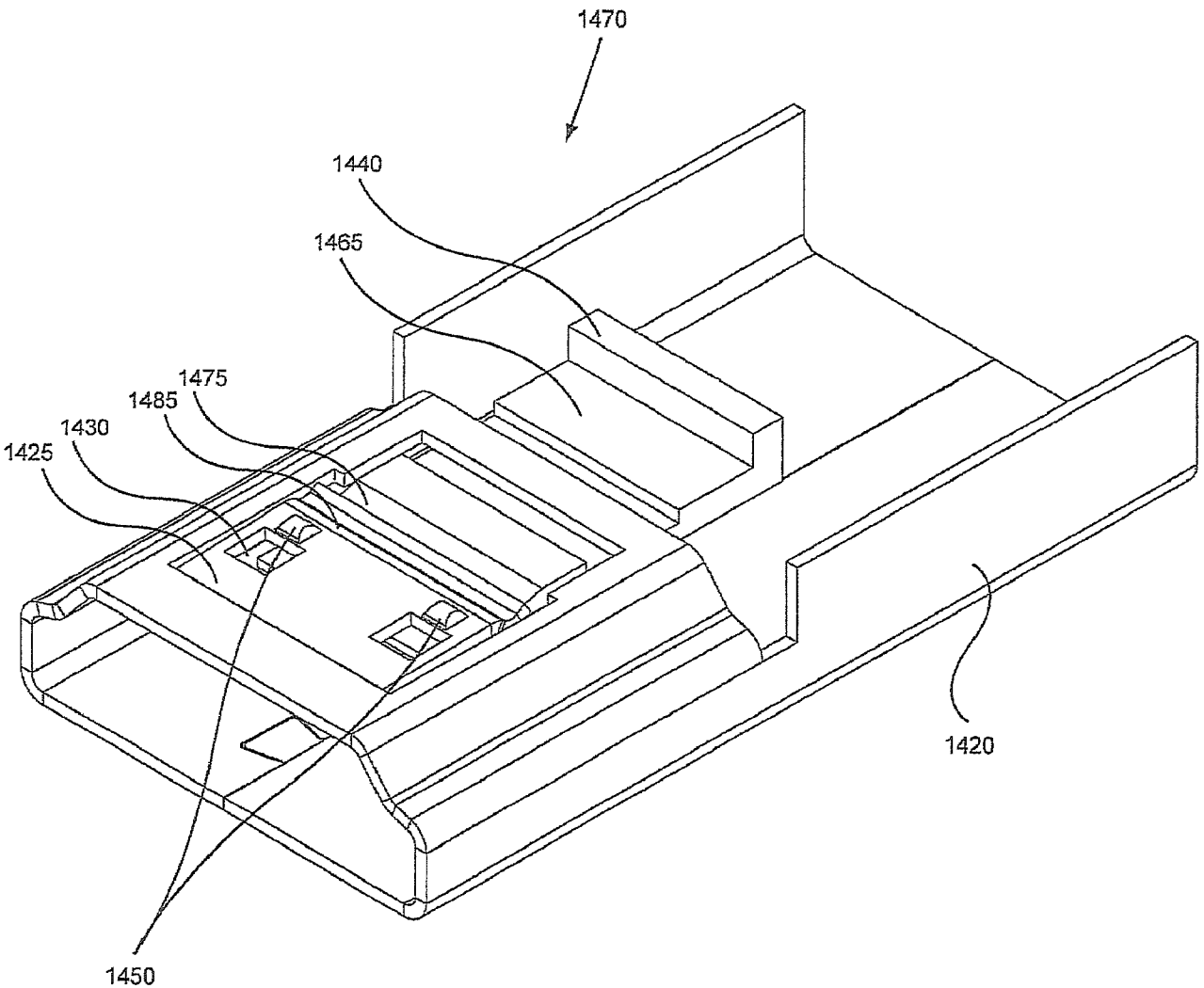
FIG. 74 depicts a perspective view of an embodiment of the releasably locking high definition multimedia interface plug of FIG. 72 in a partially locked position.
Figure 75:
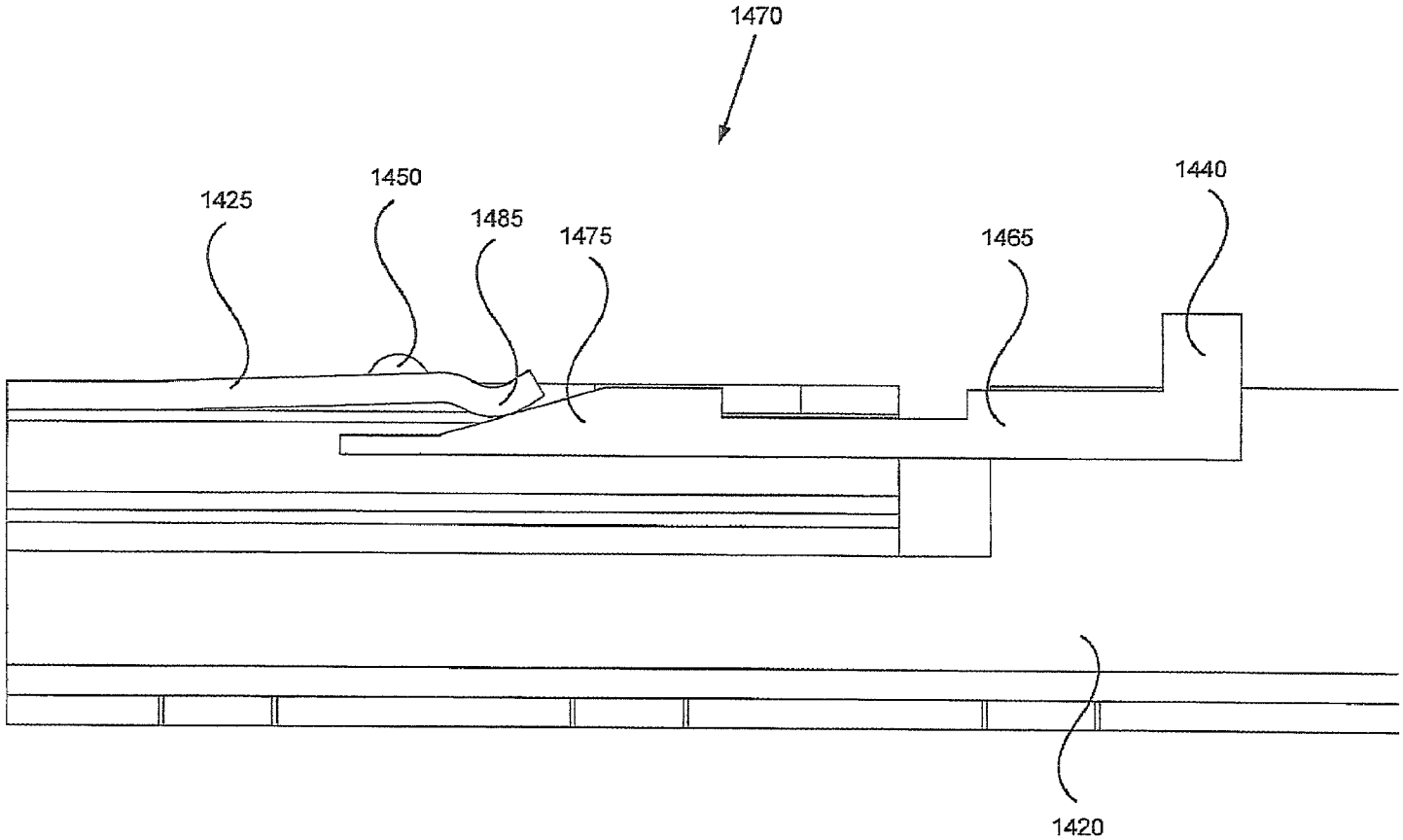
FIG. 75 depicts a cutaway side view of an embodiment of the releasably locking high definition multimedia interface plug of FIG. 72 in a partially locked position.

FIGS. 72 and 73 depict multiple views of an embodiment of the releasably locking high definition multimedia interface plug 1400 of FIG. 72 in an unlocked position 1470. When the actuator 1465 is slidably moved in an axial direction away from the high definition multimedia interface connection end 1435 and toward the connector body and high definition multimedia interface cable 10, the actuator 1465 obtains an unlocked position 1470 where the ramped portion of the forward edge 1475 of the actuator 1465 is not in contact with the interface tab 1485 located at the distal end of the flexible engagement member 1425. As a result, the locking tab(s) 1450 coupled to the flexible engagement member 1425 is not biased and therefore resides substantially within the opening 1430 in the body extension member 1420 of releasably locking high definition multimedia interface plug 1400. However, those in the art should appreciate that the components of the high definition multimedia interface plug 1400 may be oppositely configured such that movement of the actuator 1465 in an axial direction towards the high definition multimedia interface connection end 1435 and away from the connector body and high definition multimedia interface cable 10 permits connector components to obtain an unlocked position 1470 where the ramped portion of the forward edge 1475 of the actuator 1465 is not in contact with the flexible engagement member 1425.

FIGS. 74, 75, 76 and 77 depict multiple views of an embodiment of the releasably locking high definition multimedia interface plug 1400 of FIG. 72 in a locked position 1460. When the actuator 1465 is slidably moved in an axial direction towards the high definition multimedia interface connection end 1435 and away from the connector body and high definition multimedia interface cable 10, the actuator 1465 obtains a locked position 1460 where the ramped portion of the forward edge 1475 of the actuator 1465 physically contacts the interface tab 1485 located at the distal end of the flexible engagement member 1425. As a result the flexible engagement members 1425 is biased in an upwards position and with the locking tab(s) 1450 coupled thereon may bend or be biased upward allowing protrusion of the locking tab(s) 1450 to be maneuvered into typical sidewall opening 25 of a standard high definition multimedia interface receptacle 20 and thereby help to engage the receptacle 20 and secure the plug 1400 to the receptacle 20. When engaged in a secure manner the actuator 1465 may reside in the locked position 1460.

Embodiments of a releasably engaging high definition multimedia interface plug 1400 may include means for locating the locking tab(s) 1450, so that the locking tab(s) 1450 protrudes from the opening 1430 of body extension member 1420 and physically contacts and exerts a resultant force upon a typical spring biased tab 22 of the corresponding standard high definition multimedia interface receptacle 20 into which the locking plug 1400 has been inserted. Moreover, embodiments of a releasably engaging high definition multimedia interface plug 1400 may include means for locating the locking tab(s) 1450, so that the locking tab(s) 1450 does not contact the typical spring biased tab 22 of the corresponding standard high definition multimedia interface receptacle 20 into which the locking plug 1400 has been inserted. The means for locating the locking tab(s) 1450 may be an actuator 1465 having a ramped portion of a forward edge 1475 that is operable with embodiments of the present invention to move a locking tab(s) 1450. In addition, the means for locating the locking tab(s) 1450 may interact with the button 1440. Furthermore, the means for locating the locking tab(s) 1450 may be operable to move the locking tab(s) 1450 to contact and exert a resultant force upon a typical spring biased tab 22 of a standard high definition multimedia interface receptacle 20.

With continued reference to the all the drawings, and particularly FIGS. 72-77, a method of releasably securing a high definition multimedia interface plug 1400 to a standard high definition multimedia interface receptacle 20 is described. The methodology may include a step of providing a releasably engaging high definition multimedia interface plug 1400 comprising a lock button 1440, a high definition multimedia interface connection end 1435, a body extension member 1420 having an opening 1430 therein, locking tab(s) 1450 coupled to flexible engagement member 1425 having an interface tab 1485 on the flexible engagement member's distal end, where the flexible engagement member 1425 is coupled to the body extension member 1420, and an actuator 1465 having a ramped portion of a forward edge 1475.

A locked position 1460 of the actuator 1465 may pertain to the interface plug 1400, wherein the ramped portion of the forward edge 1475 of the actuator 1465 is locatable below the flexible engagement member 1425 and in contact with the interface tab 1485 located at the distal end of said flexible engagement member 1425. Moreover, an unlocked position 1470 of the actuator 1465 may pertain to the interface plug 1400, wherein the ramped portion of the forward edge 1475 of the actuator 1465 is locatable in a position away from the flexible engagement member 1425 and the ramped portion of the forward edge 1475 is not in contact with the interface tab 1485 located at the distal end of said flexible engagement member 1425.

A further methodological step may include moving the actuator 1465, by means of the button 1440, so that the ramped portion of the forward edge 1475 of the actuator 1465 obtains an unlocked position 1470 where it is not in contact with the interface tab 1485 located at the distal end of the flexible engagement member 1425 and the locking tab(s) 1450 resides substantially within the opening 1430 of the body extension member 1420 and so that the locking tab(s) 1450 will not contact the typical spring biased tab 22 of the corresponding standard high definition multimedia interface receptacle 20 into which the releasably engaging plug 1400 is insertable.

Another methodological step may include inserting the releasably engaging high definition multimedia interface plug 1400 into a corresponding standard high definition multimedia interface receptacle 20. Once inserted, a further methodological step may include moving the ramped portion of the forward edge 1475 of the actuator 1465 in a direction away from the plug body and towards the high definition multimedia interface connection end 1435, so that the ramped portion of the forward edge 1475 of the actuator 1465 obtains a locked position 1460 where it is in contact with the interface tab 1485 located at the distal end of the flexible engagement member 1425. The locking tab(s) 1450 residing on the flexible engagement member 1425 is therefore biased to protrude from the opening 1430 of the body extension member 1420 and so that the locking tab(s) 1450 physically contacts and exerts a resultant force upon a typical spring biased tab 22 of the corresponding standard high definition multimedia interface receptacle 20 into which the releasably engaging plug 1400 is inserted, thereby releasably securing the plug 1400 within the receptacle 20.

To release the plug 1400 from its secure connection with the receptacle 20, further methodology may include again moving the ramped portion of the forward edge 1475 of the actuator 1465 so that the actuator 1465 obtains an unlocked position 1470 where it is not in contact with the interface tab 1485 located at the distal end of the flexible engagement member 1425. The locking tab(s) 1450 residing on the flexible engagement member 1425 resides substantially within the opening 1430 of the body extension member 1420 and so that the locking tab(s) 1450 will not contact the typical spring biased tab 22 of the corresponding standard high definition multimedia interface receptacle 20 into which the releasably engaging plug 1400 has been inserted. Then the methodology for releasably engaging a high definition multimedia interface plug 1400 with a standard high definition multimedia receptacle 20 may include removing the releasably engaging high definition multimedia interface plug 1400 from the corresponding standard high definition multimedia interface receptacle 20.

Figure 78:
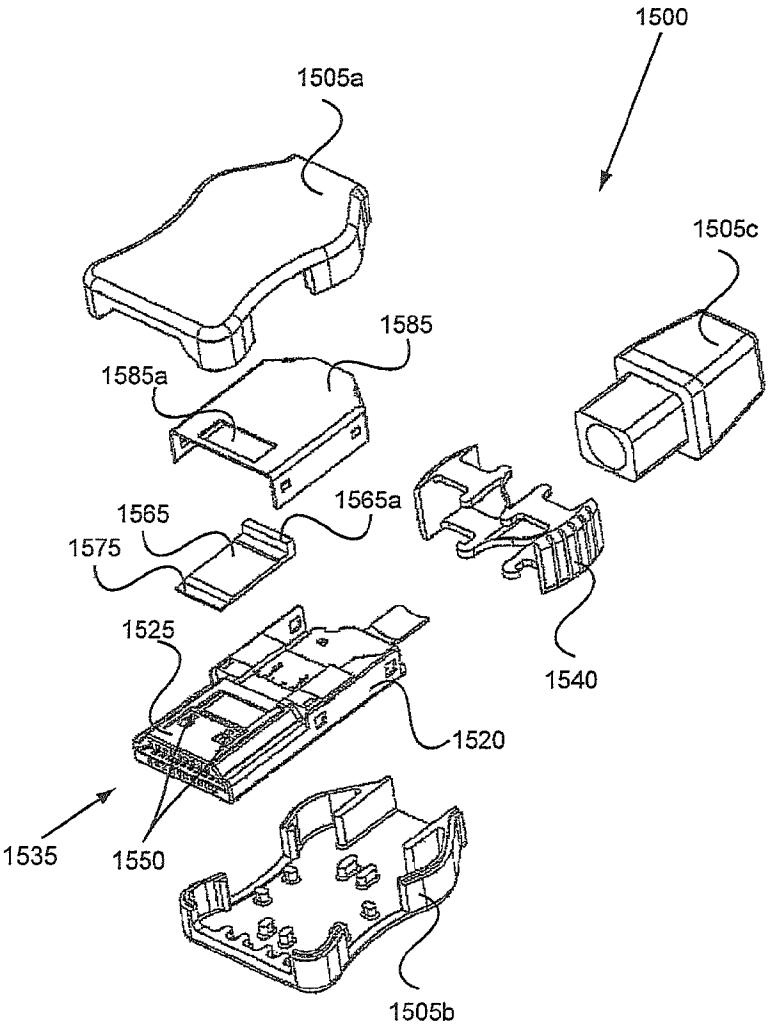
FIG. 78 depicts an exploded view of an embodiment of a releasably locking high definition multimedia interface plug, according to the present invention.
Figure 79:
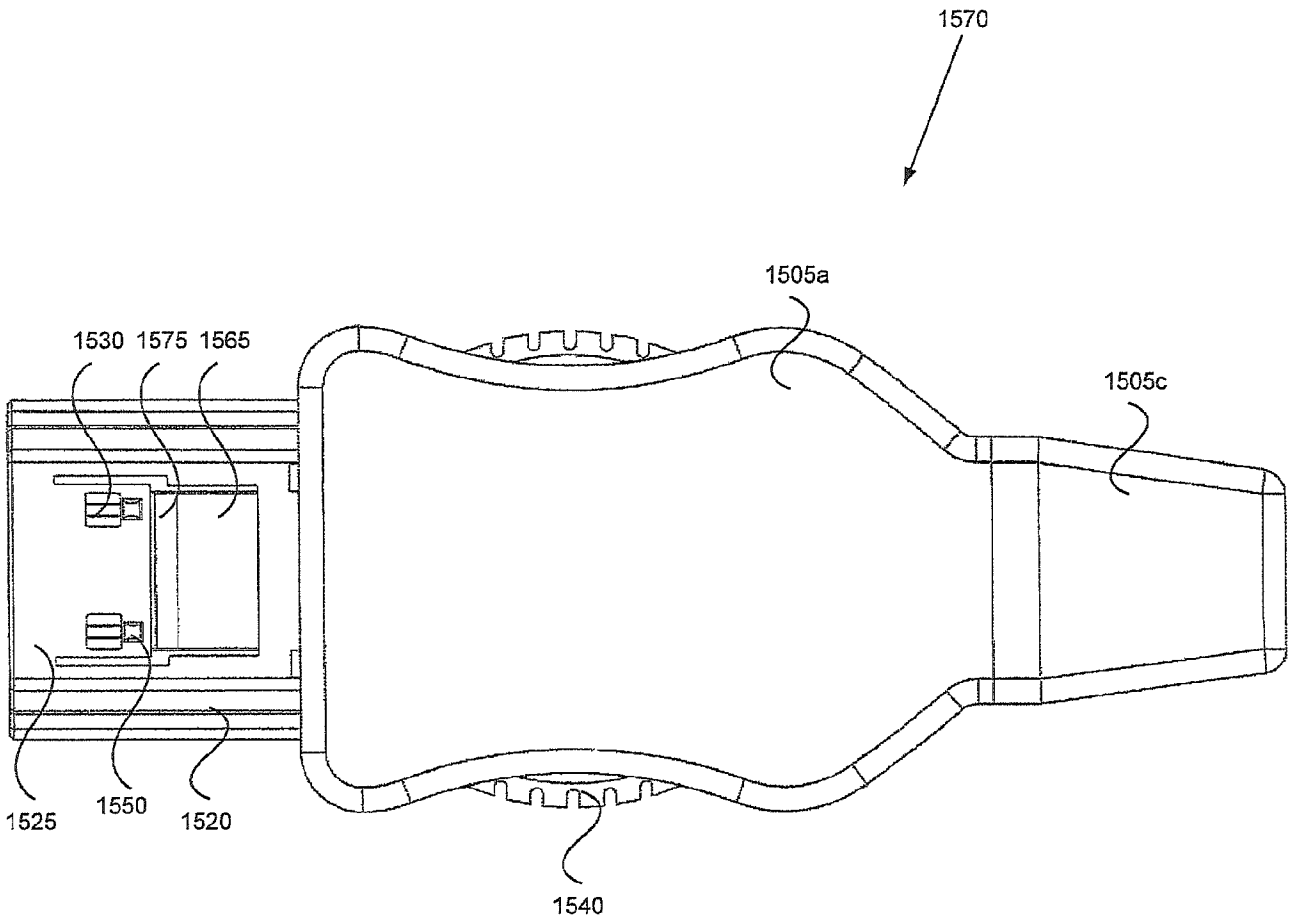
FIG. 79 depicts a top view of an embodiment of the releasably locking high definition multimedia interface plug of FIG. 78 in an unlocked position.
Figure 80:
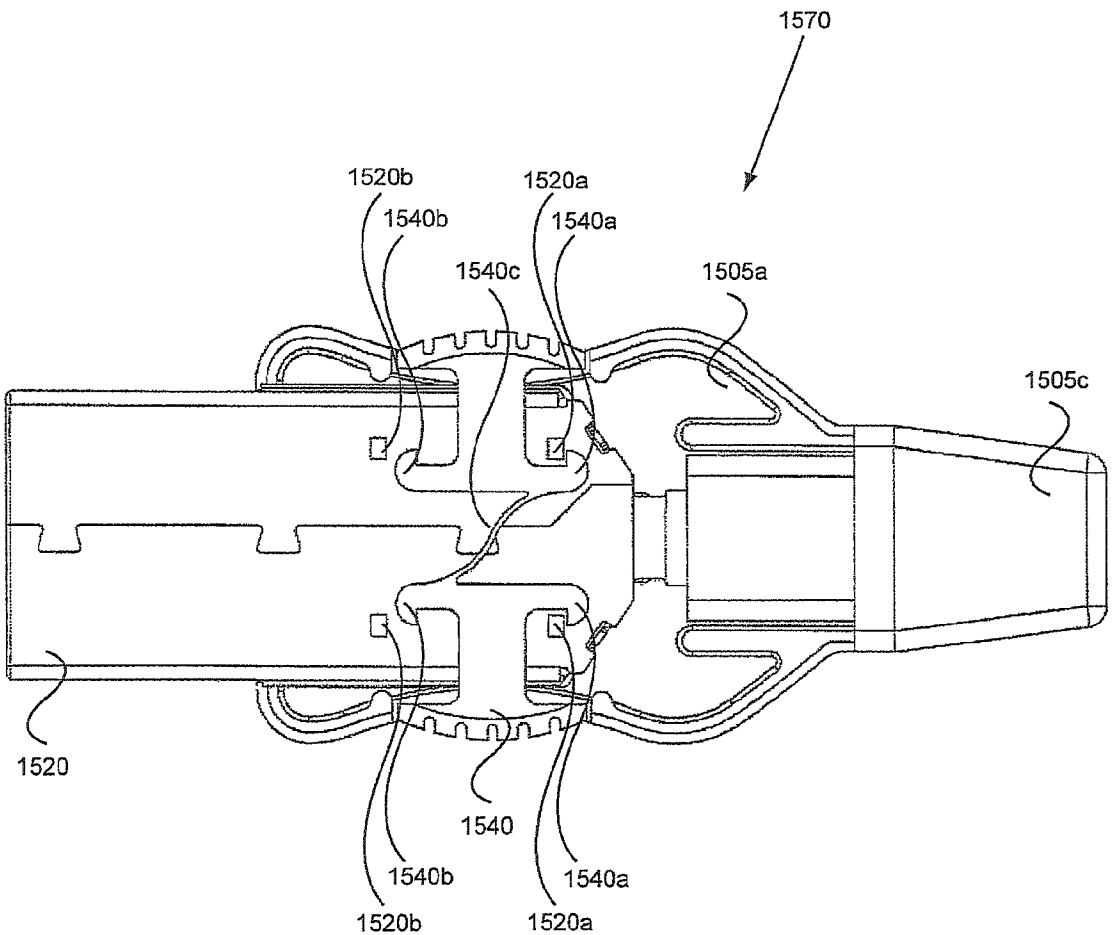
FIG. 80 depicts a cutaway bottom view of an embodiment of the releasably locking high definition multimedia interface plug of FIG. 78 in an unlocked position.
Figure 81:
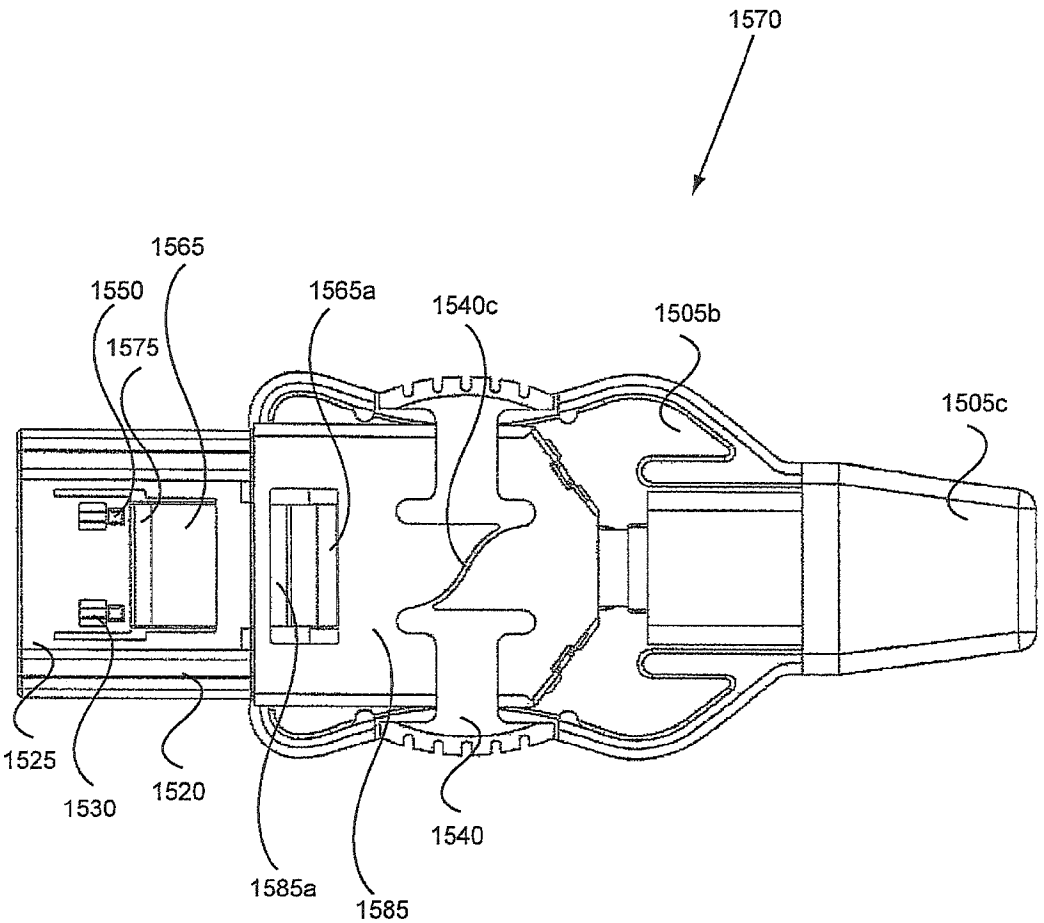
FIG. 81 depicts a cutaway top view of an embodiment of the releasably locking high definition multimedia interface plug of FIG. 78 in an unlocked position.

FIG. 78 depicts a perspective view of an embodiment of a releasably locking high definition multimedia interface plug 1500, according to the present invention. The releasably locking high definition multimedia interface plug 1500 may be used for connecting high definition multimedia interface cable 10 to high definition electronic components having standard high definition multimedia interface receptacles, such as receptacle 20 depicted in FIGS. 1-4. As such, embodiments of a releasably engaging high definition multimedia interface plug 1500 may include many similar structural features and similar functional operability as other embodiments of locking releasably engaging high definition multimedia interface plugs 100/200/300/400/500/600/700/800/900/1100/1200/1300/1400 previously described. Accordingly, the releasably locking high definition multimedia interface plug 1500 comprises a connector plug body 1505 having multiple portions (including a plug top 1505*a*, plug bottom 1505*b*, and plug cable receiver 1505*c*), a lock button 1540 (including an unlocking hook(s) 1540*a* and locking hook(s) 1540*b* and a spring biased member 1540*c*—see FIG. 80), a high definition multimedia interface connection end 1535, an extension member 1520 of the body 1505, the body extension member 1520 comprising an opening 1530 (see FIG. 81), an unlocking post(s) 1520*a*, a locking post(s) 1520*b* (see FIG. 80), locking tab(s) 1550 coupled to or residing on a flexible engagement member 1525, where the flexible engagement member 1525 may be coupled to the body extension member 1520, an actuator 1565 having an engagement edge 1565*a* and a ramped portion of a forward edge 1575, and an actuator engagement member 1585 having an engagement opening 1585*a* therein. The connector plug 1500 may also include at least one terminal contact, such as contact 126 (see FIG. 5), positioned within an inner section, such as inner section 180 (see FIG. 11) of the extension 1520 portion of the connector plug body 1505.

The lock button 1540 is configured to be manipulated by a user in a manner that ultimately affords work upon the actuator 1565. Such work may be facilitated by means of an actuator engagement member 1585 that may operate with the lock button 1540 and engage the actuator 1565 causing the actuator 1565 to move the associated locking tab(s) 1550 between a locked position 1560 (see FIGS. 83-86) and an unlocked position 1570 (see FIGS. 79-82). The lock button 1540 may be integrally formed with actuator engagement member 1585, or may be separately attached to the actuator engagement member 1585 and located to contact or otherwise be configured to afford work upon the actuator 1565 in some operable manner. The engagement member 1585 may interact with the lock button 1540 operable with the body 1505 to move the actuator 1565. The ramped portion of the forward edge 1575 of the actuator 1565 may be positioned to be slidably movable below the flexible engagement member 1525 of the interface plug 1500. The ramped portion of the forward edge 1575 of the actuator 1565 may operate with the flexible engagement member 1525 such that when the ramped portion of the forward edge 1575 of the actuator 1565 physically contacts the flexible engagement member 1525 the flexible engagement member 1525 is biased in an upwards position moving the associated locking tab(s) 1550. The locking tab(s) 1550 coupled to, residing on, or otherwise operable with the flexible engagement member 1525, may thereby be operably positioned to protrude into and engage the typical sidewall opening 25 of a corresponding standard high definition multimedia interface receptacle 20 into which the locking plug 1500 has been inserted. The extension 1520 of the body 1505 may include the at least one opening 1530 and the flexible engagement member 1525. The flexible engagement member 1525 may be flexibly coupled to the body extension 1520 proximate the interface connection end 1535.

FIGS. 79-82 depict multiple views of an embodiment of the releasably locking high definition multimedia interface plug 1500 of FIG. 78 in an unlocked position 1570. As depicted, a user may apply force to opposite sides of the lock button 1540, thereby compressing an inter-disposed spring biased member 1540*c*. The spring biased member may be a thin compliant component structure extending between two opposing sides of the lock button 1540 and may have a tendency to bendably resist compressive forces applied to the two opposing sides of the lock button 1540. The spring biased member may also be a coil spring or other common resilient component. The opposing side lock button 1540 configuration is not limiting and other configurations are contemplated, such as a top-located lock button operable with a spring biased member to move connector components into and out of engagement with each other in order to accomplish locking structure and functionality of a connector 1500.

When the spring biased member 1540*c* is compressed, associated locking and unlocking hooks 1540*b* and 1540*a* are moved out of engagement with non-movable locking and unlocking posts 1520*b* and 1520*a*. The non-movable locking and unlocking posts 1520*b* and 1520*a* may reside on and extend from an underside of the extension 1520 portion of plug body 1505. Hence, when the lock button 140 is compressed and is caused to move in an axial direction away from the high definition multimedia interface connection end 1535 and toward the cable receiver 1505*c* portion of the body 1505 and the cable 10, the unlocking hook(s) 1540*a* is free to move in the same axial direction unobstructed by the unlocking post(s) 1520*a*. Once the lock button 1540 is disengaged (such as when the user releases his or her grip), the expansion force of the spring biased member 1540*c* causes the unlocking hook(s) 1540*a* to move and engage, contact and/or partially surround the unlocking post(s) 1520*a* thereby securing the movable connector 1500 components into an unlocked position 1570 where the ramped portion of the forward edge 1575 of the actuator 1565 is not in contact with the flexible engagement member 1525. Portions of the locking and unlocking hooks 1540*a-b* may be rounded to facilitate slidable, tolerant, snap-like engagement with corresponding locking and unlocking posts 1520*a-b*. During operation, a clicking feel and/or sound associated with the tolerant physical engagement of the unlocking hook(s) and post(s) 1540*a* and 1520*a* may help a user to identify when the connector 1500 has been properly operated to obtain an unlocked position. Those in the art should appreciate that the components of the high definition multimedia interface plug 1500 may be oppositely configured such that movement of the lock button 1540 and associated actuator 1565 in an axial direction towards the high definition multimedia interface connection end 1535 and away from the cable receiver 1505*c* portion of the body 1505 and the cable 10, may operate the connector components so that the actuator 1565 obtains an unlocked position 1570 where the ramped portion of the forward edge 1575 of the actuator 1565 is not in contact with the flexible engagement member(s) 1525.

The lock button 1540 may work upon the engagement member 1585, among other things, by means of the spring biased member 1540*c*, so that the axial direction in which the lock button 1540 is moved invokes movement of the engagement member 1585. When the spring biased member 1540*c* is compressed, the lock button 1540 may physically contact or otherwise operate with the engagement member to exert a resultant force upon the engagement member 1585. The engagement edge 1565*a* of the actuator 1565 couples to, contacts, fits within, or otherwise operates with the engagement opening 1585*a* of the engagement member 1585 and, as a result, the actuator 1565 may be slidably moved in an axial direction away from the high definition multimedia interface connection end 1535 and toward the cable receiver 1505*c* portion of the body 1505 and the cable 10, wherein the actuator 1565 may obtain an unlocked position 1570 where the ramped portion of the forward edge 1575 of the actuator 1565 is not in contact with the flexible engagement member 1525. As a result, the locking tab(s) 1550 associated with the flexible engagement member 1525 is not biased and therefore may reside substantially within the opening 1530 in the body extension member 1520 of the releasably locking high definition multimedia interface plug 1500.

Figure 82:
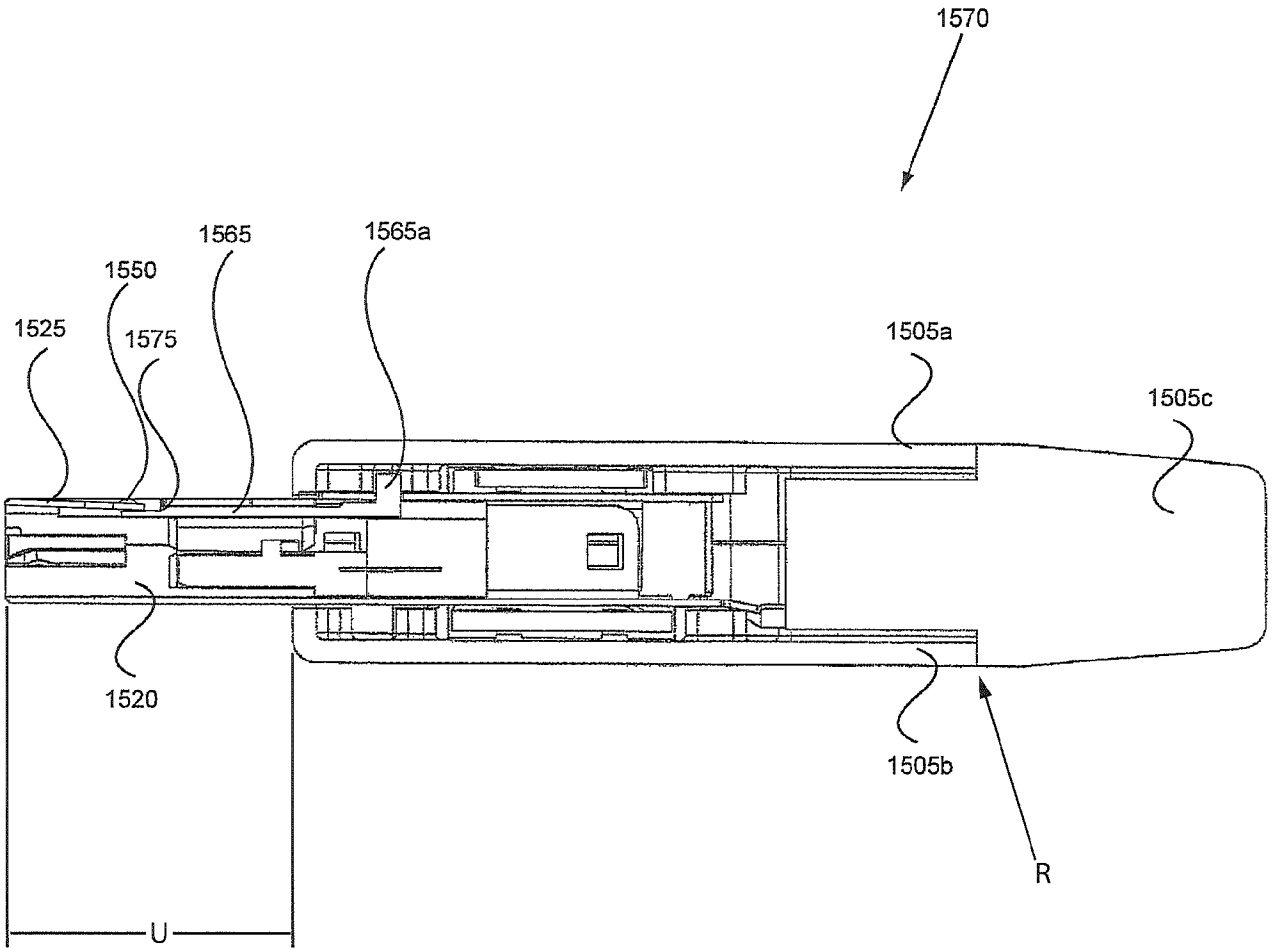
FIG. 82 depicts a cutaway side view of an embodiment of the releasably locking high definition multimedia interface plug of FIG. 78 in an unlocked position.
Figure 83:
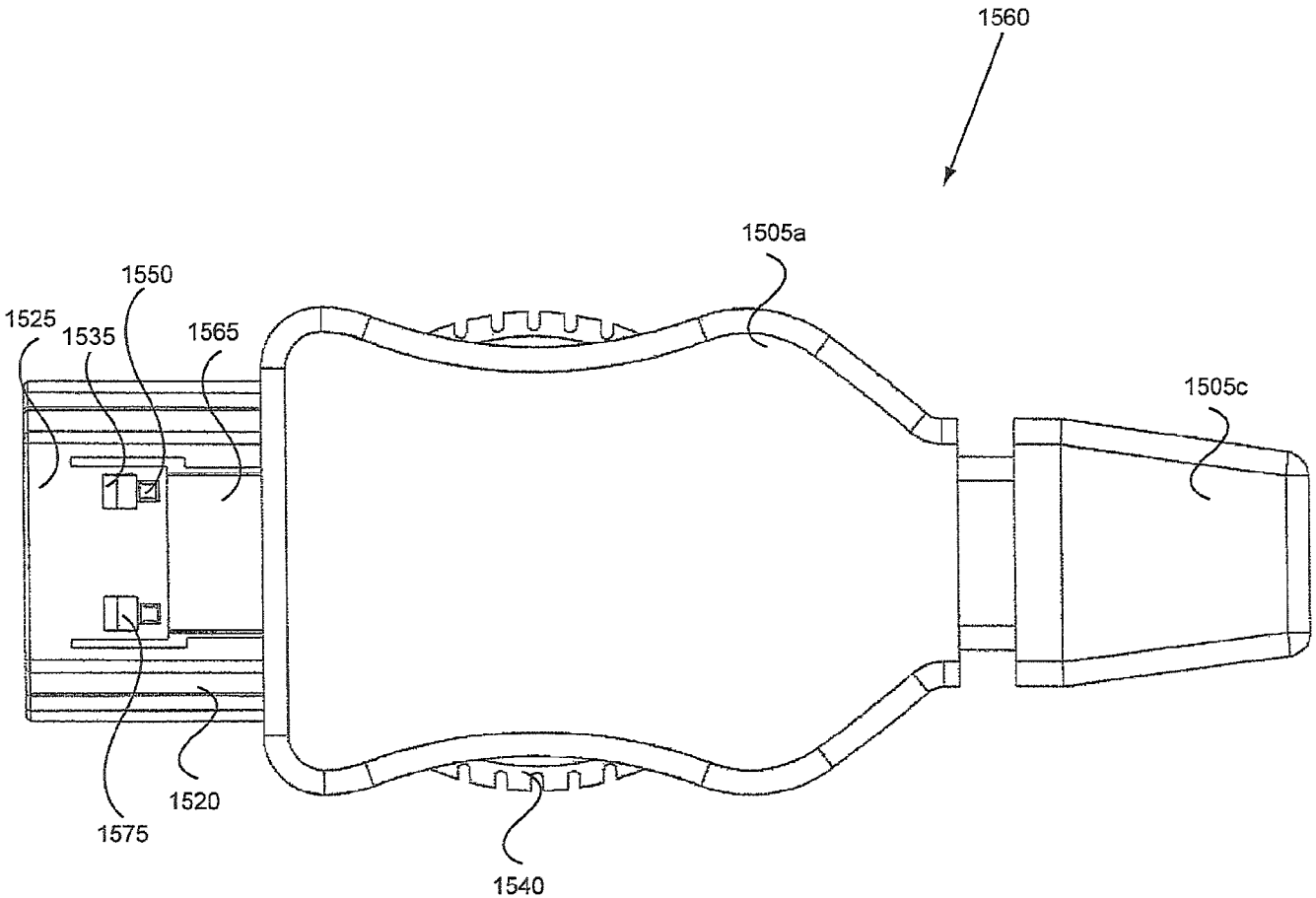
FIG. 83 depicts a top view of an embodiment of the releasably locking high definition multimedia interface plug of FIG. 78 in a locked position.
Figure 84:
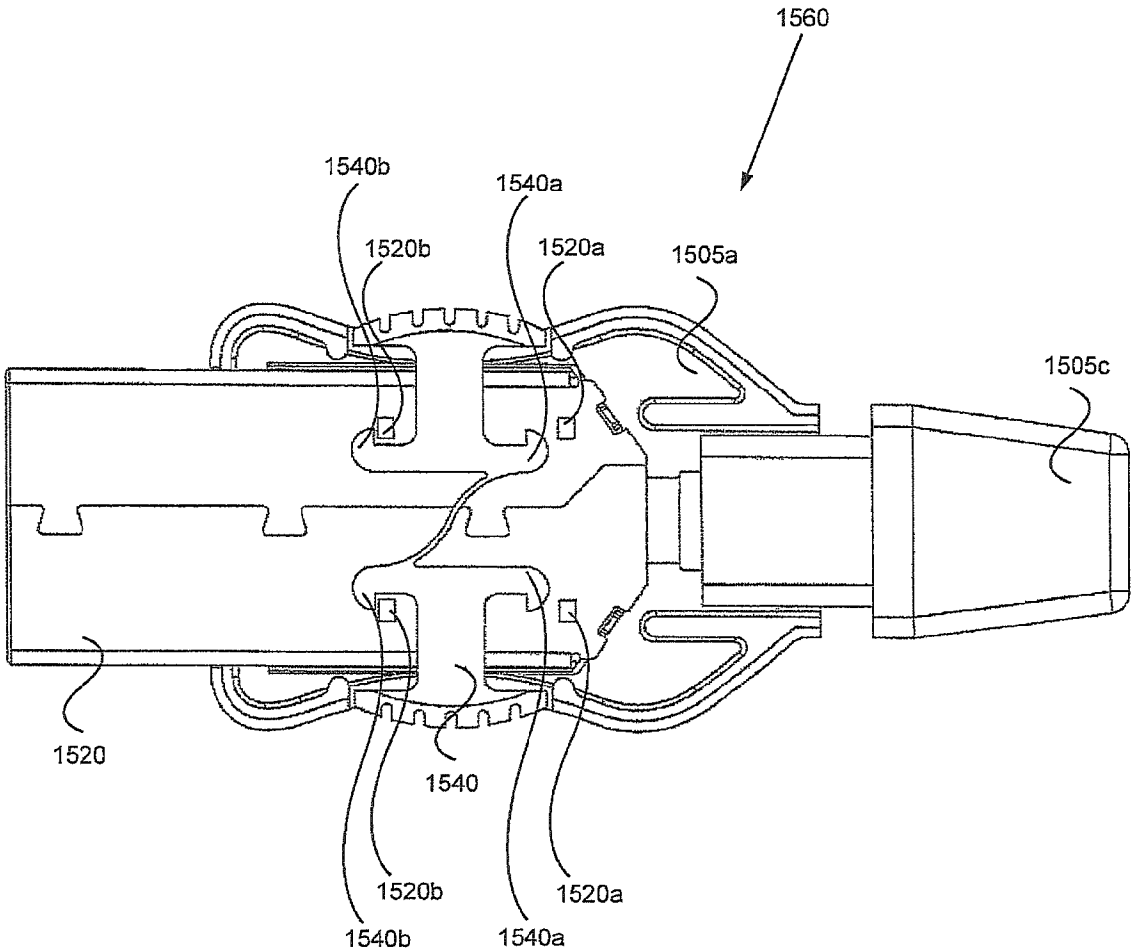
FIG. 84 depicts a cutaway bottom view of an embodiment of the releasably locking high definition multimedia interface plug of FIG. 78 in a locked position.
Figure 85:
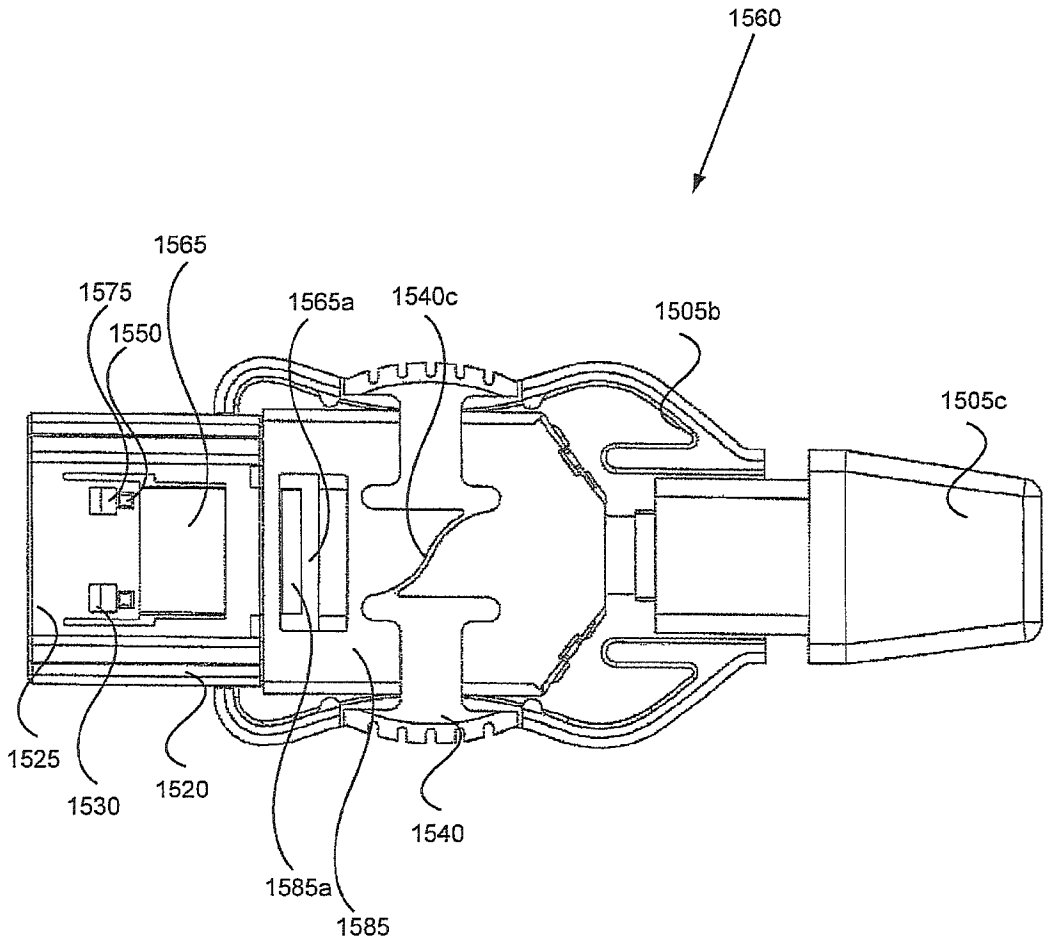
FIG. 85 depicts a cutaway top view of an embodiment of the releasably locking high definition multimedia interface plug of FIG. 78 in a locked position.

The lock button 1540 may be connected to or otherwise operable with the engagement member 1585; therefore the direction in which the lock button 1540 is moved may invoke associated movement of the engagement member 1585. In addition, movement of the lock button 1540 may also invoke associated movement of the plug top 1505*a* and plug bottom 1505*b* body portions, with respect to the cable receiver 1505*c* and the extension member 1520 body portions. For example, as depicted in FIG. 82, when the connector 1500 is in an unlocked position 1570, the plug top 1505*a* and plug bottom 1505*b* body portions may be slidably positioned upon a shank 1505*cs* of the plug receiver 1505*c* body portion and nestled up against a face 1505*cf* of the plug receiver 1505*c* body portion so that there is substantially no distance R between the plug top 1505*a* and plug bottom 1505*b* body portions and the face 1505*cf* of the plug receiver 1505*c* body portion. Moreover, when the connector 1500 is in an unlocked position 1570, the plug top 1505*a* and plug bottom 1505*b* body portions may be slidably positioned on the extension 1520 body portion at a location wherein a distance U is manifest between the end of the extension 1520 body portion (the high definition multimedia interface connection end 1535 of the connector 1500) and the plug top 1505*a* and plug bottom 1505*b* body portions.

FIGS. 83, 84, 85 and 86 depict multiple views of an embodiment of the releasably locking high definition multimedia interface plug 1500 of FIG. 78 in a locked position 1560. When the spring biased member 1540*c* is compressed and the lock button 1540 is moved in an axial direction towards the high definition multimedia interface connection end 1535 and away from the cable receiver 1505*c* portion of the body 1505 and the cable 10, the locking hook(s) 1540*b* is free to move in the same axial direction unobstructed by the locking post(s) 1520*b*. Once the lock button 1540 is disengaged (such as when the user releases his or her grip), the expansion force of the spring biased member 1540*c* causes the locking hook(s) 1540*b* to move and engage, contact and/or partially surround the locking post(s) 1520*b* thereby securing the movable connector 1500 components into a locked position 1560 where the ramped portion of the forward edge 1575 of the actuator 1565 is in contact with and does bias the flexible engagement member 1525 and associated locking tab(s) 1550.

As described above, when the spring biased member 1540*c* is compressed, such as by a user squeezing the opposing sides of the lock button 1540, portions of the lock button 1540 may physically contact or otherwise operate with an engagement member 1585 to exert a resultant force upon the engagement member 1585. The engagement member 1585 may work upon an actuator and, as a result, the actuator 1565 may be slidably moved in an axial direction towards the high definition multimedia interface connection end 1535 and away from the cable receiver 1505*c* portion of the body 1505 and the cable 10, so that the actuator 1565 obtains a locked position 1560 where the ramped portion of the forward edge 1575 of the actuator 1565 is in contact with the flexible engagement member 1525. As a result the flexible engagement member 1525 is biased upwards into a locked position along with the associated locking tab(s) 1550. When the locking tab(s) 1550 is moved to a locked position, the tab(s) may be maneuvered into engagement with a typical sidewall opening 25 of a standard high definition multimedia interface receptacle 20 and may thereby help to securely engage the receptacle 20 and lock the plug 1500 to the receptacle 20. When engaged in a secure manner the actuator 1565 may reside in the locked position 1560.

Figure 86:
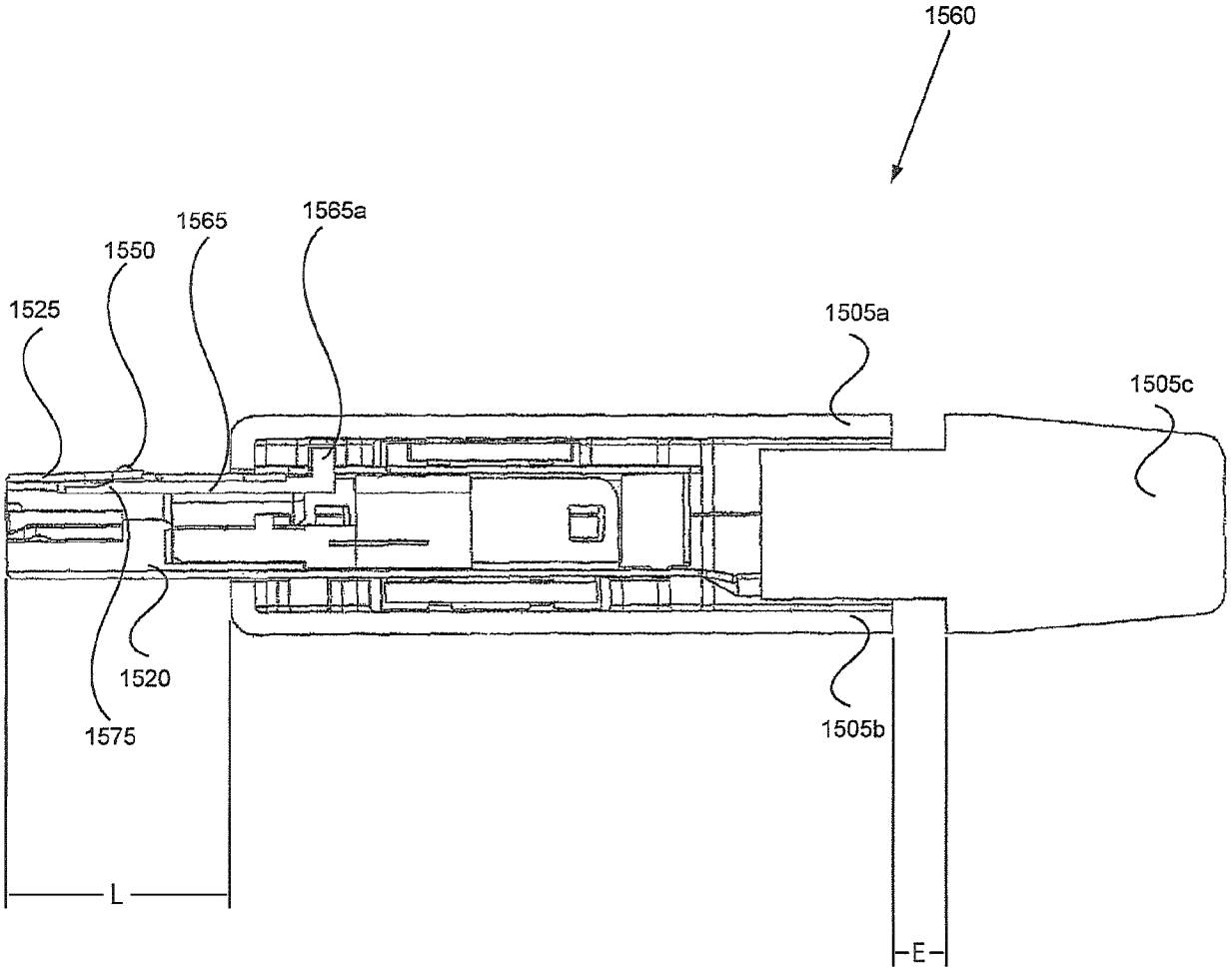
FIG. 86 depicts a cutaway side view of an embodiment of the releasably locking high definition multimedia interface plug of FIG. 78 in a locked position.

Movement of the lock button 1540 may invoke associated movement of the engagement member 1585 and the plug top 1505*a* and plug bottom 1505*b* body portions, with respect to the cable receiver 1505*c* and the extension member 1520 body portions. For example, as depicted in FIG. 86, when the connector 1500 is in a locked position 1560, the plug top 1505*a* and plug bottom 1505*b* body portions may be slidably positioned upon a shank 1505*cs* of the plug receiver 1505*c* body portion and extended away from a face 1505*cf* of the plug receiver 1505*c* body portion so that there is an extended distance E between the plug top 1505*a* and plug bottom 1505*b* body portions and the face 1505*cf* of the plug receiver 1505*c* body portion. Moreover, when the connector 1500 is in a locked position 1560, the plug top 1505*a* and plug bottom 1505*b* body portions may be slidably positioned on the extension 1520 body portion at a location wherein a distance L is manifest between the end of the extension 1520 body portion (the high definition multimedia interface connection end 1535 of the connector 1500) and the plug top 1505*a* and plug bottom 1505*b* body portions. The distance L corresponding to the locked position 1560 is shorter than the distance U corresponding to the unlocked position 1570 of connector plug 1500.

Embodiments of a releasably engaging high definition multimedia interface connector plug 1500 may include means for locating the locking tab(s) 1550, so that the locking tab(s) 1550 protrudes from the opening 1530 of the extension member 1520 of body 1505 and physically extends into and engages a typical sidewall opening 25 of the corresponding standard high definition multimedia interface receptacle 20 into which the locking plug 1500 has been inserted. Moreover, embodiments of a releasably engaging high definition multimedia interface plug 1500 may include means for locating the locking tab(s) 1550, so that the locking tab(s) 1550 does not extend into engagement with the typical sidewall opening 25 of the corresponding standard high definition multimedia interface receptacle 20 into which the locking plug 1500 has been inserted. The means for locating the locking tab(s) 1550 may be an actuator 1565 having a ramped portion of a forward edge 1575 that is operable with embodiments of the present invention to move a locking tab(s) 1550. In addition, the means for locating the locking tab(s) 1550 may operably interact with a lock button 1540. Furthermore, the means for locating the locking tab(s) 1550 may also be operable to move the locking tab(s) 1550 to contact and exert a resultant force upon a typical spring biased tab 22 of a standard high definition multimedia interface receptacle 20.

With continued reference to the all the drawings, and particularly FIGS. 78-86, a method of releasably securing a high definition multimedia interface plug 1500 to a standard high definition multimedia interface receptacle 20 is described. The methodology may include a step of providing a releasably engaging high definition multimedia interface plug 1500 comprising a plug body 1505 (plug top 1505*a*, plug bottom 1505*b*, and plug cable receiver 1505*c*), a lock button 1540 comprising an unlocking hook(s) 1540*a* and locking hook(s) 1540*b* and a spring biased member 1540*c*, a high definition multimedia interface connection end 1535, a body extension member 1520 comprising an opening 1530 and an unlocking post(s) 1520*a* and locking post(s) 1520*b*, locking tab(s) 1550 coupled to or operably associated with a flexible engagement member 1525, where the flexible engagement member 1525 is coupled to the body extension member 1520, an actuator 1565 having a engagement edge 1565*a* and a ramped portion of a forward edge 1575, and a actuator engagement member 1585 having an engagement opening 1585*a* therein.

A locked position 1560 of the actuator 1565 may pertain to embodiments of the interface plug 1500, wherein the ramped portion of the forward edge 1575 of the actuator 1565 is locatable below the flexible engagement member 1525, so as to contact and bias the flexible engagement member 1525. Moreover, an unlocked position 1570 of the actuator 1565 may pertain to embodiments of the interface plug 1500, wherein the ramped portion of the forward edge 1575 of the actuator 1565 is locatable in a position away from the flexible engagement member 1525, so that it does not contact the flexible engagement member 1525.

A further methodological step may include moving the actuator 1565, by operable means of the lock button 1540, so that the ramped portion of the forward edge 1575 of the actuator 1565 obtains an unlocked position 1570 where it is not in contact with the flexible engagement member 1525 and the locking tab(s) 1550 resides substantially within the opening 1530 of the body extension member 1520 and so that the locking tab(s) 1550 does not engage the typical sidewall opening 25 of a corresponding standard high definition multimedia interface receptacle 20 into which the releasably engaging high definition multimedia interface plug 1500 is inserted. In addition, when in an unlocked position 1570, the locking tab(s) 1550 will not contact the typical spring biased tab 22 of the corresponding standard high definition multimedia interface receptacle 20.

Another methodological step may include inserting the releasably engaging high definition multimedia interface plug 1500 into a corresponding standard high definition multimedia interface receptacle 20. Once inserted, or possibly during insertion, a further methodological step may include moving the lock button 1540 in a direction away from the cable receiver 1505*c* portion of the body 1505 and the cable 10 and towards the high definition multimedia interface connection end 1535. The result of moving the lock button 1540 will be movement of the ramped portion of the forward edge 1575 of the actuator 1565 in a direction away from the cable receiver 1505*c* portion of the body and the cable 10 and towards the high definition multimedia interface connection end 1535, so that the ramped portion of the forward edge 1575 of the actuator 1565 obtains a locked position 1560 where it is in contact with the flexible engagement member 1525. The locking tab(s) 1550 associated with the flexible engagement member 1525 is therefore biased to protrude from the opening 1530 of the extension member 1520 of the body 1505 and so that the locking tab(s) 1550 extends into engagement with the typical sidewall opening 25 of the of the corresponding standard high definition multimedia interface receptacle 20 into which the releasably engaging plug 1500 is inserted, thereby releasably securing the plug 1500 within the receptacle 20. The locking tab(s) 1550 may also physically contact and exert a resultant force upon the typical spring biased tab(s) 22 of the standard high definition multimedia interface receptacle 20.

To release the plug 1500 from its secure connection with the receptacle 20, further methodology may include again moving the lock button 1540 in a direction towards the cable receiver 1505*c* portion of the plug body 1505 and away from the high definition multimedia interface connection end 1535. The result of moving the lock button 1540 will be movement of the ramped portion of the forward edge 1575 of the actuator 1565 in a direction towards the cable receiver 1505*c* portion of the plug body 1505 and away from the high definition multimedia interface connection end 1535, where the ramped portion of the forward edge 1575 of the actuator 1565 is not in contact with the flexible engagement member 1525. The locking tab(s) 1550 associated with the flexible engagement member 1525 may then reside substantially within the opening 1530 of the body extension member 1520 and so that the locking tab(s) 1550 do not engage the typical sidewall opening 25 of the corresponding standard high definition multimedia interface receptacle 20 into which the releasably engaging high definition multimedia interface plug 1500 has been inserted. In addition, when the ramped portion of the forward edge 1575 of the actuator 1565 is not in contact with the flexible engagement member 1525, the locking tab(s) 1550 will not contact the typical spring biased tab 22 of the corresponding standard high definition multimedia interface receptacle 20. Then the methodology for releas ably engaging a high definition multimedia interface plug 1500 with a standard high definition multimedia receptacle 20 may include removing the releasably engaging high definition multimedia interface plug 1500 from the corresponding standard high definition multimedia interface receptacle 20.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A locking high definition multimedia interface plug comprising:

a connector body, having top and bottom portions movably mounted on a cable receiver portion;

a body extension, extending from the connector body and sized for insertion into a standard high definition multimedia interface receptacle, the body extension having an opening, wherein the top and bottom portions are movable with respect to the body extension;

a locking tab, located on the body extension;

said means for locating the locking tab, so that the locking tab protrudes from the opening of the extension and extends into engagement with a typical sidewall opening of the corresponding standard high definition multimedia interface receptacle into which the locking plug has been inserted; and means for locating the locking tab, so that the locking tab does not contact nor extend into engagement with a typical sidewall opening of the corresponding standard high definition multimedia interface receptacle into which the locking plug has been inserted.

2. The locking plug of claim 1, wherein the means for locating the locking tab interact with a lock button.

3. The locking plug of claim 1, wherein the means for locating the locking tab are operable to move the locking tab into or out of engagement with a spring biased tab of the standard high definition multimedia interface receptacle.

* * * * *